US008830126B2

(12) United States Patent
Maruyama et al.

(10) Patent No.: US 8,830,126 B2
(45) Date of Patent: Sep. 9, 2014

(54) APPARATUS HAVING MUSHROOM STRUCTURES

(75) Inventors: Tamami Maruyama, Yokohama (JP); Tatsuo Furuno, Yokosuka (JP); Yasuhiro Oda, Yokosuka (JP); Jiyun Shen, Yokosuka (JP); Tomoyuki Ohya, Yokohama (JP)

(73) Assignee: NTT DoCoMo, Inc., Tokyo (JP)

( * ) Notice: Subject to any disclaimer, the term of this patent is extended or adjusted under 35 U.S.C. 154(b) by 621 days.

(21) Appl. No.: 13/032,301

(22) Filed: Feb. 22, 2011

(65) Prior Publication Data

US 2011/0210906 A1 Sep. 1, 2011

(30) Foreign Application Priority Data

Feb. 26, 2010 (JP) ..... 2010-043572
Jul. 8, 2010 (JP) ..... 2010-156254
Jan. 4, 2011 (JP) ..... 2011-000245

(51) Int. Cl.
*H01Q 15/00* (2006.01)

(52) U.S. Cl.
USPC ..... 343/700 MS; 343/753; 343/754; 343/755; 343/844

(58) Field of Classification Search
CPC ..... H01Q 19/06; H01Q 15/008; H01Q 3/14
USPC ..... 343/700 MS, 753, 754, 844, 755
See application file for complete search history.

(56) References Cited

U.S. PATENT DOCUMENTS

2003/0231142 A1 12/2003 McKinzie, III et al.
2008/0266179 A1 * 10/2008 Sotoudeh et al. ..... 343/700 MS
2009/0146907 A1 * 6/2009 Brown ..... 343/912
2009/0153404 A1 * 6/2009 Ryou et al. ..... 343/700 MS
2010/0053013 A1 3/2010 Konishi et al.

FOREIGN PATENT DOCUMENTS

EP 1 120 856 A1 8/2001
JP 2003-526978 A 9/2003
JP 2005-110273 A 4/2005
JP 2009-4779 1/2009
JP 2009-100445 A 5/2009
JP 2009-105575 A 5/2009
JP 2009-118442 A 5/2009

(Continued)

OTHER PUBLICATIONS

Fan Yang, et al., "Polarization-Dependent Electromagnetic Band Gap (PDEBG) Structures: Designs and Applications", Microwave and Optical Technology Letters, vol. 41, No. 6, Jun. 20, 2004, pp. 439-444.

(Continued)

*Primary Examiner* — Dameon E Levi
*Assistant Examiner* — Collin Dawkins
(74) *Attorney, Agent, or Firm* — Oblon, Spivak, McClelland, Maier & Neustadt, L.L.P.

(57) ABSTRACT

An apparatus having multiple mushroom structures is disclosed. Each of the multiple mushroom structures includes: a ground plate; a first patch provided parallel to the ground plate with a separation of a distance to the ground plate; and a second patch provided parallel to the ground plate with a separation of another distance to the ground plate, which another distance being different from the distance from the first patch to the ground plate, wherein the second patch is a passive element which is capacitatively coupled with at least the first patch.

8 Claims, 116 Drawing Sheets

(56) References Cited

FOREIGN PATENT DOCUMENTS

| | | | |
|---|---|---|---|
| JP | 2009-207078 | A | 9/2009 |
| JP | 2009-218968 | | 9/2009 |
| JP | 2010-199881 | | 9/2010 |
| WO | WO 2008/062562 | A1 | 5/2008 |
| WO | WO 2011-070736 | A1 | 6/2011 |

OTHER PUBLICATIONS

Kihun Chang, et al., "Artificial Surface Having Frequency Dependent Reflection Angle", ISAP, 2008, 4 pages.

Daniel F. Sievenpiper, et al., "Two-Dimensional Beam Steering Using an Electrically Tunable Impedance Surface", IEEE Transactions on Antennas and Propagation, vol. 51, No. 10, Oct. 2003. pp. 2713-2722.

Daniel F. Sievenpiper, et al., "High-Impedance Electromagnetic Surfaces". Ph. D. dissertation, UCLA, 1999, 161 pages.

Extended European Search Report issued Jun. 24, 2011, in Patent Application No. 11250218.2.

Kihun Chang, et al., "High-impedance Surface with Nonidentical Lattices", Antenna Technology: Small Antennas and Novel Metamaterials, XP 31248634, Mar. 4, 2008, pp. 474-477.

Kihun Chang, et al., "Physically flat but electromagnetic parabolic surface using EBG structure with stepped reflection phase", Antennas and Propagation, XP 31470322, Mar. 23, 2009, pp. 2609-2612.

D. Sievenpiper, et al., "Microwave Beam Steering Reflector Based on a Tunable Impedance Surface", European Microwave Conference, XP 31067498, Oct. 1, 2000, pp. 1-4.

Office Action mailed Jul. 1, 2014, in Japanese Patent Application No. 2012-186308 (with English-language Translation).

* cited by examiner

FIG.2C
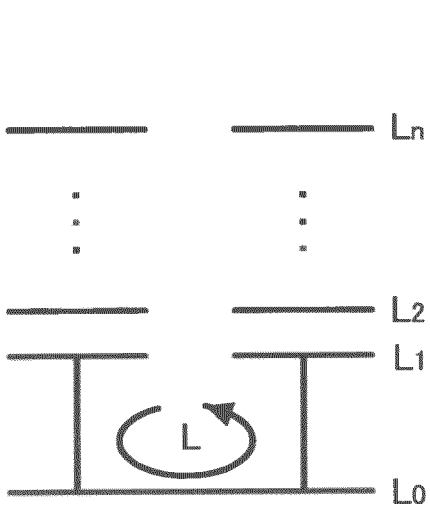
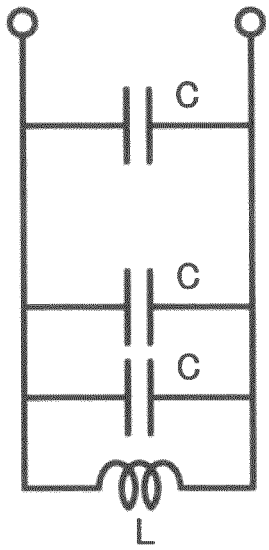

FIG.12

| DESIGN PHASE [DEGREE] | PHASE [DEGREE] | Wy [mm] |
|---|---|---|
| 95 | 95.047 | 1.34 |
| 77 | 77.038 | 1.591 |
| 59 | 58.900 | 1.726 |
| 41 | 41.028 | 1.82 |
| 23 | 23.127 | 1.887 |
| 5 | 5.018 | 1.94 |
| −13 | −12.745 | 1.973 |
| −31 | −31.127 | 2.015 |
| −49 | −48.933 | 2.066 |
| −67 | −66.860 | 2.106 |
| −85 | −85.102 | 2.148 |
| −103 | −102.861 | 2.191 |
| −121 | −120.932 | 2.238 |
| −139 | −138.990 | 2.295 |

FIG.13

| | |
|---|---|
| FR4 RELATIVE PERMITTIVITY | 4.4 |
| FR4tan $\delta$ | 0.018 |
| FR4 SUBSTRATE THICKNESS | 1.6mm+0.8mm |
| VIA HOLE DIAMETER | 0.50mm |
| VIA HEIGHT | 1.60mm |
| GAP gx IN X DIRECTION | 0.10mm |
| PATCH WIDTH Wx IN X DIRECTION | 2.30mm |
| 1 CYCLE LENGTH IN X DIRECTION | 48.0mm |
| X DIRECTION PITCH $\Delta x$ | 2.40mm |
| Y DIRECTION PITCH $\Delta y$ | 2.40mm |

FIG.19

| PATCH DESIGN VALUE [mm] | DESIGN PHASE [DEGREE] | USED PATCH SIZE [mm] | PHASE OF USED PATCH [DEGREE] | PHASE DIFFERENCE IN USED PATCH |
|---|---|---|---|---|
| 1.186954445 | 101 | 1.187 | 100.9983384 | |
| 1.591319073 | 77 | 1.591 | 77.03841523 | 23.95992318 |
| 1.763979174 | 53 | 1.764 | 52.9945085 | 24.04390673 |
| 1.867949097 | 29 | 1.868 | 28.98654148 | 24.00796701 |
| 1.940051136 | 5 | 1.940 | 5.018049128 | 23.96849236 |
| 1.977940394 | −19 | 1.978 | −19.07546996 | 24.09351909 |
| 2.052234001 | −43 | 2.052 | −42.89839371 | 23.82292374 |
| 2.106282459 | −67 | 2.106 | −66.85964752 | 23.96125381 |
| 2.162069933 | −91 | 2.162 | −90.96920415 | 24.10955663 |
| 2.223174525 | −115 | 2.223 | −114.9304041 | 23.96119996 |
| 2.295042454 | −139 | 2.300 | −140.1917646 | 25.26136045 |

| | INTERVAL 0.8mm | INTERVAL 0.4mm |
|---|---|---|
| ×1 SIZE | 39.3 | 31.1 |
| ×0.95 SIZE | 36.4 | 27.6 |

FIG.21
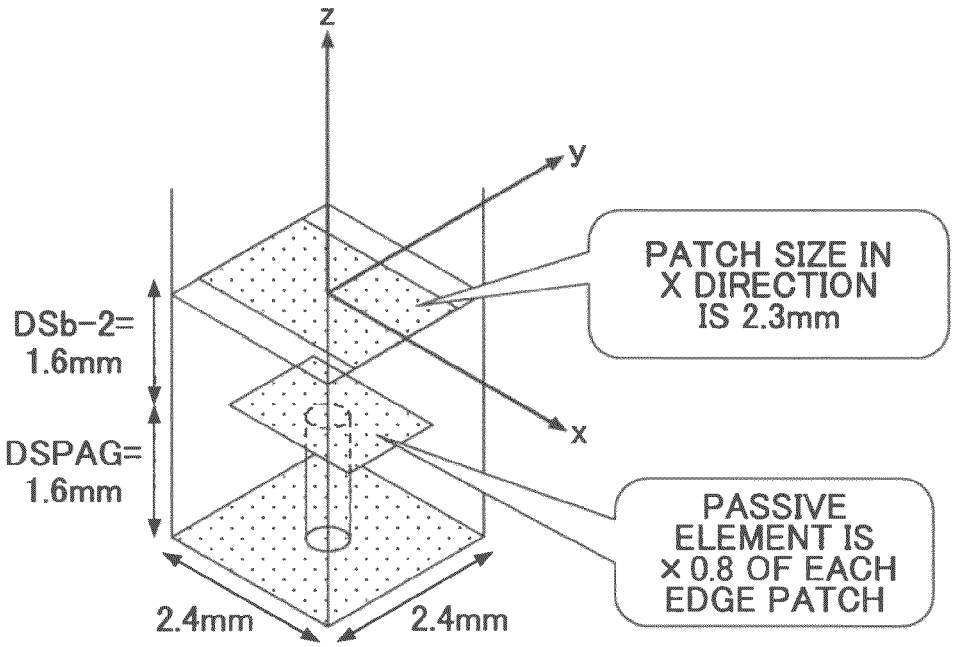
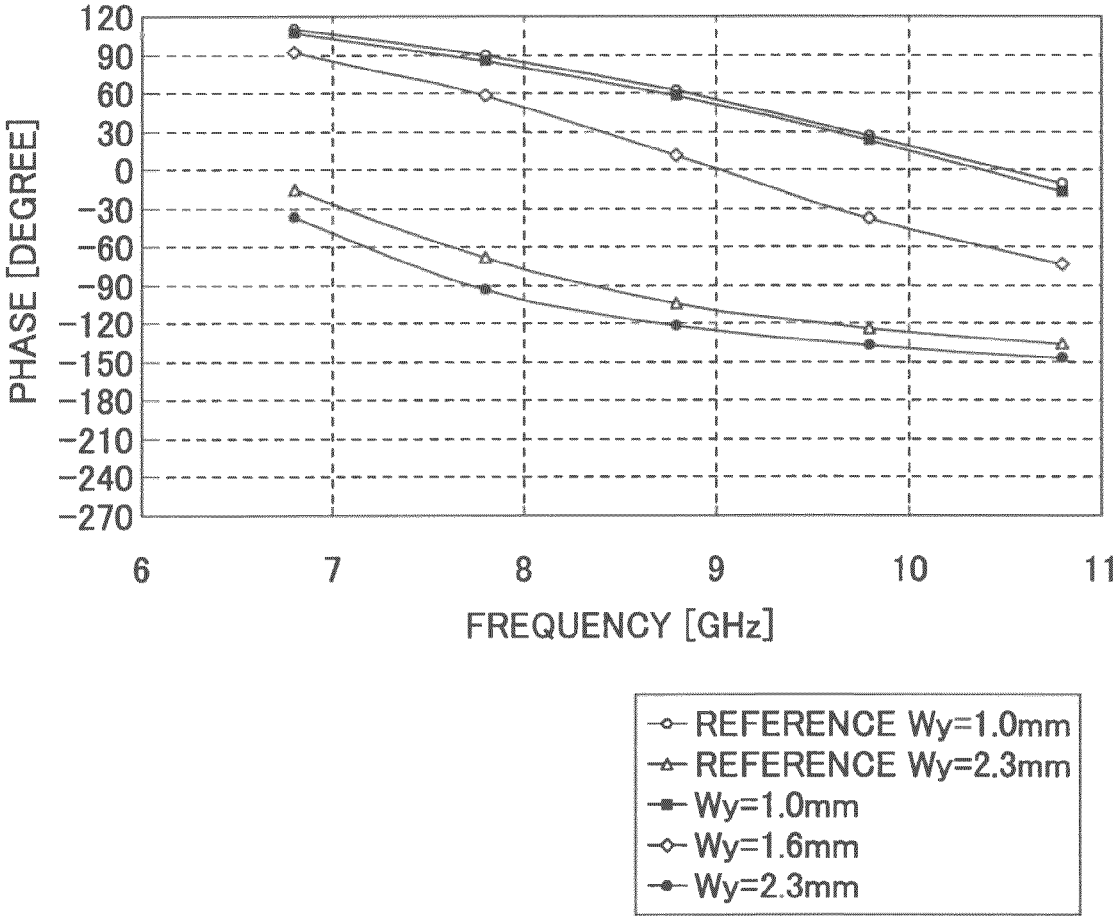

FIG.22
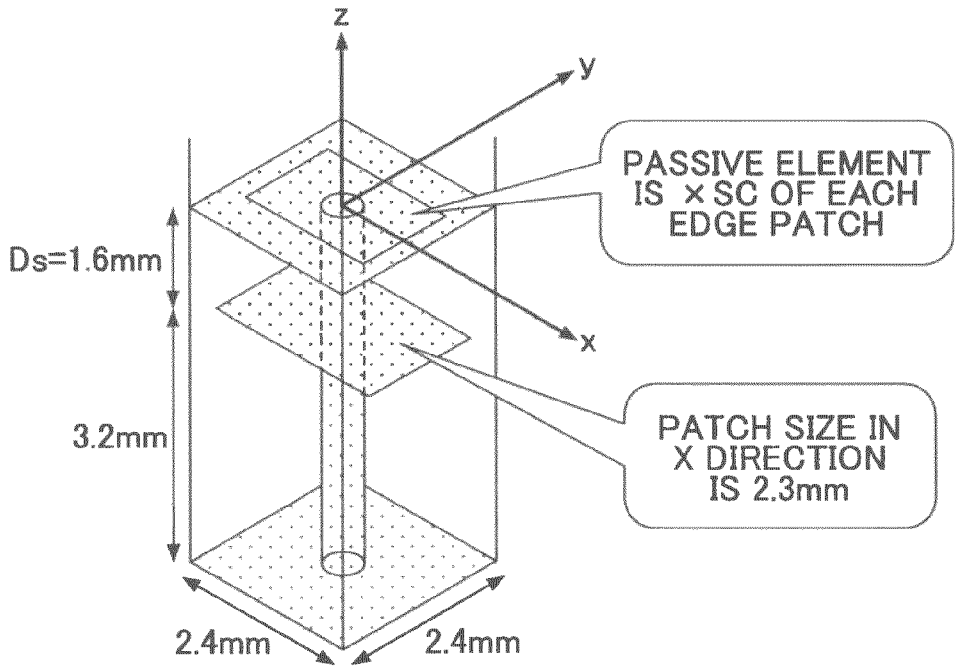
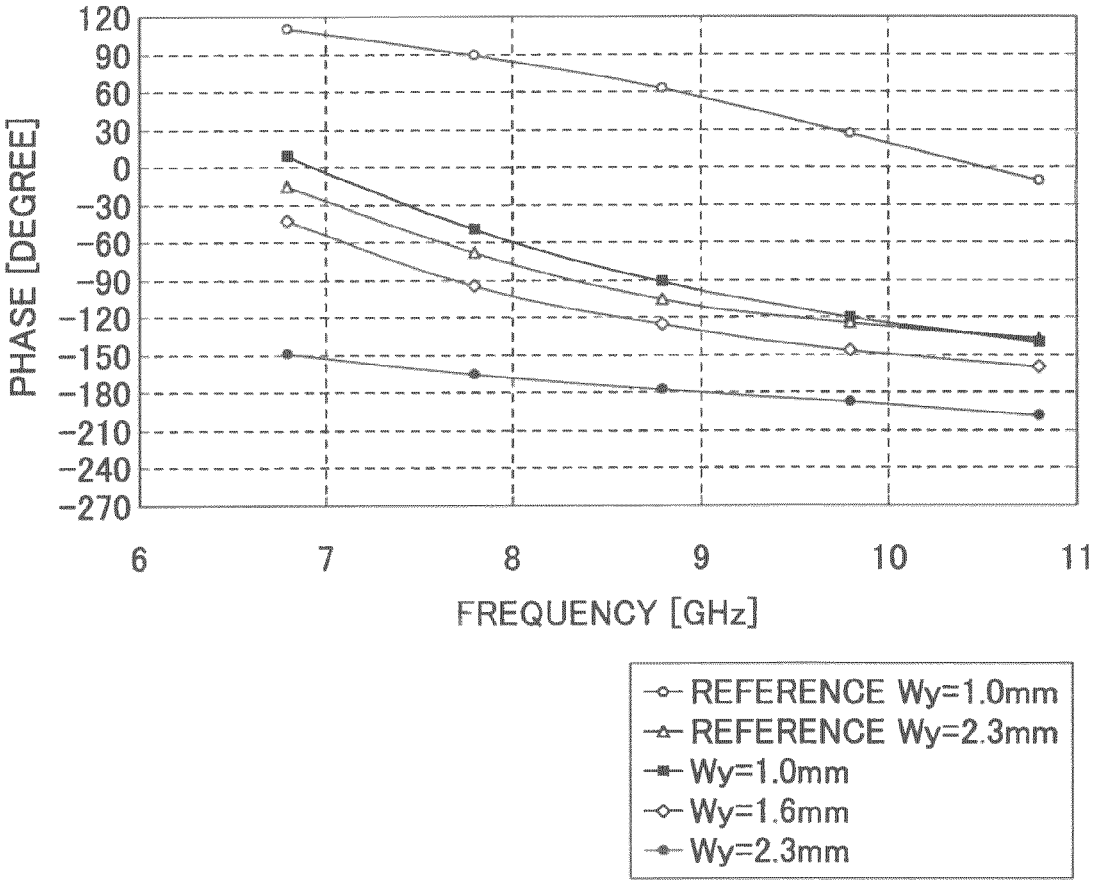

FIG.23
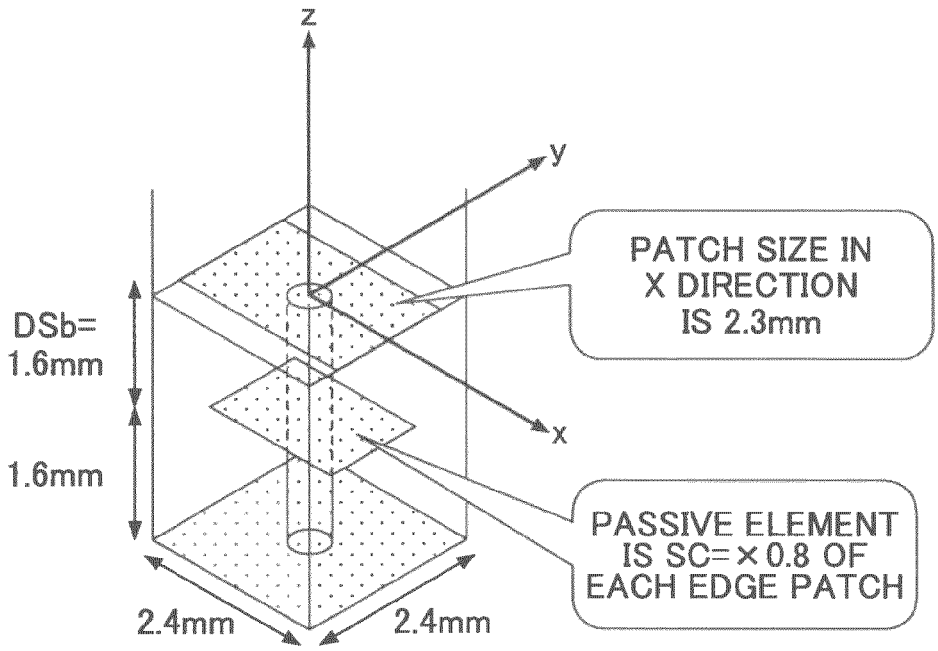
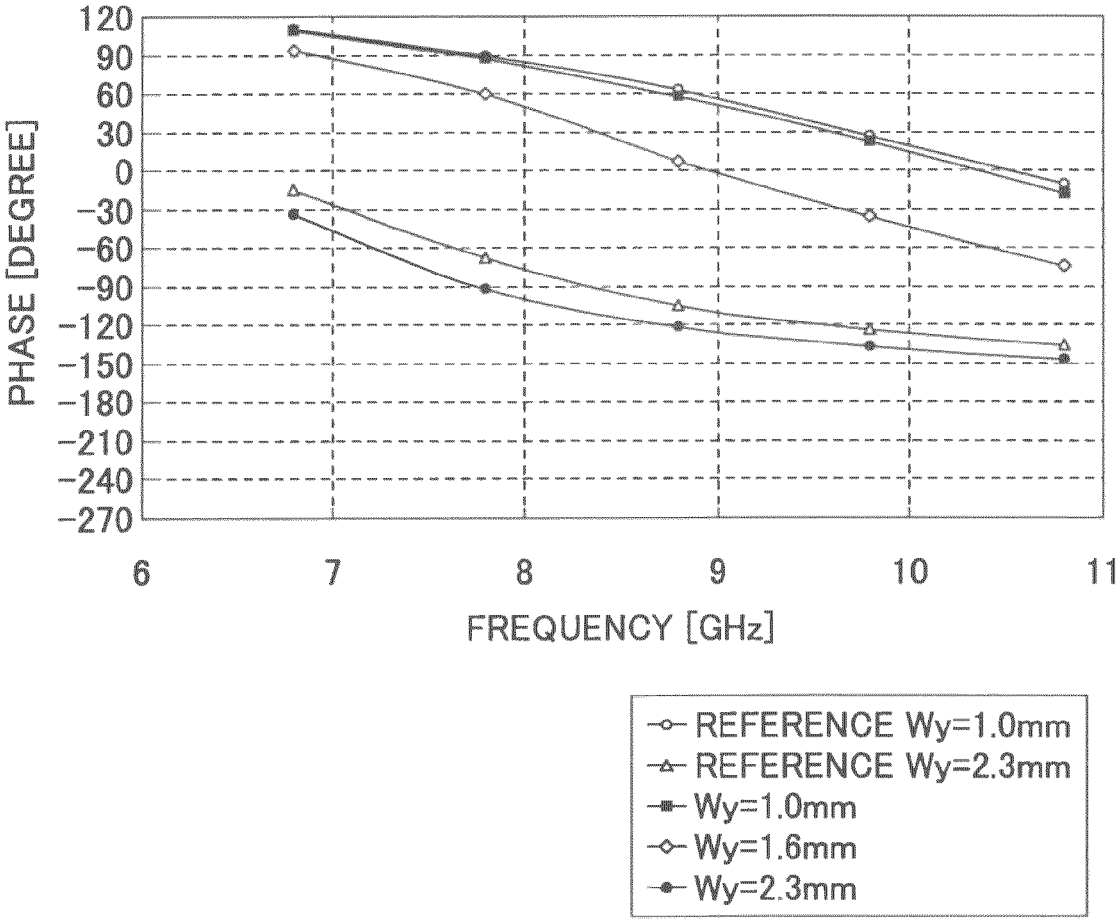

FIG.39

| PATCH NUMBER | 1 | 2 | 3 | 4 | 5 | 6 | 7 | 8 | 9 | 10 | 11 | 12 |
|---|---|---|---|---|---|---|---|---|---|---|---|---|
| PHASE [DEGREE] | — | 72 | 54 | 36 | 18 | 0 | −18 | −36 | −54 | −72 | −90 | −108 |
| gy [mm] | — | 1.85 | 1.18 | 0.88 | 0.69 | 0.57 | 0.46 | 0.37 | 0.30 | 0.23 | 0.16 | 0.10 |
| Wy [mm] | 0.55 | 0.885 | 1.37 | 1.615 | 1.77 | 1.885 | 1.985 | 2.065 | 2.135 | 2.205 | 2.27 | 2.30 |

FIG.42

| DESIGN PHASE [DEGREE] | PHASE [DEGREE] | gy [mm] |
|---|---|---|
| 101 | 100.9983 | 1.187 |
| 77 | 77.03842 | 1.591 |
| 53 | 52.99451 | 1.764 |
| 29 | 28.98654 | 1.868 |
| 5 | 5.018049 | 1.940 |
| −19 | −19.0755 | 1.978 |
| −43 | −42.8984 | 2.052 |
| −67 | −66.8596 | 2.106 |
| −91 | −90.9692 | 2.162 |
| −115 | −114.930 | 2.223 |
| −139 | −140.192 | 2.300 |

| | |
|---|---|
| Y DIRECTION GROUND PLATE SIZE Py1 | 2.4mm |
| Y DIRECTION GROUND PLATE SIZE Py2 | 4.8mm |
| Y DIRECTION GROUND PLATE SIZE Py3 | 12mm |
| Y DIRECTION GROUND PLATE SIZE Py4 | 31.2mm |

FIG.46A

| X DIRECTION PITCH Δx | 2.4mm | Y DIRECTION PITCH Δy | 2.4mm |
|---|---|---|---|
| X DIRECTION ONE CYCLE Ux | 48mm | | |
| X DIRECTION PATCH SIZE Wx1 | 2.3mm | Y DIRECTION PATCH SIZE Wy1 | 1.866mm |
| X DIRECTION PATCH SIZE Wx2 | 2.3mm | Y DIRECTION PATCH SIZE Wy2 | 2.256mm |
| X DIRECTION PATCH SIZE Wx3 | 2.3mm | Y DIRECTION PATCH SIZE Wy3 | 1.434mm |
| X DIRECTION PATCH SIZE Wx4 | 2.3mm | Y DIRECTION PATCH SIZE Wy4 | 2.140mm |
| X DIRECTION PATCH SIZE Wx5 | 2.3mm | Y DIRECTION PATCH SIZE Wy5 | 2.272mm |
| X DIRECTION PATCH SIZE Wx6 | 2.3mm | Y DIRECTION PATCH SIZE Wy6 | 1.828mm |
| X DIRECTION PATCH SIZE Wx7 | 2.3mm | Y DIRECTION PATCH SIZE Wy7 | 1.998mm |
| X DIRECTION PATCH SIZE Wx8 | 2.3mm | Y DIRECTION PATCH SIZE Wy8 | 2.097mm |
| X DIRECTION PATCH SIZE Wx9 | 2.3mm | Y DIRECTION PATCH SIZE Wy9 | 2.162mm |
| X DIRECTION PATCH SIZE Wx10 | 2.3mm | Y DIRECTION PATCH SIZE Wy10 | 2.208mm |
| X DIRECTION PATCH SIZE Wx11 | 2.3mm | Y DIRECTION PATCH SIZE Wy11 | 2.242mm |
| X DIRECTION PATCH SIZE Wx12 | 2.3mm | Y DIRECTION PATCH SIZE Wy12 | 2.268mm |
| X DIRECTION PATCH SIZE Wx13 | 2.3mm | Y DIRECTION PATCH SIZE Wy13 | 2.298mm |

REFLECTION PHASE OF 2.4 × 2.4 × 0.2mm MUSHROOM

REFLECTION PHASE OF 2.4 × 2.4 × 1.6mm MUSHROOM

REFLECTION PHASE OF 2.4 × 2.4 × 2.4mm MUSHROOM

FIG.59

| | METAL | SUBSTRATE THICKNESS 0.8mm | SUBSTRATE THICKNESS 1.6mm | | |
|---|---|---|---|---|---|
| DESIGN PHASE [DEGREE] | 180 | 162 | 144 | 126 | 108 |
| PHASE [DEGREE] | 180.00 | 162.00 | 142.43 | 126.00 | 107.99 |
| PATCH SIZE [mm] | 2.400 | 1.624 | 1.000 | 2.070 | 2.253 |

| SUBSTRATE THICKNESS 2.4mm | | | | | | | |
|---|---|---|---|---|---|---|---|
| 90 | 72 | 54 | 36 | 18 | 0 | −18 | −36 |
| 90.02 | 71.98 | 54.09 | 35.87 | 17.95 | −0.04 | −18.45 | −35.93 |
| 1.767 | 1.967 | 2.077 | 2.148 | 2.198 | 2.239 | 2.264 | 2.290 |

| VIA HEIGHT 2.3mm AND 2.4mm | | | | | | |
|---|---|---|---|---|---|---|
| −54 | −72 | −90 | −108 | −126 | −144 | −162 |
| −54.08 | −71.71 | −90.23 | −108.02 | −126.17 | −143.98 | −162.00 |
| 2.284 | 2.311 | 2.340 | 2.371 | 2.409 | 2.465 | 2.609 |

FIG.75

| | SUBSTRATE THICKNESS 0.2mm | SUBSTRATE THICKNESS 0.8mm | SUBSTRATE THICKNESS 1.6mm | | | | | | |
|---|---|---|---|---|---|---|---|---|---|
| DESIGN PHASE [DEGREE] | 175.6 | 157.6 | 139.6 | 121.6 | 103.6 | | | | |
| PHASE [DEGREE] | 175.60 | 157.59 | 139.60 | 121.57 | 103.60 | | | | |
| PATCH SIZE [mm] | 1.866 | 2.256 | 1.434 | 2.140 | 2.272 | | | | |
| | | | SUBSTRATE THICKNESS 2.4mm | | | | | | |
| | | | 85.6 | 67.6 | 49.6 | 31.6 | 13.6 | −4.4 | −22.4 | −40.4 |
| | | | 85.61 | 67.61 | 49.49 | 31.54 | 13.60 | −4.12 | −22.31 | −40.27 |
| | | | 1.828 | 1.998 | 2.097 | 2.162 | 2.208 | 2.242 | 2.268 | 2.298 |
| | | | VIA HEIGHT 2.2mm AND 2.4mm | | | | | | |
| | | | −58.4 | −76.4 | −94.4 | −112.4 | −130.4 | −148.4 | −166.4 |
| | | | −58.33 | −76.58 | −94.54 | −112.38 | −130.53 | −148.38 | −166.39 |
| | | | 2.306 | 2.342 | 2.382 | 2.430 | 2.496 | 2.625 | 2.998 |

| | |
|---|---|
| Y DIRECTION GROUND PLATE SIZE Py1 | 2.4mm |
| Y DIRECTION GROUND PLATE SIZE Py2 | 4.8mm |
| Y DIRECTION GROUND PLATE SIZE Py3 | 12mm |
| Y DIRECTION GROUND PLATE SIZE Py4 | 48mm |

FIG.91

| | | | |
|---|---|---|---|
| X DIRECTION PITCH Vx | 2.4mm | Y DIRECTION PITCH Vy | 2.4mm |
| X DIRECTION ONE CYCLE Ux | 48mm | | |
| X DIRECTION PATCH SIZE Wx1 | 2.3mm | Y DIRECTION PATCH SIZE Wy1 | 1.866mm |
| X DIRECTION PATCH SIZE Wx2 | 2.3mm | Y DIRECTION PATCH SIZE Wy2 | 2.256mm |
| X DIRECTION PATCH SIZE Wx3 | 2.3mm | Y DIRECTION PATCH SIZE Wy3 | 1.434mm |
| X DIRECTION PATCH SIZE Wx4 | 2.3mm | Y DIRECTION PATCH SIZE Wy4 | 2.140mm |
| X DIRECTION PATCH SIZE Wx5 | 2.3mm | Y DIRECTION PATCH SIZE Wy5 | 2.272mm |
| X DIRECTION PATCH SIZE Wx6 | 2.3mm | Y DIRECTION PATCH SIZE Wy6 | 1.828mm |
| X DIRECTION PATCH SIZE Wx7 | 2.3mm | Y DIRECTION PATCH SIZE Wy7 | 1.998mm |
| X DIRECTION PATCH SIZE Wx8 | 2.3mm | Y DIRECTION PATCH SIZE Wy8 | 2.097mm |
| X DIRECTION PATCH SIZE Wx9 | 2.3mm | Y DIRECTION PATCH SIZE Wy9 | 2.162mm |
| X DIRECTION PATCH SIZE Wx10 | 2.3mm | Y DIRECTION PATCH SIZE Wy10 | 2.208mm |
| X DIRECTION PATCH SIZE Wx11 | 2.3mm | Y DIRECTION PATCH SIZE Wy11 | 2.242mm |
| X DIRECTION PATCH SIZE Wx12 | 2.3mm | Y DIRECTION PATCH SIZE Wy12 | 2.268mm |
| X DIRECTION PATCH SIZE Wx13 | 2.3mm | Y DIRECTION PATCH SIZE Wy13 | 2.298mm |
| X DIRECTION PATCH SIZE Wx14 | 2.3mm | Y DIRECTION PATCH SIZE Wy14 | 2.306mm |
| X DIRECTION PATCH SIZE Wx15 | 2.3mm | Y DIRECTION PATCH SIZE Wy15 | 2.342mm |
| X DIRECTION PATCH SIZE Wx16 | 2.3mm | Y DIRECTION PATCH SIZE Wy16 | 2.382mm |
| X DIRECTION PATCH SIZE Wx17 | 2.3mm | Y DIRECTION PATCH SIZE Wy17 | 2.430mm |
| X DIRECTION PATCH SIZE Wx18 | 2.3mm | Y DIRECTION PATCH SIZE Wy18 | 2.496mm |
| X DIRECTION PATCH SIZE Wx19 | 2.3mm | Y DIRECTION PATCH SIZE Wy19 | 2.625mm |
| X DIRECTION PATCH SIZE Wx20 | 2.3mm | Y DIRECTION PATCH SIZE Wy20 | 2.699mm |

APPARATUS HAVING MUSHROOM STRUCTURES

BACKGROUND OF THE INVENTION

1. Field of the Invention

The present invention relates to apparatuses having mushroom structures. Such apparatuses can be used not only for a reflector which reflects a radio wave in a specific direction, but also for an antenna at the time of transmitting and receiving a radio wave, a filter which attenuates a specific frequency, etc.

2. Description of the Related Art

In mobile communications, when there is an obstacle such as a building in a path of a radio wave, a received level deteriorates. To this end, there is a technique in which a reflector is provided at an elevation as high as that of the building and in which a reflected wave is transmitted to where the radio wave is hard to reach. When the radio wave is reflected by the reflector, it becomes difficult for the reflector to direct the radio wave in a desired direction if an incident angle of the radio wave within a vertical plane is relative small (FIG. 1). This is because, in general, the incident angle and a reflection angle of the radio wave are equal. In order to deal with this problem, it is possible to slant the reflector such that it looks into the ground. In this way, the incident angle and the reflection angle may be made large relative to the reflector, making it possible to direct an incoming wave in a desired direction. However, it is undesirable from a viewpoint of safety to slant to the ground side a reflector which is provided at an elevation as high as that of the building which blocks the radio wave. From such a viewpoint, a reflector is desired which allows directing a reflected wave in a desired direction even when an incident angle of a radio wave is relatively small.

As such a reflector, there is a structure such that elements in the order of half a wavelength are periodically arranged. However, such a structure becomes significantly large. On the other hand, a reflect array in which a number of elements which are smaller than half a wavelength is attracting attention in recent years. One example of such a reflect array is a reflect array having mushroom structures.

With the reflect array which uses the mushroom structures, an inductance L and a capacitance C in an equivalent circuit are adjusted to adjust a resonance frequency to control a reflection phase and control a direction in which a radio wave reflects. Regarding schemes of adjusting the resonance frequency, there exists a scheme which displaces a position of a via from a center of a patch (see Non-patent document 1), a scheme which changes a size of the patch (see Non-patent document 2), a scheme which changes a voltage using a varactor diode (see Non-patent document 3), etc.

Non-patent document 1: F. Yang and Y. Rahmat-Samii, "Polarization dependent electromagnetic band gap (PDEBG) structures: Design and applications," Microwave Opt. Technol. Lett., Vol. 41, No. 6, pp. 439-444, June 2004

Non-patent document 2: K. Chang, J. Ahn, and Y. J. Yoon, "Artificial surface having frequency dependent reflection angle," ISAP 2008

Non-patent document 3: D. Sievenpiper, J. H. Schaffner, H. J. Song, R. Y. Loo, and G. Tangonan, "Two-dimensional beam steering using an electrically tunable impedance surface," IEEE Trans. Antennas Propagat., Vol. 51, No. 10, pp. 2713-2722, October 2003

In order to realize a reflect array which directs a radio wave in a desired direction using a large number of elements, elements which provide a predetermined reflection phase need to be aligned. Ideally, for a predetermined range of some structural parameters such as a patch size, it is desirable that the reflection phase changes in the whole range (two $\pi$ radian=360 degrees) from $-\pi$ radian to $+\pi$ radian.

However, there is a problem that no matter which of the above schemes is used a range of reflection phase in a given frequency does not cover a wide range.

SUMMARY OF THE INVENTION

The object of the present invention is to provide a structure which can be used for an apparatus having a large number of mushroom structures, wherein a range of reflection phase is wide for a predetermined range of structural parameters such as a patch size.

According to one embodiment of the present invention is provided an apparatus having multiple mushroom structures, each of the multiple mushroom structures including:

a ground plate;

a first patch provided parallel to the ground plate with a separation of a distance to the ground plate; and a second patch provided parallel to the ground plate with a separation of another distance to the ground plate, which another distance being different from the distance from the first patch to the ground plate, wherein the second patch is a passive element which is capacitatively coupled with at least the first patch.

The embodiment as described above of the present invention makes it possible to provide a structure which can be used for an apparatus having a large number of mushroom structures, wherein a range of reflection phase is wide for a predetermined range of structural parameters such as a patch size.

BRIEF DESCRIPTION OF THE DRAWINGS

FIG. 2C is a conceptual diagram of the multi-layer mushroom structures and an equivalent circuit diagram;

FIG. 12 is a diagram (H45) illustrating exemplary numerical values of the patch size and the reflection phase;

FIG. 13 is a diagram illustrating exemplary numerical values related to the mushroom structure;

FIG. 19 is a diagram (H70) illustrating exemplary numerical values of the patch size and the reflection phase;

FIG. 21 is a diagram illustrating a simulation result related to a mushroom structure of the first structure;

FIG. 22 is a diagram illustrating a simulation result related to a mushroom structure of the first structure;

FIG. 23 is a diagram illustrating a simulation result related to a mushroom structure of the first structure;

FIG. 39 is a diagram illustrating exemplary numerical values of a patch size and a gap in a reflect array which reflects a radio wave in a 45 degree direction relative to a z axis;

FIG. 42 is a diagram illustrating exemplary numerical values of a patch size and a gap in a reflect array which reflects a radio wave in a 70 degree direction relative to a z axis;

FIG. 46A is a diagram (V45) illustrating a patch size in the L1 layer;

FIG. 59 is a drawing (H45) indicating exemplary numerical values for an element used in the reflect array in FIG. 58;

FIG. 75 is a diagram (H45) indicating exemplary numerical values for an element used in the reflect array in FIG. 74;

FIG. 91 is a diagram (V45) illustrating a patch size in the L1 layer;

FIG. 100A is a diagram illustrating a structure which performs vertical control with a structure which includes a second structure; and FIG. 100B is a diagram illustrating a structure which performs horizontal control with a structure which includes the second structure.

DETAILED DESCRIPTION OF PREFERRED EMBODIMENTS

Figure 1:
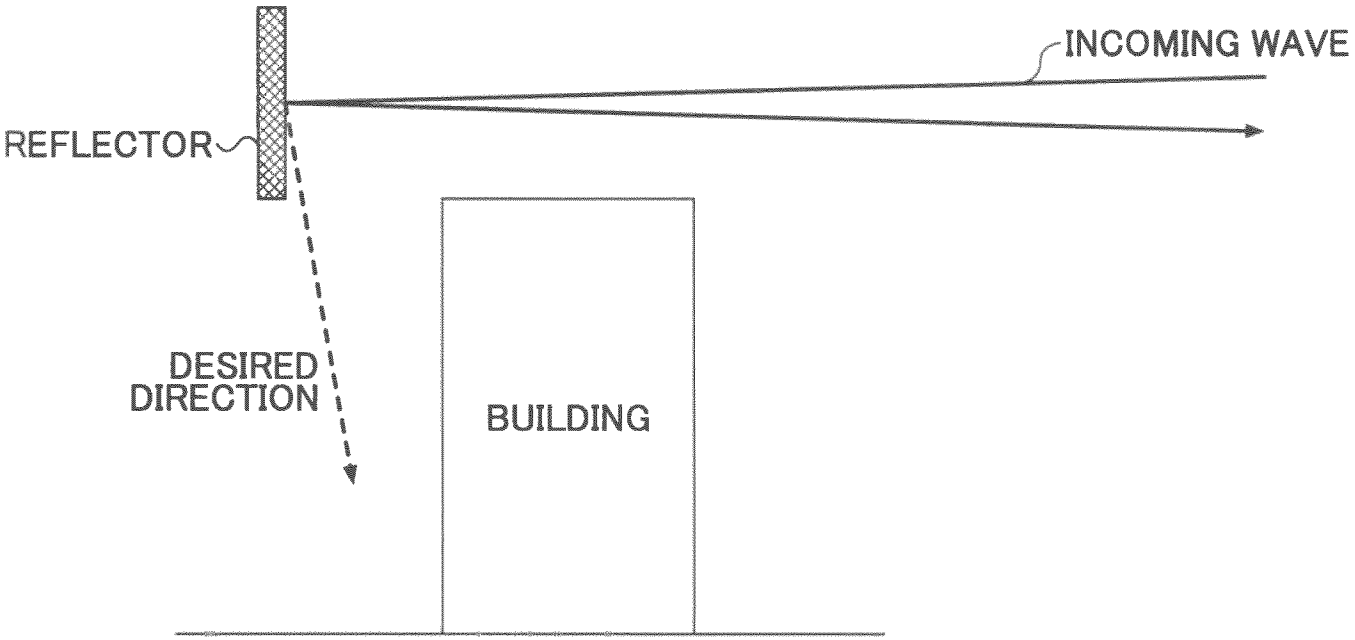
FIG. 1 is a view for explaining a conventional problem.

The present invention is described from the following points of view:

1. Overview
2. First structure
2.1 Mushroom structure
2.2 Reflect array
2.2.1 Reflect array with reflection angle of 45 degrees
2.2.1 Reflect array with reflection angle of 70 degrees
2.3 Mutual relationship between first patch and second patch
2.4 More general multi-layer mushroom structure
3. Second structure
4. Third structure
5. Variation
5.1 Patch arrangement
5.2 Vertical control
5.3 Case of using first structure (reflection angle of 45 degrees)
5.4 Case of using first structure (reflection angle of 70 degrees)
5.5 Case of using second structure (reflection angle of 45 degrees)
5.6 Vertical control with improved second structure 5.7 Structure without via
6. Manufacturing method
7. Combination structure
7.1 Combination method
7.2 Combination of second structure and third structure
7.3 Horizontal control at 45 degrees (part 1)
7.4 Horizontal control at 45 degrees (part 2)
7.5 Vertical control at 45 degrees
7.6 Combination of improved second structure and third structure

Embodiment 1

1. General

A reflection phase of a reflect array becomes 0 at a resonance frequency, which resonance frequency may be adjusted by inductance L and capacitance C in an equivalent circuit. Therefore, the reflection phase at a given frequency may be controlled by adjusting the inductance L and/or the capacitance C. A first structure according to a below-described embodiment focuses on the capacitance.

A reflect array according to the first structure is formed by one ground plate, multiple mushroom structures arranged on the ground plate, and a passive array which is arranged on the mushroom structures. The passive array serves to allow a value of capacitance of a parallel resonance model which approximates the mushroom structures to be doubled, for example. In other words, besides capacitance due to a gap between neighboring mushroom structures (a gap between first patches), capacitance which occurs in a gap between second patches makes it possible to increase the overall capacitance. The capacitance may be controlled by changing a size of a gap between neighboring first patches and/or a gap between neighboring second patches. Thus, a size of the first and second patches (in other words, a size of a gap) may be changed to broaden a range in which capacitance may be controlled, making it possible to broaden a range in which a reflection phase changes.

A second structure according to a below-described embodiment focuses on inductance. The inductance L of the mushroom structures is approximately proportional to a distance t from a ground plate to a patch (a length of a via hole). Thus, mushroom structures with differing distances between the ground plate and the patch also operate differently with respect to the reflection phase. Mushrooms of different distance t between the ground plate and the patch may be combined to achieve a reflection phase which could not be realized for a certain distance or thickness.

A third structure according to the below-described embodiment focuses on capacitance, but, unlike the first structure, multiple patches are not arranged in parallel. Instead, in order to obtain a larger capacitance, patches of neighboring mushroom structures are allowed not only to provide a gap in the same plane, but also to provide gaps in mutually different planes (it is allowed to overlap with a separation of a distance). In this way, capacitance not realized due to manufacturing limit, etc, can be achieved, making it possible to expand the range of the reflection phase.

2. First Structure 2.1 Mushroom Structure

Figure 2A:
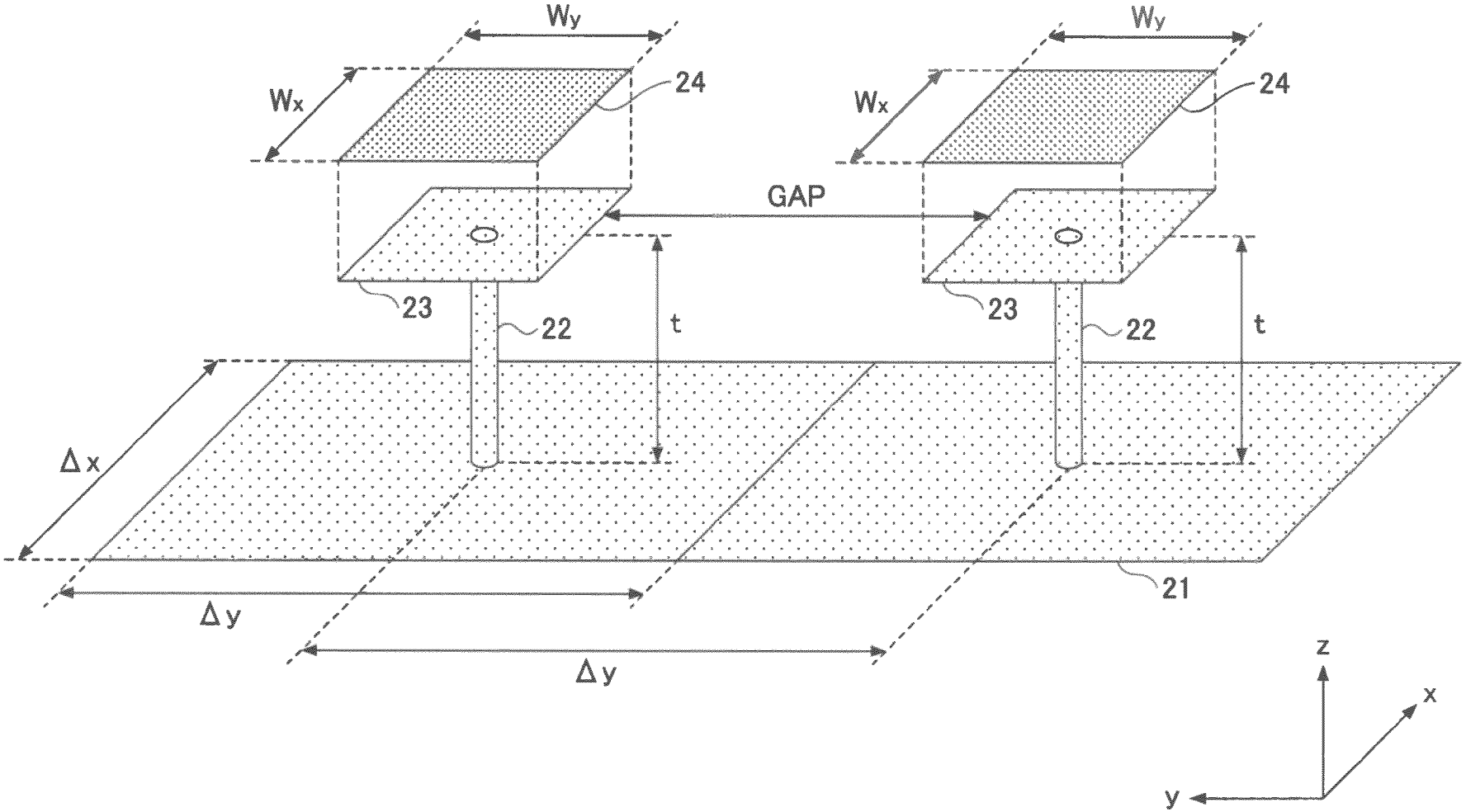
FIG. 2A is a diagram illustrating mushroom structures which can be used in the present embodiment.

FIG. 2A illustrates mushroom structures which can be used in the present embodiment. In FIG. 2A are shown two mushroom structures. Elements of such mushroom structure elements may be arranged in a large number to form a reflect array. The present invention is not limited to the reflect array, so that it can be used for other objectives such as an antenna, a filter, etc.

In FIG. 2A are shown a ground plate 21, a via hole 22, a first patch 23, and a second patch 24.

The ground plate 21 is a conductor which supplies a common potential to a number of mushroom structures. Δx and Δy in FIG. 2A are equal to a gap in an x-axis direction and a gap in a y-axis direction between via holes in neighboring mushroom structures. Δx and Δy represent a size of the ground plate 21 which corresponds to one of the mushroom structures. In general, the ground plate 21 is as large as an array on which a large number of mushroom structures are arranged.

The via hole 22 is provided to electrically short the ground plate 21 and the first patch 23. The first patch 23 has a length of Wx in the x-axis direction and a length of Wy in the y-axis direction. The first patch 23 is provided in parallel with the ground plate 21 with a separation of a distance of t, and is shorted to the ground plate 21 via the via hole 22.

The second patch 24, which is also arranged in parallel with the ground plate 21, is arranged with a separation thereto, which is larger than that to the first patch 23. The first patch 23 is electrically coupled to the ground plate 21. However, the second patch 24 is a passive element which is not electrically connected to the ground plate 21. The first patch 23 on the left-hand side and the first patch 23 on the right-hand side are capacitatively coupled. Similarly, the second patch 24 on the left-hand side and the second patch 24 on the right-hand side are also capacitatively coupled. Moreover, the first patch 23 and the second patch 24, which are arranged in parallel, are also capacitatively coupled. As described below, the second patch 24 may be provided between the first patch 23 and the ground plate 21.

As an example, the first patch 23 is provided with a separation of 1.6 mm from the ground plate 21, and in between the first patch 23 and the second patch 24 is provided a dielectric layer with a permittivity of 4.4, a thickness of 0.8 mm, and tan δ of 0.018.

In the example shown, only two patches, the first and the second, are shown, but three or more patches may be provided. For example, a third patch may be provided which is a passive element with a separation of a further distance from the second patch 24.

Figure 3:
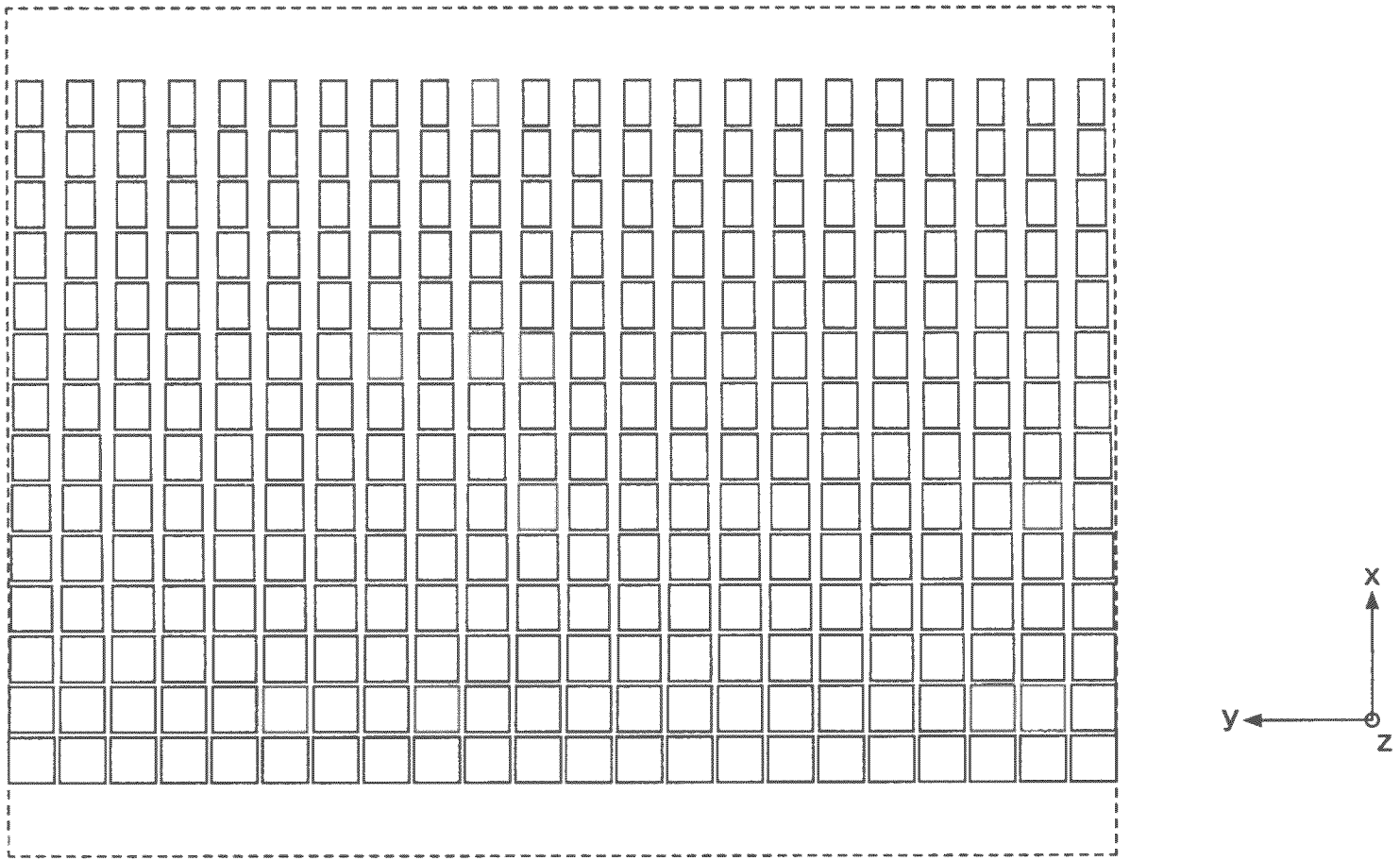
FIG. 3 is a schematic plane view when mushroom structures are two-dimensionally arranged.

FIG. 3 illustrates a schematic plane view when the mushroom structures shown in FIG. 2A are two-dimensionally arranged. In this way, a large number of mushroom structures may be arranged according to a certain rule to form a reflect array, for example. For the reflect array, a radio wave arrives from a direction (a z-axis) which is vertical to the paper face, and reflects in a direction having an angle α with respect to the z-axis in an X-Z face.

Figure 4:
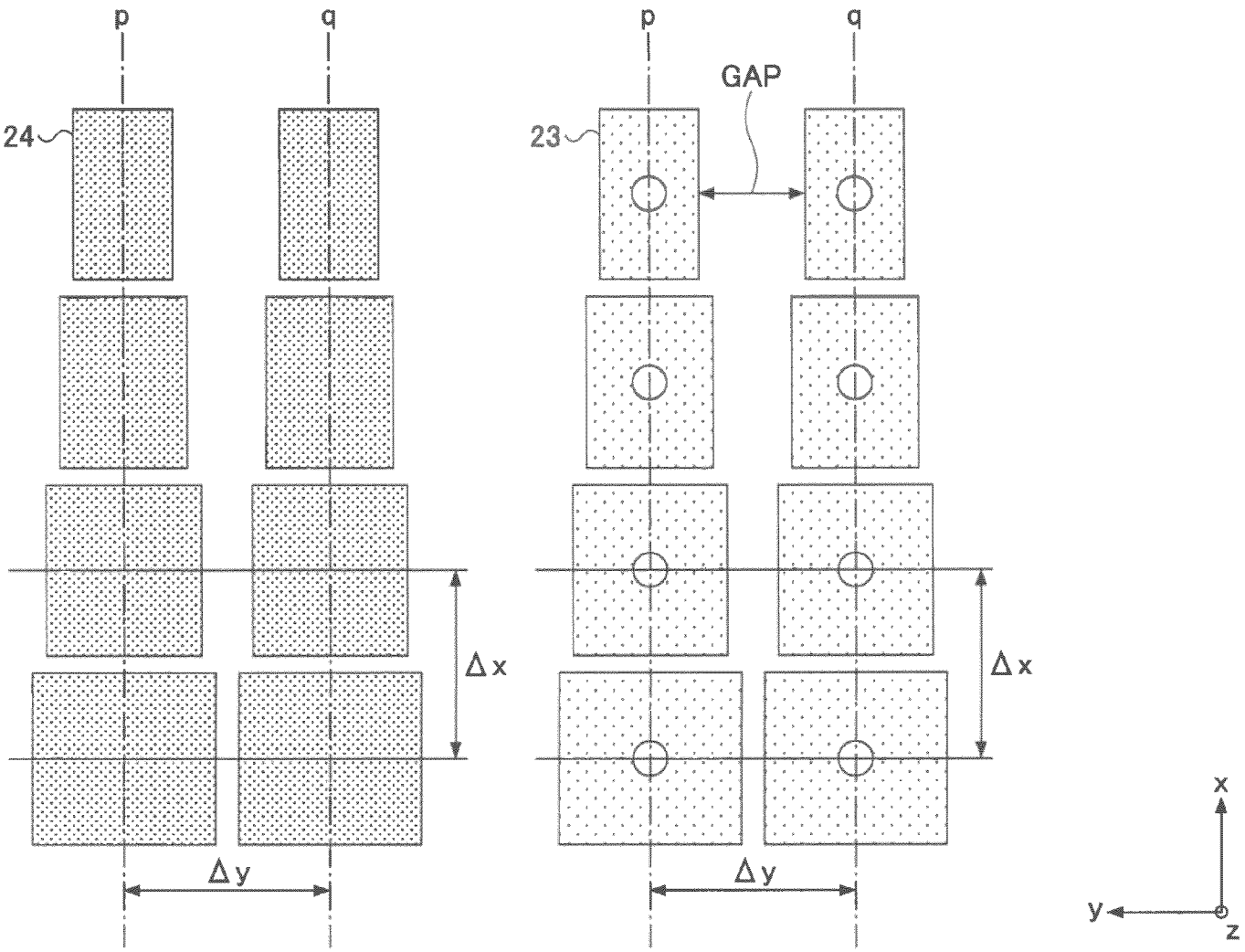
FIG. 4 is a diagram for explaining how individual mushroom structures in FIG. 3 are arranged.

FIG. 4 shows a diagram for explaining an arrangement of individual mushroom structures in FIG. 3. Shown on the right-hand side are four first patches 23 lined up along a line p and four first patches 23 lined up, adjacent to the line, along a line q. Shown on the left hand side are second patches 24 provided over the first patches 23 with a separation of a distance from the first patches 23. The number of patches is arbitrary. In examples shown in FIG. 2A, FIG. 3, and FIG. 4, the first patch 23 and the second patch 24 have the same size, which is not mandatory to the present invention, so that different sizes may be used. However, from a point of view of approximately doubling the capacity of the mushroom structures, it is desirable that the first patch 23 and the second patch 24 are of the same size.

In the present embodiment, a gap between the first patch 23 of the mushroom structure along a line p and the first patch 23 of the mushroom structure along another line q is gradually changing along the lines p and q.

In examples shown in FIGS. 3 and 4, a reflected wave by a certain element (mushroom structure) lined up along upward and downward directions of the paper face (for example, line p in FIG. 4), and a reflected wave by an element neighboring the element along the line are mutually offset in phase by a predetermined amount. A large number of elements which have such characteristics may be lined up to form a reflect array.

Figure 5:
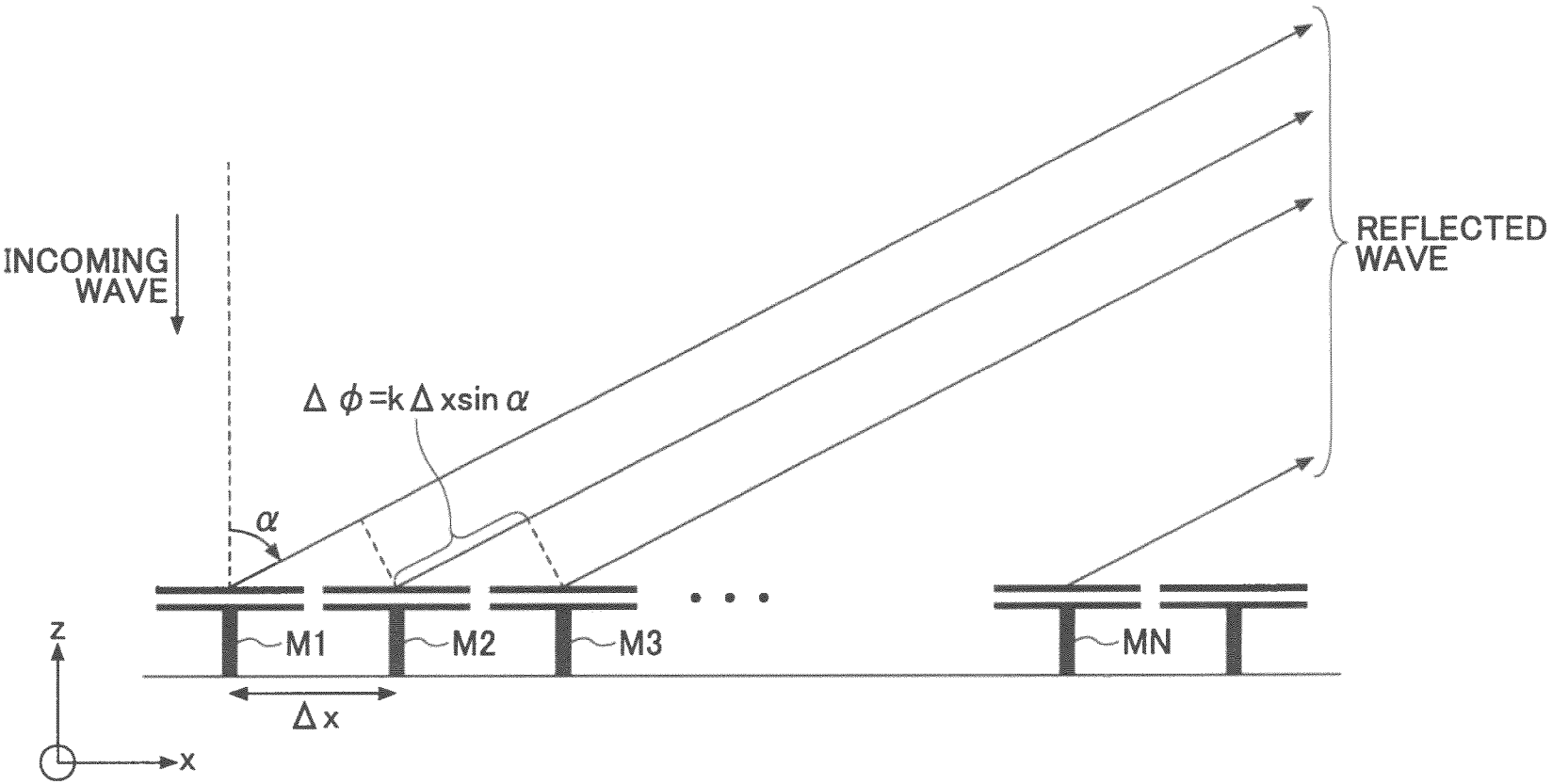
FIG. 5 is a diagram schematically illustrating how a radio wave arrives from a z axis $\infty$ direction and is reflected relative to mushroom structures M1 to MN arranged in an x-axis direction.

FIG. 5 is a diagram schematically illustrating how a radio wave arrives from a z-axis ∞ direction and is reflected relative to mushroom structures M1 to MN arranged in an x-axis direction. Assume that the reflected wave forms an angle α with respect to an incident direction (the z-axis direction). Assuming that a gap between via holes is Δx, a reflection angle α and a reflected wave phase difference Δϕ due to neighboring elements meet the following equation:

$$\Delta\phi = k \cdot \Delta x \cdot \sin\alpha$$

$$\alpha = \sin^{-1}[(\lambda\Delta\phi)/(2\pi\Delta x)],$$

where k, which is a wave number, is equal to 2π/λ. λ is a wavelength of a radio wave. In order to form a reflect array which is sufficiently large with respect to the wavelength, what is set with a phase difference between neighboring elements of Δϕ repeatedly such that a reflection phase difference of N·Δϕ by the whole of N mushroom structures M1-MN becomes 360 degrees (2π radian) is to be lined up. For example, when N=20, Δϕ=360/20=18 degrees. Thus, elements may be designed such that a reflection phase difference between neighboring elements are 18 degrees and an arrangement of 20 thereof may be repeatedly lined up to realize a reflection array which reflects a radio wave in a direction of angle α.

Figure 6:
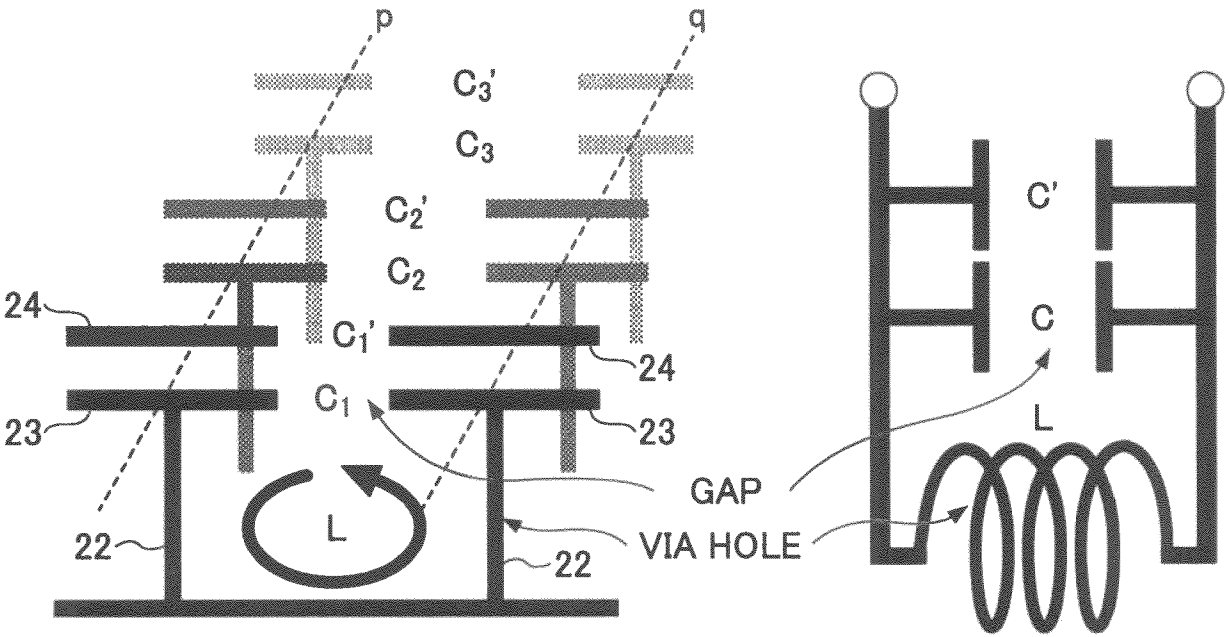
FIG. 6 is a set of equivalent circuit diagrams for mushroom structures.

FIG. 6 shows an equivalent circuit for mushroom structures shown in FIG. 2A, FIG. 3, and FIG. 4. As shown on the left-hand side of FIG. 6, there is capacitance C due to a gap between the first patch 23 of mushroom structures lined up along the line p and the first patch 23 of mushroom structures lined up along the line q. Similarly, there is capacitance C' due to the second patch 24 of mushroom structures. Moreover, there is inductance L due to a via hole 22 of mushroom structures lined up along a line p and a via hole of mushroom structures lined up along a line q. Therefore, an equivalent circuit of neighboring mushroom structures becomes a circuit as shown on the right-hand side of FIG. 6. In other words, in the equivalent circuit, the inductance L, the capacitance C, and another capacitance C' are connected in parallel. The capacitance C, inductance L, a surface impedance Zs, and a reflection coefficient Γ may be shown as follows:

$$C = \frac{\varepsilon_0(1+\varepsilon_r)W_x}{\pi}\operatorname{arccosh}\left(\frac{\Delta y}{\Delta y - W_y}\right) \tag{1}$$

$$L = \mu \cdot t \tag{2}$$

$$Z_s = \frac{j\omega L}{1 - 2\omega^2 LC} \tag{3}$$

$$\Gamma = \frac{Z_s - \eta}{Z_s + \eta} = |\Gamma|\exp(j\phi) \tag{4}$$

In Equation (1), $\in_0$ represents a permittivity of a vacuum, and $\in_r$ represents a relative permittivity of a material interposed between the first patches. Δy represents a via hole interval in the y-axis direction. Wy represents a length of the first patch in the y-axis direction. Therefore, Δy−Wy represents a magnitude of a gap between neighboring first patches. Thus, an argument of an arccosh function represents a ratio between a via hole gap Δy and a gap. In Equation (2), μ represents a permeability of a material interposed between via holes. In Equation (3), ω represents an angular frequency and j represents an imaginary number unit. For brevity and clarity, it is set that C'=C, which is not mandatory. In Equation (4), η represents free space impedance and ϕ represents a phase difference.

Figure 7:
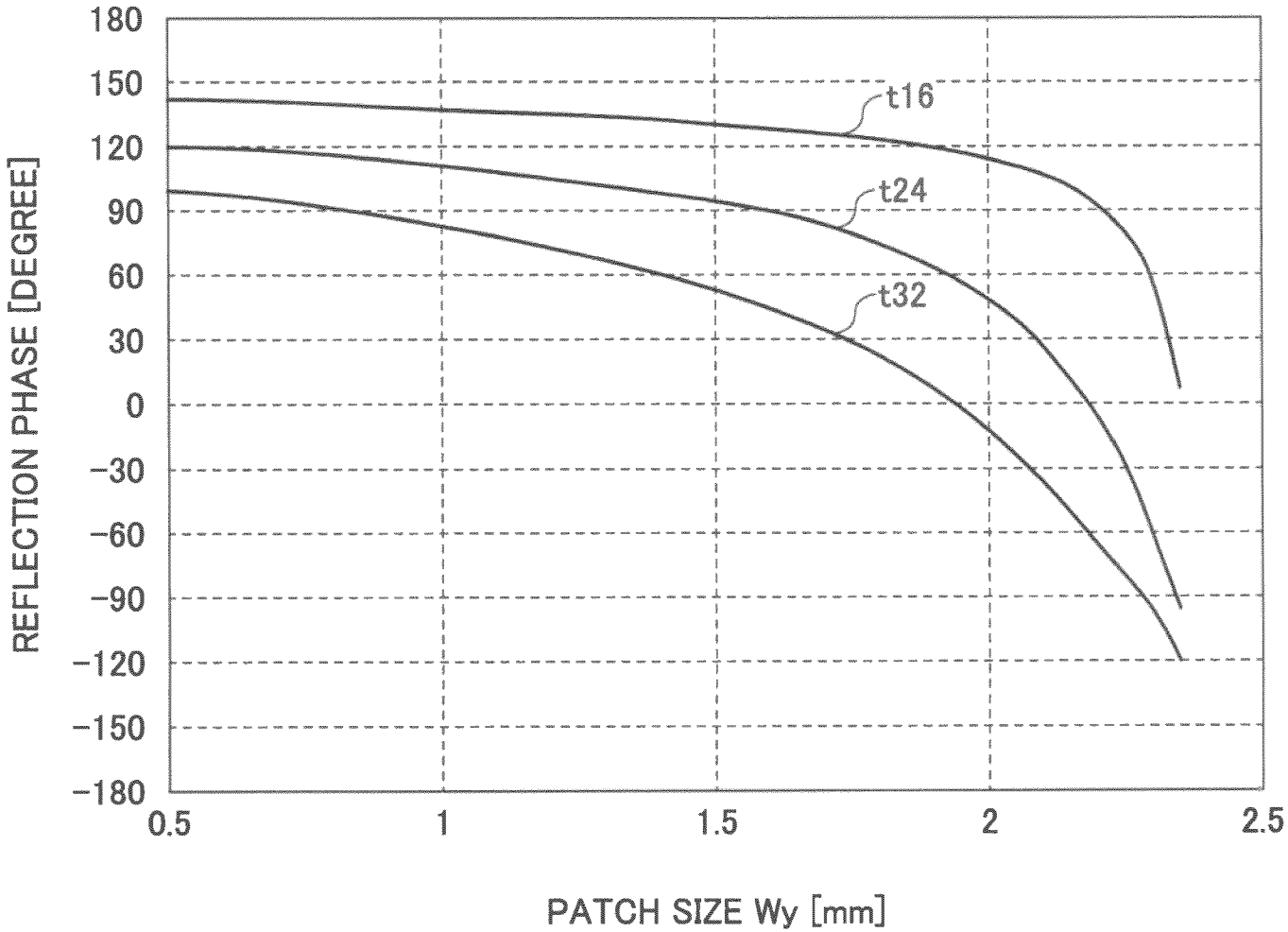
FIG. 7 is a diagram illustrating a relationship between a patch size Wy and a reflection phase when conventional structures are used as the mushroom structures.

FIG. 7 shows a relationship between a reflection phase and a size Wy of a first patch of the mushroom structure. The mushroom structure in this case is a set of conventional mushroom structures in which a second patch 24 is not provided unlike the structure of FIG. 2A. In other words, it is merely a structure such that the first patch is provided with a distance t of separation with respect to a ground plate. FIG. 7 shows a graph representing a relationship between a reflection phase and a size Wy of a first patch for each of three types of distances t. t16 shows a graph when the distance t is 1.6 mm. t24 shows a graph when the distance t is 2.4 mm. t32 shows a graph when the distance t is 3.2 mm. A gap Δy between neighboring via holes is 2.4 mm.

For the graph t16, when the size Wy of the first patch changes from 0.5 mm to 1.9 mm, the reflection phase only slowly decreases from 140 degrees to 120 degrees, but when the size Wy exceeds 1.9 mm, the reflection phase decreases drastically, and, when the size Wy is 2.3 mm, the reflection phase becomes in the order of zero degrees.

Similarly, for the graph t24, when the size Wy of the first patch changes from 0.5 mm to 1.6 mm, the reflection phase only slowly decreases from 120 degrees to degrees, but when the size Wy exceeds 1.6 mm, the reflection phase decreases drastically, and, when the size Wy is 2.3 mm, the reflection phase becomes in the order of −90 degrees.

For the graph t32, when the size Wy of the first patch changes from 0.5 mm to 2.3 mm, the reflection phase gradually decreases from 100 degrees to −120 degrees.

In this way, for the conventional structures, even when the first patch Wy is changed from 0.5 mm to 2.3 mm, a range within which a reflection phase can be adjusted at most only 220 degrees between −120 to +100 degrees, even for the largest t32.

Figure 8:
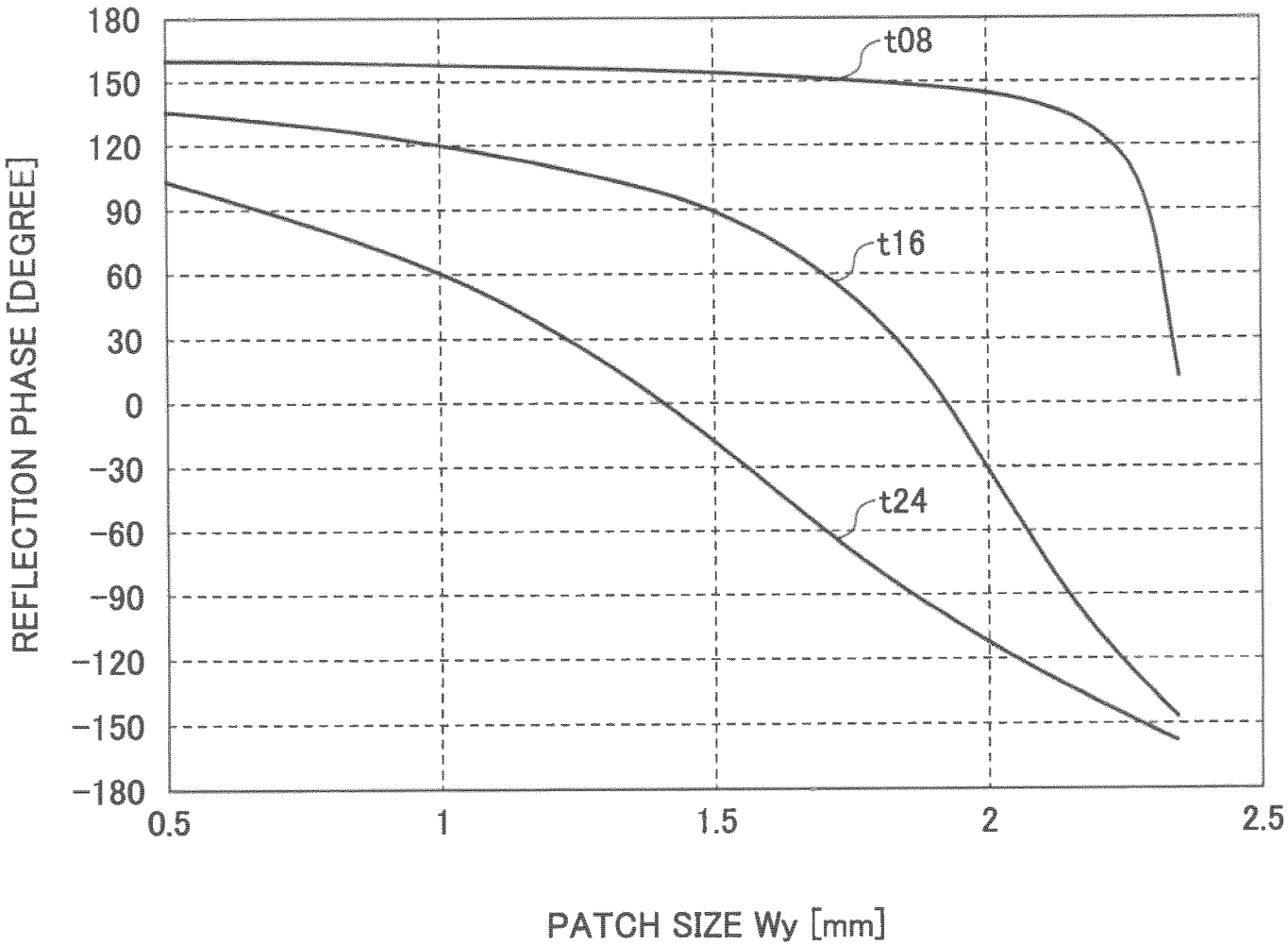
FIG. 8 is a diagram illustrating a relationship between a patch size Wy and a reflection phase for mushroom structures used in a first structure of the present embodiment.

FIG. 8 shows a relationship between a reflection phase and a size Wy of a first patch of the mushroom structures as shown in FIG. 2A. A first patch 23 is provided with a separation of a distance t relative to the ground plate 21. FIG. 8 is a graph showing a relationship between a reflection phase and a size Wy of the first patch for each of three types of distance t. t08 shows a graph when the distance t is 0.8 mm. t16 shows a graph when the distance t is 1.6 mm. t24 shows a graph when the distance t is 2.4 mm. A gap Δy between neighboring via holes is 2.4 mm.

For the graph t08, when the size Wy of the first patch changes from 0.5 mm to 1.8 mm, the reflection phase only slowly decreases from 160 degrees to 150 degrees, but when the size Wy exceeds 1.8 mm, the reflection phase decreases drastically, and when the size Wy is 2.3 mm the reflection phase becomes in the order of 10 degrees.

For the graph t16, when the size Wy of the first patch changes from 0.5 mm to 1.7 mm, the reflection phase only slowly decreases from 135 degrees to 60 degrees, but when the size Wy exceeds 1.7 mm, the reflection phase decreases drastically, and when the size Wy is 2.3 mm the reflection phase becomes in the order of −150 degrees.

For the graph t24, when the size Wy of the first patch changes from 0.5 mm to 2.3 mm, the reflection phase gradually decreases from 100 degrees to −150 degrees.

In this way, in the first structure of the present embodiment, when the first patch Wy is changed from 0.5 mm to 2.3 mm, a range within which a reflection phase can be adjusted reaches 285 degrees (e.g., +135 to −150 degrees) for the largest t16. According to the present embodiment, as shown in FIG. 2A, the second patch 24 may be provided in addition to the first patch 23 to expand the range in which a reflection phase can be adjusted.

2.2 Reflect Array

As described with reference to FIG. 5, elements are designed such that a reflection phase difference between neighboring elements is a predetermined value and those elements may be lined up to realize a reflect array which reflects a radio wave in a direction of an angle α. For example, twenty elements with reflective phase differences of 18 degrees each may be lined up to form a reflect array. When forming such a reflect array, a size of an element is determined based on a mutual relationship between a reflection phase difference and a patch size as shown in FIGS. 7 and 8.

When a reflect array is designed using the conventional structures, design is performed with reference to the graph t32 in FIG. 7. For example, it is demonstrated that the patch size Wy of an element of a reflection phase of zero degrees is 1.9 mm and the patch size Wy of an element of a reflection phase of +18 degrees is 1.8 mm, and the patch size Wy of an element of a reflection phase of +36 degrees is 1.7 mm. The reason that 3.2 mm is chosen as a height t of the first patch is that it exhibited the widest reflection phase range. Patches of sizes derived in this way may be lined up to achieve a reflect array. In this case, even when the first patch Wy is changed from 0.5 mm to 2.3 mm, the maximum value of the phase difference is at most 220 degrees. The maximum value of the phase difference is ideally 360 degrees (=2π radians). As a result, not all of elements which realize a desired phase difference may be provided in the reflect array, so that a characteristic of the reflect array somewhat deviates from what is ideal.

When designing a reflect array according to the first structure of the present embodiment, design is performed with reference to a graph t16 in FIG. 8. For example, it is demonstrated that the patch size Wy of an element of a reflection phase of zero degrees is 1.9 mm and the patch size Wy of an element of a reflection phase of +18 degrees is 1.75 mm, and the patch size Wy of an element of a reflection phase of +36 degrees is 1.7 mm. The reason that 1.6 mm is chosen as a height t of the first patch is that it exhibited a widest reflection phase range. Patches of patch sizes derived in this way may be lined up to achieve a reflect array. In this case, if the first patch Wy is changed from 0.5 mm to 2.3 mm, the maximum value of the phase difference reaches 285 degrees and approaches an ideal 360 degrees (=2π radians). As a result, more elements which realize a desired phase difference may be provided in the reflect array, so that a characteristic of the reflect array approaches what is ideal. As described below, when realizing a reflect array which reflects in a 45 degree direction under certain conditions, 20 elements are ideally needed which differ in reflection phase difference by 18 degrees. In the present embodiment, 14 (70% out of 20) could actually be created. On the contrary, for the conventional structures, the maximum value of the phase difference is at most 220 degrees. Thus, 220 degrees divided by 18 degrees is approximately 12.2 theoretically, only 12 may be created at a maximum, so that only about 4 may be practically created.

2.2.1 Reflect Array with Reflection Angle of 45 Degrees

Figure 9:
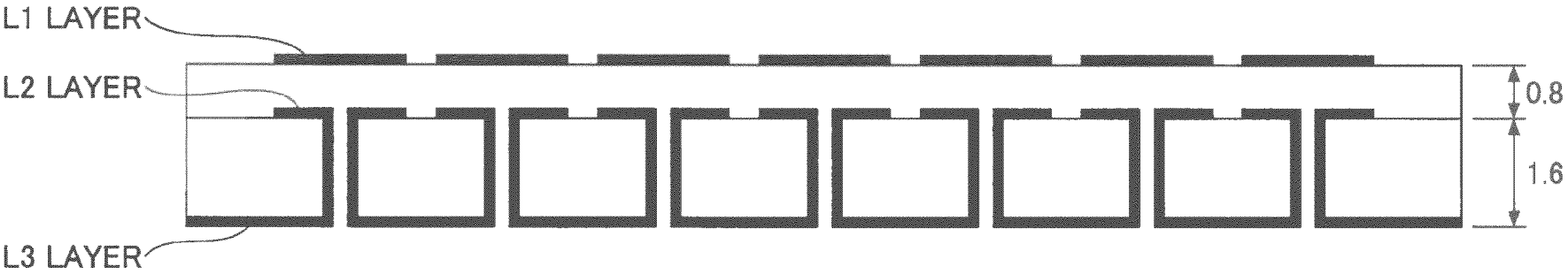
FIG. 9 is a partial cross-sectional diagram of a reflect array which uses the first structure.

FIG. 9 is a partial cross-sectional diagram of a reflect array which uses the first structure. The reflect array has three conductive layers of L1, L2, and L3, and dielectric layers between each conductive layer. As an example, the conductive layer is formed by materials including copper, for example. Moreover, the dielectric layer is formed by a material which has relative permittivity of 4.4 and tan δ of 0.018. In between L1 and L2 layers is interposed a dielectric layer of a thickness of 0.8 mm. In between L2 and L3 layers is interposed a dielectric layer of a thickness of 1.6 mm. The L1 layer corresponds to the second patch 24 in FIG. 2A. The L2 layer corresponds to the first patch 23 in FIG. 2A. The L3 layer corresponds to the ground plate 21. Therefore, a through hole between the L2 layer and the L3 layer corresponds to the via hole 22.

Figure 10:
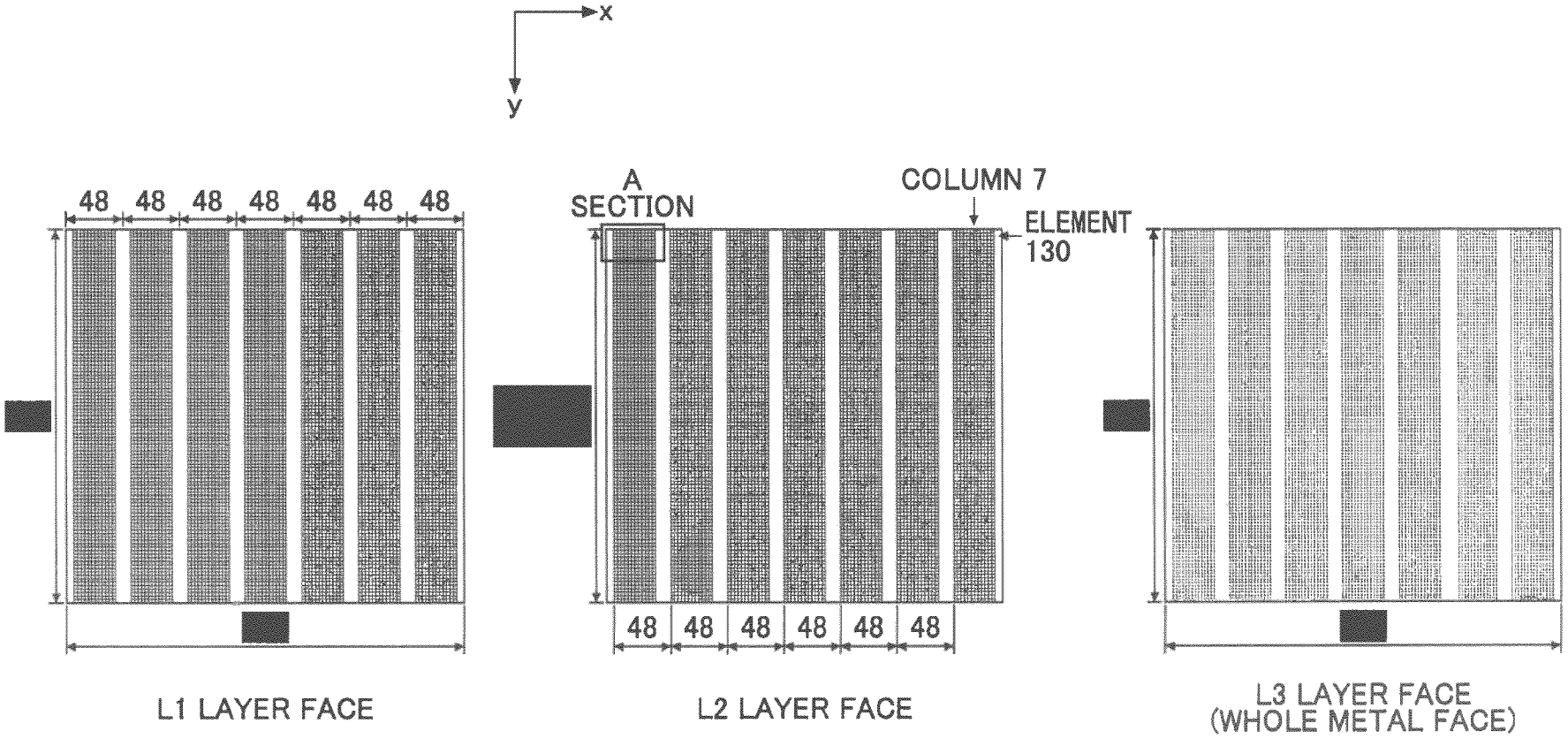
FIG. 10 is a plane view (H45) of an L1 layer, an L2 layer, and an L3 layer in a reflect array.
Figure 11:
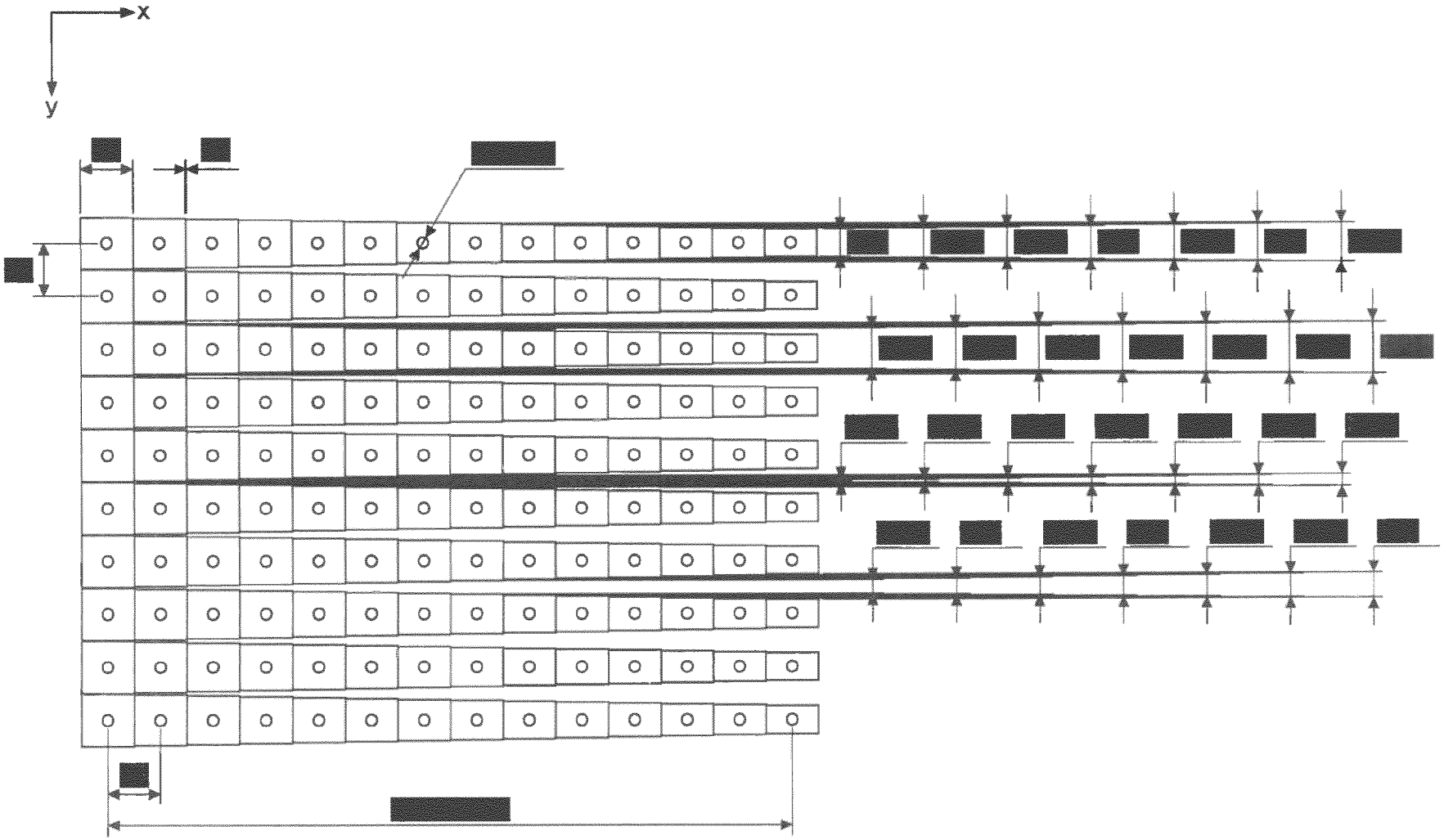
FIG. 11 is a detailed diagram (H45) of an A section in the L2 layer.

FIG. 10 schematically illustrates a plane view of the L1, L2 and L3 layers. One element is formed with mushroom structures as shown in FIG. 2A, and the element is arranged in a matrix form. In the example shown, one of bands of 7 columns extending in the y-axis direction includes 14×130 elements. A gap between the elements is 2.4 mm. The reflect array shown is designed such that it reflects a radio wave in a 45 degree angle relative to an incident direction and such that the reflection phase difference between neighboring elements is 18 degrees. In other words, one band (column) extending in the y-axis direction is designed such that the reflection phase changes by 2π between both ends of the x-axis direction. Ideally, it is desired that 20 elements change the reflection phase by 2π. However, for reason of manufacturing constraints, fourteen elements are used. Thus, within one period in the x-axis direction of 48 mm (=2.4×20), a region exists within which an element is not formed. Such a band or column may be lined up repeatedly in multiple numbers to realize a larger-sized reflect array. In FIGS. 10 and 11, specific dimensional details are omitted as they are not essential to the present invention. The ability to line up a band or a column in multiple numbers to properly adjust the size is applicable not only for reflecting the radio wave in the horizontal direction (x-axis direction), but also for reflecting the radio wave in the vertical direction as described below. It is applicable not only to the first structure, but also the second structure, the third structure, as well as the combination structure.

FIG. 11 shows in detail a region (a part of a band or a column) shown as in "A section" in the L2 layer in FIG. 10. For one line, 14 elements are lined up in the x-axis direction. The A section is a part of the L2 layer, so that each one of 14 rectangles corresponds to a first patch 23 (FIG. 2A) having sizes Wx and Wy. Each of these 14 elements lined up in the x-axis direction is designed such that it has a predetermined phase difference (18 degrees=360 degrees/20) with a neighboring element.

FIG. 12 shows a specific numerical example of a reflection phase and a dimension (patch size Wy) of these 14 elements. As shown, "a design phase" indicates an ideal design value, while "an actual phase" indicates an actual phase which could be realized. FIG. 13 shows a specific numerical example related to an element of mushroom structures created using an FR4 substrate. Numerical value examples shown in FIGS. 12 and 13 are determined from a point of view of horizontal control in which a radio wave with an electric field directed to the y-axis direction in FIG. 10 that is incident from a z-axis direction is reflected at a 45-degree angle in a lateral direction relative to a polarizing face (i.e., an x-axis direction of FIG. 10) by 45 degrees.

Figure 14:
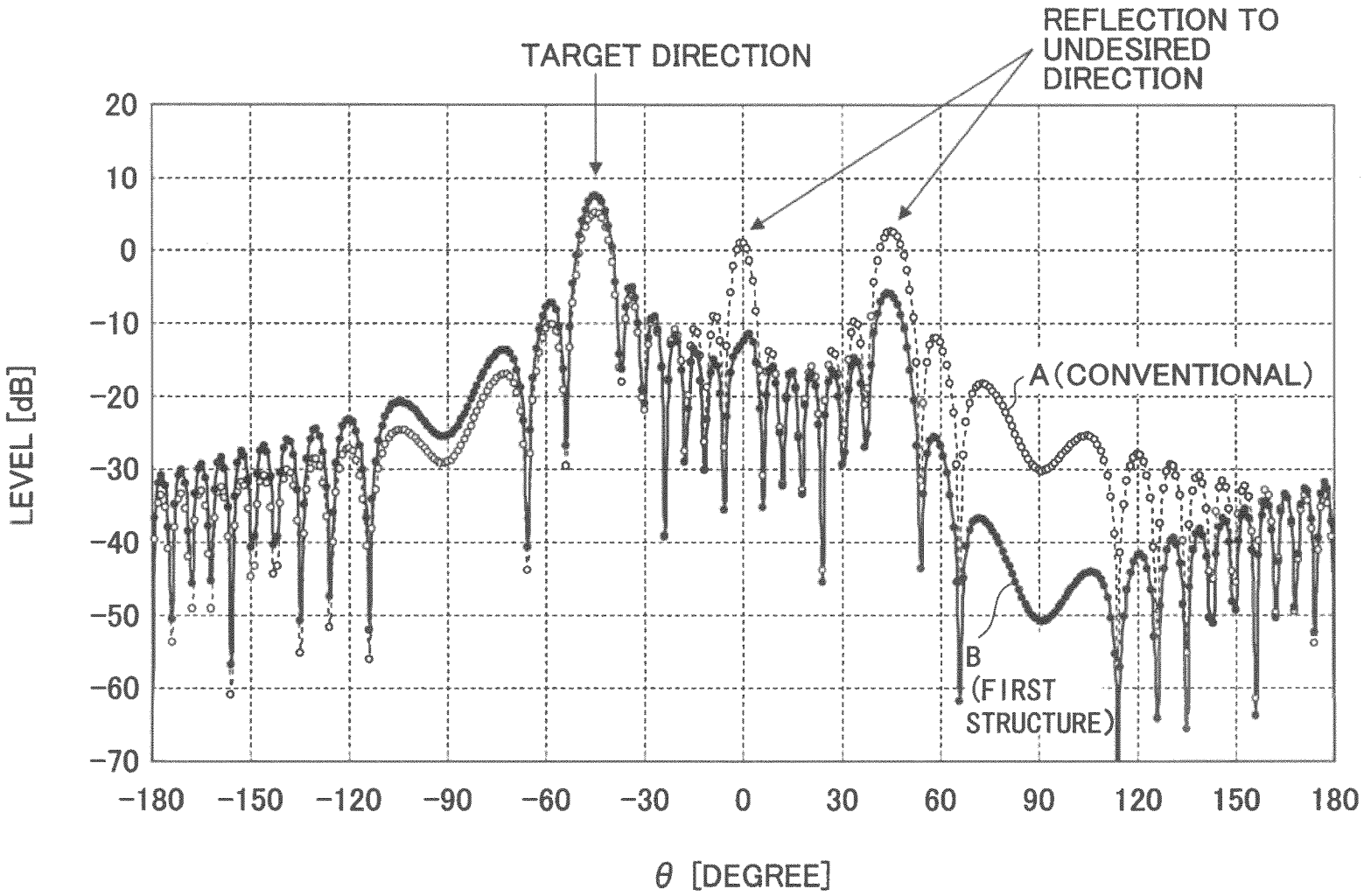
FIG. 14 is a diagram illustrating an exemplary characteristic comparison between a reflect array when the conventional structures are used as the mushroom structures and a reflect array when the first structure of the present embodiment is used.

FIG. 14 shows an exemplary characteristic comparison for each of reflect arrays (graphs A and B) according to a first structure of the present embodiment and the conventional structures. Either of the reflect arrays is designed such that a radio wave is reflected in a direction of horizontal −45 degrees relative to an incoming direction of the radio wave. In this case, the frequency of the radio wave is 8.8 GHz (=c/λ), a reflection phase differences Δφ between elements is 18 degrees (=360/20) and a dimension Δx between elements is 2.4 mm. In this case, as explained with reference to FIG. 5, the reflection angle α becomes $$\alpha = \arcsin[(\lambda\Delta\varphi)/(2\pi\Delta x)]$$

$$= \arcsin(\lambda_{8.8GHz} \cdot 18 \text{ degrees}/(2\pi \cdot 2.4 \text{ mm}))$$

is approximately equal to 45.21 degrees. Thus, both graphs A and B demonstrate a large peak at −45 degrees. A radio wave which reflects in a direction other than −45 degrees is a spurious reflected wave. As shown in the graph A, for a conventional structure, large reflection occurs not only in a −45 degree direction, but also in 0-degree, +45-degree, 60-degree, etc., directions. Moreover, a relative high level of reflection is also observed between +70 to +150 degrees. On the other hand, as shown in graph B, for the first structure of the present embodiment, it can be seen that a spurious reflected wave is substantially suppressed in 0-degree, +45-degree, +60-degree, +70-degree, +150-degree, etc.

Figure 15:
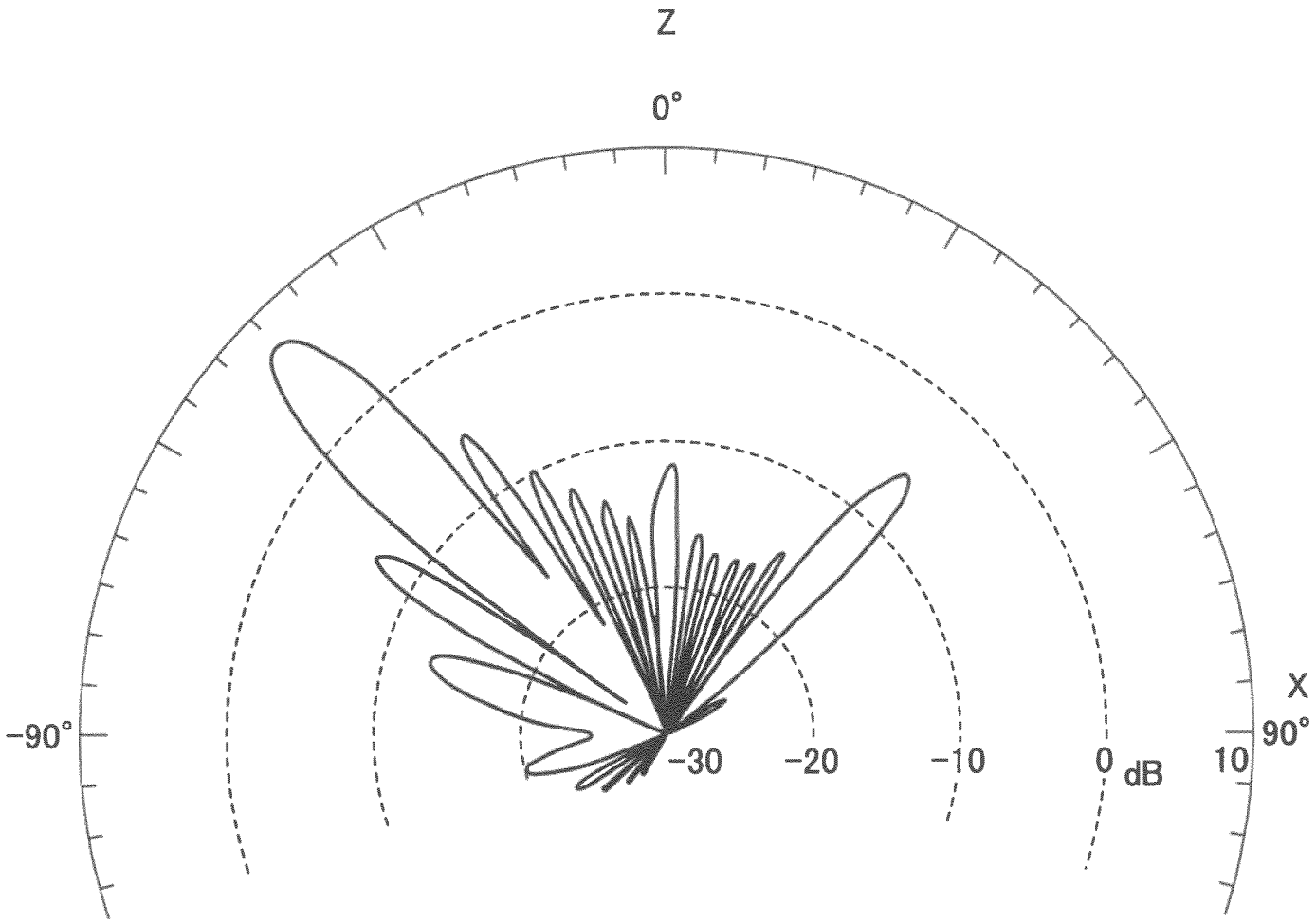
FIG. 15 is a diagram illustrating a far radiation field related to the reflect array according to the first structure of the present embodiment.

FIG. 15 shows, in a polar coordinate format, a far radiation field related to graph B (a graph for the present embodiment) of FIG. 14.

Figure 16:
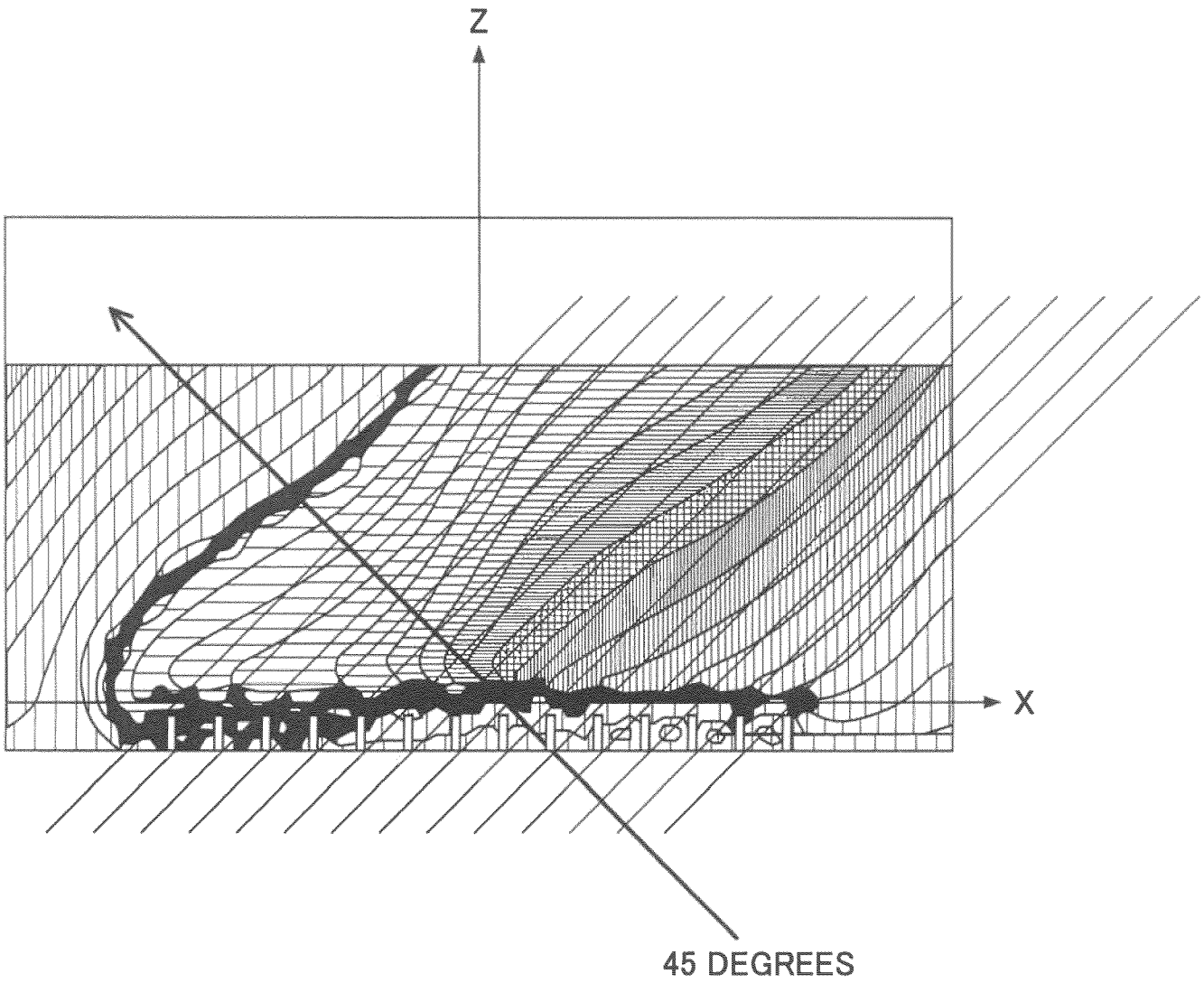
FIG. 16 is a diagram illustrating an iso-phase face of a wave reflected by the reflect array according to the first structure of the present embodiment.

FIG. 16 illustrates an iso-phase face of a wave reflected by a reflect array which uses the first structure of the present embodiment. With 14 elements (mushroom structures of the first structure) lined up along the x-axis direction, a radio wave arrives from a z-axis direction, and the radio wave is reflected in a θ=−45 degrees onto a ZX face relative to the z-axis direction. A normal of the iso-phase faces a −45 degree direction relative to the z-axis, in which direction a reflected wave proceeds appropriately.

2.2.2 Reflect Array with Reflection Angle of 70 Degrees

Exemplary numerical values shown in FIGS. 10-16 (except FIG. 13) are selected from a viewpoint of reflecting in a horizontal direction of 45 degrees relative to an incident direction. The present embodiment is not limited to the 45 degrees, so that a reflect array may be formed which reflects a radio wave in an arbitrary direction.

Figure 17:
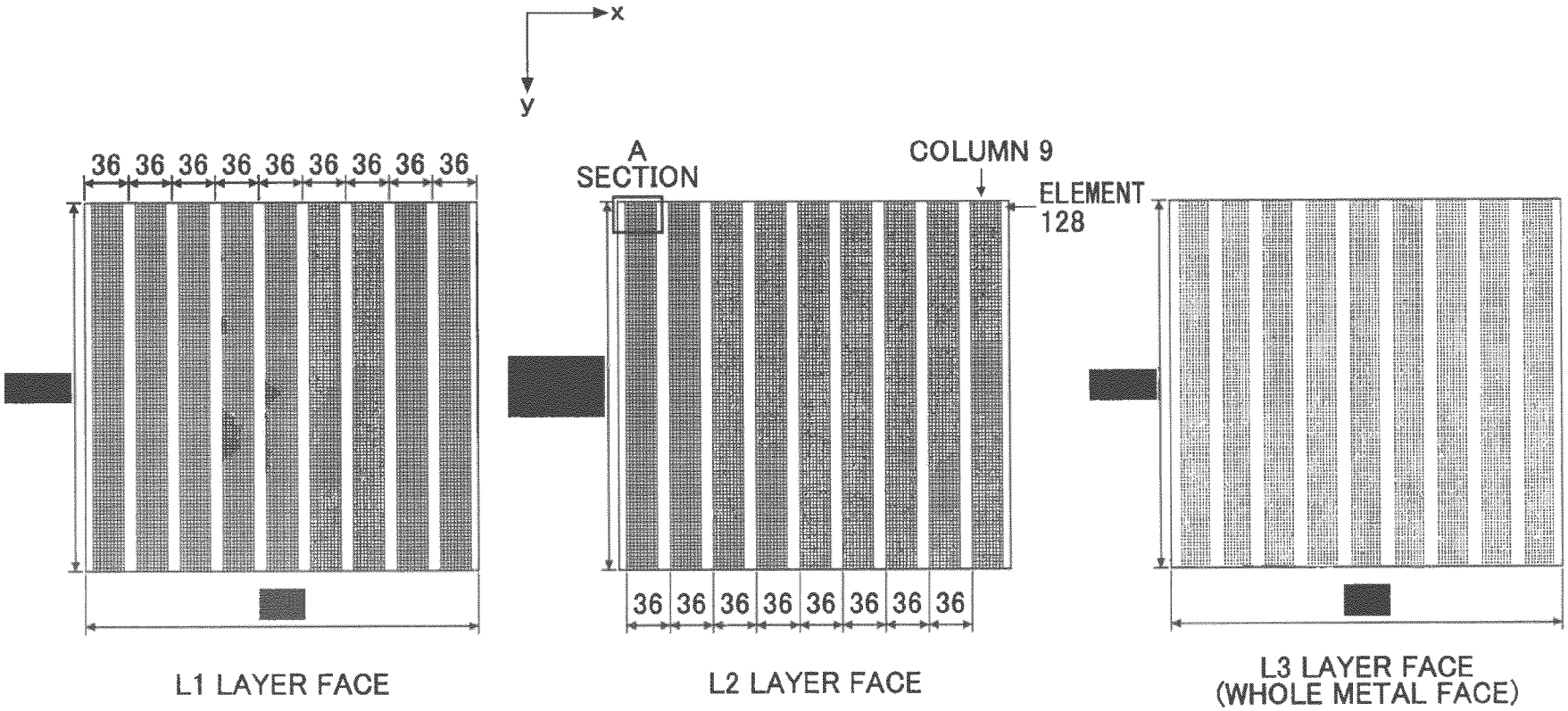
FIG. 17 is a plane view (H70) of the L1 layer, the L2 layer, and the L3 layer in the reflect array.
Figure 18:
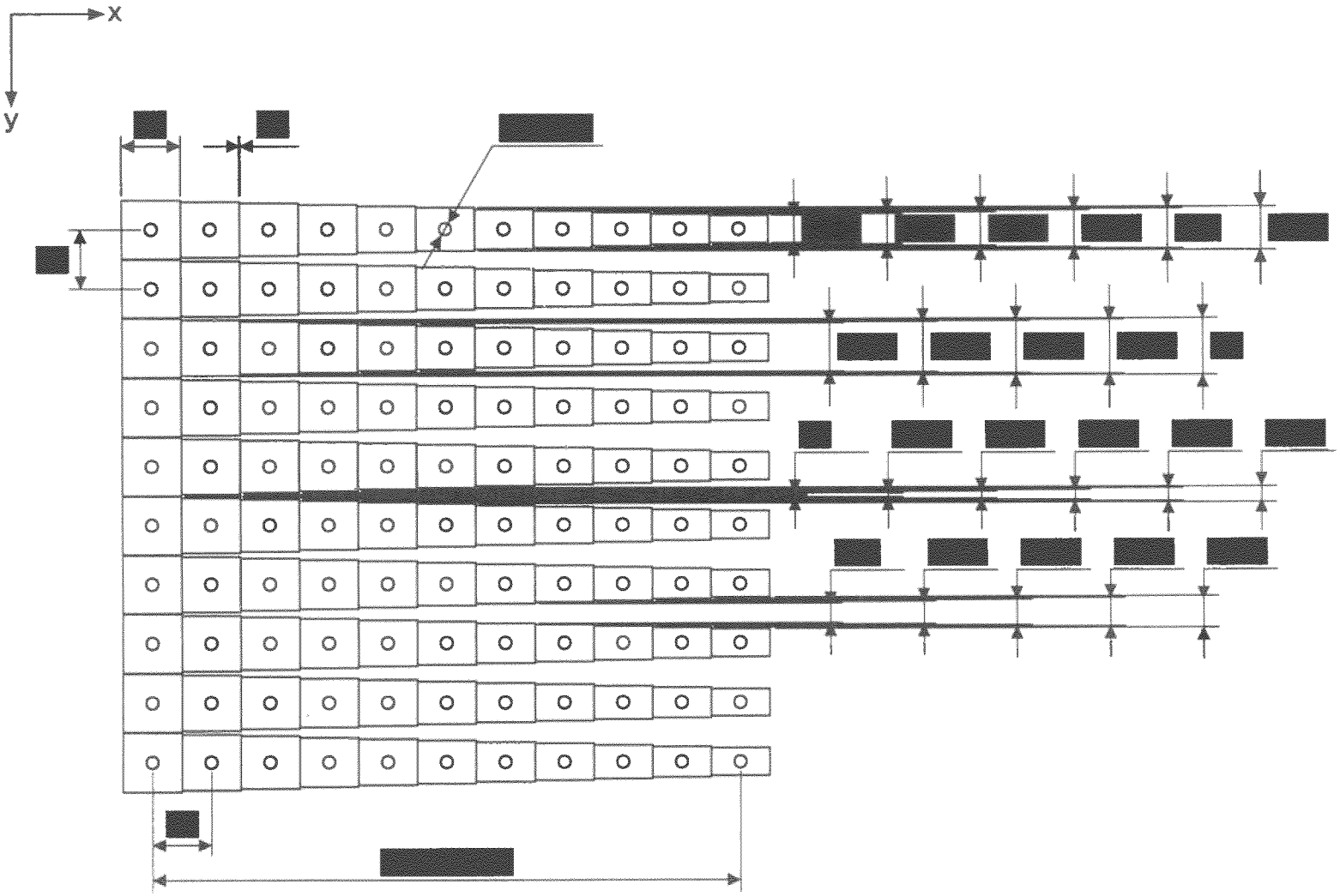
FIG. 18 is a detailed diagram (H70) of the A section in the L2 layer.

FIG. 17 shows conductive layers L1 to L3 in a reflect array which reflects in a horizontal direction of 70 degrees relative to an incident direction. The layer structures of L1, L2, and L3 layers are the same as in FIG. 6. In this example, one of bands of 9 columns extending in the y-axis direction includes 11×128 elements. A gap between the elements is 2.4 mm. A reflection phase difference between neighboring elements is designed to be 24 degrees. In other words, one band (column) extending in the y-axis direction is designed such that the reflection phase changes by 2π between both ends of the x-axis direction. Ideally, it is desired that 15 elements change the reflection phase by 2π. However, for reason of design constraints, etc., eleven elements are used. Thus, within one period in the x-axis direction of 36 mm (=2.4×15), a region exists within which an element is not formed. Such a band or column may be lined up repeatedly in multiple numbers to realize a larger-sized reflect array. In FIGS. 17 and 18, specific dimensional details are omitted as they are not essential to the present invention.

FIG. 18 shows in detail a region (a part of a band or a column) shown as "A section" in the L2 layer in FIG. 17. For one line, 11 elements are lined up in the x-axis direction. Each one of 11 rectangles corresponds to a first patch 23 (FIG. 2A) having sizes Wx and Wy. Each of these 11 elements lined up in the x-axis direction has a certain phase difference (24 degrees=360 degrees/15) with a neighboring element.

FIG. 19 shows a specific numerical example of a reflection phase and a dimension (patch size Wy) of these 11 elements. As shown, "a design phase" indicates an ideal design value, while "a phase of a patch used" shows an actual phase which could be realized. Also in this design example, numerical values shown in FIG. 13 are used (one cycle length of 36 mm in the x-axis direction).

2.3 Mutual Relationship Between First Patch and Second Patch

In FIG. 2A, for brevity and clarity of explanations, it is assumed that dimensions in x and y directions of the first patch 23 and the second patch of a passive element However, this is not mandatory to the present embodiment, so that the dimension of the first patch 23 and the dimension of the second patch 24 of the passive element may differ.

Figure 20:
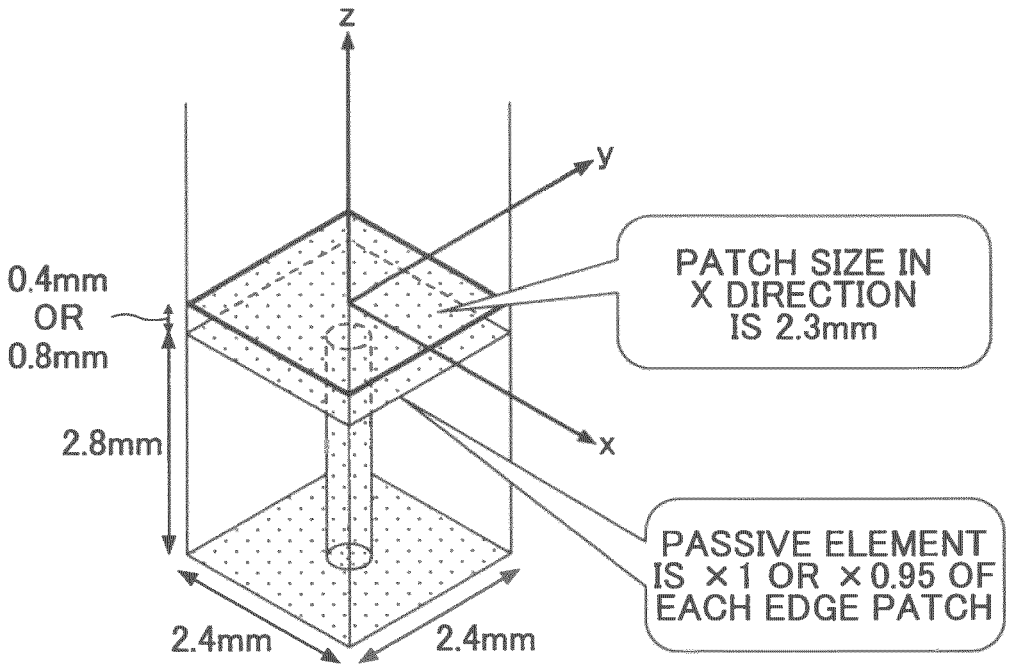
FIG. 20 is a diagram illustrating exemplary numerical values related to a mushroom structure of the first structure.

As in FIG. 2A, FIG. 20 shows, with specific numerical value examples, mushroom structures in which a second patch is provided on the first patch 23. FIG. 20 also shows a table which indicates to what degree a reflection phase could be enlarged relative to a conventional scheme when a dimension between the first and the second patches is changed and when an area of the second patch is changed. In the table, cases of when a gap between the first and second patches is 0.4 mm and when it is 0.8 mm are compared. Moreover, a case in which the second patch is of the same size as the first patch (size ×1) and a case in which the second patch is 95% reduction (size ×0.95) of the first patch are compared. As shown in the table, when the gap is set to 0.8 mm, and the second patch is not reduced (the second patch is set to the size of ×1), the effect of enlarging of the reflection phase became the largest (+39.3 degrees). The enlargement effect of the reflection phase is with respect to mushroom structures to be the reference. The reference mushroom structures are the conventional structures in which patches are not layered in multiple numbers.

In FIG. 2A, the second patch 24 is farther away from the ground plate 21 than the first patch 23 is, which is not mandatory in the present embodiment. The second patch 24 may be nearer to the ground plate 21 than the first patch 23.

As in FIG. 2A, FIG. 21 shows a structure such that the second patch 24 is farther to the ground plate 21 than the first patch 13 is, and a result of simulation to the structure. A case such that a positional relationship between the first and second patches are reversed is explained with reference to FIG. 22. For each of cases in which patch sizes Wy are 1.0 mm, 1.6 mm, and 2.3 mm, simulation results in FIG. 21 show an exemplary comparison of a reflection phase with a reference mushroom structure and a reflection phase with a multi-layer mushroom structure of the present embodiment. For the reference mushroom structure, a reflection phase may be changed over approximately 167.4 degrees when the patch size Wy is 2.3 mm. On the other hand, for the multi-layer mushroom structure according to the present embodiment, a reflection phase may be changed over approximately 179.7 degrees when the patch size Wy is 1.6 mm, making it possible to enlarge the range of the reflection phase by approximately 12.3 degrees. An effect of increasing capacitance has been recognized both between first patches which neighbor via a gap and between first and second patches if the second patch of a passive element is arranged to be of the same size as that of the first patch when a value indicated with DSPAG (patch heights or via heights) in FIG. 21 is set to 3.2 mm and a distance Dsp-2 between the first and second patches is set to 0.4 mm. On the contrary, an effect is recognized which increases capacitance only between the first and second patches if the size of the second patch of the passive element is set to be that of 0.5 times the first patch.

Unlike FIG. 2A, FIG. 22 shows a structure such that the second patch 24 is closer to the ground plate 21 than the first patch 23 is, and a result of simulation for the structure. As shown, while a via hole passes through the second patch, no electrical connection is made and no electricity is supplied, For each of cases in which patch sizes Wy are 1.0 mm, 1.6 mm, and 2.3 mm, simulation results show an exemplary comparison of a reflection phase with a reference mushroom structure and a reflection phase with a multi-layer mushroom structure of the present embodiment. In a case of dimensions shown with such a structure, a range of reflection phase with a reference mushroom structure was found to be wider than a case of a multi-layer mushroom structure. An effect of increasing capacitance has been recognized primarily between the first patch and the second patch if a value shown as Ds in FIG. 22 (a distance between the first patch and the second patch) is set to 0.4 mm and if an amount SC which shows how many times an area of the first patch an area of the second patch is. If a value of Ds is set to 3.2 mm and an SC is set to 1.0, an effect of increasing capacitance has been recognized primarily between patches neighboring via a gap. An effect of increasing capacitance has been recognized both between first patches neighboring via a gap and between the first patch and the second patch if a value of Ds is set to 0.4 mm and SC is set to 1.0.

Unlike FIG. 2A, FIG. 23 also shows a structure such that the second patch 24 is closer to the ground plate 21 than the first patch 13 is, and a result of simulation for the structure. For each of cases in which patch sizes Wy are 1.0 mm, 1.6 mm, and 2.3 mm, simulation results show an exemplary comparison of a reflection phase with reference mushroom structures and a reflection phase with a multi-layer mushroom structure of the present embodiment. For the reference mushroom structures, a reflection phase may be changed over approximately 167.4 degrees when the patch size Wy is 2.3 mm. On the other hand, for the multi-layer mushroom structure according to the present embodiment, a reflection phase may be changed over approximately 178.6 degrees when the patch size Wy is 1.6 mm, making it possible to enlarge the range of the reflection phase by approximately 11.2 degrees. An effect of increasing capacitance has been recognized primarily between the first patch and the second patch if a value shown as Ds in FIG. 23 (a distance between the first patch and the second patch) is set to 0.4 mm and if an amount SC which shows how many times an area of the first patch an area of the second patch is set to 0.5. If a value of Ds is set to 3.2 mm and an SC is set to 1.0, an effect of increasing capacitance has been recognized primarily between patches neighboring via a gap. An effect of increasing capacitance has been recognized both between patches neighboring via a gap and between the first patch and the second patch. If a value of Ds is set to 0.4 mm and SC is set to 1.0, an effect of increasing capacitance between first and second patches has been demonstrated at both between neighboring patches via a gap and between the first and the second patches.

2.4 More General Multi-Layer Mushroom Structures

The patch of the mushroom structures shown in FIG. 2A, etc., include only two, the first and the second, which is not mandatory to the present embodiments as described above. Three or more patches may be arranged in a multi-layer on a ground plate.

Figure 2B:
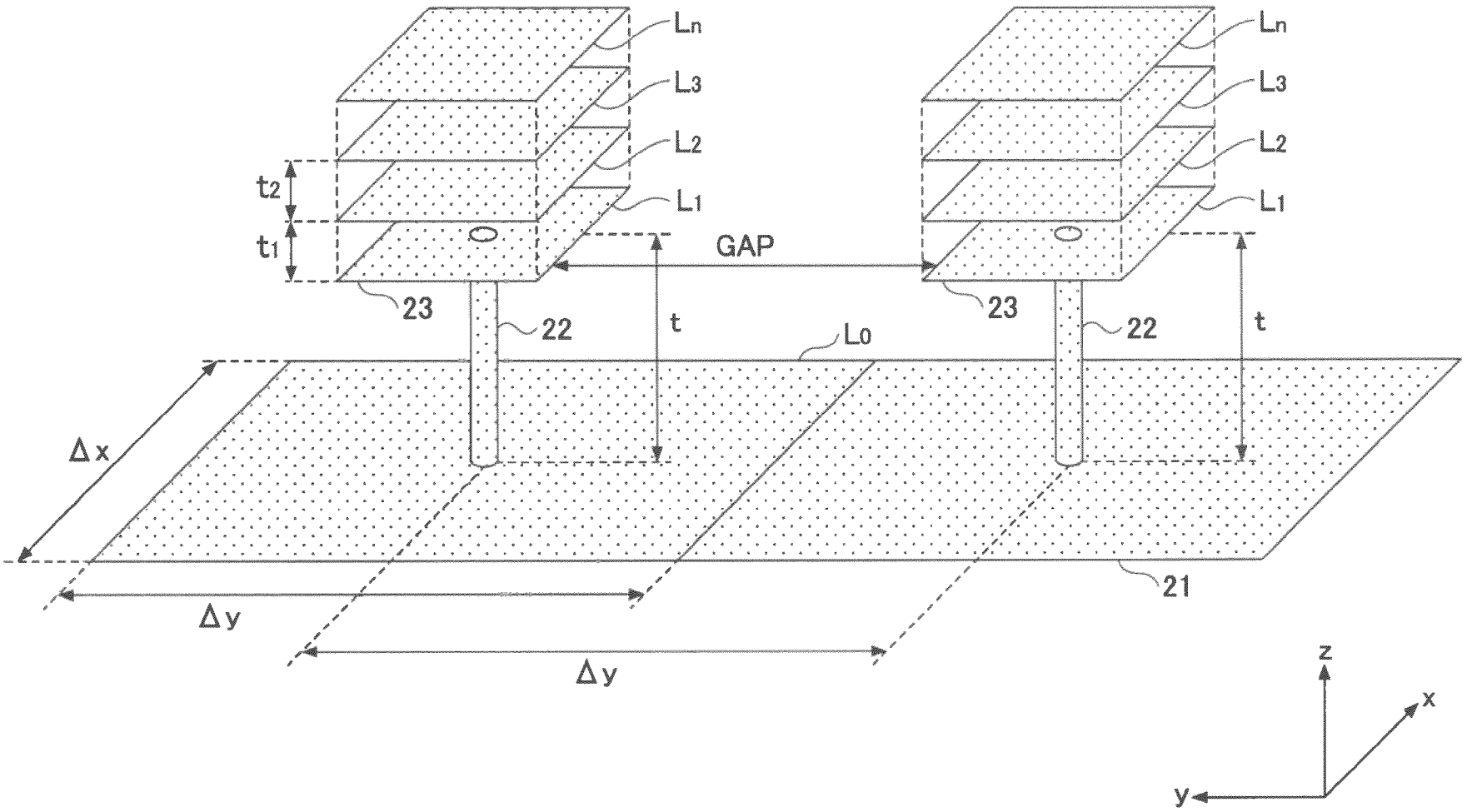
FIG. 2B is a diagram illustrating more general multi-layer mushroom structures.

FIG. 2B shows mushroom structures in which n patches L1, L2, L3 . . . L4 are arranged in parallel in a multi-layer on a ground plate. The lowermost layer $L_0$ corresponds to the ground plate. The structure shown in FIG. 2B can be used in lieu of the mushroom structures shown in FIG. 2A. It may be used as mushroom structures in the below-described multi-layer structure. In the example shown, dimensions of x-axis and y-axis directions of each patch are aligned as Wx and Wy respectively, which is also not mandatory. Any appropriate size may be used. Moreover, it is also not necessary that gaps t, $t_1$, $t_2$ . . . between patches multi-layered are uniformly aligned. For convenience of explanations, patches $L_1$-$L_n$ on the ground plate all have the same size Wx and Wy, and gaps between patches multi-layered are mutually equal. Thus, gaps between patches neighboring in the same plane are equal at any layer.

FIG. 2C shows a schematic structure (left) of mushroom structures (left) and an equivalent circuit diagram (right). Capacitance is produced by patches mutually neighboring within the same plane via a gap. This point has the same structure as FIG. 2A, and such a capacitance is obtained for each layer which is multi-layered. For a structure of FIG. 2B, a capacitance is produced for each layer in n planes of L1-Ln, or in n layers. In this way, an equivalent circuit becomes a circuit as shown on the right-hand side of FIG. 2C. In this case, surface impedance Zs may be approximately handled as $(j\omega L)/(1-n\omega^2 LC)$.

Figure 2D:
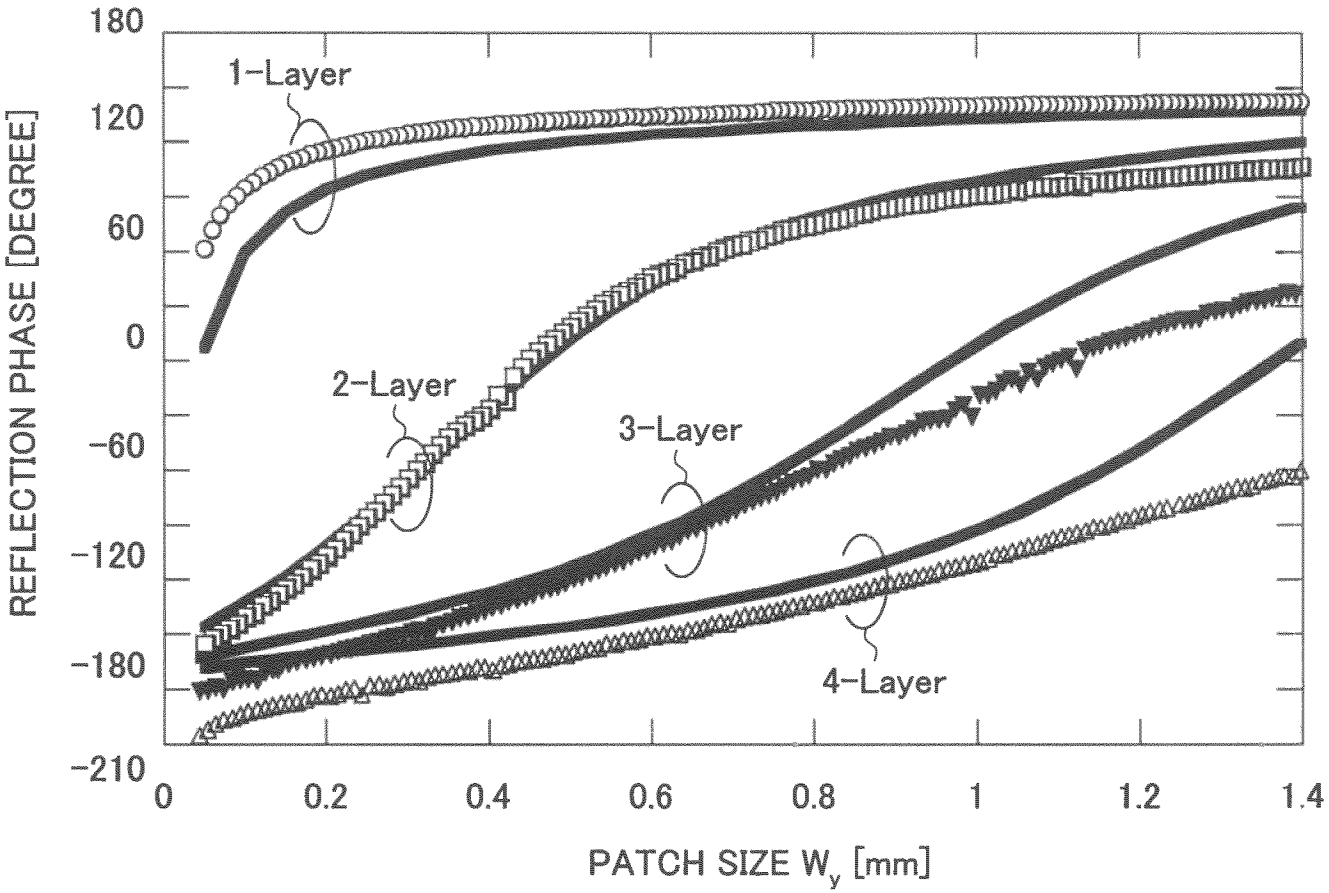
FIG. 2D is a diagram illustrating an example of comparing mushroom structures having different number of layers.

FIG. 2D shows a result of simulating a relationship between the patch size Wy and the reflection phase for various structures of different number of patches (number of layers) of the mushroom structures. As shown, "1-Layer" indicates a result of simulation for the conventional structure in which only one patch exists over a ground plate. In the conventional structure, the surface impedance Zs may be approximately handled as $(j\omega L)/(1-\omega^2 LC)$. Based on the surface impedance Zs, a graph for calculating the reflection phase is expressed in solid lines as shown. On the other hand, without relying on such mathematical expressions, a result of simulating with a finite element method a structure in which only one layer of patches exists on a ground plate is plotted in circles.

As shown, "2-Layer" indicates a result of simulation for the structure in FIG. 2A, in which two layers of patches exist over a ground plate. As described above, in this case, surface impedance Zs may be approximately handled as $(j\omega L)/(1-2\omega^2 LC)$. Based on the surface impedance Zs, a graph for calculating the reflection phase is expressed in solid lines as shown. On the other hand, without relying on such mathematical expressions, a result of simulating with a finite element method a structure in which two layers of patches exists on a ground plate is plotted in quadrilaterals.

"3-Layer" indicates a result of simulation for the structure in FIG. 2B, in which three layers of patches exist over a ground plate. In this case, surface impedance Zs may be approximately handled as $(j\omega L)/(1-3\omega^2 LC)$. Based on the surface impedance Zs, a graph for calculating the reflection phase is expressed in solid lines as shown. On the other hand, without relying in such mathematical expressions, a result of simulating with a finite element method a structure in which three layers of patches exists on a ground plate is plotted in reverse triangles.

"4-Layer" indicates a result of simulation for the structure in FIG. 2B, in which four layers of patches exist over a ground plate. In this case, surface impedance Zs may be approximately handled as $(j\omega L)/(1-4\omega^2 LC)$. Based on the surface impedance Zs, a graph for calculating the reflection phase is expressed in solid lines as shown. On the other hand, without relying on such mathematical expressions, a result of simulating with a finite element method a structure in which four layers of patches exists on the ground plate is plotted in triangles.

With reference to each graph, it is seen that a solid line based on $Zs=(j\omega L)/(1-n\omega^2LC)$ relatively matches a result of calculation with a finite element method. This means that arranging patches of mushroom structures in n layers approximately increase the capacitance by n times. Therefore, patches of mushroom structures may be arranged in multiple layers to control capacitance.

According to the exemplary illustration, if a number of layers in a multi-layer increases, a deviation between a calculation expression for Zs and a result of simulating with a finite element method increases as the patch size increases. This indicates that greater the number of layers of mushroom structures, less the viability of handling the overall mushroom structures as one concentrated element. Thus, when the number of layers is large and the patch size is large, it is preferable to design based on actual simulation results by a finite element method, etc., rather than a theoretical expression for Zs ($Zs=(j\omega L)/(1-n\omega^2LC)$).

3. Second Structure

The first structure as described above adds a patch of a passive element to arrange patches in a multi-layer to increase capacitance C. The second structure of the present embodiment focuses on inductance L rather than on capacitance C.

Figure 24:
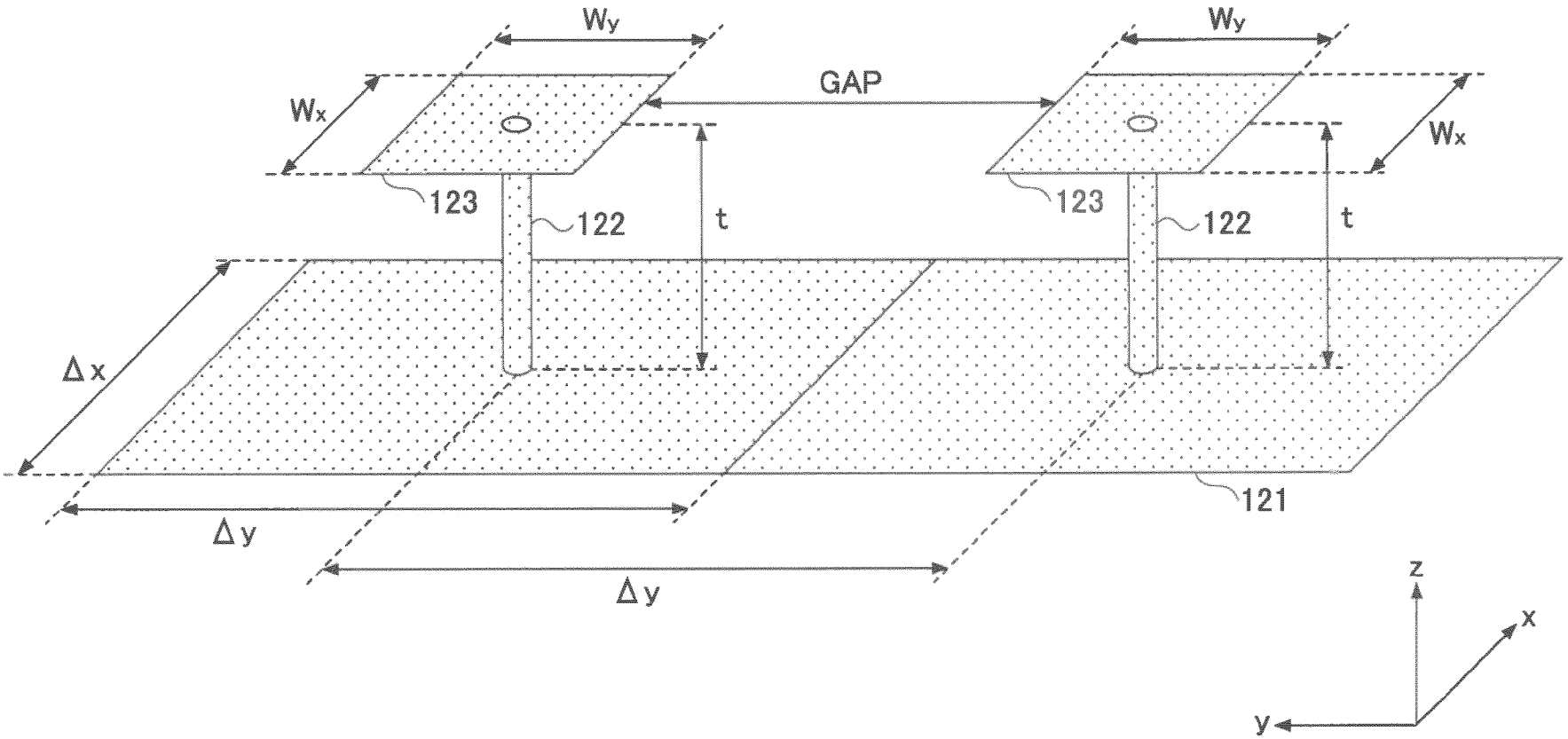
FIG. 24 is a diagram illustrating mushroom structures which can be used in the second structure of the present embodiment.

FIG. 24 shows a mushroom structure which can be used for the second structure. FIG. 24 shows a ground plate 121, a via hole 122, and a patch 123.

The ground plate 121 is a conductor which supplies a common potential to a number of mushroom structures. Δx and Δy represent a gap in an x-axis direction and a gap in a y-axis direction between the via holes in neighboring mushroom structures. Δx and Δy represent a size of the ground plate 121 which corresponds to one of the mushroom structures. In general, the ground plate 121 is as large as an array on which a large number of mushroom structures are arranged.

The via hole 122 is provided to electrically short the ground plate 121 and the patch 123. The patch 123 has a length of Wx in the x-axis direction and a length of Wy in the y-axis direction. The patch 123 is provided in parallel with the ground plate 121 with a separation of a distance of t to the ground plate 121, and is shorted to the ground plate 121 via the via hole 122. As an example, the patch 123 is provided with a separation of 1.6 mm from the ground plate 121.

Figure 25:
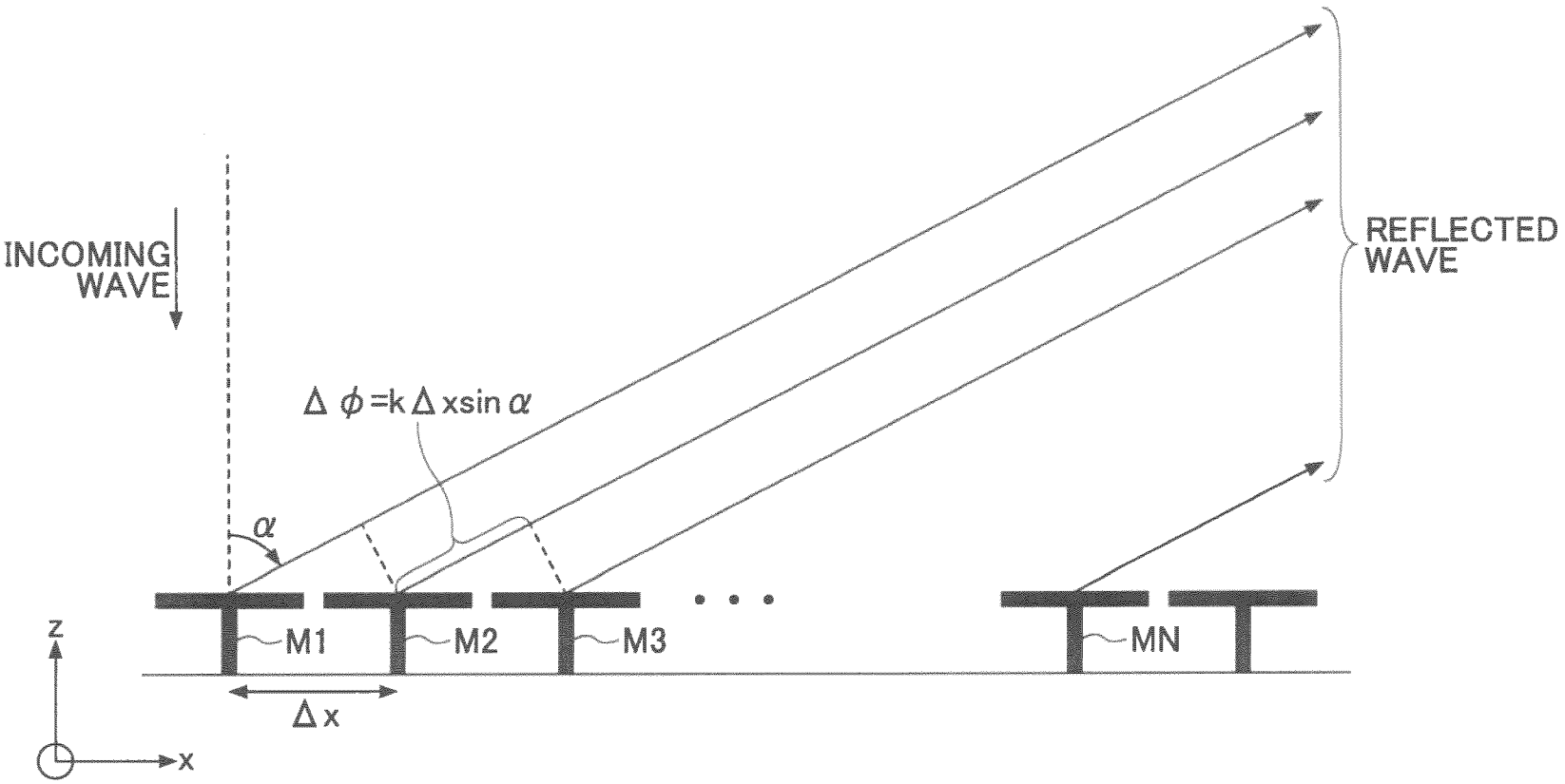
FIG. 25 is a diagram schematically illustrating how a radio wave arrives along a z axis and is reflected relative to the mushroom structures M1 to MN arranged in the x-axis direction.

FIG. 25 schematically illustrates how a radio wave arrives from a z axis ∞ direction and is reflected relative to mushroom structures M1 to MN lined up in an x-axis direction. Assume that the reflected wave forms an angle α with respect to an incident direction (a z-axis direction). Assuming that a gap between via holes is Δx, a reflection angle α and a reflected wave phase difference Δφ due to neighboring mushroom structures (elements) meet the following equations:

$$\Delta\phi=k\cdot\Delta x\cdot\sin\alpha$$

$$\alpha=\arcsin[(\lambda\Delta\phi)/(2\pi\Delta x)],$$

wherein, k, which is a wave number, is equal to 2π/λ. λ is a wavelength of a radio wave. A phase difference Δφ between neighboring elements is set such that a reflection phase difference N·Δφ by the whole of N mushroom structures M1-MN becomes 360 degrees (2π radians). For example, when N=20, Δφ=360/20=18 degrees. Thus, elements are designed such that a reflection phase difference between neighboring elements is 18 degrees and 20 thereof may be repeatedly lined up to realize a reflect array which reflects a radio wave in a direction of angle α.

Figure 26:
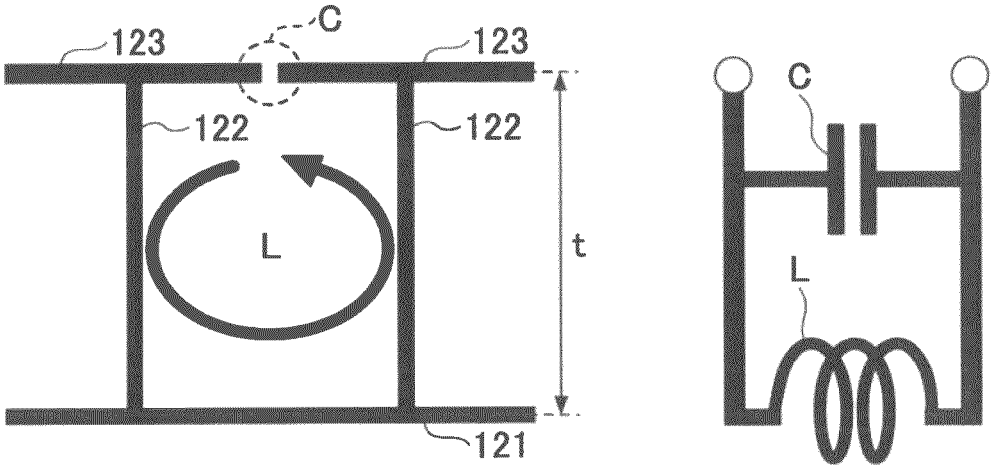
FIG. 26 is a set of equivalent circuit diagrams for mushroom structures.

FIG. 26 shows an equivalent circuit for mushroom structures shown in FIG. 24, As shown on the left-hand side in FIG. 26, a capacitance C exists due to a gap between a patch 123 of a certain mushroom structure and a patch 123 of a mushroom structure neighboring in a y-axis direction. Moreover, an inductance L exists due to a via hole 122 of a certain mushroom structure and a via hole 122 of a mushroom structure neighboring in the y-axis direction. Therefore, an equivalent circuit of neighboring mushroom structures becomes a circuit as shown on the right-hand side of FIG. 26. In other words, in the equivalent circuit, the inductance L and the capacitance C are connected in parallel. The capacitance C, the inductance L, surface impedance Zs, and a reflection coefficient Γ may be shown as follows:

$$C=\frac{\varepsilon_0(1+\varepsilon_r)W_x}{\pi}\operatorname{arccosh}\left(\frac{\Delta y}{\Delta y-W_y}\right) \tag{5}$$

$$L=\mu\cdot t \tag{6}$$

$$Z_s=\frac{j\omega L}{1-\omega^2LC} \tag{7}$$

$$\Gamma=\frac{Z_s-\eta}{Z_s+\eta}=|\Gamma|\exp(j\phi) \tag{8}$$

In Equation (5), $\in_0$ represents a permittivity of a vacuum, and $\in_r$ represents a relative permittivity of a material interposed between patches. Δy represents a gap between via holes. Wy shows a patch size. Thus, Δy−Wy shows a magnitude of a gap. In Equation (6), λ represents a permeability of a material interposed between via holes, and t represents a height of the via hole 122 (a distance between the ground plate 121 and the patch 123). In Equation (7), ω represents an angular frequency and j represents an imaginary number unit. In Equation (8), η represents free space impedance and φ represents a phase difference.

With reference to the above Equation (5), the inductance L is proportional to the height of the patch 123 (a distance between the ground plate 121 and the patch 123). Thus, in the mushroom structures as shown in FIG. 24, a height t of the patch 123 may be changed to change the inductance L, or, in other words, a resonance frequency.

Figure 27:
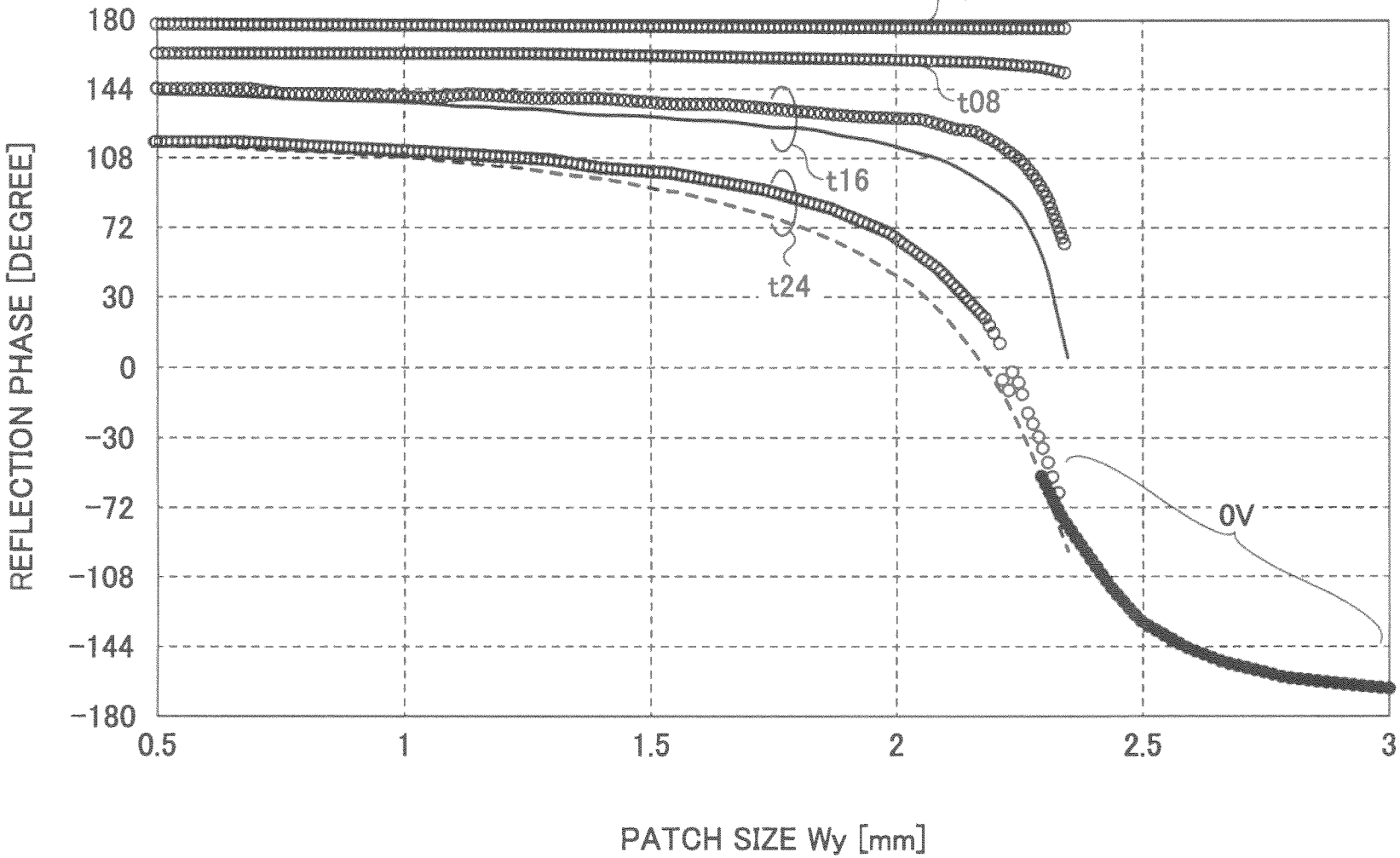
FIG. 27 is a diagram illustrating a relationship between the patch size and the reflection phase for different patch heights.

FIG. 27 shows a relationship between a reflection phase and a size Wy of a patch of the mushroom structures as shown in FIG. 24. As shown, the solid line indicates a theoretical value, what is plotted in circles represent a simulation value using a limited element method. FIG. 27 shows a graph representing a relationship between a reflection phase and a patch size Wy for each of four types of distance t. t02 shows a graph when the distance t is 0.2 mm. t08 shows a graph when the distance t is 0.8 mm. t16 shows a graph when the distance t is 1.6 mm. t24 shows a graph when the distance t is 2.4 mm. The via hole gap Δy is 2.4 mm as an example.

For the graph t02, even when the patch size Wy changes from 0.5 mm to 2.3 mm, the reflection phase remains at 180 degrees.

Also for the graph t08, even when the patch size Wy changes from 0.5 mm to 2.3 mm, the reflection phase remains at 162 degrees.

For the graph t16, when the patch size Wy changes from 0.5 mm to 2.1 mm, the reflection phase only slowly decreases from 144 degrees to 126 degrees, but when the size Wy exceeds 2.1 mm, the reflection phase decreases drastically, and when the size Wy is 2.3 mm the reflection phase reaches 54 degrees with a simulated value (circle) and 0 degrees with a theoretical value (solid line).

For the graph t24, when the patch size Wy changes from 0.5 mm to 1.7 mm, the reflection phase only slowly decreases from 117 degrees to 90 degrees, but when the size Wy exceeds 1.7 mm, the reflection phase decreases drastically, and when the size Wy is 2.3 mm the reflection phase reaches −90 degrees.

In this way, when heights t of the patches in the mushroom structures differ, sizes of the patches may be changed to vary the range of the reflection phase which may be realized. Thus, when elements of mushroom structures are lined up to realize a reflect array, structures of differing patch heights t may be combined to realize a mushroom structure column in which a reflection phase appropriately varies and to realize a reflect array with superior reflection characteristics.

When designing a reflect array according to the second structure of the present embodiment, graphs t02, t08, t16, and t24 in FIG. 27 are referred to and patch sizes which realize a desired reflection phase is determined. For example, the patch size Wy is set to 2.2 mm in a graph t24 of t=2.4 mm to realize an element of reflection phase of zero degrees, the patch size Wy is set to 2 mm in the graph t24 of t=2.4 mm to realize a reflection phase of 32 degrees, and the patch size Wy is set to 1 mm in t=1.6 mm to realize an element of reflection phase of 144 degrees. Patches of patch sizes derived in this way may be lined up to achieve a reflect array.

Figure 28:
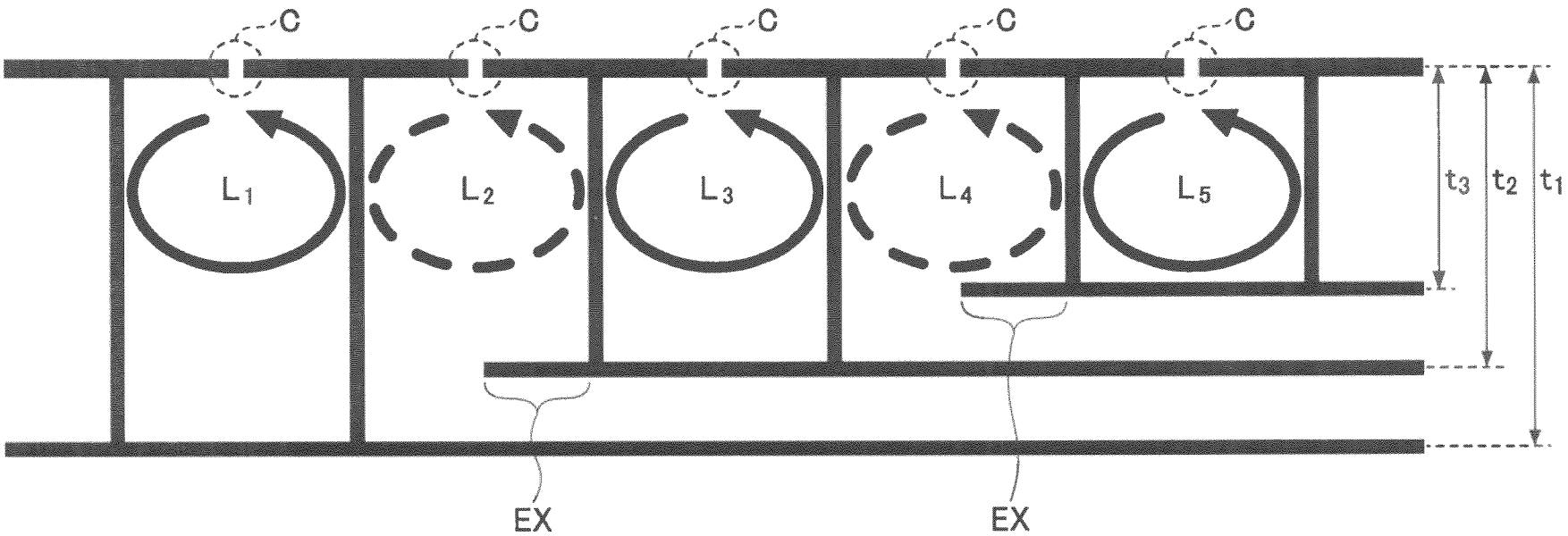
FIG. 28 is a diagram illustrating an example of a reflect array which uses the second structure of the present embodiment.

FIG. 28 schematically shows how mushroom structures of differing patch heights are lined up. In the illustrated example, there are three types, t1, t2, and t3 as patch heights. For example, when there is only a certain patch height such as t=t1, for example, it may not be possible to arrange a sufficient number of mushroom structures for which the reflection phase gradually changes. However, structures of patch heights of t=t2 and t3 also may be used together to enhance a degree of freedom of design and to make it easier to realize an element with an appropriate reflection phase.

In the example shown in FIG. 28, multiple patches with differing heights from the ground plate are foLmed such that they exist on the same plane. However, this is not mandatory to the present invention, so that multiple patches with differing heights from the ground plate do not have to exist on the same plane.

Figure 29:
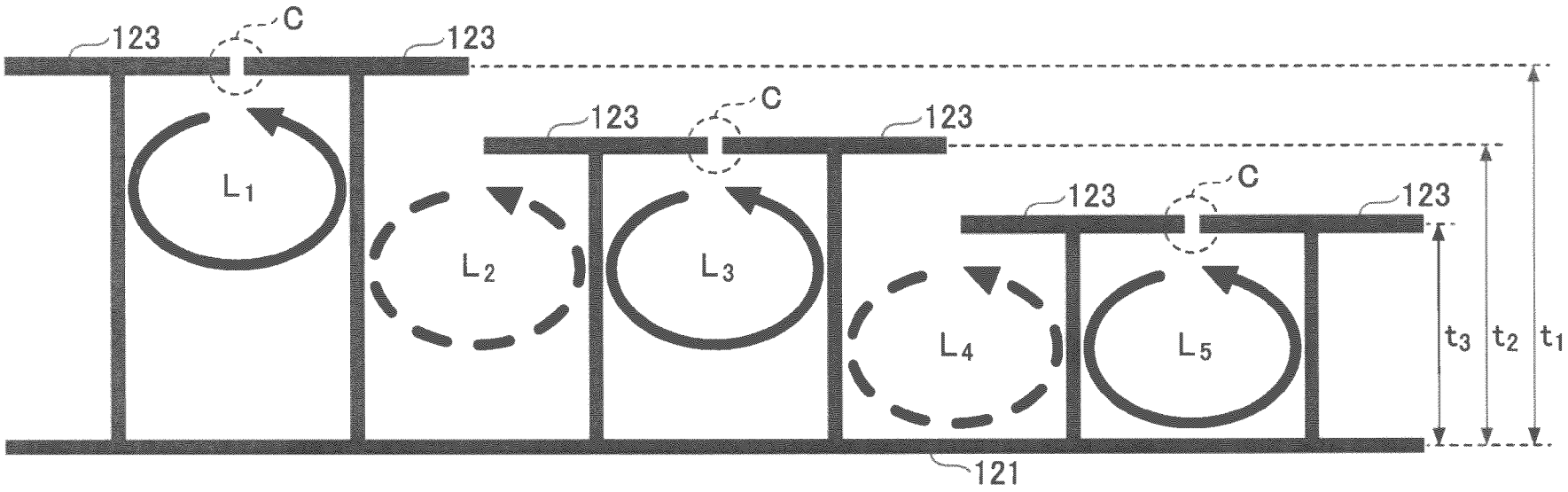
FIG. 29 is a diagram illustrating another example of the reflect array which uses the second structure of the present embodiment.

FIG. 29 shows how a ground plate 121 is provided in common for multiple mushroom structures with differing heights from the ground plate to the patch. On the other hand, not all patches 123 exist on the same plane.

Figure 30:
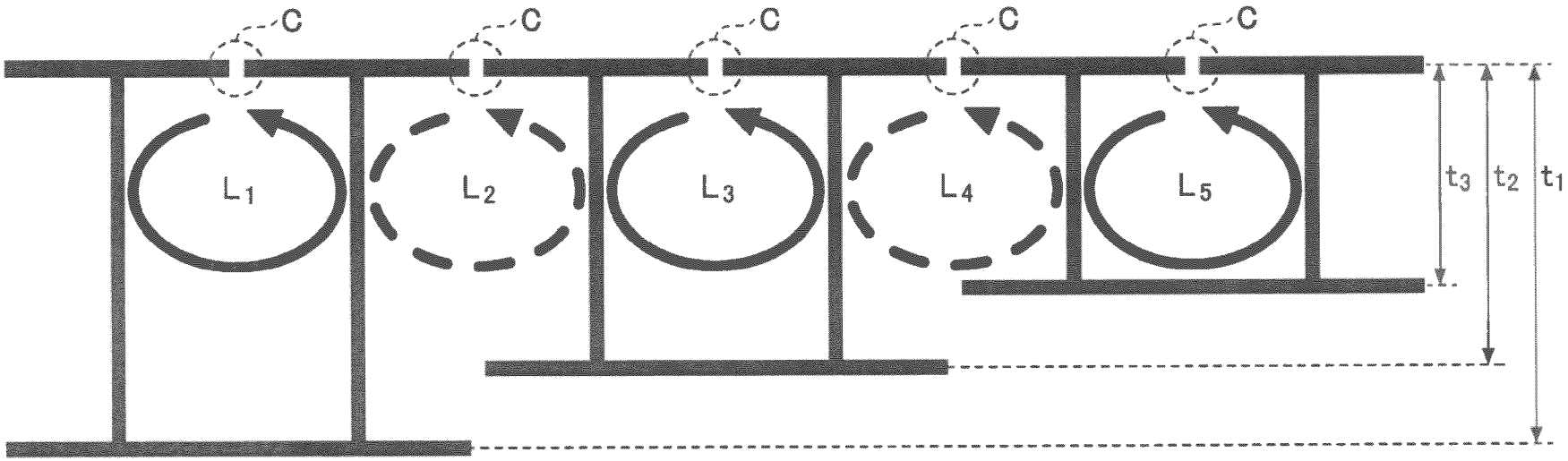
FIG. 30 is a diagram illustrating yet another example of the reflect array which uses the second structure of the present embodiment.

FIG. 30 shows yet another example. In an example shown in FIG. 28, multiple patches with differing heights from the ground plate are formed such that they exist in the same plane. Ground plates are formed in multiple layers in FIG. 28 while the ground plates are not formed in multiple layers in FIG. 30. In other words, a ground plate is properly removed such that a different ground plate does not exist on the lower side of a certain ground plate. Such a structure is preferable from a point of view of suppressing spurious reflection due to the ground plate.

4. Third Structure

The first structure as described above adds a passive patch to arrange multiple patches in a multi-layer in a mutually-parallel manner to increase a capacitance C. The third structure of the present embodiment increases the capacitance C by devising a positional relationship between patches that define a gap. Mushroom structures as shown in FIG. 24 may also be used in the third structure. In other words, a patch 123 is provided with a separation of a distance of t from a ground plate 121, and is shorted to the ground plate 121 via a via hole 122. A gap in an x-axis direction and a gap in a y-axis direction between the via holes in neighboring mushroom structures are Δx and Δy respectively. The patch 123 has a length of Wx in the x-axis direction and a length of Wy in the y-axis direction. Alternatively, the mushroom structures shown in FIG. 2A or 2B may be used also in the third structure. In this case, a second patch 24 is provided in addition to the patch 123. For brevity and clarity of explanations, the third structure is to use the mushroom structures as shown in FIG. 24.

As explained with reference to FIG. 25, elements M1 to MN of the mushroom structures may be lined up in the x-axis direction such that a reflected wave phase difference due to each element meets a certain relationship to direct the reflected wave in a desired direction.

For the mushroom structures as shown in FIG. 24, the equivalent circuit is a circuit as shown in FIG. 26. Thus, the capacitance C, the inductance L, the surface impedance Zs, and the reflection coefficient Γ of the equivalent circuit may be shown as follows:

$$C = \frac{\varepsilon_0(1+\varepsilon_r)W_x}{\pi}\operatorname{arccosh}\left(\frac{\Delta y}{\Delta y - W_y}\right) \tag{5}$$

$$L = \mu \cdot t \tag{6}$$

$$Z_s = \frac{j\omega L}{1-\omega^2 LC} \tag{7}$$

$$\Gamma = \frac{Z_s - \eta}{Z_s + \eta} = |\Gamma|\exp(j\phi) \tag{8}$$

Letters in the respective Equations are as shown in the second structure.

With reference to Equation (5), Δy−Wy represents a magnitude of a gap between neighboring patches. Thus, an argument of an arc cos h function represents a ratio between a via hole gap Δy and the gap.

Figure 31:
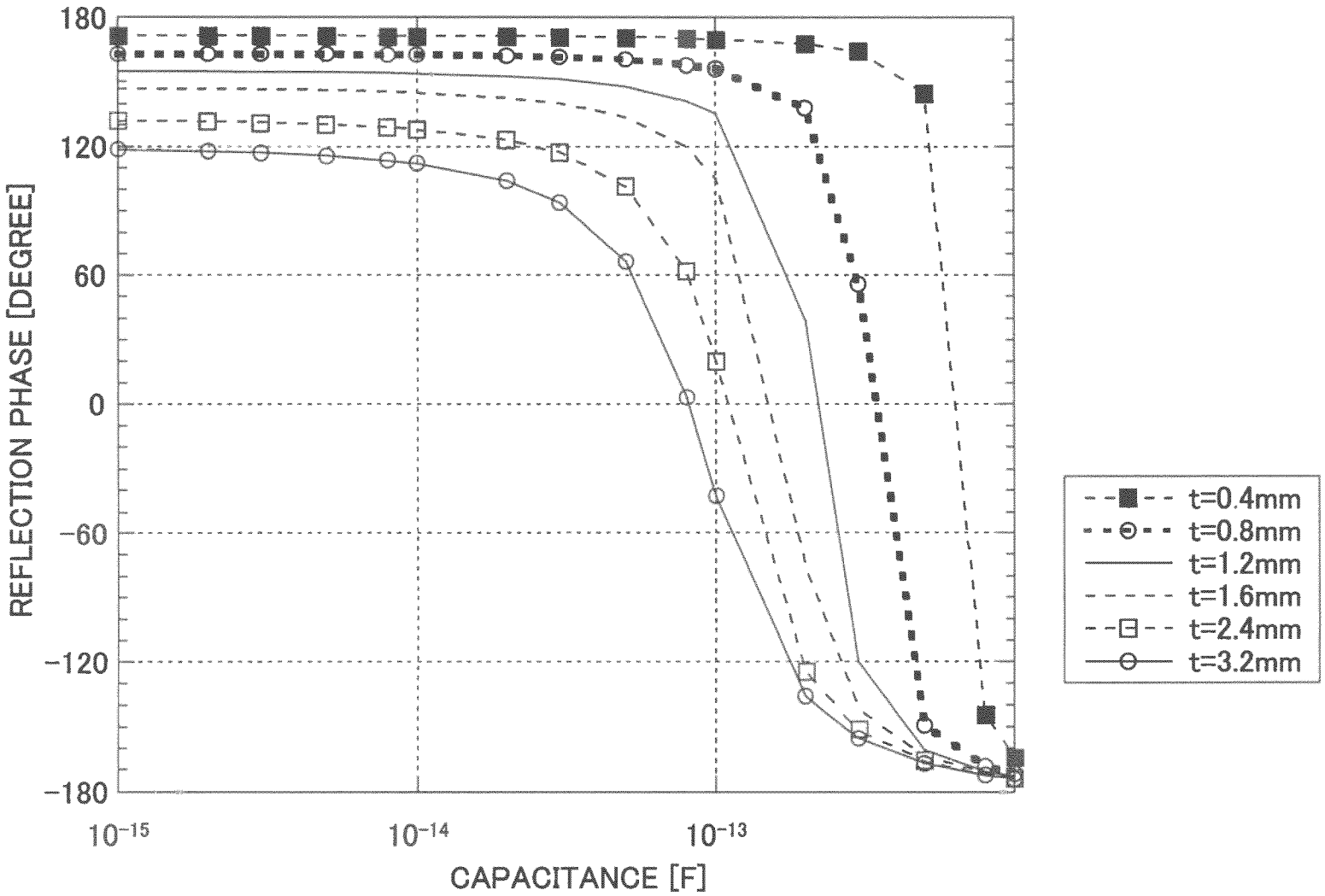
FIG. 31 is a diagram illustrating a relationship between capacitance and reflection phase of mushroom structures.

FIG. 31 is a simulation result which indicates a relationship between a reflection phase and a capacitance C for the mushroom structures as shown in FIG. 24. The simulation is carried out with an assumption that capacitance and inductance change independently. In the example shown, simulation results are shown for the relationship between capacitance C and reflection phase for each of cases such that the value of the patch height t is 0.4 mm, 0.8 mm, 1.2 mm, 1.6 mm, 2.4 mm, and 3.2 mm. As can seen from FIG. 31, it can be seen that a range of capacitance must be wide in order to realize a reflection phase over the whole range between 180 degrees and −180 degrees.

According to the above Equation (5), the capacitance C in the mushroom structures becomes a larger value as the gap (Δy−Wy) becomes narrow. Conversely, a gap needs to be made narrower in order to increase the capacitance C. However, it is not easy to accurately manufacture a very narrow gap primarily due to manufacturing process constraints. For example, it is not easy to accurately manufacture a gap which is less than 0.1 mm. Thus, for the conventional technique which uses this mushroom structure, there was a problem that a large capacitance value could not be realized.

Figure 32:
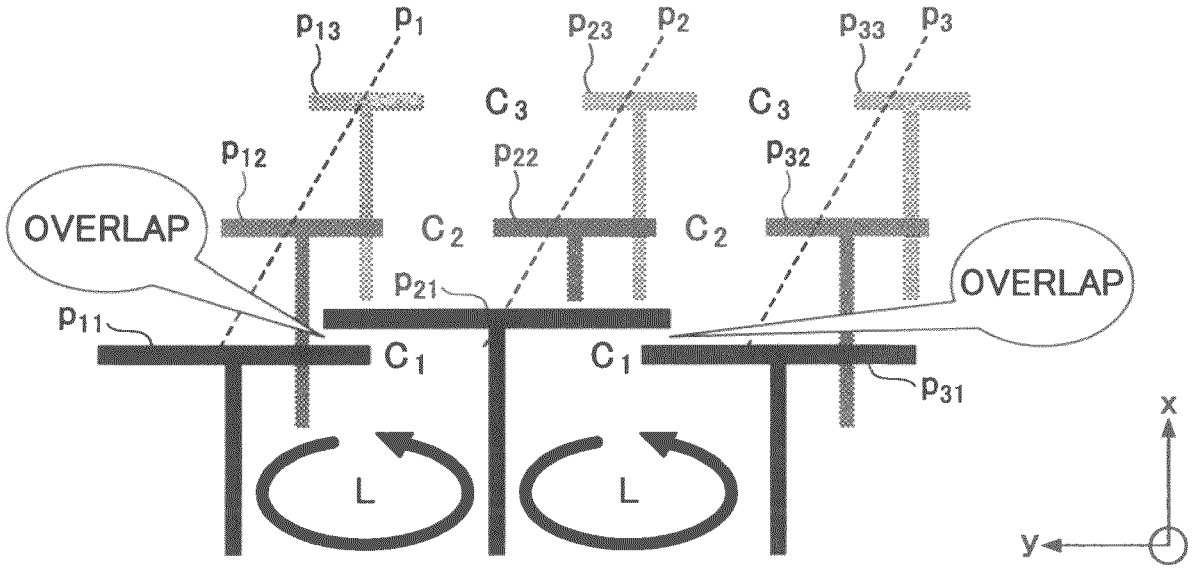
FIG. 32 is a conceptual diagram illustrating a third structure of the present embodiment.

FIG. 32 is a conceptual diagram illustrating a third structure of the present embodiment. Mushroom structures are aligned along each of three parallel lines p1 to p3. For convenience of explanations, the number of columns and the number of mushroom structures are set to 3. However, it is obvious for a skilled person that the number of columns and the number of mushroom structures actually take a larger value. For convenience, patches aligned along a line $p_i$ are to be denoted as $p_{ij}$. Patches $p_{13}$ and $p_{23}$ neighbor each other with a separation of a largest gap. Similarly, the patches $p_{23}$ and $p_{33}$ neighbor with a separation of a largest gap. Thus, a capacitance $C_3$ which is formed by these patches $p_{i3}$ (i=1-3)

becomes a small value. Patches $p_{12}$ and $p_{22}$ neighbor each other with a separation of a narrower gap. Similarly, patches $p_{22}$ and $p_{32}$ also neighbor each other with a separation of a narrow gap. Thus, a capacitance $C_2$ which is formed by these patches $p_{i2}$ (i=1-3) takes a larger value than that of $C_3$. Each of patches $pi_1$ and $pi_2$ (i=1-3) is provided within the same plane. On the other hand, patches $p_{11}$ and $p_{21}$ are located within different planes, not within the same plane, and partially overlap with each other. Similarly, patches $p_{21}$ and $p_{31}$ are located within different planes, not within the same plane, and partially overlap with each other with a separation of a distance (patches $p_{11}$ and $p_{31}$ are located within the same plane). Thus, a capacitance C1 which is formed by these patches $p_{i1}$ takes a larger value than that of $C_2$. In this way, in the third structure, at least some of neighboring patches may overlap with each other with a separation of a distance to realize a capacitance which is larger than when a gap is merely formed within the same plane.

Figure 33:
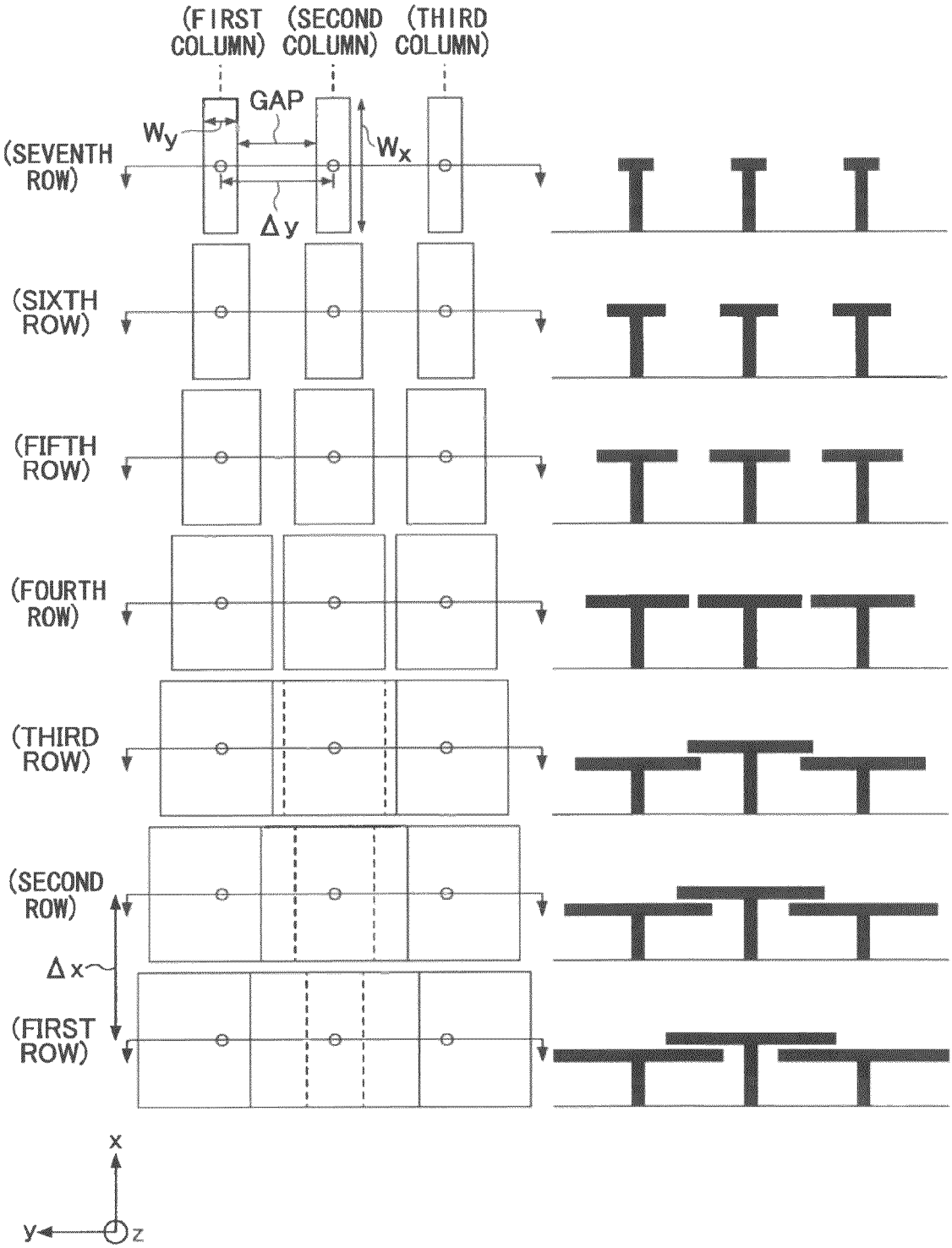
FIG. 33 is a diagram illustrating positional relationship of patches in the third structure.

FIG. 33 shows a positional relationship of patches in the third structure with a plane view (left-hand side) and a cross-sectional view (right-hand side). For convenience, patches are lined up in a seven-row, three-column format, but the number of rows and columns are arbitrary. In a manner similar to the conventional structures, for the fourth- or the seventh-row patch, patches of neighboring columns form a gap within the same plane. Conventionally, a reflect array had to be formed using only mushroom structures of a positional relationship of the fourth or the seventh row, for example, due to manufacturing limitations for forming a narrow gap within the same plane. Thus, even when a reflection phase which corresponds to a larger capacitance is to be needed, mushroom structures which produce such a reflection phase could not be obtained. For example, in FIG. 27, the patch length Wy has an upper limit of 2.3 mm. A gap Δy between patches is 2.4 mm, so that, when the patch length Wy is 2.3 mm, the gap becomes Δy−Wy=0.1 mm, and an upper limit of the patch length corresponds to the length of the gap realizable.

On the other hand, for the first row or the third row patch, patches of neighboring columns are not within the same plane. For an example shown, of patches belonging to the first to the third row, the height of the patch belonging to the second column is higher than a patch belonging to the first column and the third column. In this way, patches of neighboring columns may form a larger capacitance. Patches of neighboring columns are allowed to overlap, so that the patch length Wy may be not less than Δy as long as it is less than 2Δy. As a replacement, a height of a second-column patch may be lower than heights of the first and third column patches.

A graph OV which is shown on the lower-right hand side of FIG. 27 shows a simulation result for extending a patch length Wy to no less than 2.3 mm by allowing overlap. It is seen that overlap may be allowed relative to a neighboring patch to realize a reflection phase which almost reaches −180 degrees beyond −90 degrees, which was a conventional limit. In this way, according to the third structure, a range of reflection phase achievable may be enlarged.

Now, as shown in FIGS. 32 and 33, when allowing overlap between patches of neighboring columns, a distance (height) t from a ground plate of a neighboring patch is not the same in a strict sense. According to the above Equation (6), the height t of the patch affects inductance L (L=μt). Thus, a graph (for example, t24) which shows a relationship between a reflection phase and a patch length Wy on a certain pitch height t and a graph (OV) showing a relationship between a reflection phase and a patch length Wy for allowing overlap does not become continuous in a strict sense. This is because assumed patch heights differs in a strict sense, and, depending thereto, resonance frequencies vary. However, in the third structure, when the difference of patch heights between overlapping patches is relatively small, the graphs t24 and OV become continuous. However, it is not mandatory in the present embodiment to make these graphs continuous (in other words, to make the graphs such that differences of heights between neighboring patches is negligibly small). This is because it suffices that an appropriate reflection phase can be designed even when a graph shown as the graph OV is located in a location distant from the graph t24.

5. Variation 5.1 Patch Arrangement

The above-described patches in the first or the third structure are symmetrically formed with respect to a line on which vias are lined up (p and q in FIG. 4; a column in FIG. 33). Then, a patch size Wy in the y-axis direction is gradually changed along the line to form gaps of varying widths. However, such a way of lining up the patches is not mandatory to the present invention, so that various patch arrangements are possible.

Figure 34A:
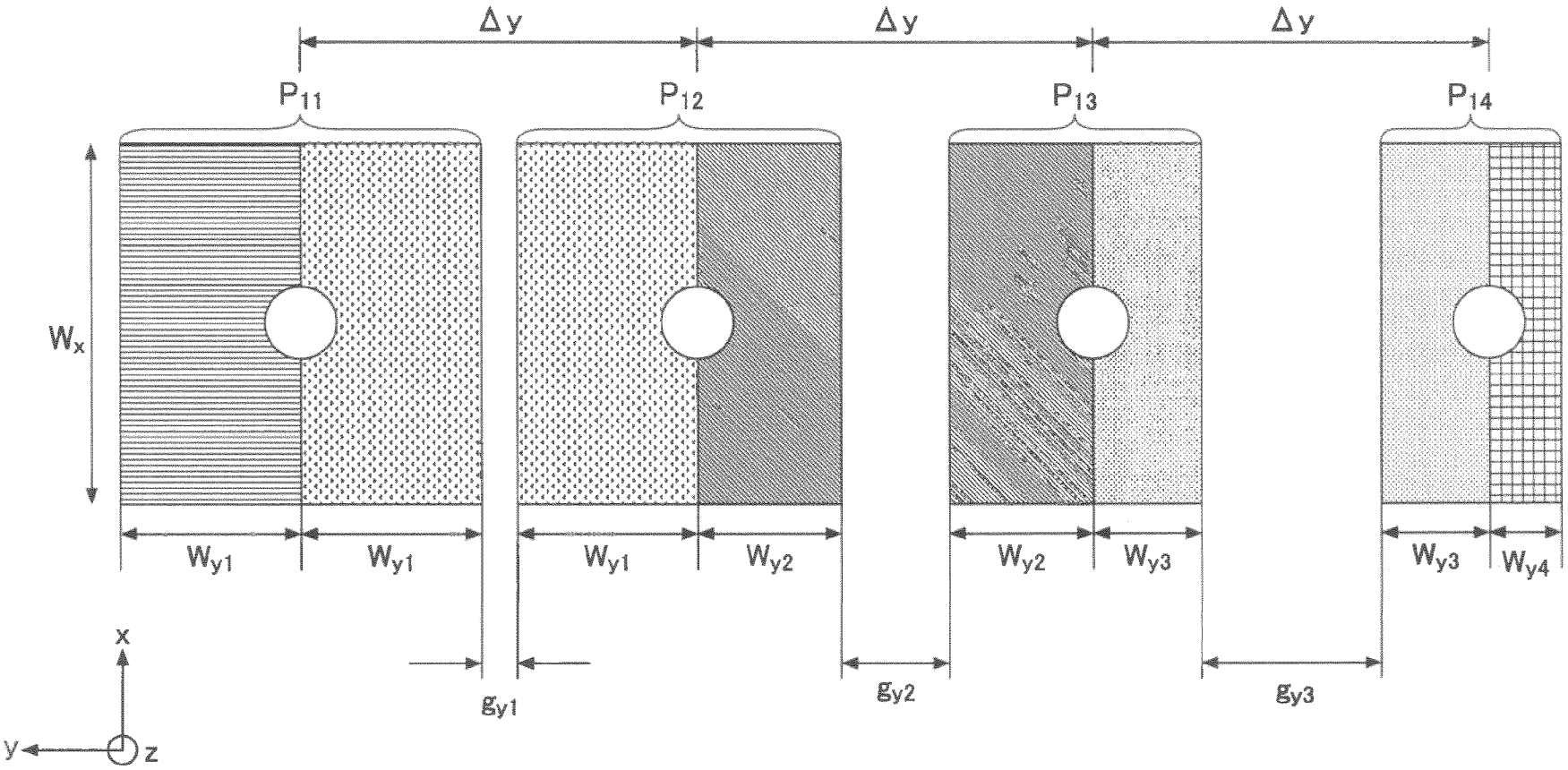
FIG. 34A is a diagram illustrating a different setting example of patch sizes and gaps.

For example, a patch and a gap may be formed as shown in FIG. 34A. Patches $p_{11}$, $p_{12}$, $p_{13}$, and $p_{14}$ having a length of Wx in the x-axis direction are lined up in the y-axis direction with a gap Δy. The first patch $p_{11}$ has a length of $2W_{y1}$ in the y-axis direction. The second patch $p_{12}$ has a length of $W_{y1}+W_{y2}$ in the y-axis direction. The third patch $p_{13}$ has a length of $W_{y2}+W_{y3}$ in the y-axis direction. The fourth patch $p_{14}$ has a length of $W_{y3}+W_{y4}$ in the y-axis direction. Thus, a gap between the first and second patches is $\Delta y-2W_{y1}=gy1$. Similarly, a gap between the second and third patches is $\Delta y-2W_{y2}=gy2$. A gap between the third and fourth patches is $\Delta y-2W_{y3}=gy3$. While each of four patches $p_{11}$, $p_{12}$, $p_{13}$, $p_{14}$ has different dimensions, distances between centers of patches are all equal (Δy). When creating a reflector array using these patches, it is necessary to realize a predetermined phase difference ΔΦ with a neighboring patch as described in FIGS. 5 and 25. The phase difference ΔΦ needs to meet the following equation with respect to a reflection angle α of a radio wave and a distance Δy between centers of patches.

$$\Delta\Phi=k\cdot\Delta y\cdot\sin\alpha$$

Here, k represents a wave number (k=2π/λ).

Figure 35:
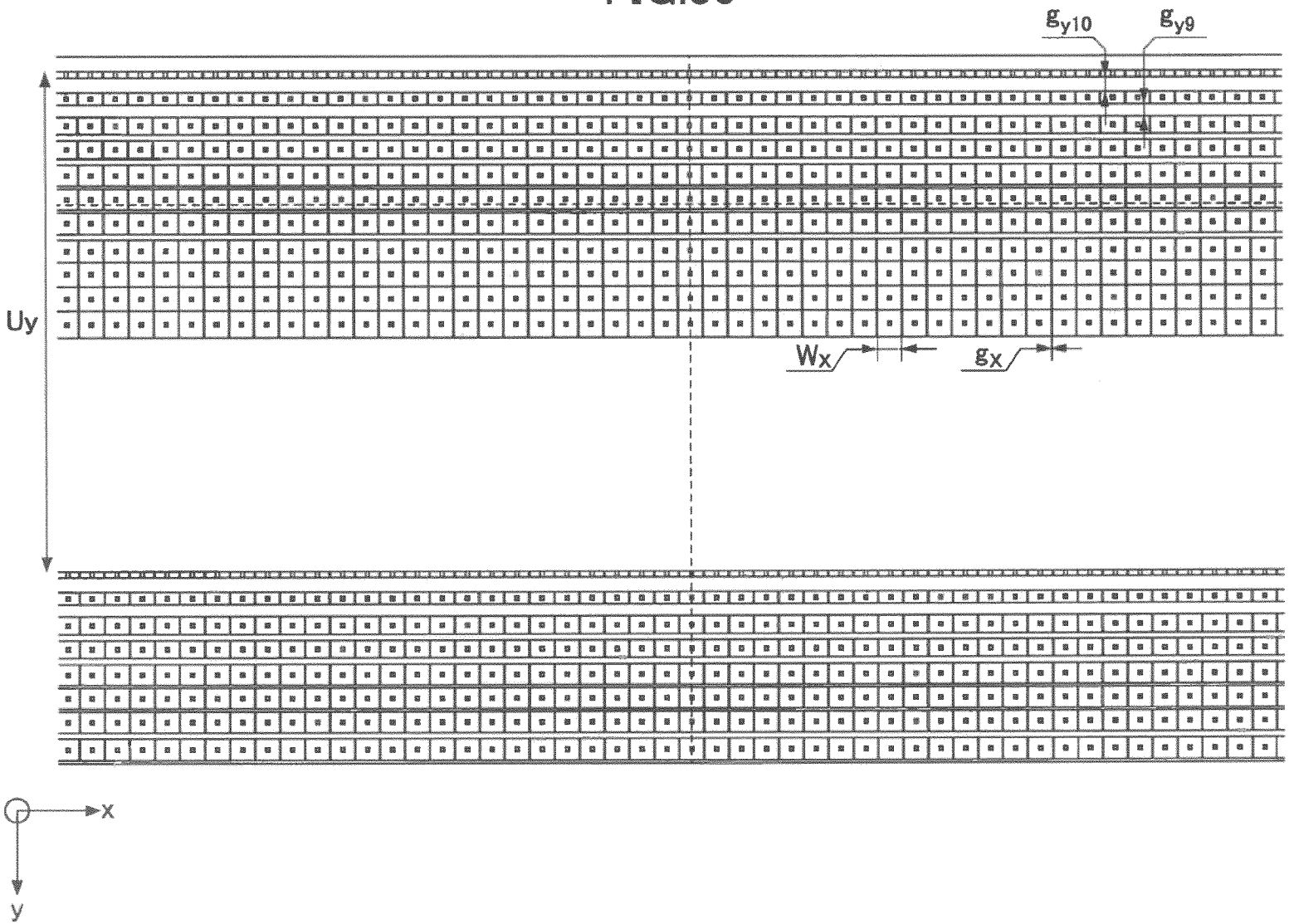
FIG. 35 is a plane view of a reflect array for vertical control.

FIG. 35 shows a conceptual plane view when a reflect array is formed by forming a patch and a gap as shown in FIG. 34A. The patch shown in FIG. 35 is connected to a ground plate via a via hole (not shown).

5.2 Vertical Control

In the structure of FIGS. 3, 4, 11, 18, and 33, a wave incident from a z-axis direction with an electric field facing the y-axis direction reflects to a direction which is lateral relative to the electric field direction, or reflects to the x-axis direction (horizontal control). On the other hand, in the structures in FIGS. 34A, 34B, and 35, a wave incident from the z-axis direction with an electric field facing the y-axis direction reflects in the same direction as the electric field, or reflects in the y-axis direction (vertical control). In other words, a phase difference between elements may be varied in a direction in which it is desired to reflect a radio wave (for example, a capacitance C and/or an inductance L may be varied) to reflect an incident radio wave in a desired direction. For convenience of explanations, a case of reflecting, in the x-axis direction, a radio wave incident from a z-axis is referred to as horizontal control and a case of reflecting in the y-axis direction is referred to as vertical control. However, horizontal and vertical are relative concepts for convenience.

5.3 Case of Using First Structure (Reflection Angle of 45 Degrees)

Figure 34B:
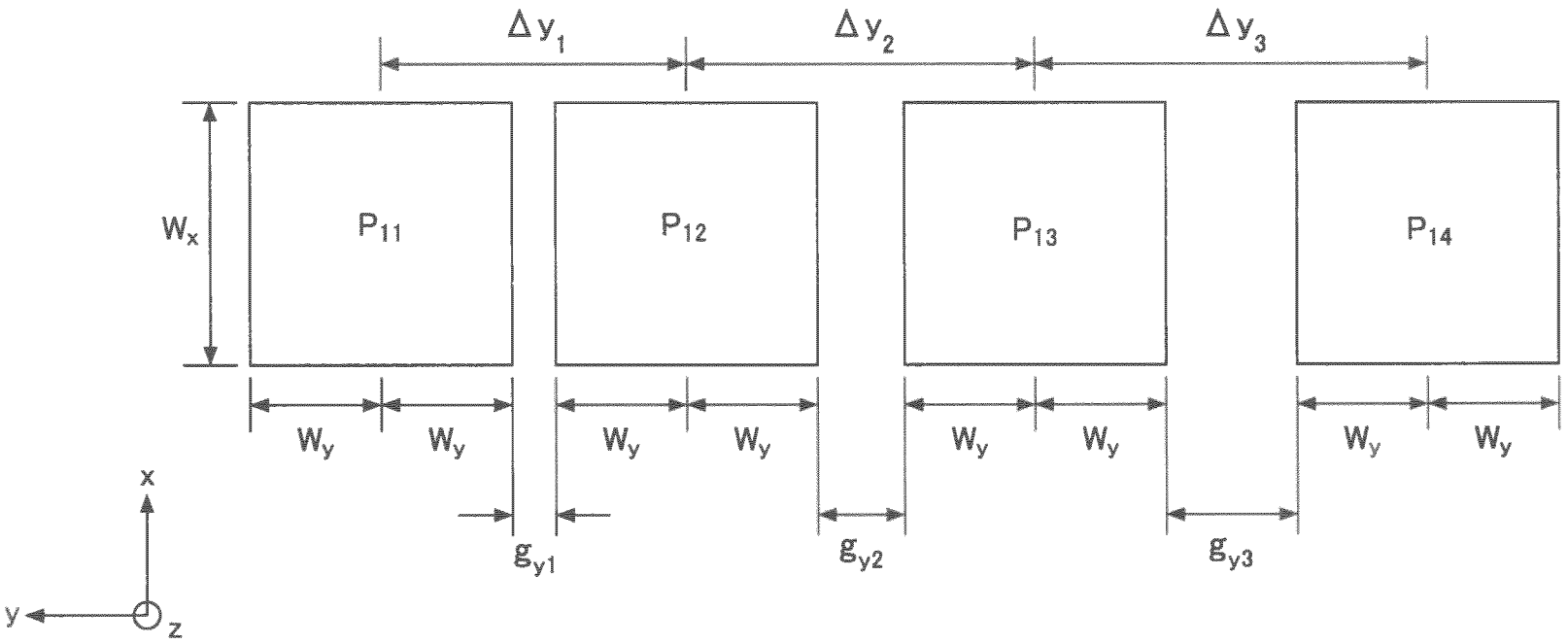
FIG. 34B is a diagram illustrating a different scheme of patch arrangement.
Figure 36:
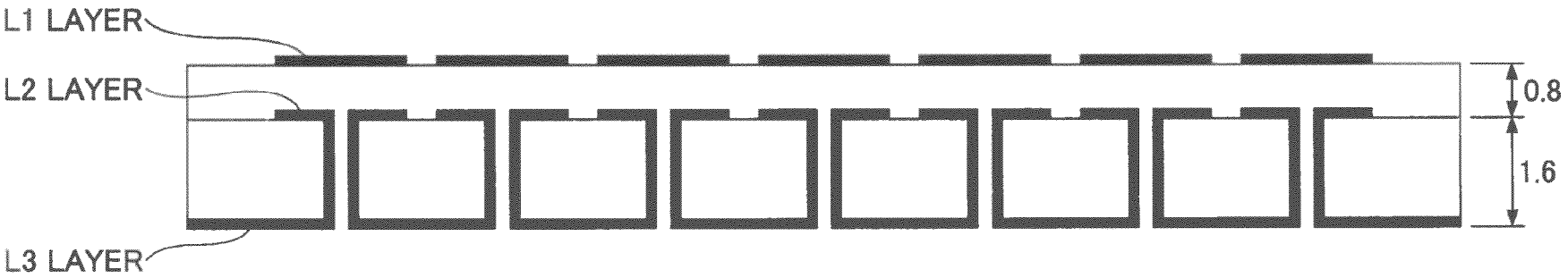
FIG. 36 is a partial cross-sectional diagram (V45) of a reflect array which uses the first structure.

FIG. 36 illustrates a partial cross-sectional diagram which shows how a first structure is used for forming a reflect array which reflects a radio wave. The shown layer structure is the same as that explained in FIG. 9. However, what is different is that a way of forming a patch and a gap as shown in FIGS. 34A, 34B, and 35 is used. The reflect array has three conductive layers of L1, L2, and L3, and dielectric layers between each conductive layer. As an example, the conductive layer is formed by materials including copper, for example. Moreover, the dielectric layer is formed by a material which has relative permittivity of 4.4 and tan δ of 0.018. In between L1 and L2 layers are interposed a dielectric layer of a thickness of 0.8 mm. In between L2 and L3 layers is interposed a dielectric layer of a thickness of 1.6 mm. The L1 layer corresponds to the second patch 24 in FIG. 2A. The L2 layer corresponds to the first patch 23 in FIG. 2A. The L3 layer corresponds to the ground plate 21. Therefore, a through hole between the L2 layer and the L3 layer corresponds to the via hole 22.

Figure 37:
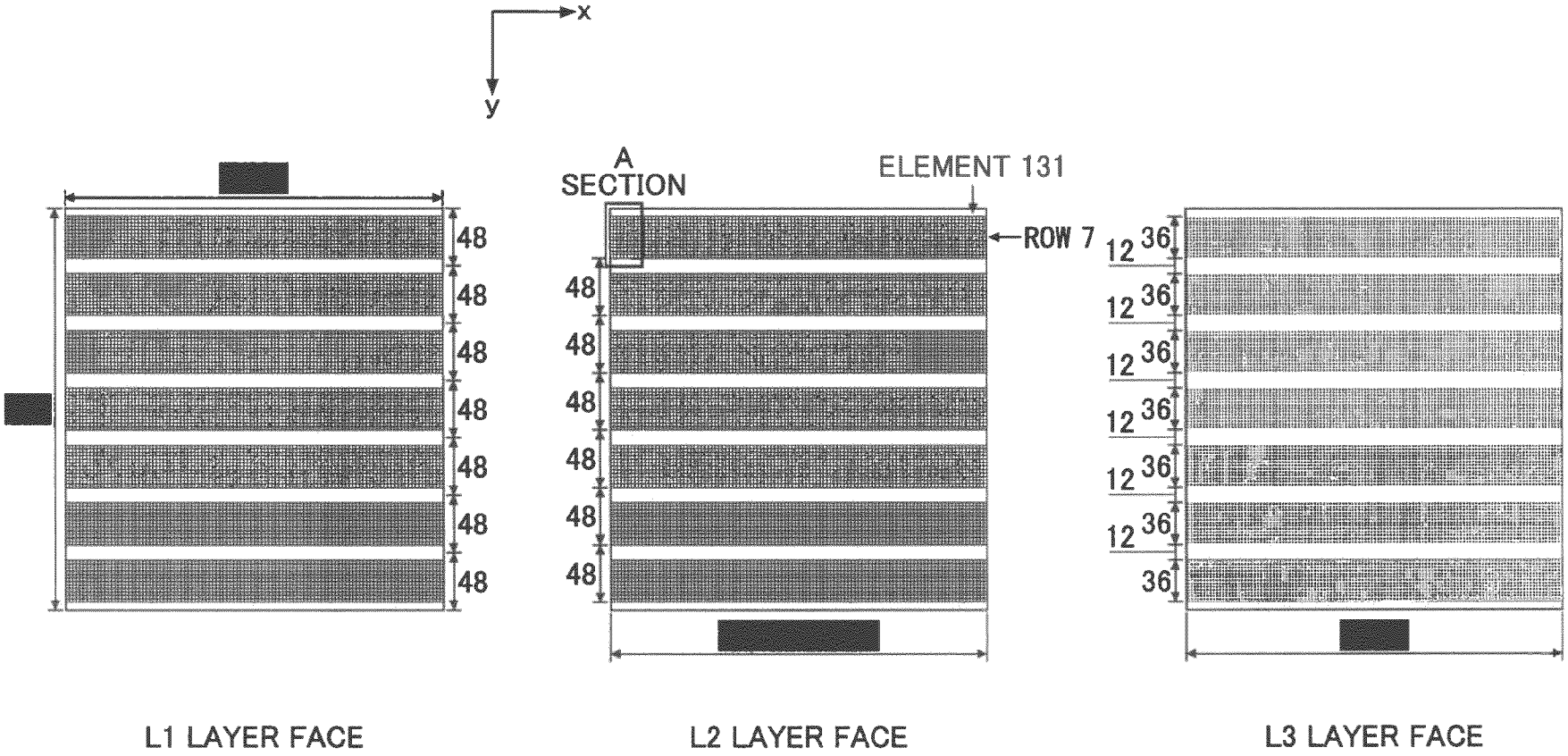
FIG. 37 is a plane view (V45) of the L1 layer, the L2 layer, and the L3 layer in the reflect array.
Figure 38:
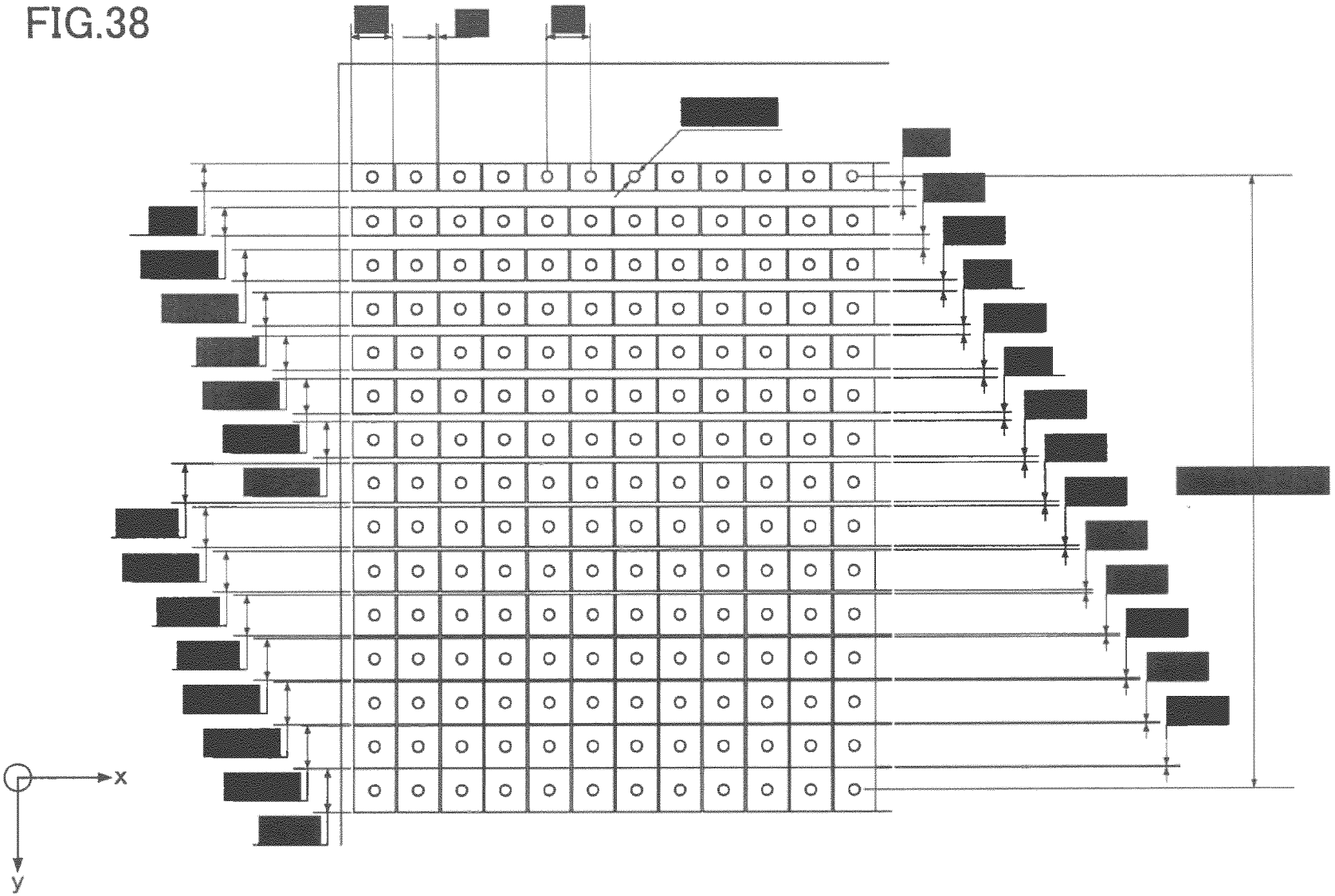
FIG. 38 is a detailed diagram (V45) of the A section in the L2 layer.

FIG. 37 schematically illustrates a plane view of L1, L2, and L3 layers. Elements, one of which is formed with mushroom structures as shown in FIG. 2A, are arranged in a matrix form. This is the same as in FIG. 10. In an illustrated example, one of bands of 7 columns extending in the x-axis direction includes 15×131 elements. A gap between the elements is 2.4 mm. An illustrated reflect array is designed such that a wave incident from a z-axis with an electric field facing a y-axis direction is reflected in a y-axis direction or a vertical direction at a 45 degree angle relative to an incident direction, and such that a reflection phase difference between neighboring elements is 18 degrees. In other words, one band (column) extending in the x-axis direction is designed such that the reflection phase changes by 2π between both ends in the y-axis direction of the band. Ideally it is desired that 20 elements change the reflection phase by 2π. However, for reason of manufacturing constraints, etc., fifteen elements are used. Thus, within one period in the y-axis direction of 48 mm (=2.4×20), a region exists within which an element is not formed. Such a band or column may be lined up repeatedly in multiple numbers to realize a larger-sized reflect array. In FIGS. 37 and 38, specific dimensional details are omitted as they are not essential to the present invention.

FIG. 38 shows in detail a region (a part of a band or a column) shown as "A section" in the L2 layer in FIG. 37. For one column (in the y-axis direction), 15 elements are lined up. Each one of 15 rectangles corresponds to a first patch 23 (FIG. 2A) having sizes Wx and Wy. Each of these 15 elements has a predetermined phase difference (18 degrees=360 degrees/20) with a neighboring element.

FIG. 39 illustrates exemplary numerical values when the number of elements provided in the y-axis direction is set to 12. The exemplary numerical value in FIG. 39 is also for forming a reflected wave at a 45 degree angle relative to an incident direction of a radio wave.

5.4 Case of Using First Structure (Reflection Angle of 70 Degrees)

Exemplary numerical values shown in FIGS. 37 to 39 are determined from a viewpoint of reflecting a radio wave in a direction of 45 degrees relative to an incident direction. The present embodiment is not limited to the 45 degrees, so that a reflect array may be formed which reflects a radio wave in an arbitrary direction.

Figure 40:
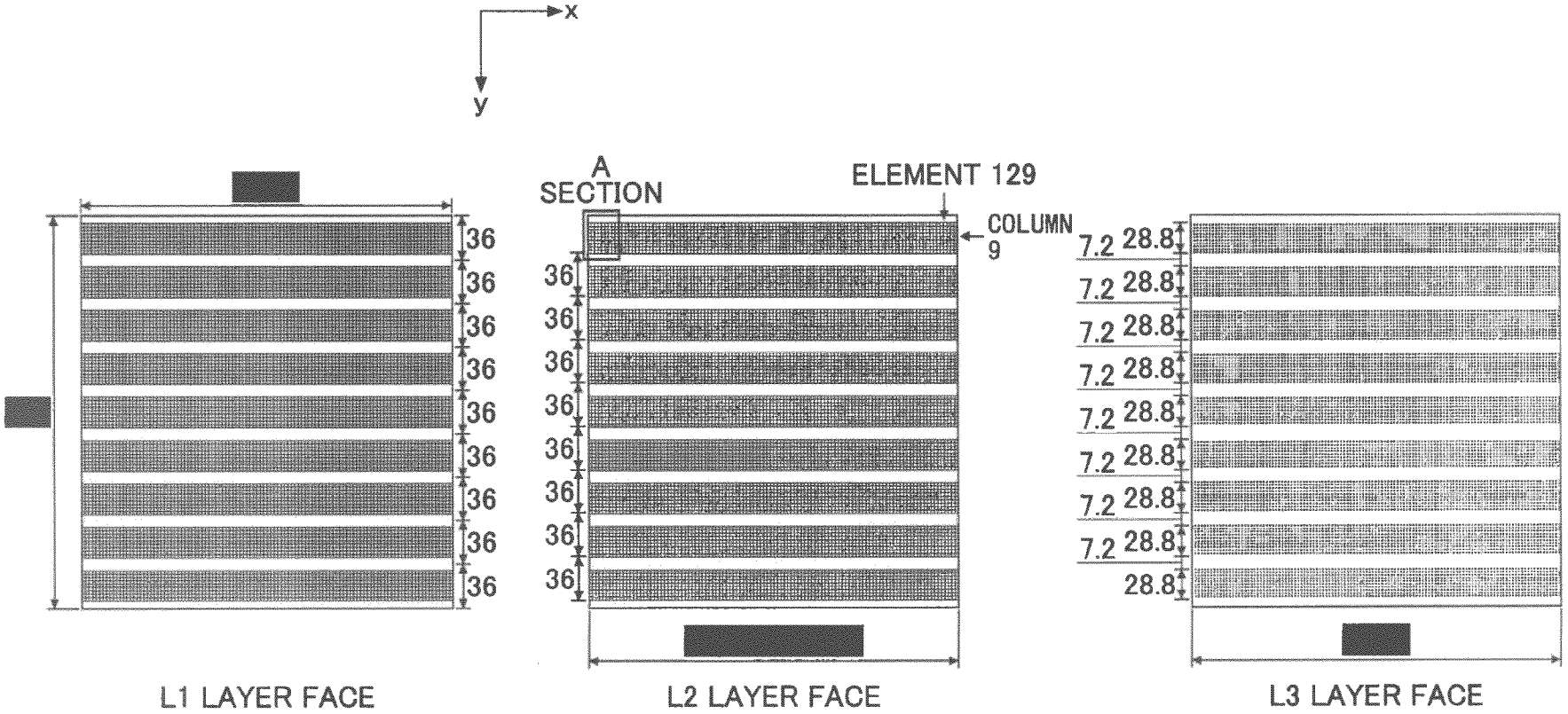
FIG. 40 is a plane view (H70) of the L1 layer, the L2 layer, and the L3 layer in the reflect array.
Figure 41:
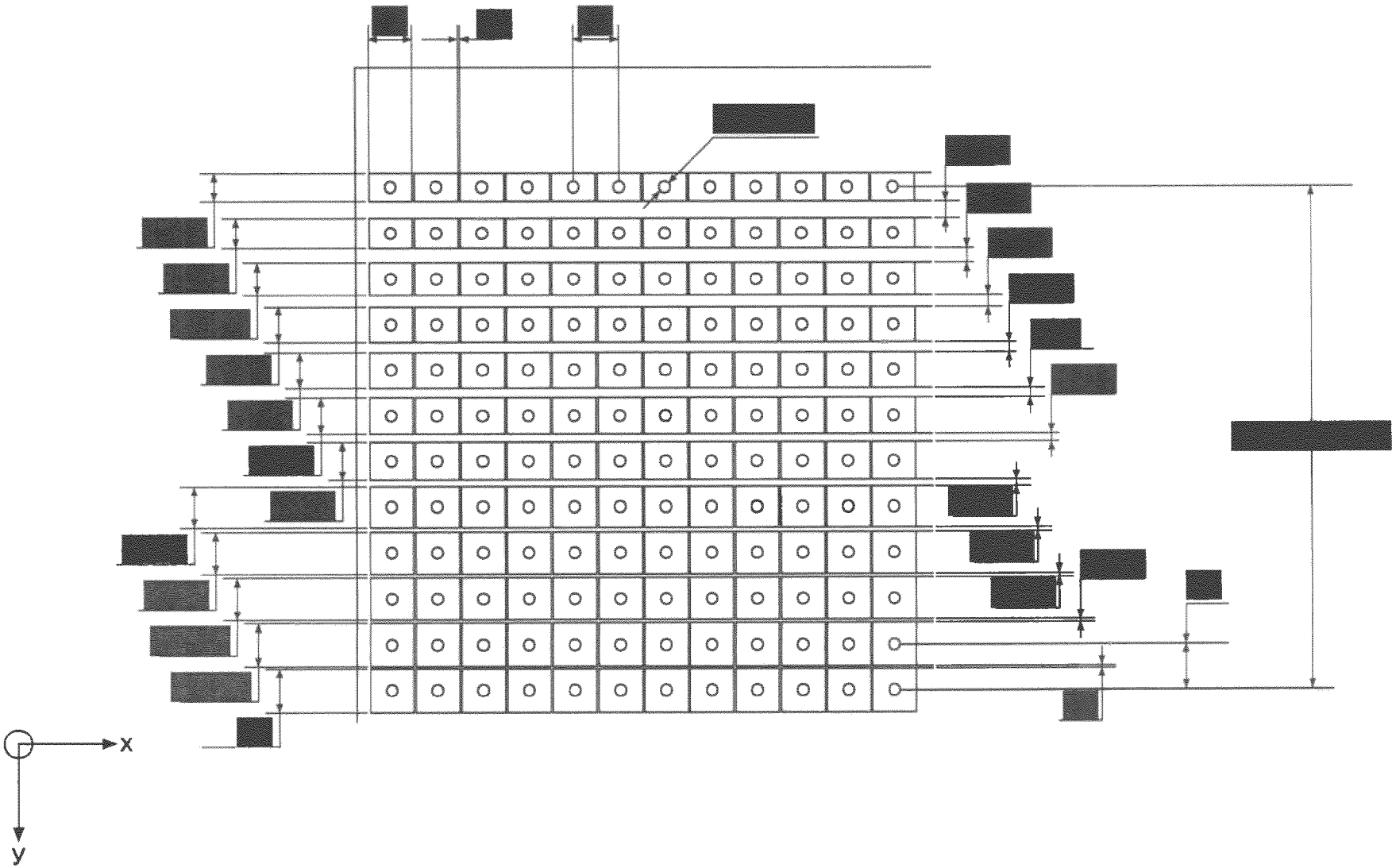
FIG. 41 is a detailed diagram (V70) of the A section in the L2 layer.

FIG. 40 shows layers L1 to L3 in a reflect array which reflects a radio wave in a direction of 70 degrees relative to an incident direction. The layer structures of the L1, L2, and L3 layers are the same as those shown in FIGS. 9 and 36. For this example, one of bands of 9 columns extending in the x-axis direction includes 12×129 elements. A gap between the elements is 2.4 mm. A reflection phase difference between neighboring elements is designed to be 24 degrees. In other words, one band (column) extending in the x-axis direction is designed such that the reflection phase changes by 2π between both ends of the y-axis direction. Ideally it is desired that 15 elements change the reflection phase by 2π. However, for reason of design constraints, etc., twelve elements are used. Thus, within one period in the y-axis direction of 36 mm (=2.4×15), a region exists within which an element is not formed. Such a band or column may be lined up repeatedly in multiple numbers to realize a larger-sized reflect array. In FIGS. 40 and 41, specific dimensional details are omitted as they are not essential to the present invention.

FIG. 41 shows in detail a region (a part of a band or a column) shown as "A section" in the L2 layer in FIG. 40. For one column (in the y-axis direction), 12 elements are lined up. Each one of 12 rectangles corresponds to a first patch 23 (FIG. 2A) having sizes Wx and Wy. Each of these 12 elements has a certain phase difference (24 degrees=360 degrees/15) with a neighboring element.

The exemplary numerical values in FIG. 42 are also for forming a reflected wave at a 70 degree angle relative to an incident direction of a radio wave. These are exemplary numerical values when eleven elements, not twelve elements, are lined up with respect to one column (a y-axis direction) to form a reflect array.

5.5 Case of Using Second Structure (Reflection Angle of 45 Degrees)

Exemplary numerical values shown in FIG. 36 or 42 are examples when a reflect array which reflects a radio wave is formed using a first structure. Below, an example is explained of forming a reflect array which reflects a radio wave using a second structure.

Figure 43:
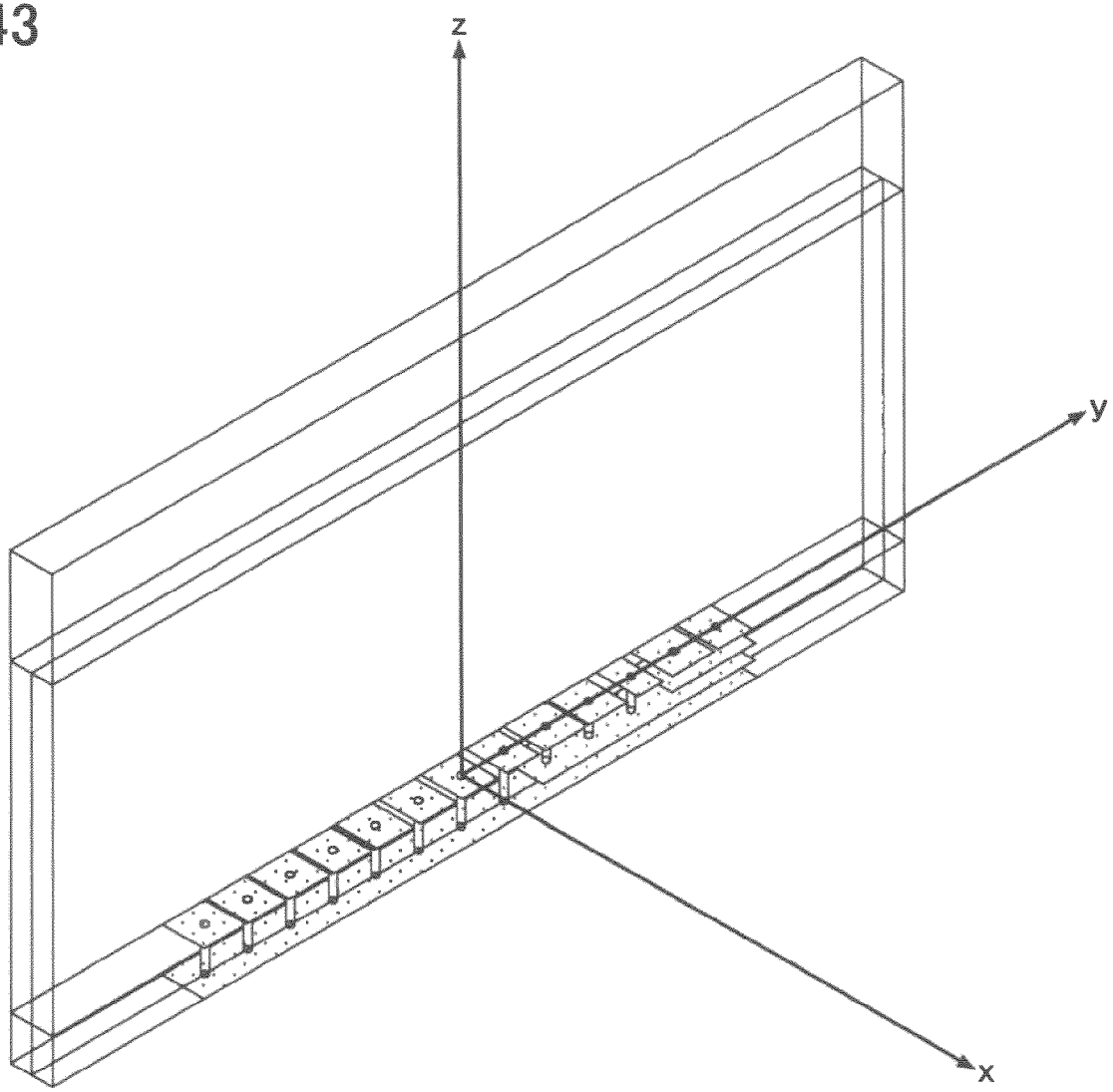
FIG. 43 is a schematic perspective view of a reflect array with four types of patch heights.

FIG. 43 is a schematic perspective view of a reflect array with 4 types of patch heights t of mushroom structures. It is necessary to note that only a part of a number of elements is drawn. An overall plane view of a reflect array is the same as what is shown in FIG. 35.

Figure 44:
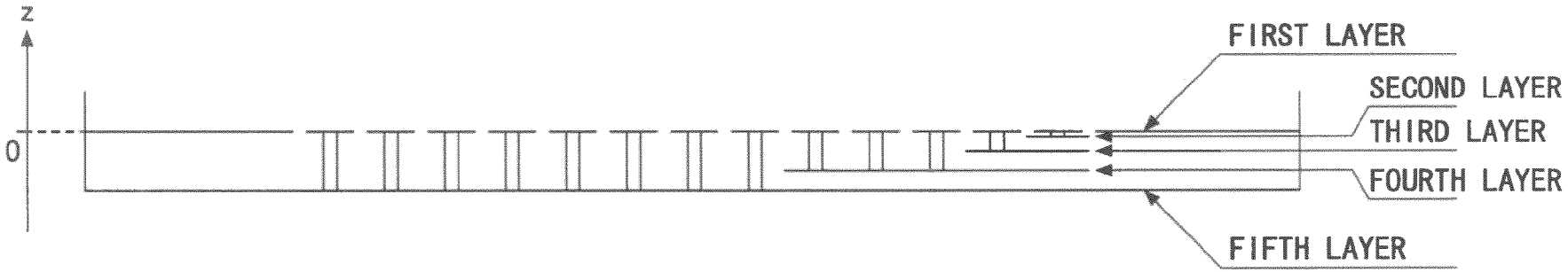
FIG. 44 is a cross-sectional diagram illustrating a layer structure.

FIG. 44 is a cross-sectional diagram illustrating a layer structure. As shown, five layers of a first to a fifth layer are used as layers which include a conductive layer in at least some thereof, between which a dielectric layer is interposed. As an example, the dielectric layer is an FR4 substrate which has relative permittivity of 4.4 and tan δ of 0.018. The first and second layers are separated by 0.2 mm. The first and third layers are separated by 0.8 mm. The first and fourth layers are separated by 1.6 mm. The first and fifth layers are separated by 2.4 mm.

Figure 45A:
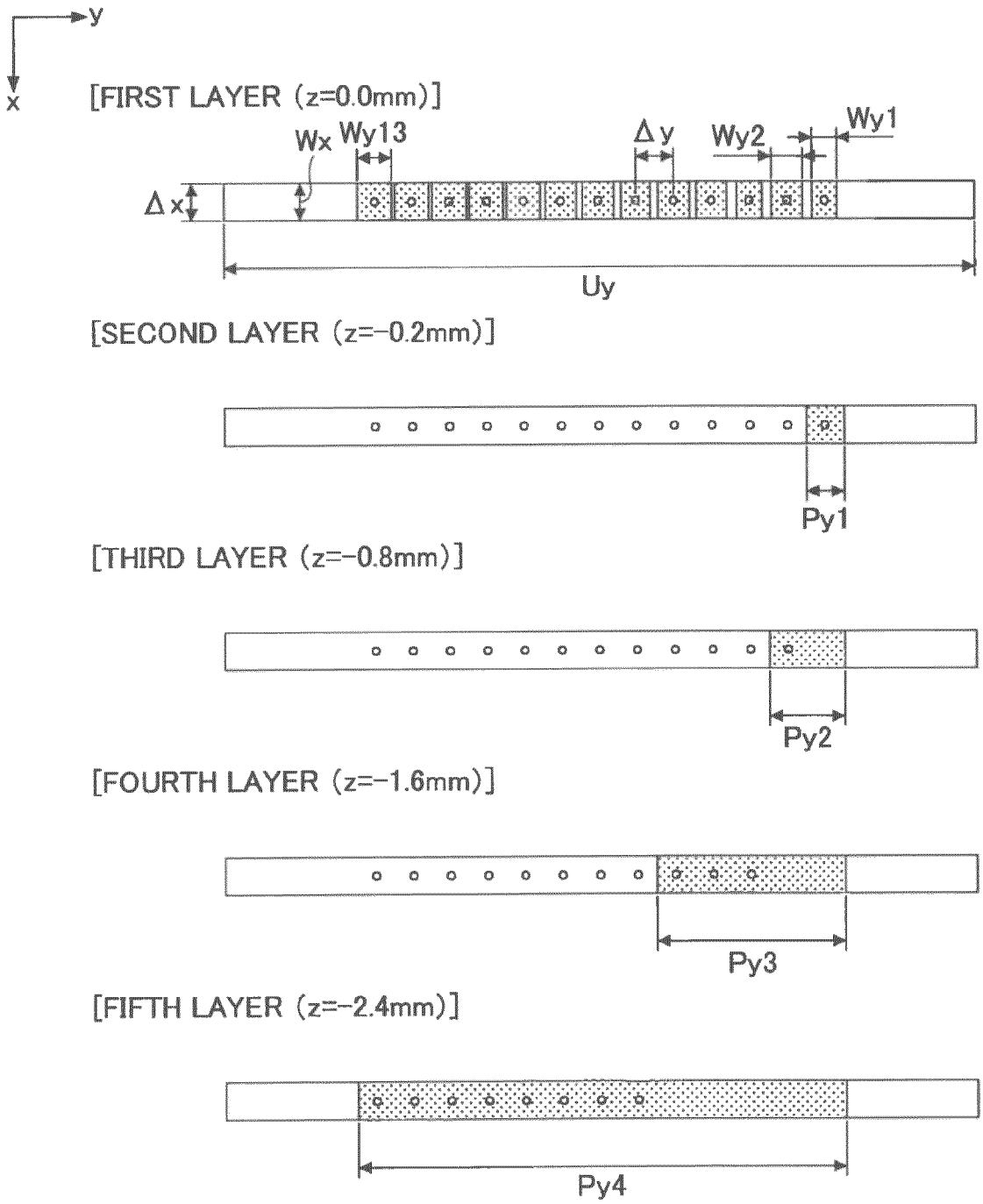
FIG. 45A is a diagram illustrating a location of a conductive layer in L1 through L5 layers.

FIG. 45A shows a location (shaded portion) of a conductive layer in first to fifth layers. For the first layer, thirteen patches corresponding to each of first to thirteenth elements are shown. As shown, thirteen circles lined up in the y-axis direction correspond to via holes. For convenience, from the right, they are referred to as the first to the thirteenth elements. FIG. 46A shows a size of thirteen patches in the first layer. For the second layer, a conductive layer having a length Py1 is provided at a location corresponding to the first element, and no conductive layers are provided at other locations. As an example, Py1 is 2.4 mm. For the third layer, a conductive layer having a length Py2 is provided at a location corresponding to the first and second elements, and no conductive layers are provided at other locations. As an example, Py2 is 4.8 mm. For the fourth layer, a conductive layer having a length Py3 is provided at a location corresponding to the first to fifth elements, and no conductive layers are provided at other locations. As an example, Py3 is 12 mm. For the fifth layer, a conductive layer having a length Py4 is provided at a location corresponding to all of the first to thirteenth elements. As an example, Py4 is 31.2 mm.

5.6 Vertical Control with Improved Second Structure

As explained with reference to FIG. 26, which shows an equivalent circuit for the second structure, an inductance of an approximate magnitude of L=μt occurs between neighboring mushroom structures. L shows an inductance, μ shows a permittivity of a material, and t shows a height of a via. In this case, heights of vias of neighboring mushroom structures are mutually equal. In FIG. 28, mushroom structures of different via heights are lined up. Inductances L1, L3, and L5 which are shown with a solid counterclockwise arrow are expected to take values of respective magnitudes of μ×t1, μ×t2, and μ×t3. However, for inductances L2 and L4 shown with a broken counterclockwise arrow, there is a step in the ground plate, so that heights of neighboring vias differ. Therefore, it is not appropriate to approximate an inductance which is produced therearound by a product of the permittivity ρ and the via height t. The same applies also to L2 and L4 in FIGS. 29 and 30. The inability to approximate the inductance with the product of the permittivity and the via height makes it difficult to conduct design when a number of mushroom structures is lined up to create a reflector, etc. Such an inconvenience becomes particularly salient when vertical control (FIGS. 34A-D) is conducted with the second structure in which multiple types of via heights exist.

Figure 45B:
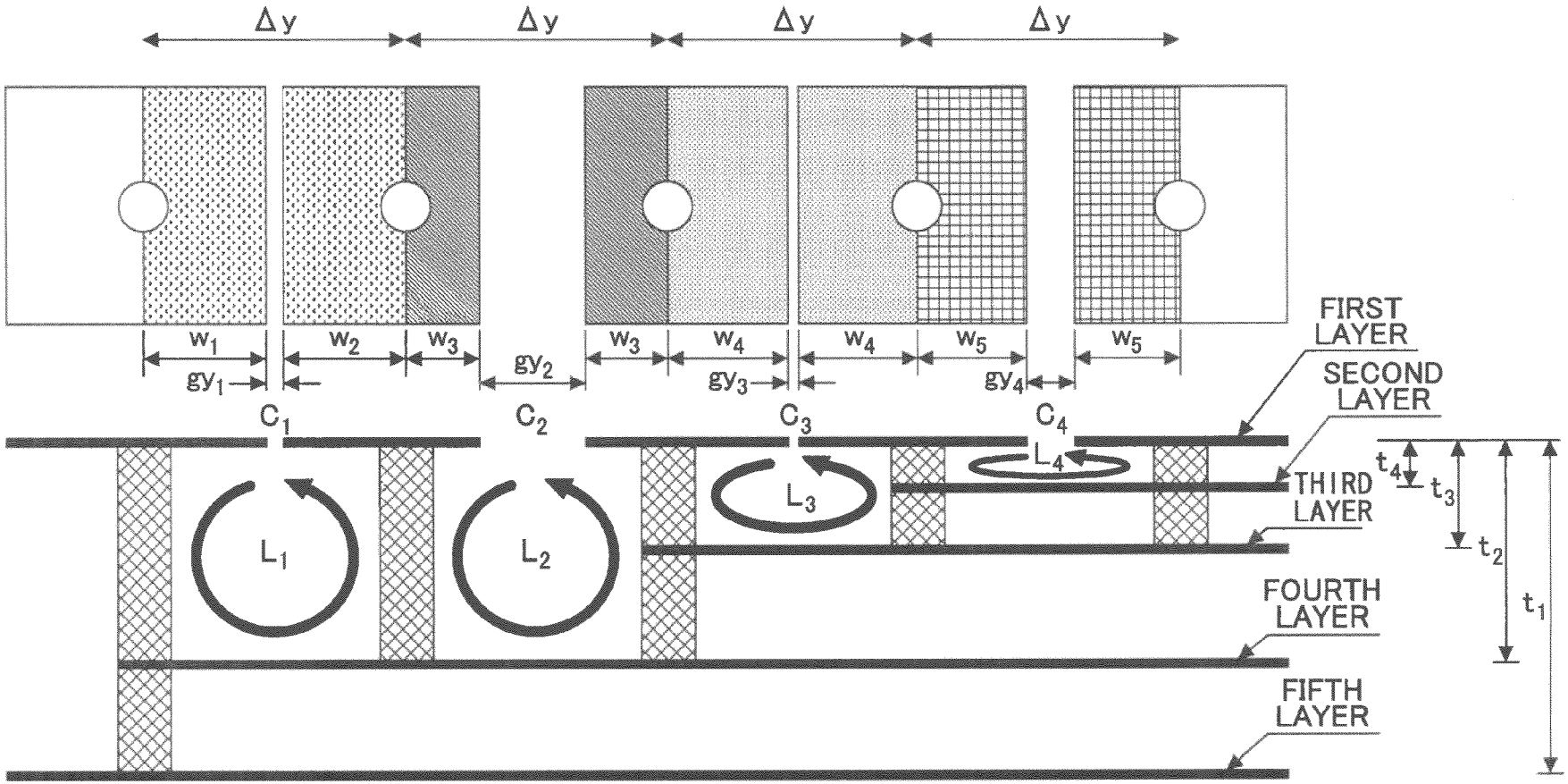
FIG. 45B is a diagram illustrating a structure when vertical control is performed using an improved second structure.

FIG. 45B shows a plane view and a cross-sectional view for conducting vertical control using the second structure which is improved so as to deal with the above-described problem. While a patch arrangement as shown in FIG. 34 is used, other arrangement schemes may be used. A thick line segment shown in the first to the fifth layers indicates that the portion is a conductive material. A conductive material in the first layer makes up a patch. The second to the fifth layers make up a ground plate. Five vias exist relative to each of the patches such that they cut across each layer. A portion in which a via and a ground plate cross is electrically connected. As shown, C1, C2, C3, and C4 show capacitances which are produced between patches. In FIG. 28, as shown with "EX", an end (or an edge) of a ground plate extends beyond a via and is located in between neighboring elements. On the other hand, for an example shown in FIG. 45B, an end of the ground plate, which does not extend beyond the via is terminated at a via position. In this way, for any of inductances L1, L2, L3, and L4, heights of neighboring vias are equal, and inductances produced may be appropriately approximated by a product of a permittivity and a via height. The end of the ground plate may be substantially terminated at a via location, and the end of the ground plate may exceed by little the via due to the manufacturing process, etc.

5.6 Structure without Via

One of at least one patches and a ground plate is electrically connected or shorted via a via hole in the above-described various mushroom structures and patch arrangements. However, this is not mandatory for realizing a reflect array. This is because the via hole is not acting directly when the mushroom structure is used as a reflector array, and an incident wave is reflected in a desired direction. A via hole height (patch height) t is related to an inductance L(=μt), and the inductance L affects the resonance frequency ω of the mushroom structure, so that presence/absence of the via hole must always be taken into account when designing patch dimensions and gap, etc. Conversely, it is possible to not provide a via hole, and to design a patch and a reflector array based on a capacitance, etc. of one or more patches and a ground plate.

Figure 46B:
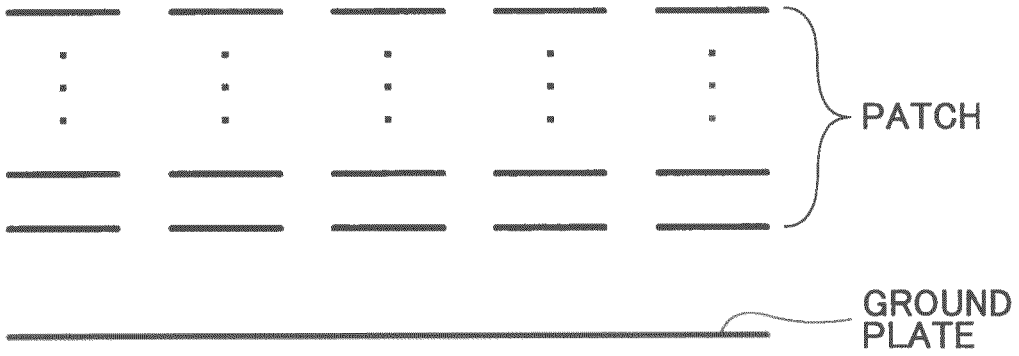
FIG. 46B is a diagram of a variation of the first structure.

For example, mushroom structures according to the first structure may control the capacitance by making the patch multi-layered (C to nC), so that an incident wave may be properly reflected even when a via hole does not exist (FIG. 46B).

Figure 46C:
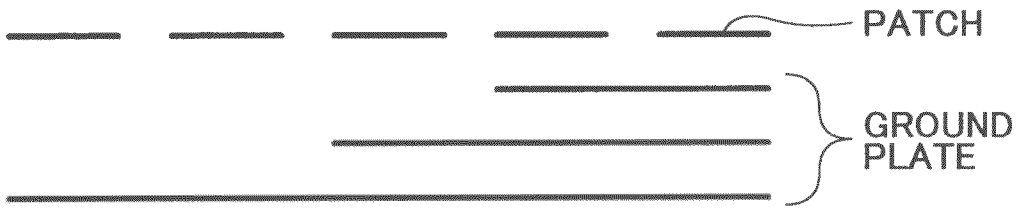
FIG. 46C is a diagram of a variation of the second structure.

For mushroom structures according to the second structure, a focus is on the fact that changing the distance between the ground plate and the patch changes the inductance L (L=μt). Thus, when via hole does not exist, the inductance as discussed above cannot be obtained. However, when via hole does not exist in the second structure, it is possible to conduct design by further taking into account the capacitance between the patch and the ground plate (FIG. 46C). Approximately, the capacitance between the patch and the ground plate is inversely proportional to the distance therebetween. Thus, not only a capacitance due to a gap between neighboring patches, but also a capacitance which depends on a distance between a patch and a ground plate may be taken into account to design a patch which corresponds to the reflection phase difference between the neighboring patches.

Figure 46D:
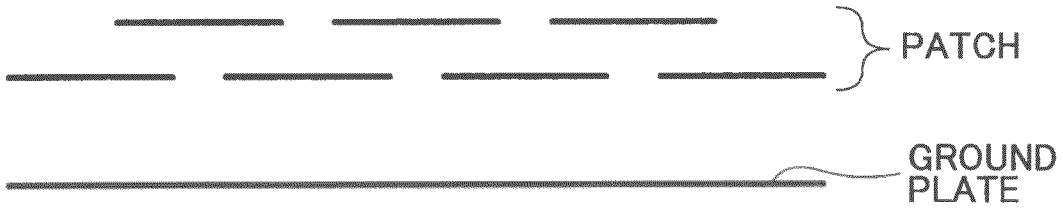
FIG. 46D is a diagram illustrating a variation of the third structure.

The mushroom structures according to the third structure controls the capacitance by allowing overlapping between patches, so that, as for the first structure, an incident wave may be properly reflected even when the via hole does not exist (FIG. 46D).

Figure 46E:
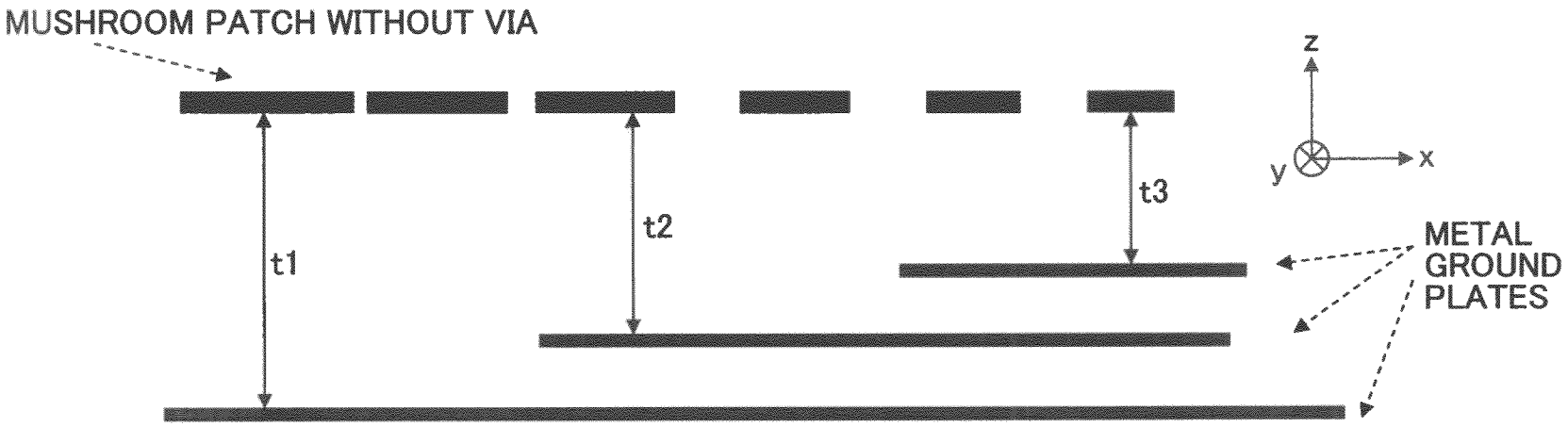
FIG. 46E is a diagram illustrating a variation when a patch size is varied.

In FIGS. 46B-D, the gaps between neighboring patches are drawn as if they are equal for convenience of illustration, which is not mandatory for the present invention, so that the gaps between the patches are set differently depending on specific product uses. FIG. 46E shows the above-described second structure with an emphasis on the fact that there is no via and gaps between patches are not uniform. The fact that gaps between patches may or may not be uniform is applicable not only to the second structure, but also the first and third structures.

Moreover, a mushroom structure without a via may be used even when horizontal control (control to reflect in the x direction) and vertical control (control to reflect in the y direction) are conducted.

FIG. 34B shows an exemplary patch arrangement for conducting vertical control using the mushroom structure without the via. The patch arrangement scheme shown in FIG. 34B is also applicable to a mushroom structure with a via. In the example shown, all of the four patches $p_{11}$, $p_{12}$, $p_{13}$, and $p_{14}$ have the same dimensions. In other words, each has a size of Wx in the x-axis direction and a size of 2Wy in the y-axis direction. This is different from an arrangement scheme shown in FIG. 34A, in which sizes of neighboring patches are different. For the patch arrangement scheme shown in FIG. 34B, distances between centers of neighboring patches are not identical. The distance Δy1 between centers of the first patch p11 and the second patch p12 is Δy1=Wy+gy1+Wy=2Wy+gy1. The distance Δy2 between centers of the second patch p12 and the third patch p13 is Δy2=Wy+gy2+Wy=2Wy+gy2. The distance Δy3 between centers of the third patch p13 and the fourth patch p14 is Δy3=Wy+gy3+Wy=2Wy+gy3. Similar to the patch arrangement of FIG. 34A, gaps between patches vary as gy1, gy2, gy3 . . . .

For the exemplary patch arrangement shown in FIG. 34B, four patches p11, p12, p13, p14 all have the same dimensions, but the distance between centers of patches vary from one location to another. When creating a reflector array using these patches, it is also necessary to realize a predetermined phase difference ΔΦ with a neighboring patch as described in FIGS. 5 and 25. The phase difference no needs to meet the following equation with respect to a reflection angle α of a radio wave and a distance Δyi between centers of patches.

$$\Delta\Phi = k \cdot \Delta yi \cdot \sin\alpha$$

Here, k represents a wave number ($k=2\pi/\lambda$), and $\Delta yi$ represents a distance between centers of different patches varying from one location to another (i=1, 2, . . . ).

Figure 34C:
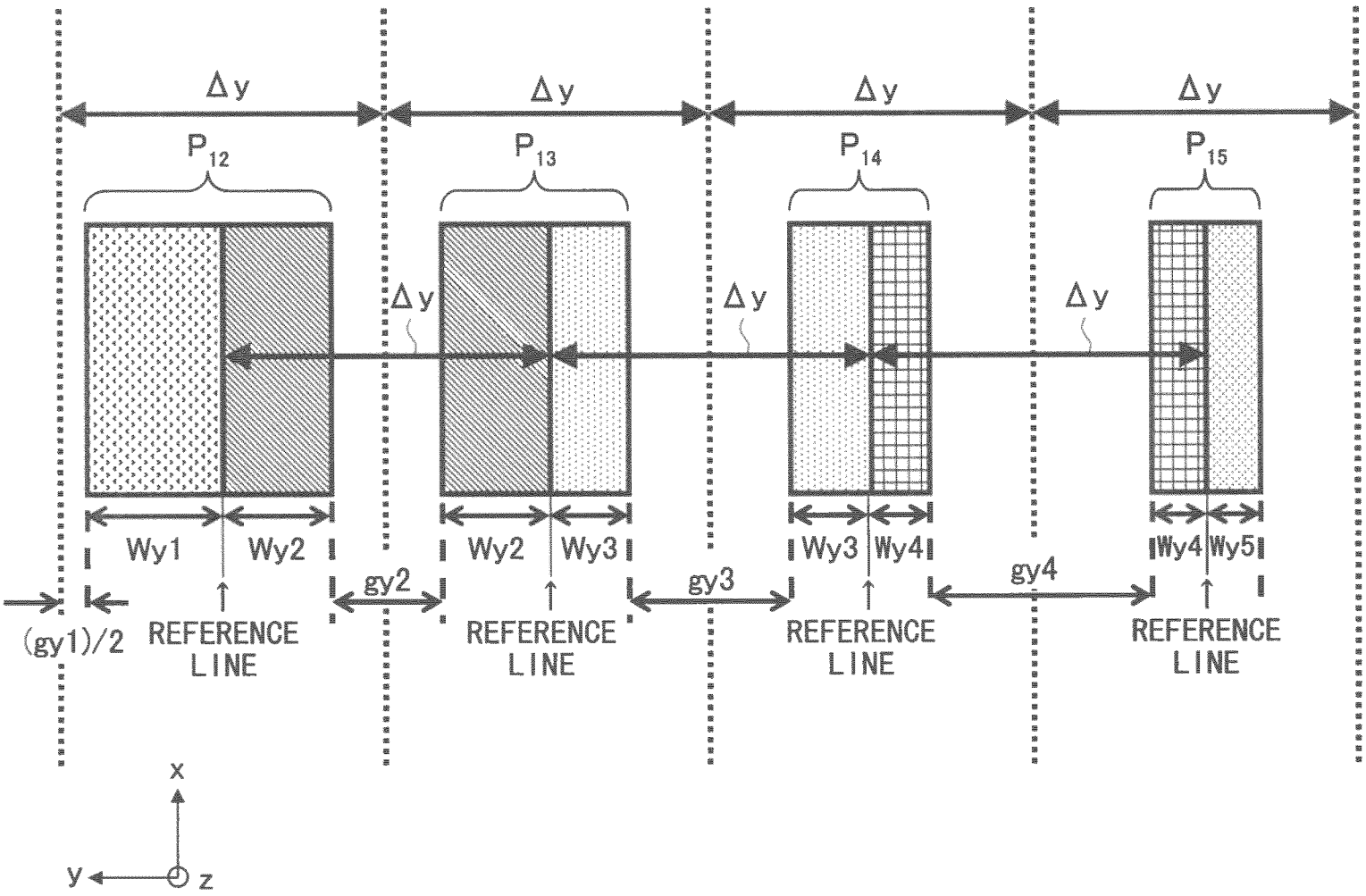
FIG. 34C is a diagram illustrating a different scheme of patch arrangement.

FIG. 34C shows a different exemplary patch arrangement for conducting vertical control using the mushroom structure without via. Similar to FIG. 34A, while each of four patches $p_{12}$, $p_{13}$, $p_{14}$, $p_{15}$ has different dimensions, distances between centers of patches are all equal ($\Delta y$). Unlike the example shown in FIG. 34A, the via is not provided. These patches have a length of Wx in the x axis direction. The first patch $p_{12}$ has a length of $W_{y1}+W_{y2}$ in the y-axis direction. The second patch $p_{13}$ has a length of $W_{y2}+W_{y3}$ in the y-axis direction. The third patch $p_{14}$ has a length of $W_{y3}+W_{y4}$ in the y-axis direction. The fourth patch $p_{15}$ has a length of $W_{y4}+W_{y5}$ in the y-axis direction. Thus, a gap between the first and second patches is $\Delta y-2W_{y2}=gy2$. Similarly, a gap between the second and third patches is $\Delta y-2W_{y3}=gy3$. A gap between the third and fourth patches is $\Delta y-2W_{y4}=gy4$. Thus, distances between reference lines are equal to $\Delta y$ and are maintained uniform. A location of a reference line corresponds to points (a straight line which passes through the points) on which a via is provided in FIG. 34A. When creating a reflector array using these patches, it is necessary to realize a predetermined phase difference $\Delta\Phi$ with a neighboring patch as described in FIGS. 5 and 25. The phase difference $\Delta\Phi$ needs to meet the following equation with respect to a reflection angle $\alpha$ of a radio wave and a patch distance $\Delta y$.

$$\Delta\Phi=k\cdot\Delta y\cdot\sin\alpha$$

Here, k represents a wave number ($k=2\pi/\lambda$).

Now, when there is a via in a mushroom structure, a location of a via may be used as a reference point for determining dimensions of a patch. However, for a mushroom structure without a via, such a reference point does not exist.

Figure 34D:
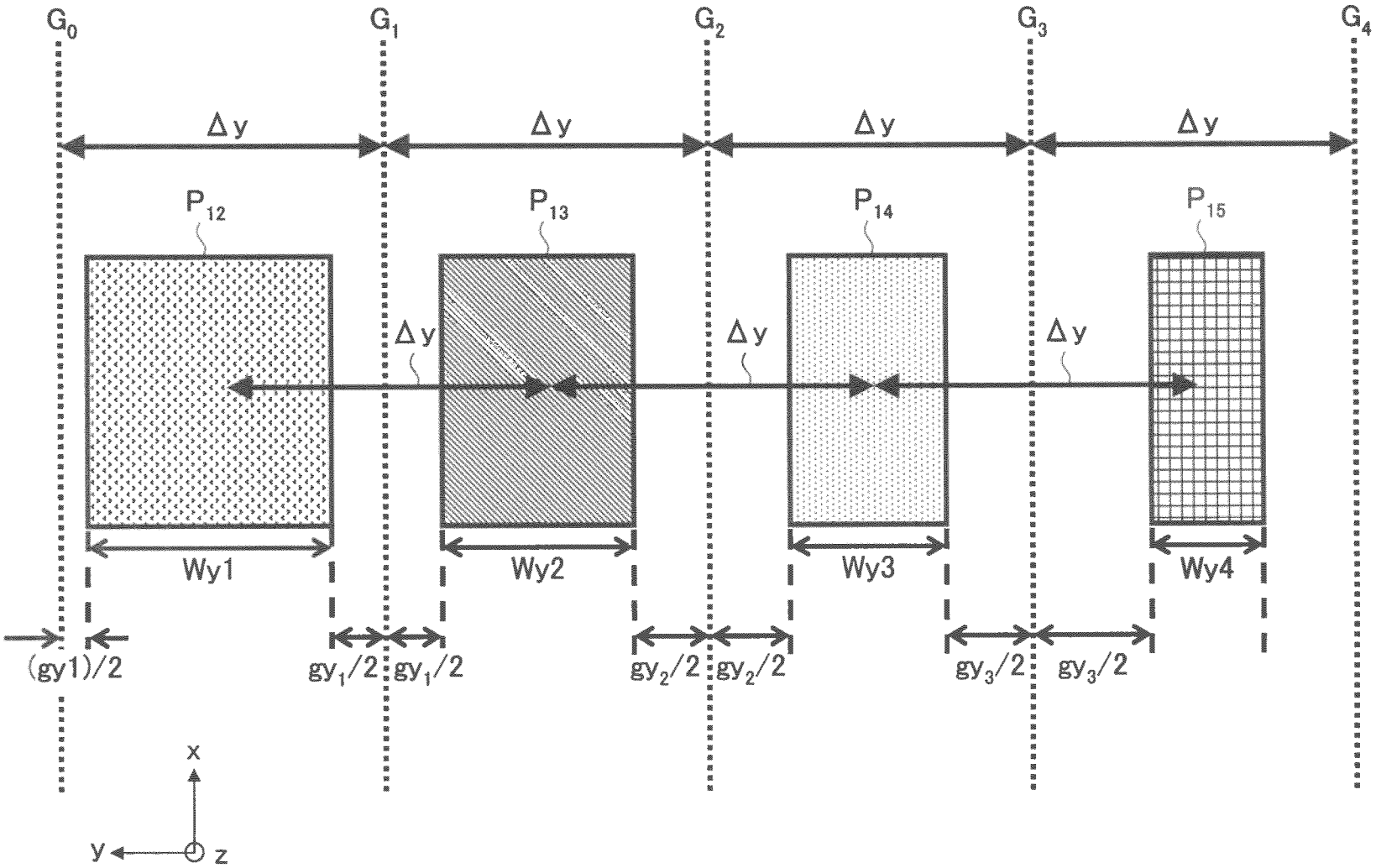
FIG. 34D is a diagram illustrating a different scheme of patch arrangement.

FIG. 34D shows a different exemplary patch arrangement for conducting vertical control using the mushroom structures without via. As for FIG. 34C, each of four patches $p_{12}$, $p_{13}$, $p_{14}$, and $p_{15}$ has different dimensions. For the example shown, distances between a center line which divides in half a gap between a first patch and a neighboring second patch, and a center line which divides in half a gap between the second patch and a neighboring third patch are all equally set ($\Delta y$). Generally, a gap between an i-th patch and an (i+1)-th patch is expressed as gyi and a center which divides in half the gap is expressed as Gi. A dimension Wyi in the y-axis direction of the i-th patch is calculated as $\Delta y-(gyi-1)/2-gyi/2$. For example, it is calculated as $Wy2=\Delta y-gy1/2-gy2/2$. In this way, a center of a gap may be made a reference point to easily calculate a dimension of a patch when there is no via.

6. Manufacturing Method

The first to the third structures and the structure of the variation may be manufactured by any appropriate method known in the art. For manufacturing any structure, a structure in which a metal layer and a dielectric layer are laminated becomes a basis. For example, two of printed substrates (for example, a glass epoxy substrate (FR4) having a permittivity of 4.4), on the front and the back of which a copper conductive layer is formed, are laminated and pressed to obtain a structure having three metal layers. In this case, a multiple of resin substrates such as prepregs may be laminated to form a dielectric layer of a desired thickness.

For example, a lowermost metal layer may be made a ground plate, an intermediate metal layer may be made a first patch, and an uppermost metal layer may be made a second patch to manufacture mushroom structures according to the first structure as shown in FIG. 2A.

Moreover, a lowermost metal layer and an uppermost metal layer are used for the first mushroom structure and an intermediate metal layer and an uppermost metal layer may be used for the second mushroom structure to manufacture the second structure as shown in FIGS. 28 and 30. The uppermost and lowermost metal layers are used for the first mushroom structure and the intermediate and uppermost metal layers may be used for the second mushroom structure to manufacture the second structure as shown in FIG. 29.

Moreover, an uppermost and intermediate (or intermediate and lowermost) metal layer may be used for mushroom structures in which neighboring patches do not overlap while the uppermost, intermediate and lowermost metal layers may be used for mushroom structures in which neighboring patches overlap to manufacture the third structure as shown in FIGS. 32 and 33.

7. Combination Structure 7.1 Combination Method

The above-described first to third structures and the structure of the variation may be used individually or in combination. Breakdown of items such as the first, second, third structures and the variation, etc., are not essential to the present invention, so that matters recited in two or more items may be used in combination as needed, or matters recited in a certain item may be applied to matters recited in a different item (as long as they do not contradict). In general, the first structure has an increased capacitance by adding a passive element to laminate multiple patches in parallel. The second structure adjusts an inductance by providing multiple types of patch heights. The third structure has an increased capacitance by allowing neighboring patches to overlap. Thus, at least two of the first, second, and third structures may be combined to further vary the capacitance and/or inductance and further enlarge the range of reflection phase.

Figure 47:
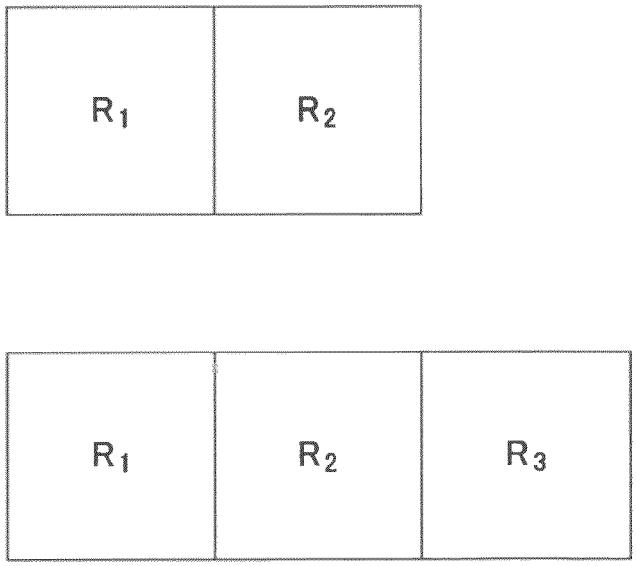
FIG. 47 is a diagram illustrating multiple regions in an array.

For example, as shown on the upper side of FIG. 47, one array may be divided into two regions R1 and R2 and different structures may be used in each of regions R1 and R2. An array includes Nx mushroom structures in the x-axis direction and Ny mushroom structures in the y-axis direction. The mushroom structures may be structures in FIG. 2A, or structures in FIG. 24. Arrays may be repeated in the x-axis direction and/or the y-axis direction to realize a reflect array of a desired magnitude.

As structures which form R1 and R2 in FIG. 47, combinations of the first and the second structures, the first and the third structures, the second and the third structures, and all of the first through the third structures may be possible. Moreover, as shown on the lower side of FIG. 47, one array is divided into three regions R1, R2, and R3, so that structures with at least two of the regions differing may be used. Structure with all of the three regions differing may be used. How regions within the array are broken down is not limited to what is shown, so that they may be divided by any appropriate scheme.

Moreover, not only using a structure which is different for each region as shown in FIG. 47, but also a combination in one mushroom structure is also possible.

Figure 48:
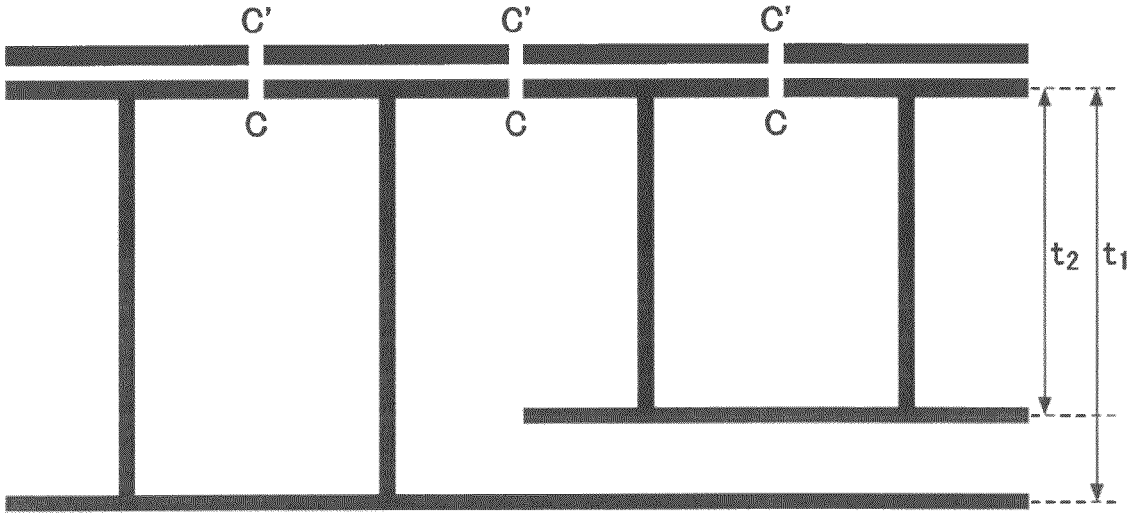
FIG. 48 is a diagram illustrating a structure in which the first structure and the second structure are combined.

FIG. 48 shows a combination of a first structure in which patches are multi-layered and a second structure which also uses what have different patch heights. This is preferable from a point of view of adjusting both capacitance and inductance.

Figure 49A:
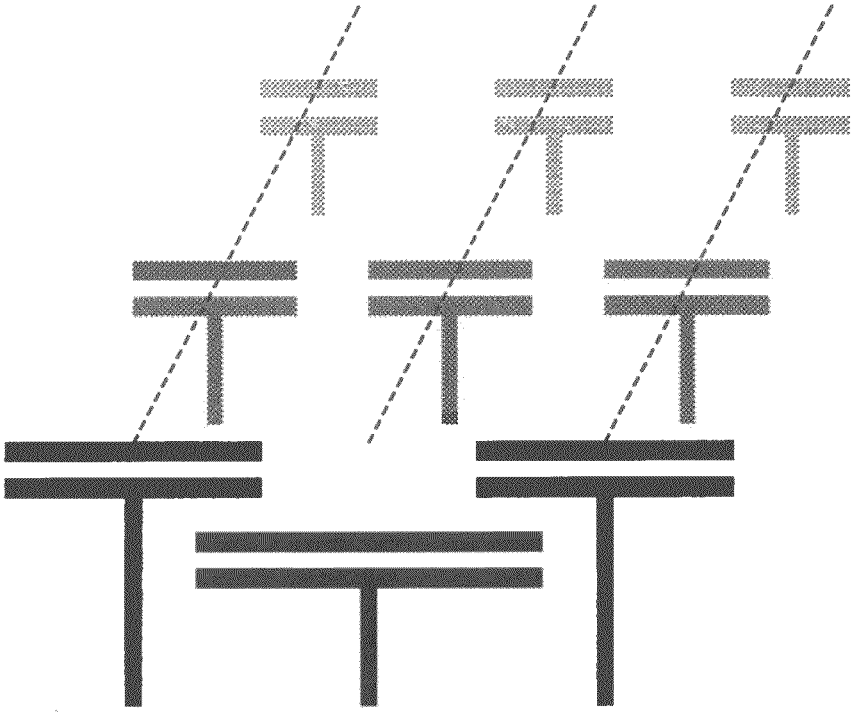
FIG. 49A is a diagram illustrating a structure in which the first structure and the third structure are combined.

FIG. 49A shows a combination of a first structure in which patches are multi-layered and a third structure which allows overlapping of neighboring patches. This is preferable from a viewpoint of further increasing the capacitance. Combining the second and third structures or combining all of the first to the third structures may be possible.

Figure 49B:
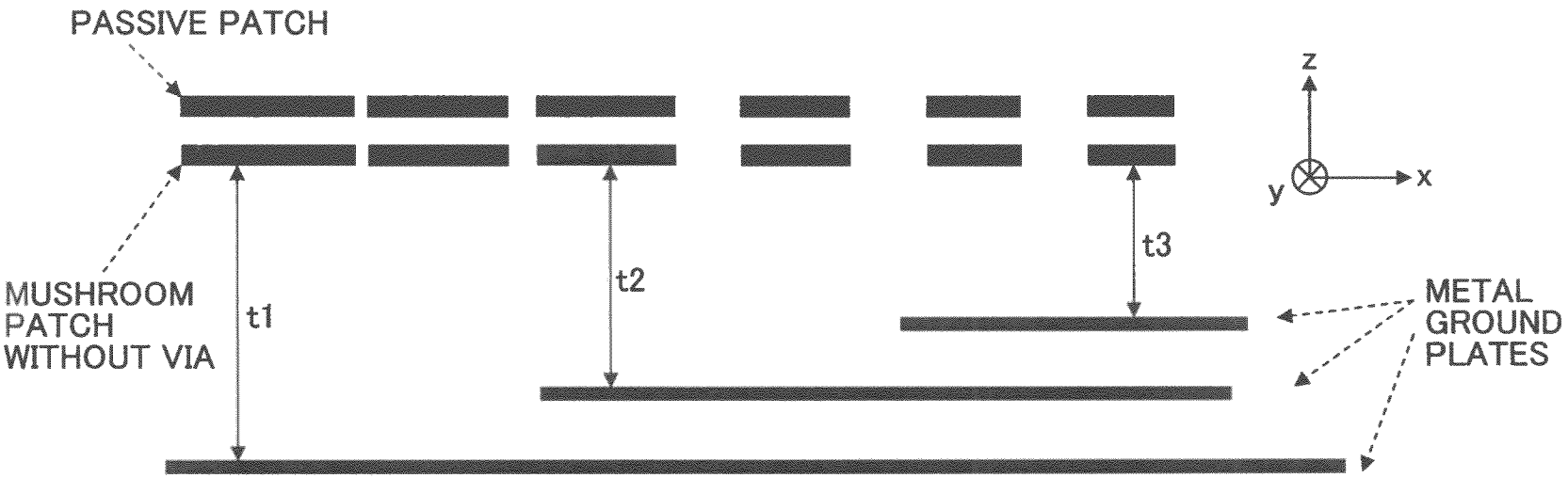
FIG. 49B is a diagram illustrating a structure (without via) in which the first structure and the second structure are combined.
Figure 49C:
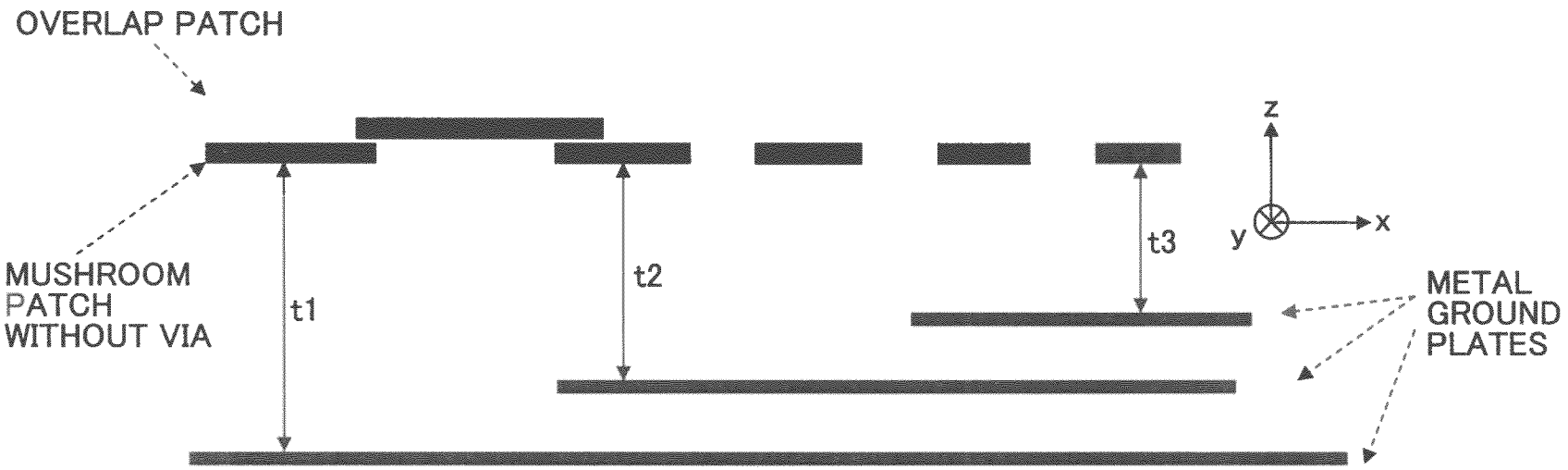
FIG. 49C is a diagram illustrating a structure (without via) in which the second structure and the third structure are combined.

As an example, FIG. 49B shows a vialess structure in which the first structure and the second structure are combined. Moreover, FIG. 49C illustrates a vialess structure in which the second structure and the third structure are combined. In this way, various structures are possible.

7.3 Combination of Second and Third Structures

A combination of the second and the third structures is described.

Figure 50:
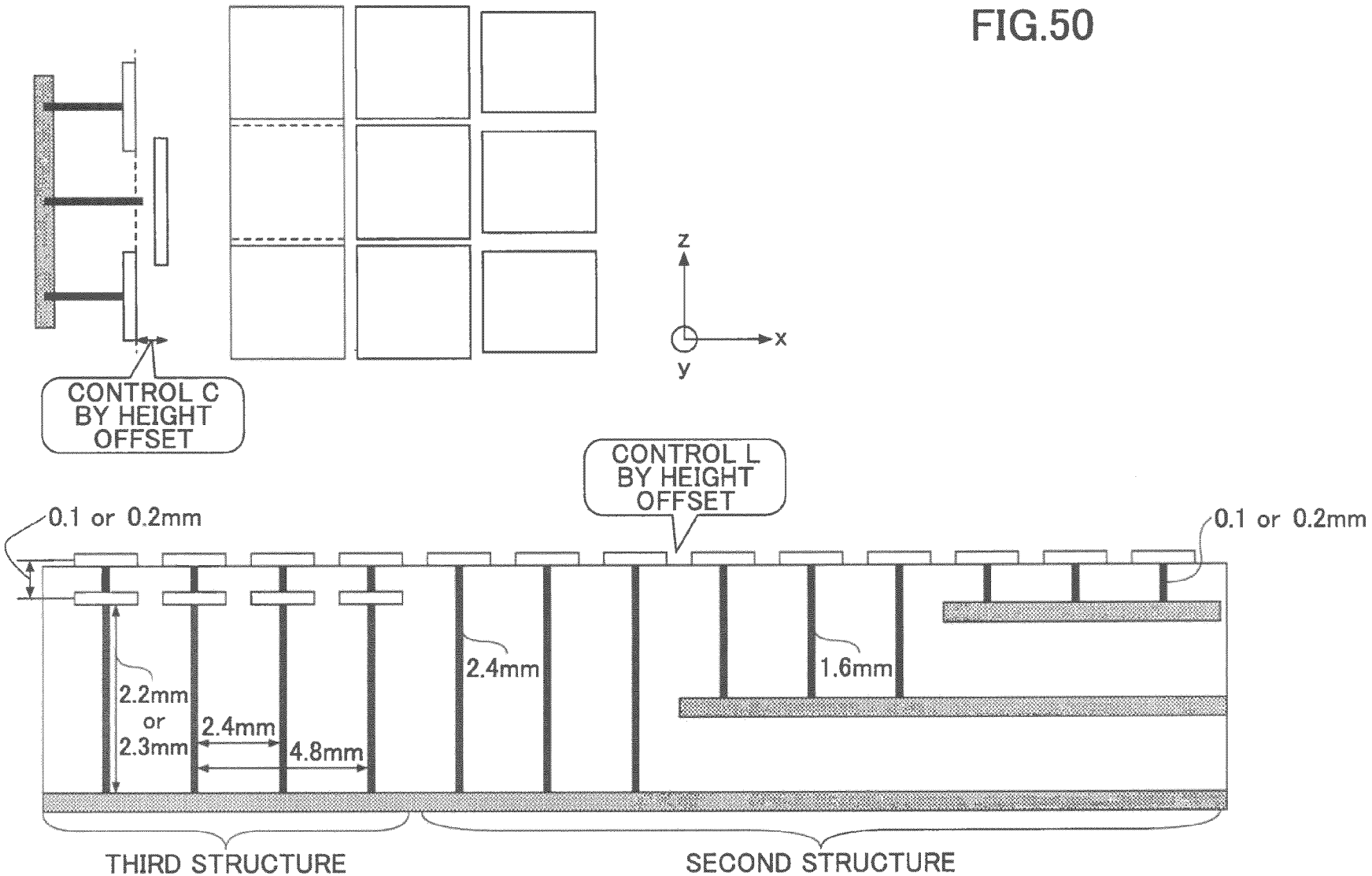
FIG. 50 is a diagram illustrating a structure in which the second structure and the third structure are combined.
Figure 55:
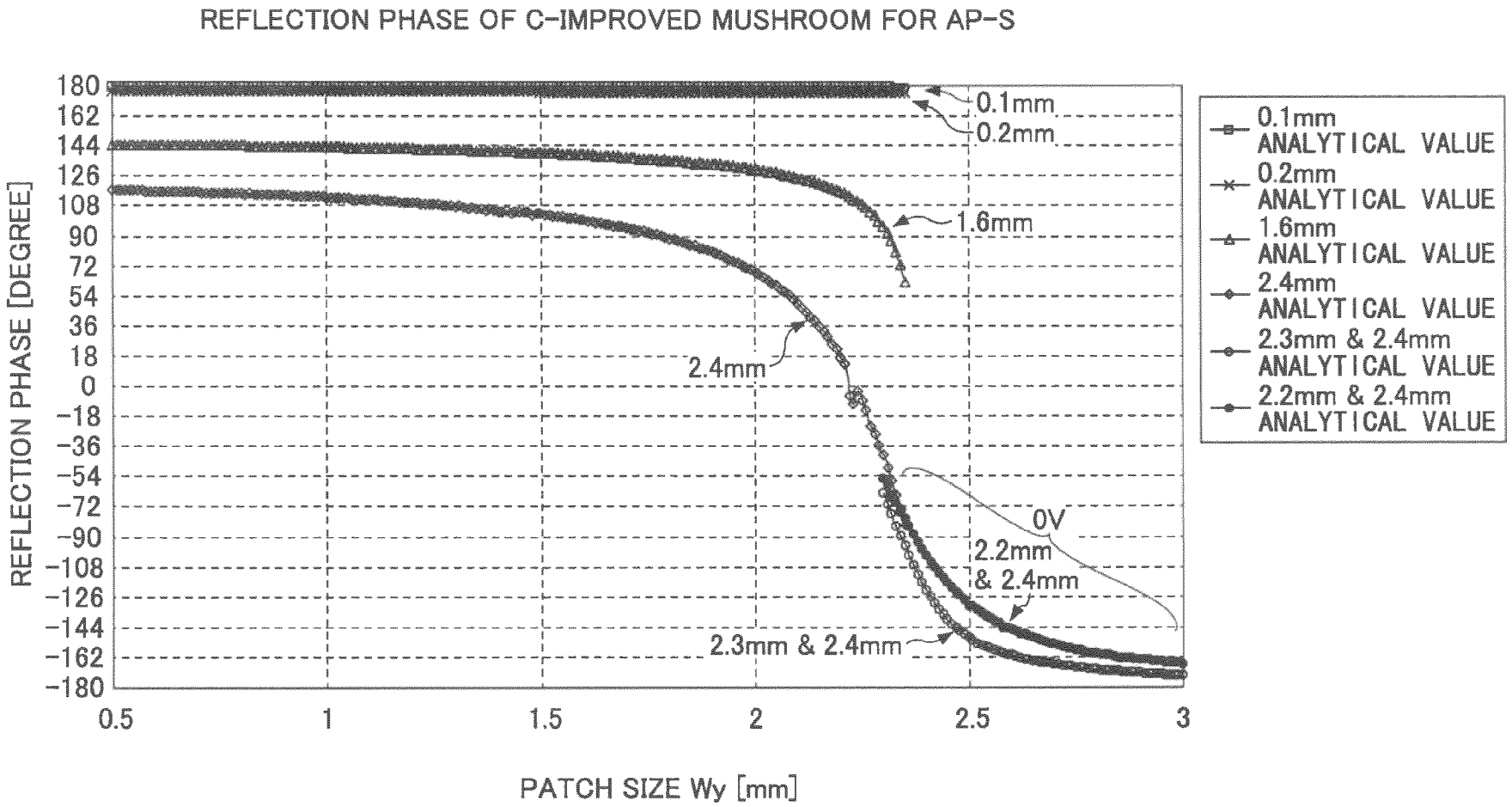
FIG. 55 is a diagram illustrating a relationship between the patch size and the reflection phase for different substrate thicknesses.
Figure 56:
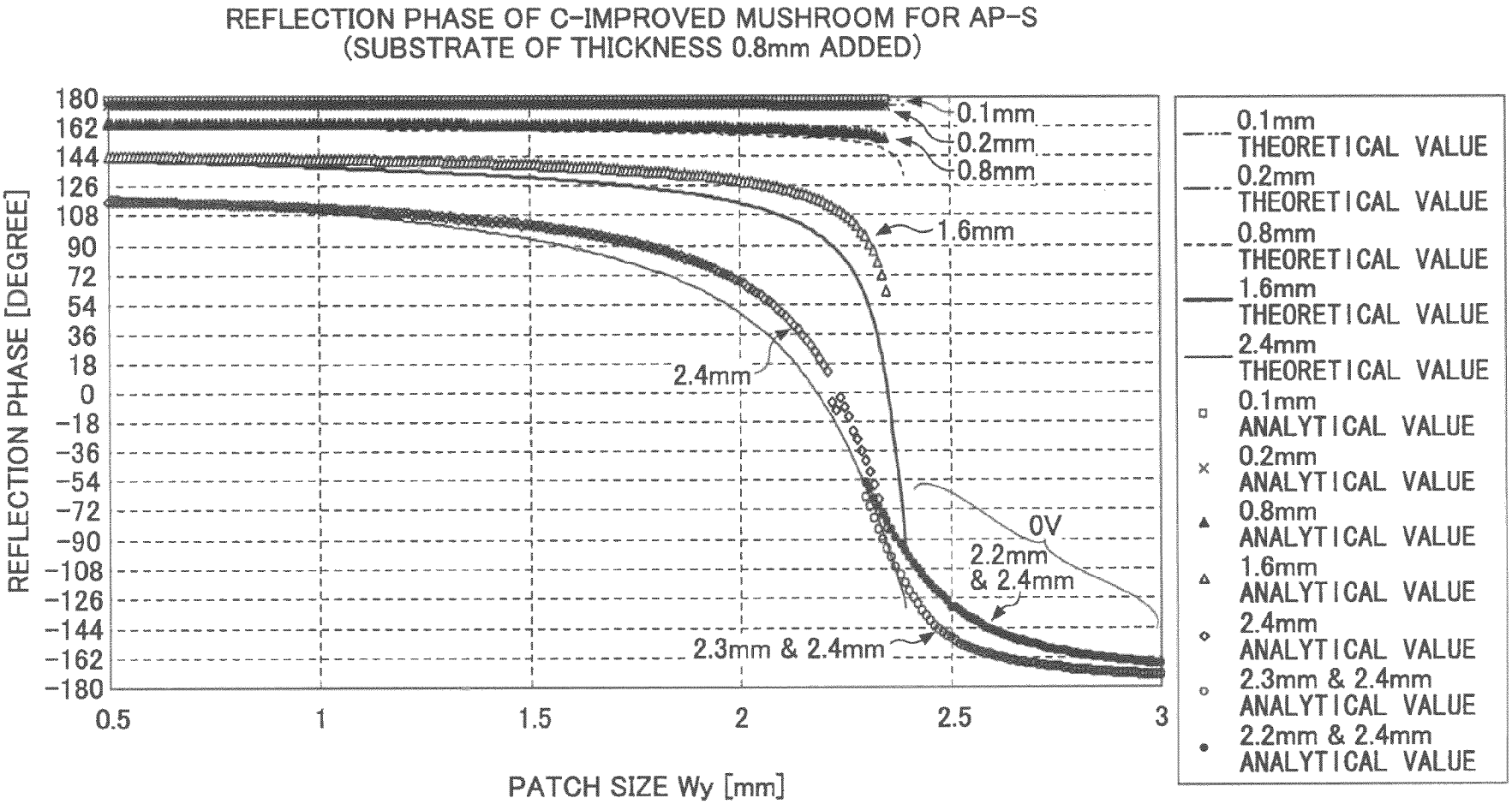
FIG. 56 is a diagram illustrating a relationship between the patch size and the reflection phase for different substrate thicknesses.
Figure 57:
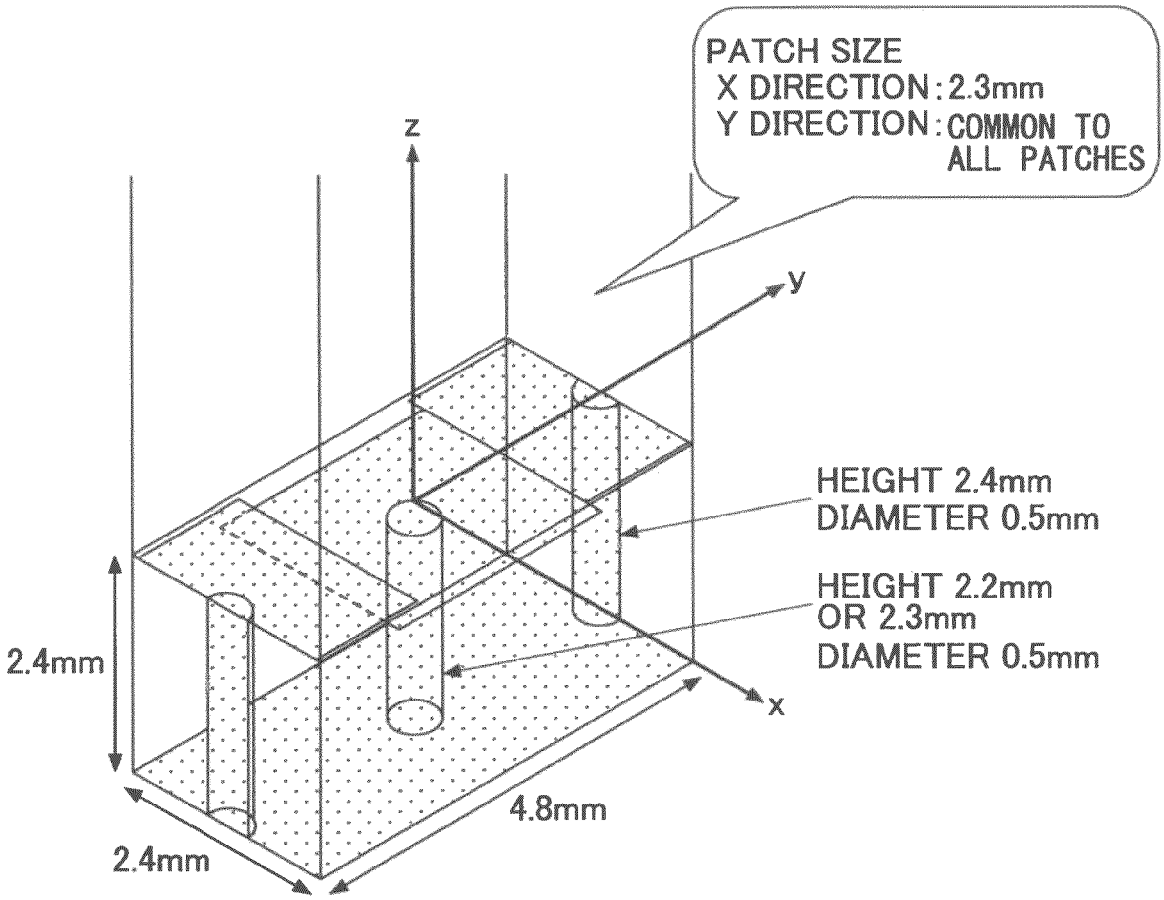
FIG. 57 is a diagram illustrating a simulation model for the third structure.

FIG. 50 shows how a second structure region on the right-hand side of the paper face is combined with a third structure region on the left-hand side of the paper face in one array. A patch or via height t in the second structure may have options of 2.4 mm, 1.6 mm, and 0.1 (or 0.2) mm. The patch heights in the third structure are 2.3 mm and 2.4 mm (or 2.2 mm and 2.4 mm). Thus, the structures shown may be considered by breaking down into the following structures:

(A) mushroom structures with a substrate thickness t of 0.1 mm;

(B) mushroom structures with the substrate thickness t of 0.2 mm;

(C) mushroom structures with the substrate thickness t of 1.6 mm;

(D) mushroom structures with the substrate thickness t of 2.4 mm;

(E) mushroom structures with the substrate thicknesses t of 2.3 mm and 2.4 mm that allows overlap (E) mushroom structure with the substrate thicknesses t of 2.2 mm and 2.4 mm that allows overlap FIGS. 51-54 show results of simulation for each structure of (A) to (D) as described above. FIG. 55 shows results of simulation for each structure of (E) and (F) as well as (A) through (D). In general, these correspond to what are described with reference to FIG. 27. FIG. 56 also shows results of simulation for mushroom structures with a substrate thickness t of 0.8 mm as well as (A) through (F). FIG. 57 shows a model for simulating the structures of (E) and (F) with respect to FIGS. 55 and 56.

7.3 Horizontal Control at 45 Degrees (Part 1)

Figure 51:
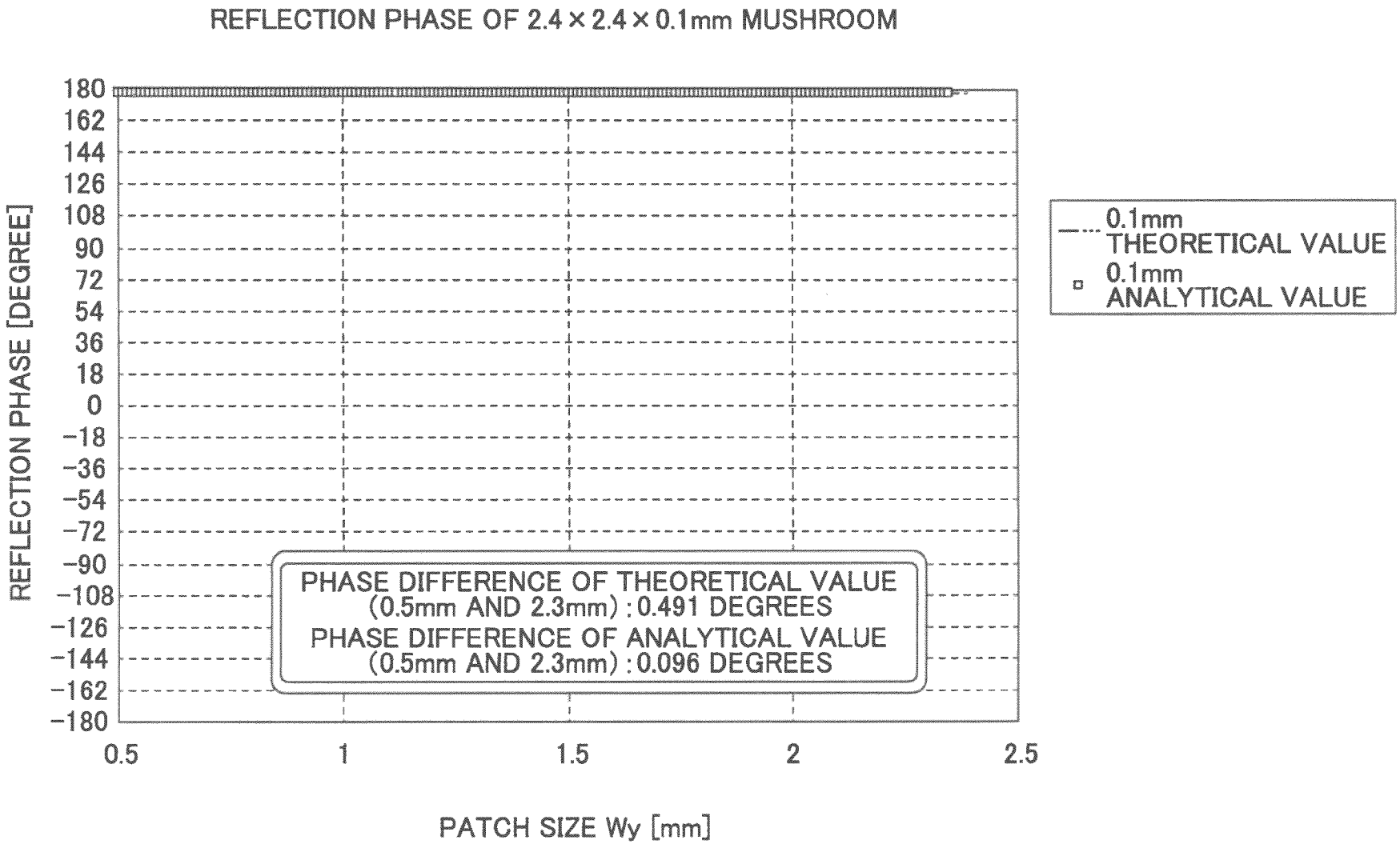
FIG. 51 is a diagram indicating a relationship between a patch size and a reflection phase for a substrate thickness of 0.1 mm.
Figure 52:
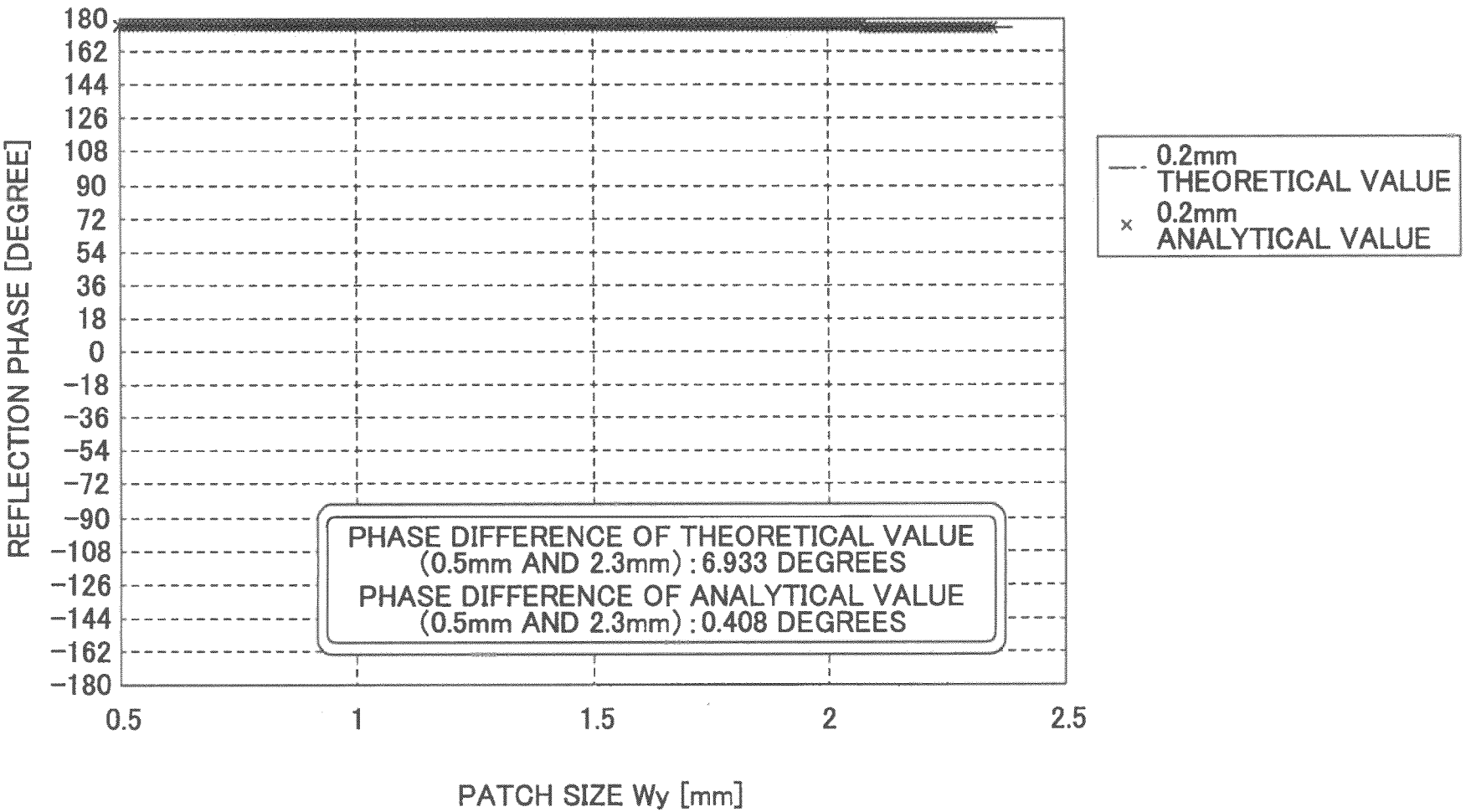
FIG. 52 is a diagram indicating the relationship between the patch size and the reflection phase for the substrate thickness of 0.2 mm.
Figure 53:
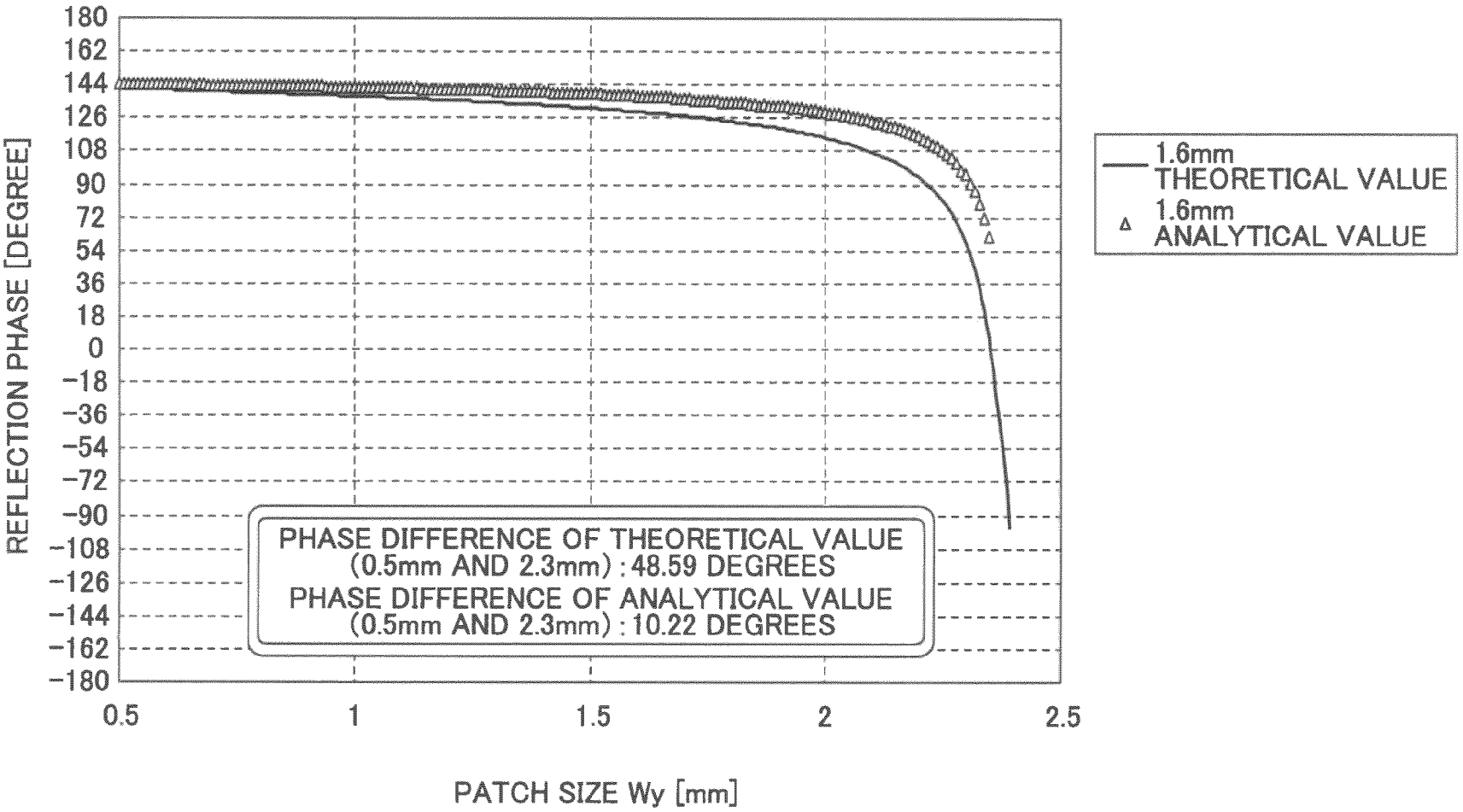
FIG. 53 is a diagram indicating the relationship between the patch size and the reflection phase for the substrate thickness of 1.6 mm.
Figure 54:
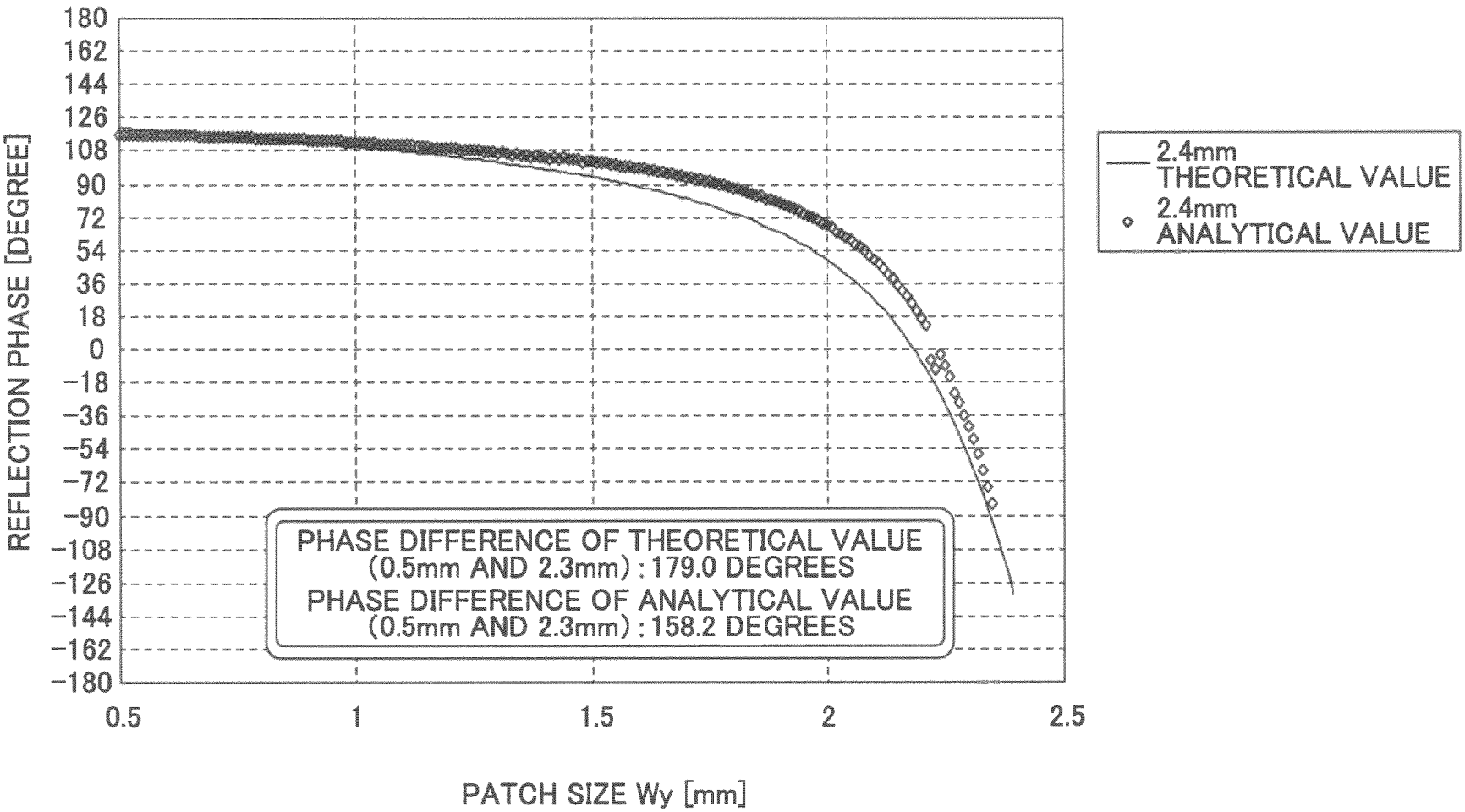
FIG. 54 is a diagram indicating the relationship between the patch size and the reflection phase for the substrate thickness of 2.4 mm.
Figure 58:
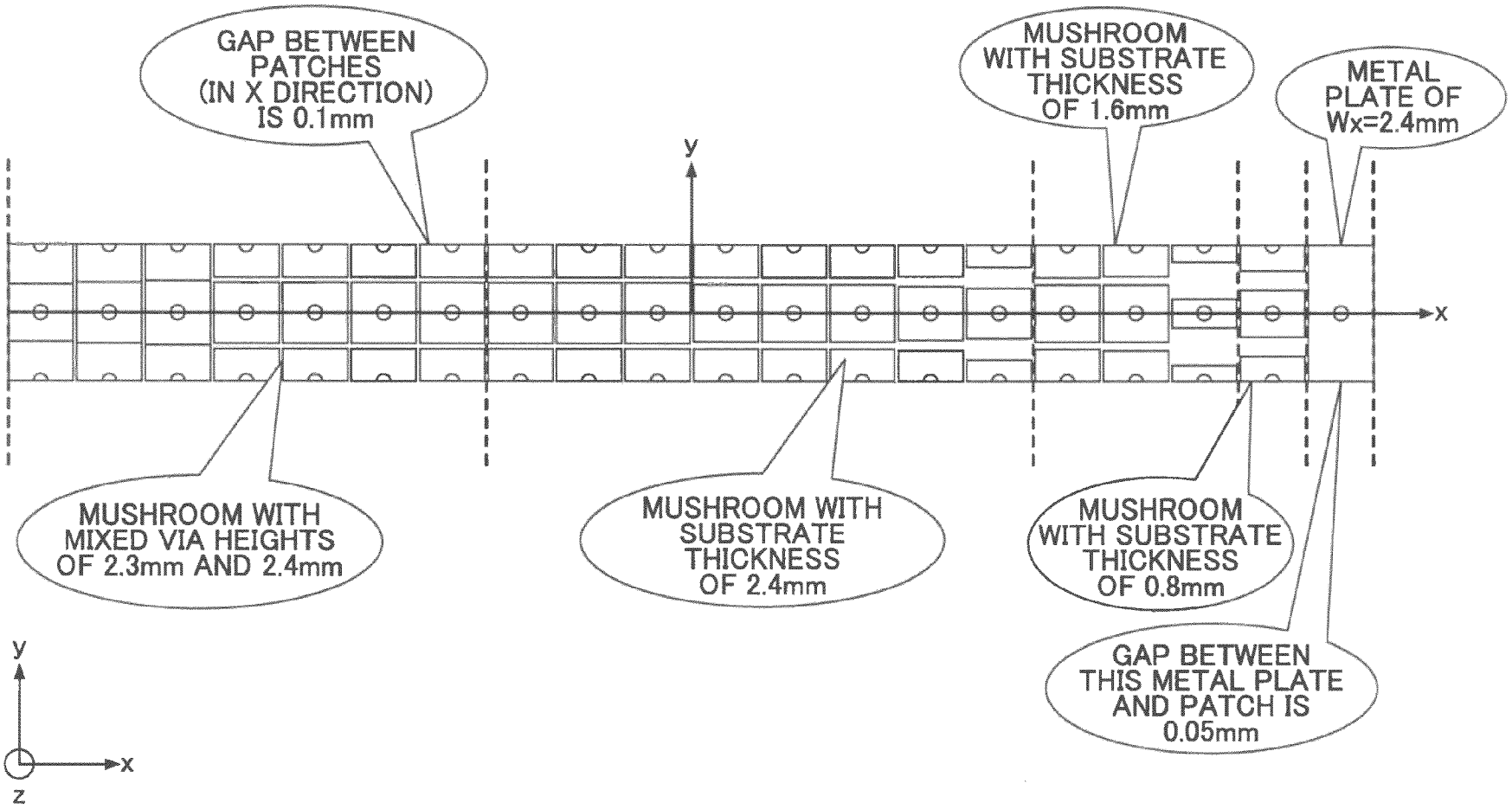
FIG. 58 is a first part of a plane view of a reflect array in which the second and third structures are combined.

FIG. 58 shows a plane view of a reflect array by a combination of the second and third structures. This reflect array is created in accordance with a mutual relationship of a substrate thickness t, a reflection phase, and a patch size Wy as shown in FIG. 56. Details of the structure are discussed below. In general, the third structure is formed by seven mushroom structures from the left-hand side along the x-axis direction. The third structure is formed by allowing overlapping between a mushroom structure with a patch height of 2.4 mm and a mushroom structure with a patch height of 2.3 mm. The second structure is formed by eight mushroom structures with a patch height of 2.4 mm, three mushroom structures with a patch height of 1.6 mm, and a mushroom structure with a patch height of 0.8 mm. Thus, a metal plate of a 2.4 mm width is provided on a location on the right-hand side shown. A gap between this metal plate and a patch is 0.05 mm. The metal plate is used in lieu of a mushroom structure with a 0.1 mm thickness. As shown in FIG. 51, a mushroom structure with a substrate thickness of 0.1 mm may be replaced with a metal plate as it causes a reflection phase of approximately 180 degrees regardless of the patch size Wy. Moreover, a gap in the x direction between patches is 0.1 mm.

FIG. 59 shows specific dimensions of each element shown in FIG. 58. "Design phase" is an ideal phase sought from a design viewpoint, while a numerical value indicated in a "phase" column is a phase which is actually realized. These numerical values are designed such that a reflect array forms a reflection in a direction of −45 degrees relative to an incident wave.

Figure 60:
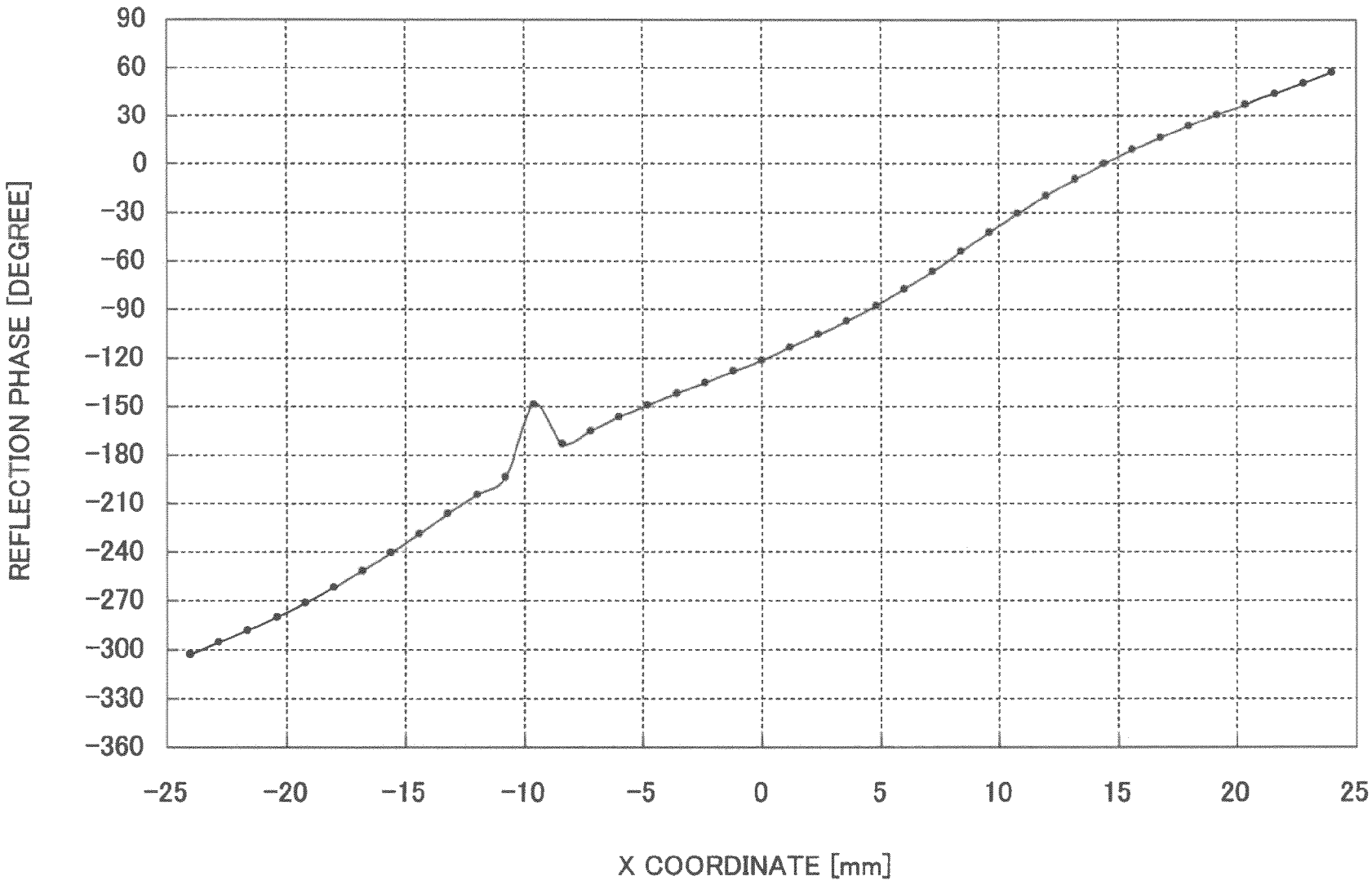
FIG. 60 is a drawing which shows a reflection phase in each element arranged in an x-axis direction.

FIG. 60 shows a value of a reflection phase by each of elements lined up in the x-axis direction. These values are values at $z=\lambda/2$ (half wavelength). In general, it is seen that a reflection phase is properly set for each element over a whole range of almost 360 degrees from −300 degrees to +60 degrees.

Figure 61:
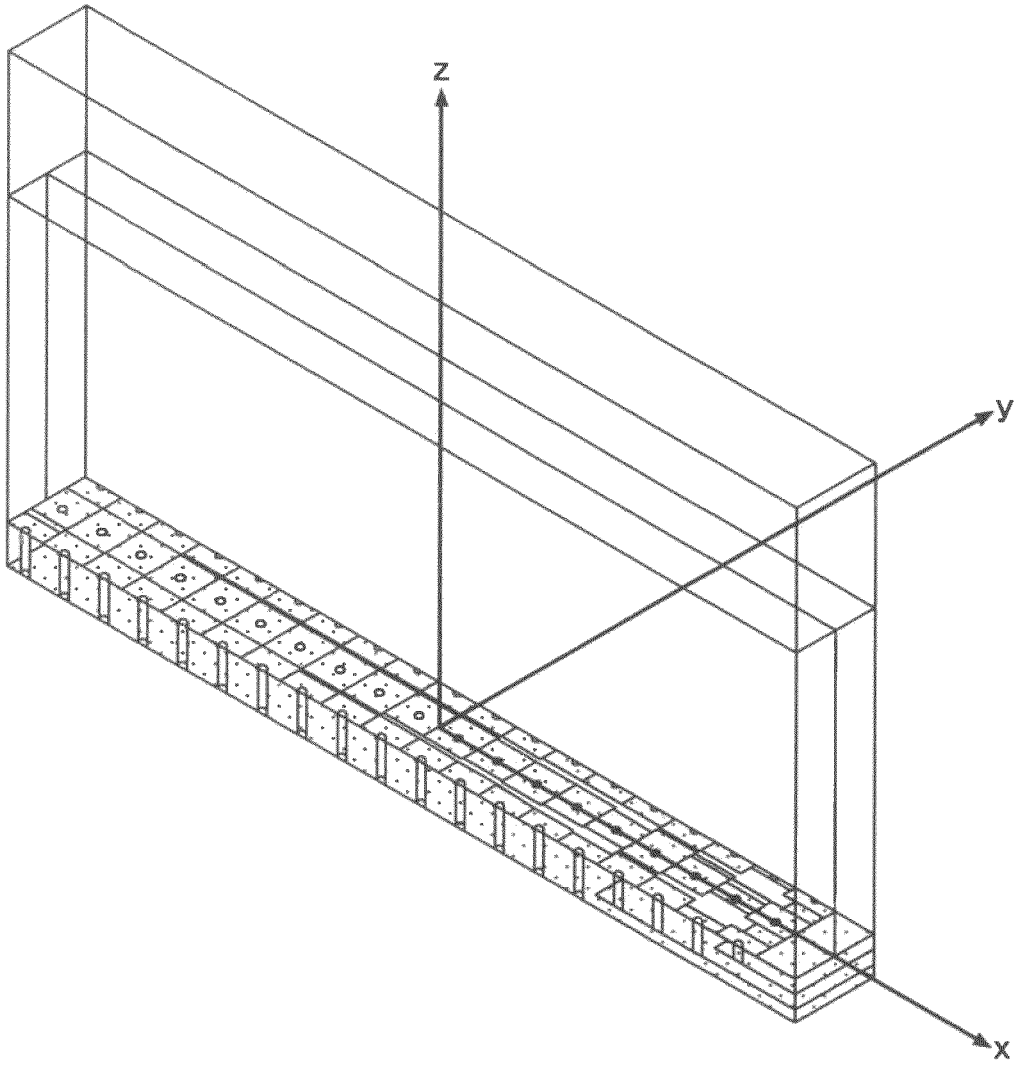
FIG. 61 is a diagram illustrating a simulation model of the reflect array in FIG. 58.

FIG. 61 shows an analytical model in a simulation, which model seen from the z-axis direction corresponds to FIG. 58.

Figure 62:
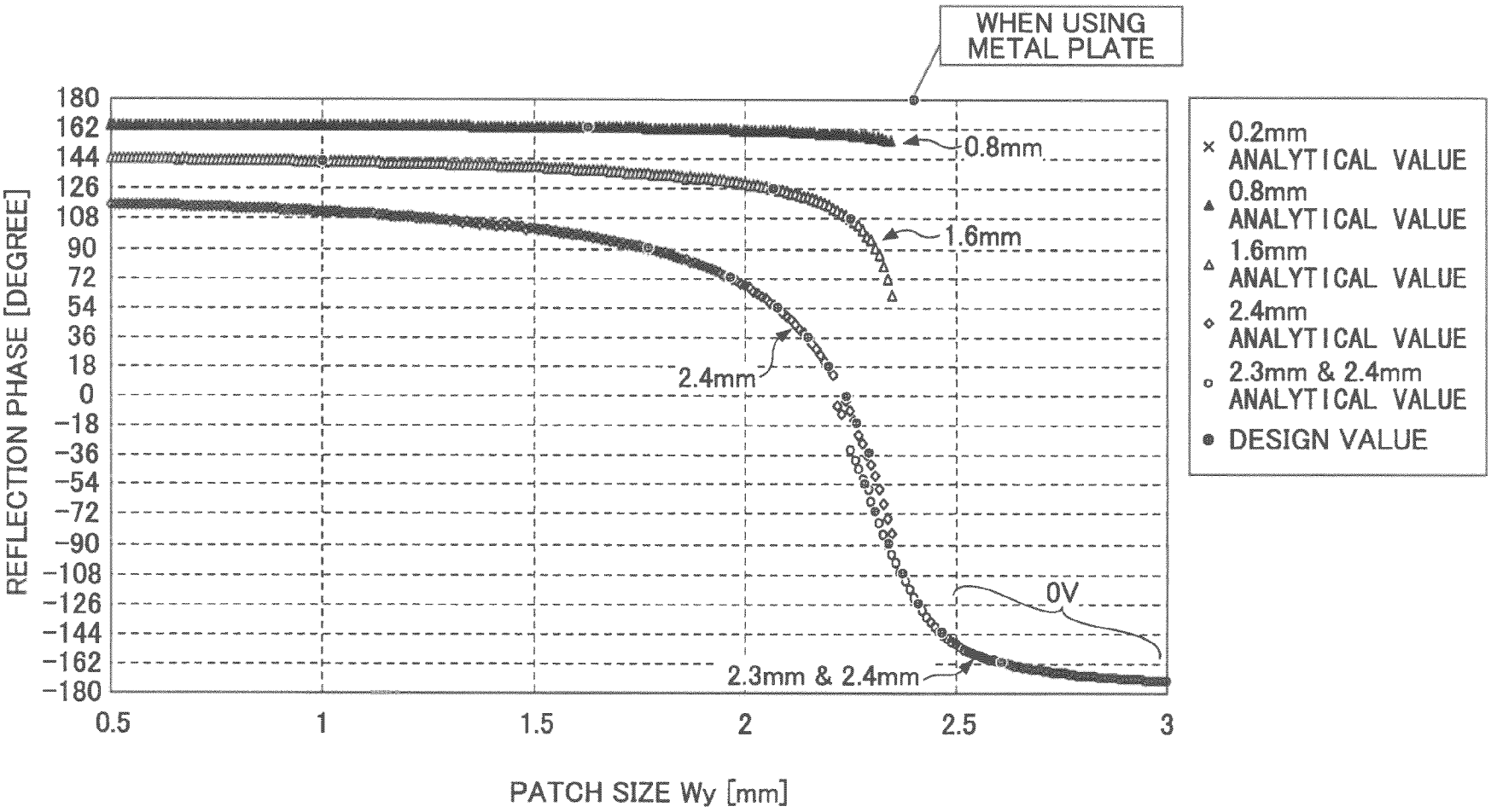
FIG. 62 is a diagram illustrating a relationship between the patch size and the reflection phase for different substrate thicknesses.

FIG. 62 shows a graph related to substrates (t=0.8 mm, 1.6 mm, 2.4 mm, 2.3 and 2.4 mm) used in a simulation model in FIGS. 58 and 61. Moreover, FIG. 62 also shows a point corresponding to a metal plate.

Figure 63:
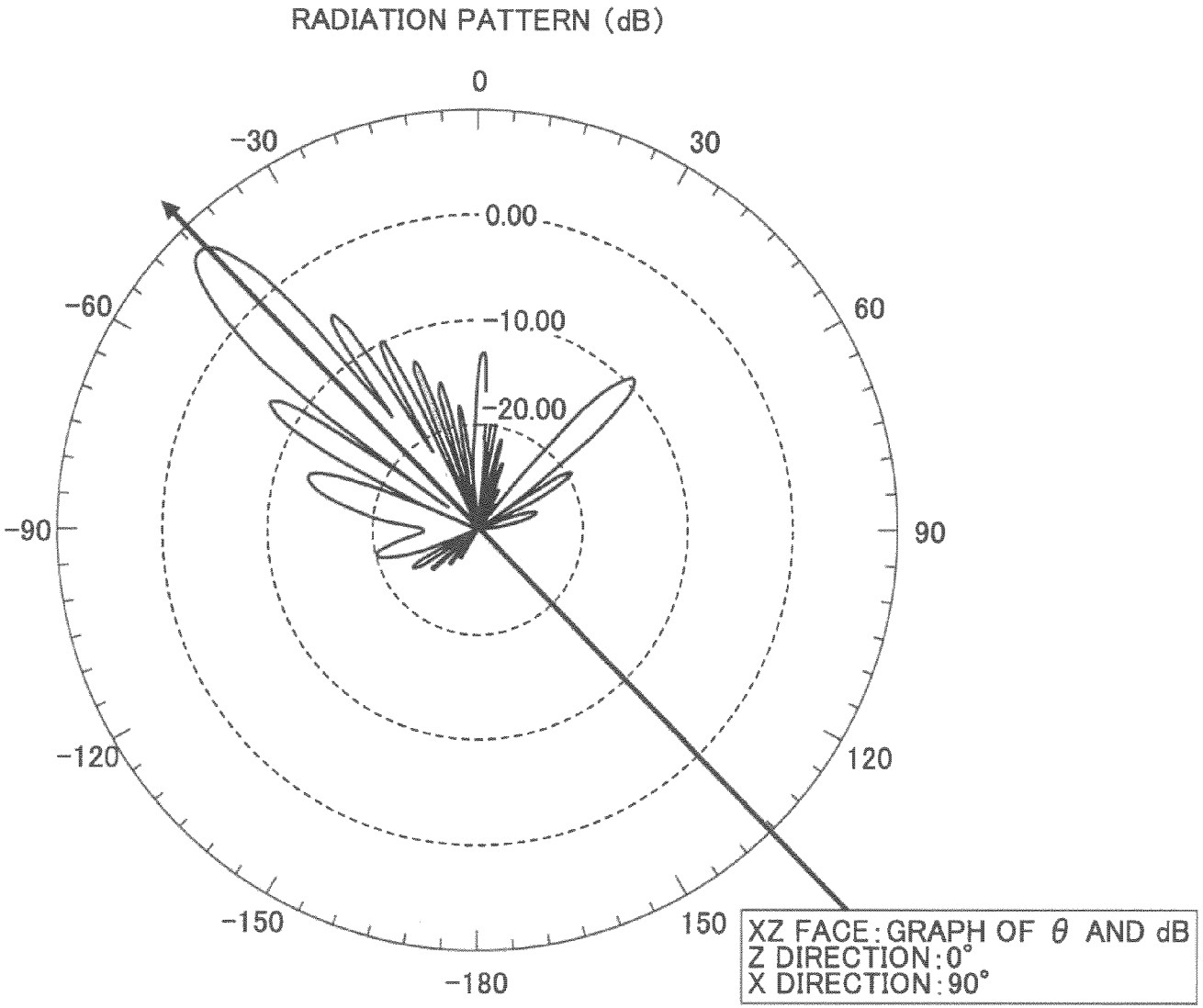
FIG. 63 is a diagram (H45) showing a far radiation field related to the reflect array in FIG. 58.

FIG. 63 shows a far radiation field of a reflect array formed as in the above. A reflect array is designed using the above-described numerical values such that it forms a reflection in a direction of −45 degrees relative to an incident wave. As shown in FIG. 63, it is seen that a reflected wave properly faces the direction of approximately −45 degrees. Moreover, it is seen that, compared with directivity in a case with only a two-layer mushroom structure (FIG. 15), radiation in a spurious direction is substantially suppressed.

Figure 64:
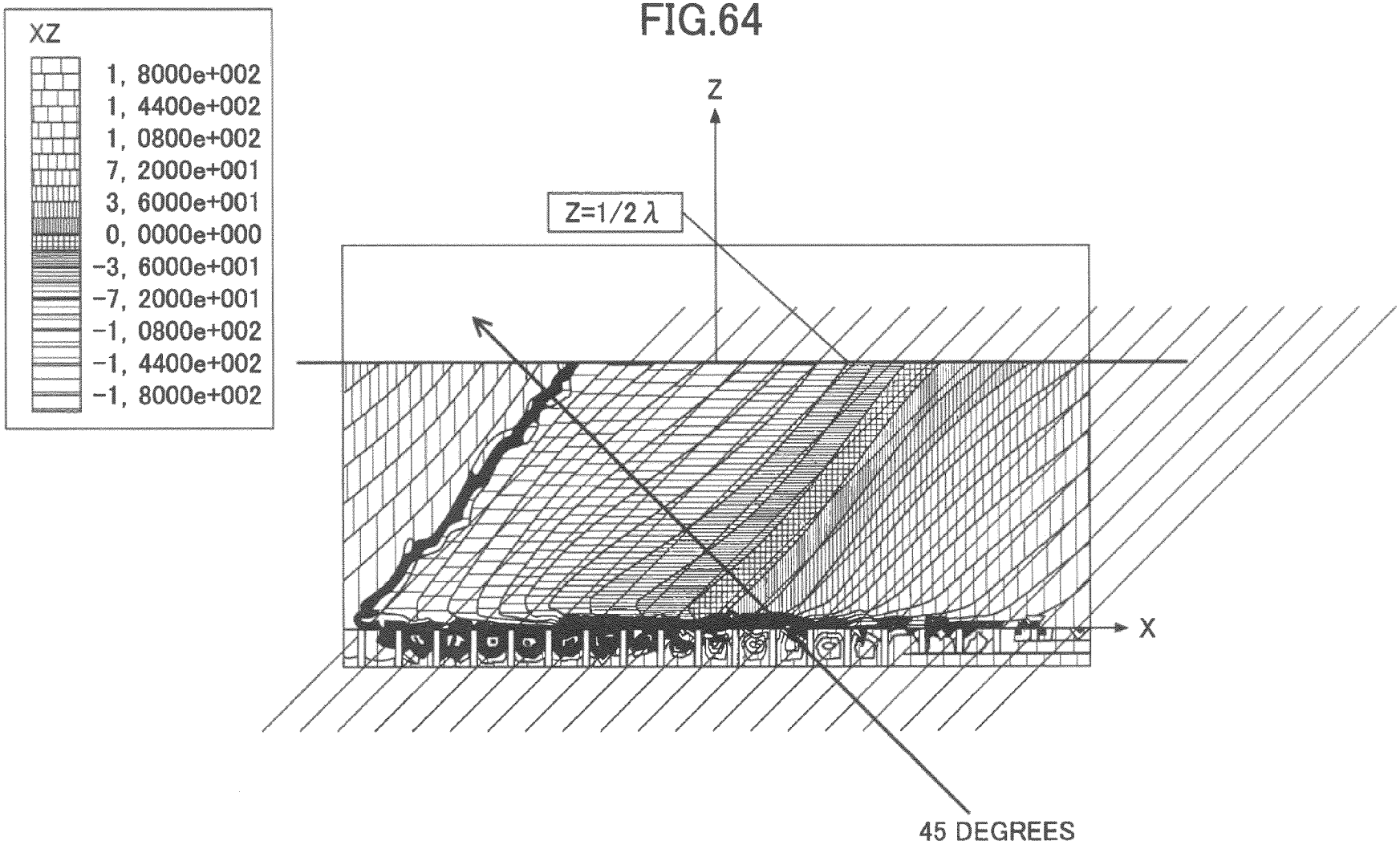
FIG. 64 is a diagram (H45) showing an iso-phase face of a wave reflected by the reflect array in FIG. 58.

FIG. 64 shows an iso-phase face of a wave reflected by a reflect array by a combination of the second and third structures. With twenty elements (mushroom structures according the second or the third structure) being lined up along the x-axis, a radio wave reflects in a direction of −45 degrees relative to the z-axis which is a direction from which the radio wave arrives. It is seen that a normal of an iso-phase face faces a −45 degree direction relative to the z-axis, in which direction a reflected, wave proceeds appropriately.

A structure of a reflect array partially shown in FIG. 58 is described in detail.

Figure 65:
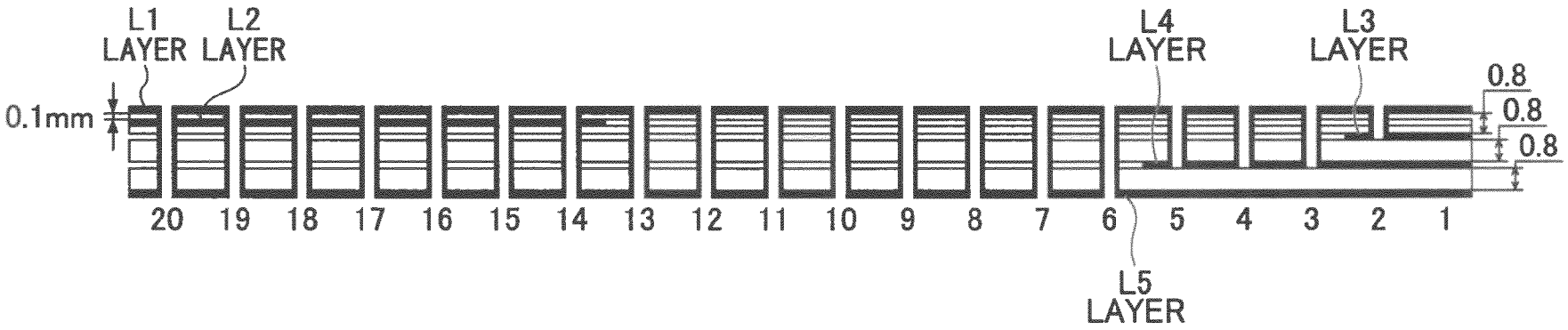
FIG. 65 is a diagram illustrating a layer structure of a reflector array which includes a region of a second structure and a region of the third structure.

FIG. 65 illustrates a layer structure of a reflect array which includes a region of the second structure and a region of the third structure. With nineteen via holes lined up in the left and right direction of the paper face, sequential numbers are affixed from the right for convenience. Each of via holes corresponds to one element (mushroom structure). Five conductive layers, which are laminated via a dielectric layer, are shown as an L1 layer, an L2 layer, an L3 layer, an L4 layer, and an L5 layer in sequence from an uppermost layer. For example, the conductive layer is formed by materials including copper, for example. The dielectric layer may be formed by an FR4 substrate or a glass epoxy resin substrate, etc. As an example, a diameter of via hole is 0.5 mm.

The first element is formed by a metal plate, not a mushroom structure. When forming the first element by a mushroom structure, it is required that a thickness of a substrate (a height of via hole) is 0.1 mm. However, a reflection phase of a mushroom structure formed using such a thin substrate is almost 180 degrees, as shown in FIG. 51, regardless of a patch size, so that the first element may be substituted with the metal plate. The second element has the L1 layer as a patch and the L3 layer as a ground plate. The third through fifth elements have the L1 layer as a patch and the L4 layer as a ground plate. The sixth through thirteenth elements have the L1 layer as a patch and the L5 layer as a ground plate. The 14th through 20th elements are according to the third structure. In this case, the L1 and L2 layers correspond to two patches with a partial overlap. The L5 layer is a ground plate in the 13th through 20th elements. As an example, a distance between the L1 and L2 layers is 0.1 mm, and a distance between the L1 and L3 layers, a distance between the L3 and L4 layers, and a distance between the L4 and L5 layers are 0.8 mm respectively. Moreover, a diameter of via is 0.5 mm.

Figure 66:
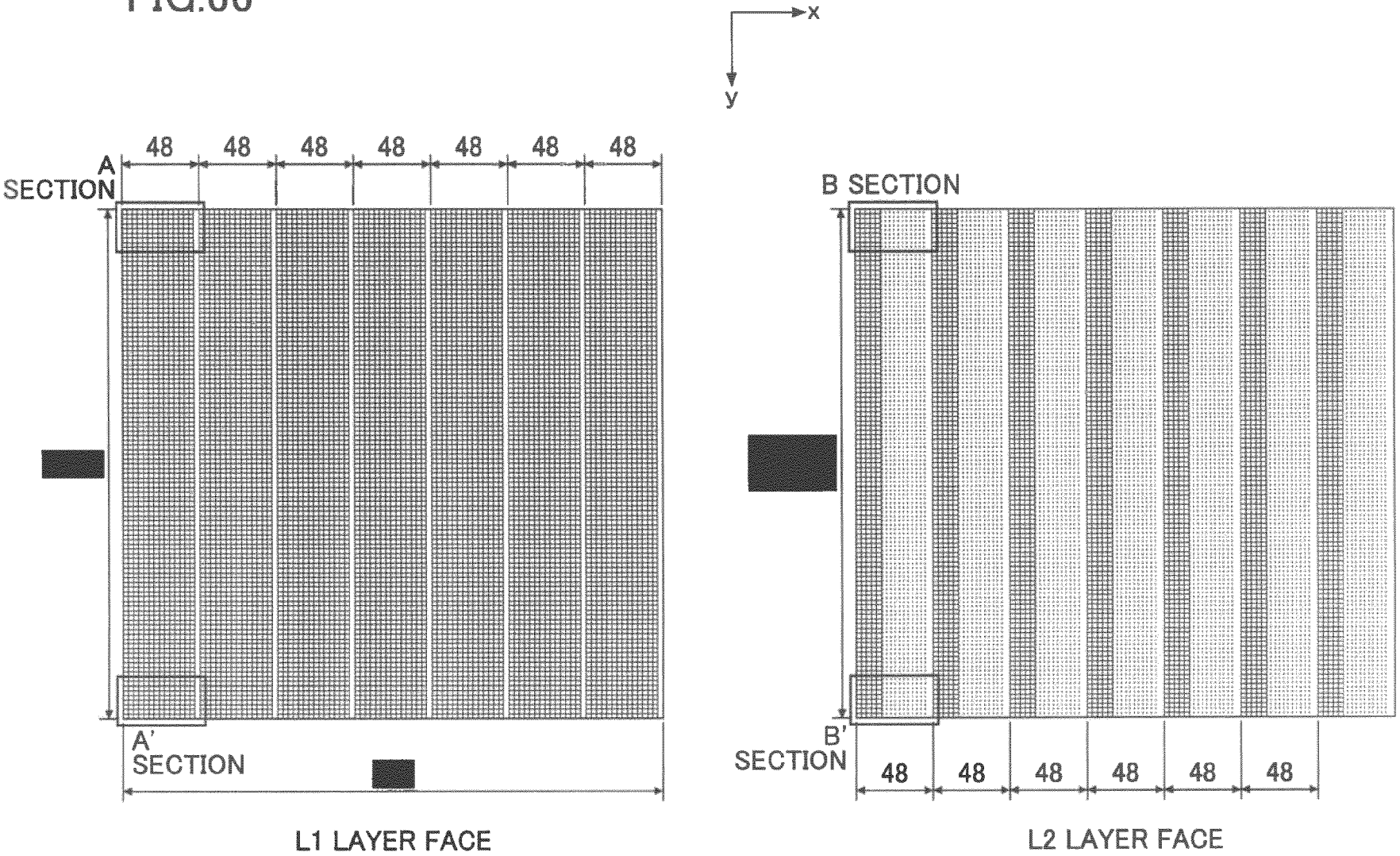
FIG. 66 is a plane view schematically illustrating the L1 and L2 layers.
Figure 67:
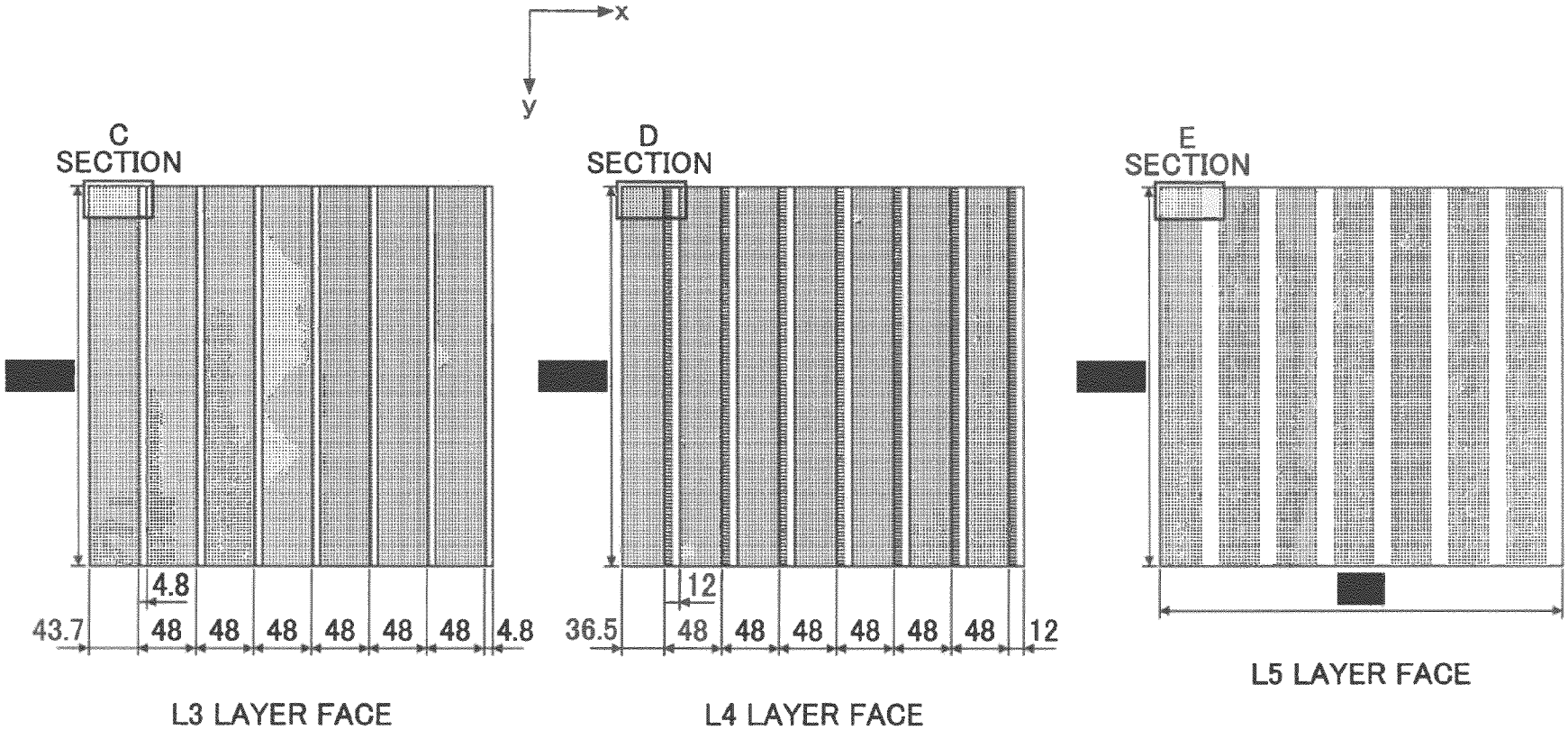
FIG. 67 is a plane view schematically illustrating the L3, L4 and L5 layers.

FIG. 66 schematically illustrates a plane view of the L1 and L2 layers. FIG. 67 schematically illustrates a plane view of L3, L4, and L5 layers. Elements, one of which is formed with mushroom structures as shown in FIG. 24, are arranged in a matrix form. In an illustrated example, one of bands of 7 columns extending in the y-axis direction includes 20×130 elements. Numbers shown is an example of a dimension (millimeter), and a gap between elements is 2.4 mm. The reflect array illustrated is designed such that it reflects, to an x-axis direction (horizontal direction) at a degree angle relative to an incident direction, a polarized wave with an electric field in the y-axis direction and such that the reflection phase difference between neighboring elements is 18 degrees. In other words, one band (column) extending in the y-axis direction is designed such that the reflection phase changes by 2π between both ends of the x-axis direction. Such a band or column may be lined up repeatedly in multiple numbers to realize a larger-sized reflect array. In FIGS. 66 through 73, specific dimensional details are omitted as they are not essential to the present invention.

Figure 68:
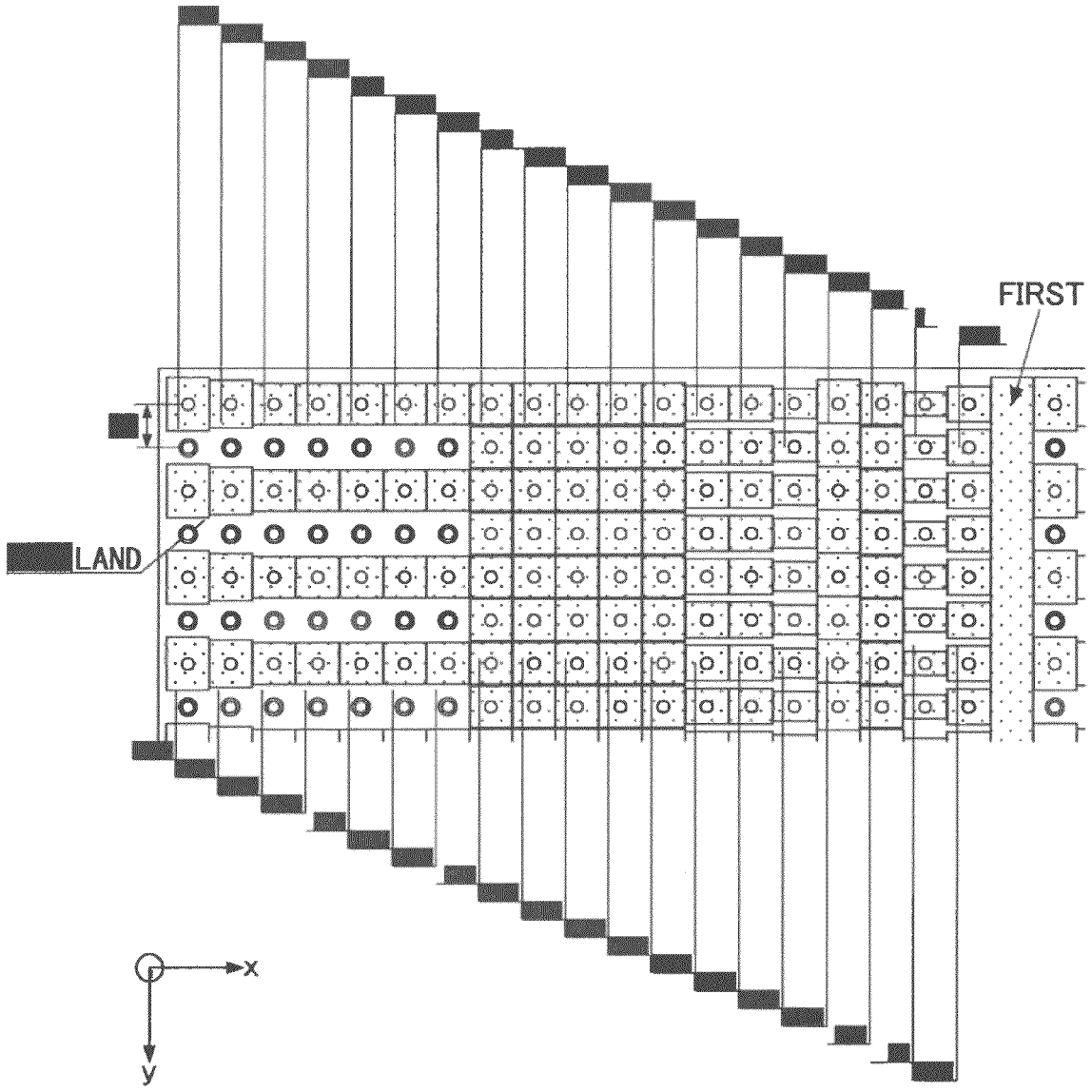
FIG. 68 is a diagram detailing a region shown as "A section" in the L1 layer.

FIG. 68 shows in detail a region (a part of a band or a column) shown as "A section" in the L1 layer in FIG. 66. With respect to one row (x-axis direction), parts corresponding to twenty elements are shown. Of parts corresponding to twenty elements, each one of rectangles of a part corresponding to the second or the twentieth element corresponds to a patch 123 (FIG. 24) having sizes of Wx and Wy. The first element (right-hand side) is substituted with a metal plate. Each of these elements lined up in the x-axis direction has a certain phase difference (18 degrees=360 degrees/20) with a neighboring element. A numerical value of a patch size shown corresponds to what is shown in FIG. 59.

Figure 69:
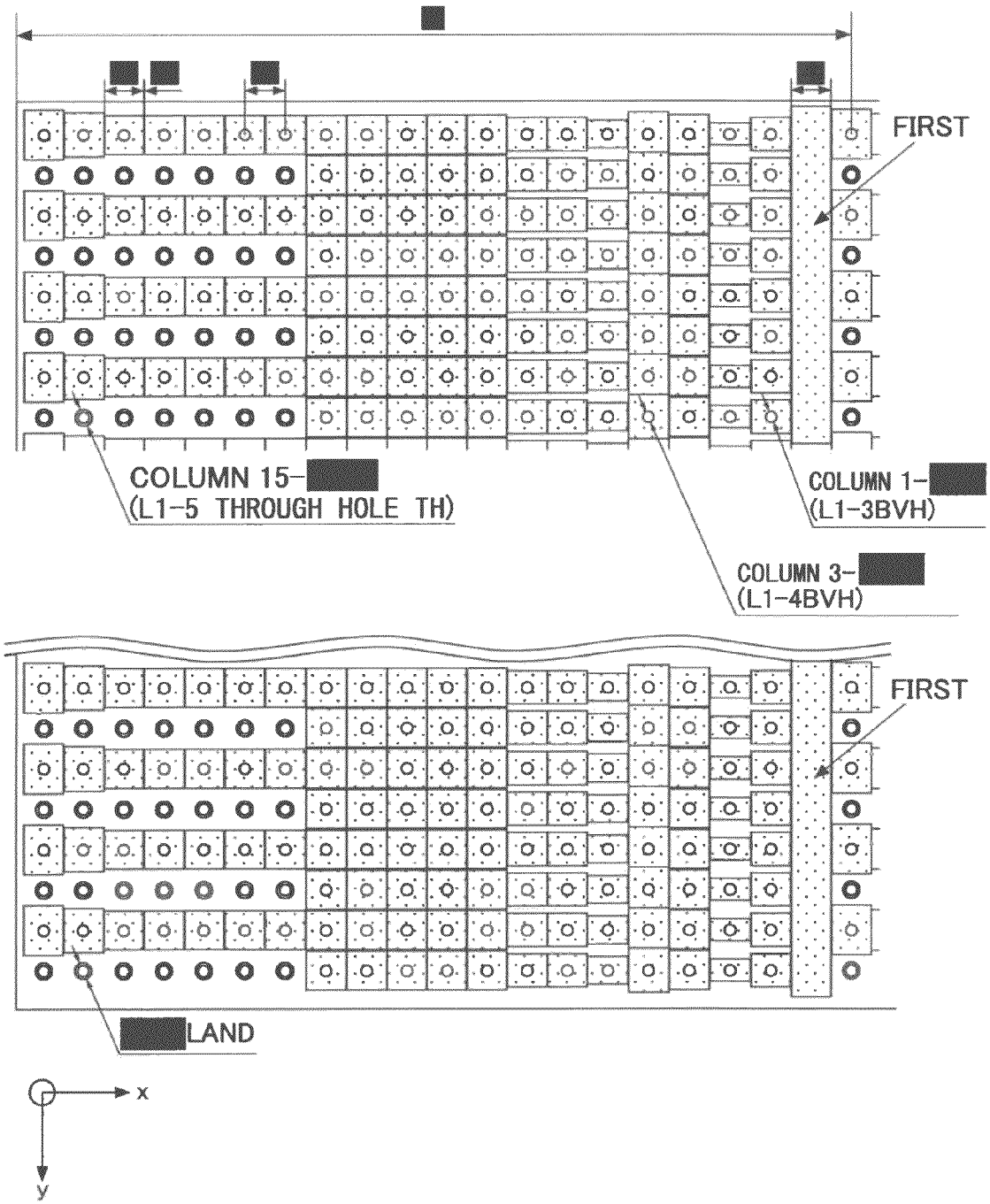
FIG. 69 is a diagram detailing regions shown as "A section" and "A' section" in the L1 layer.

FIG. 69 shows in detail a region (a part of a band or a column) shown as "A section" and "A' section" in the L1 layer in FIG. 66.

Figure 70:
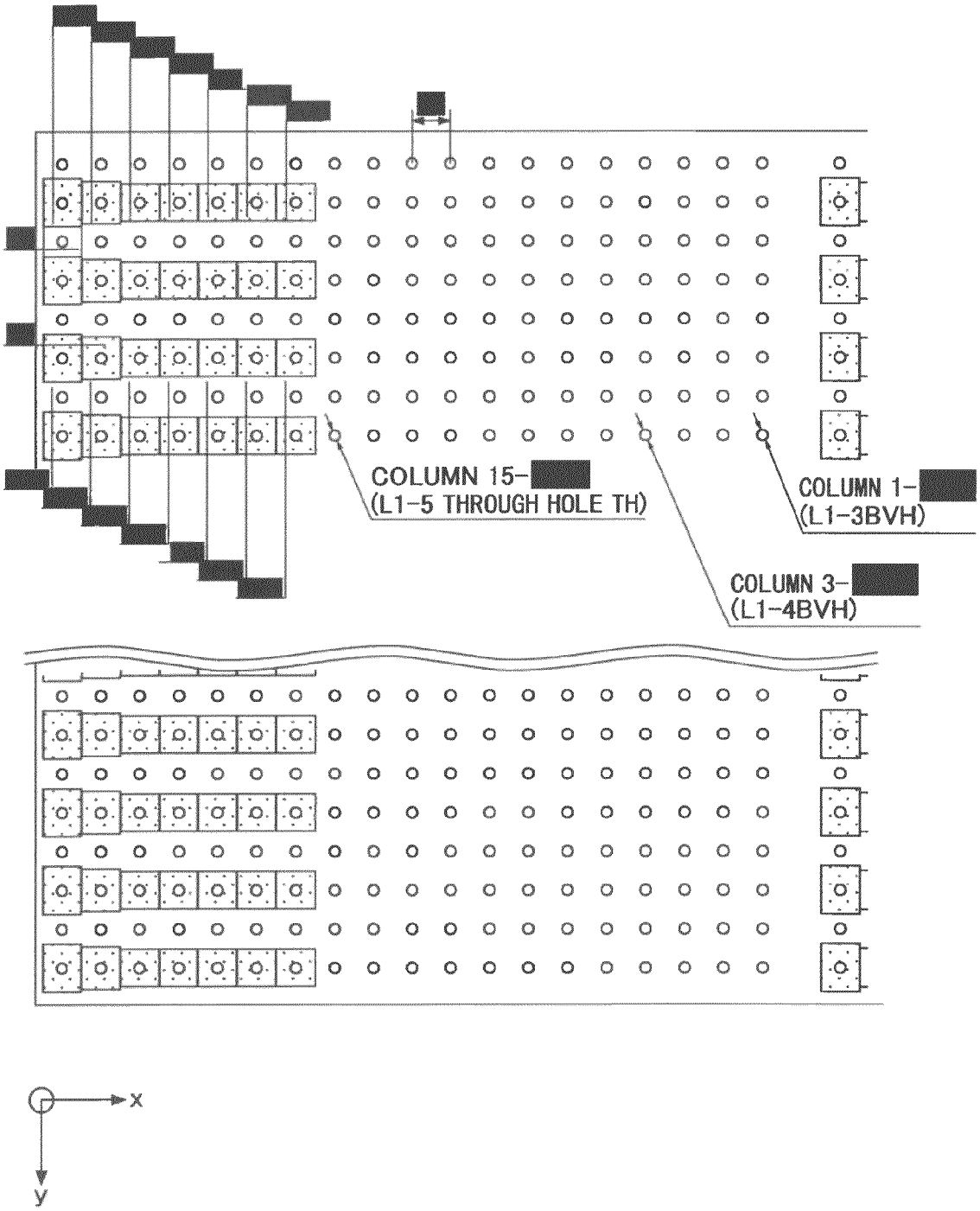
FIG. 70 is a diagram detailing regions shown as "B section" and "B' section" in the L2 layer.

FIG. 70 shows in detail a region (a part of a band or a column) shown as "B section" and "B' section" in the L2 layer in FIG. 66. Focusing on one row along the x-axis direction, seven patches from the left are lined up. These correspond to patches in the L2 layer that overlap patches in the L1 layer in the third structure in which overlap between patches are allowed.

Figure 71:
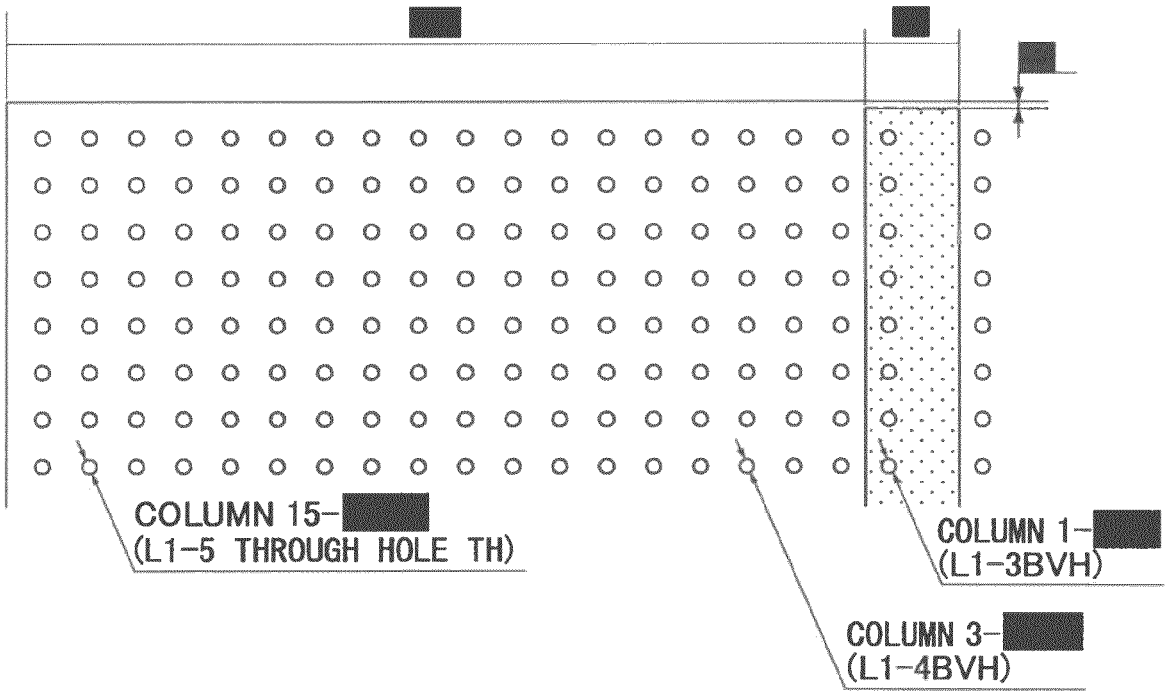
FIG. 71 is a diagram detailing a region shown as "C section" in the L3 layer.

FIG. 71 shows in detail a region (a part of a band or a column) shown as "C section" in the L3 layer in FIG. 67. As shown in FIG. 65, the L3 layer provides a ground plate for the first and second elements. This ground plate is shown on the right hand side of FIG. 71.

Figure 72:
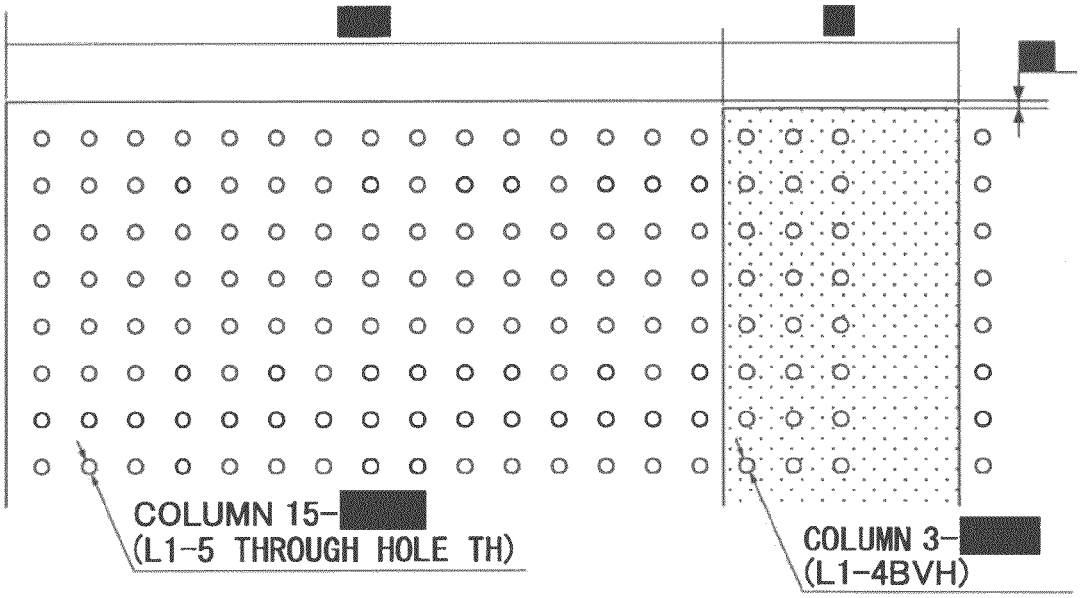
FIG. 72 is a diagram detailing a region shown as "D section" in the L4 layer.

FIG. 72 shows in detail a region (a part of a band or a column) shown as "D section" in the L4 layer in FIG. 67. As shown in FIG. 65, the L4 layer provides a ground plate for the third through fifth elements. This ground plate is shown on the right hand side of FIG. 72.

Figure 73:
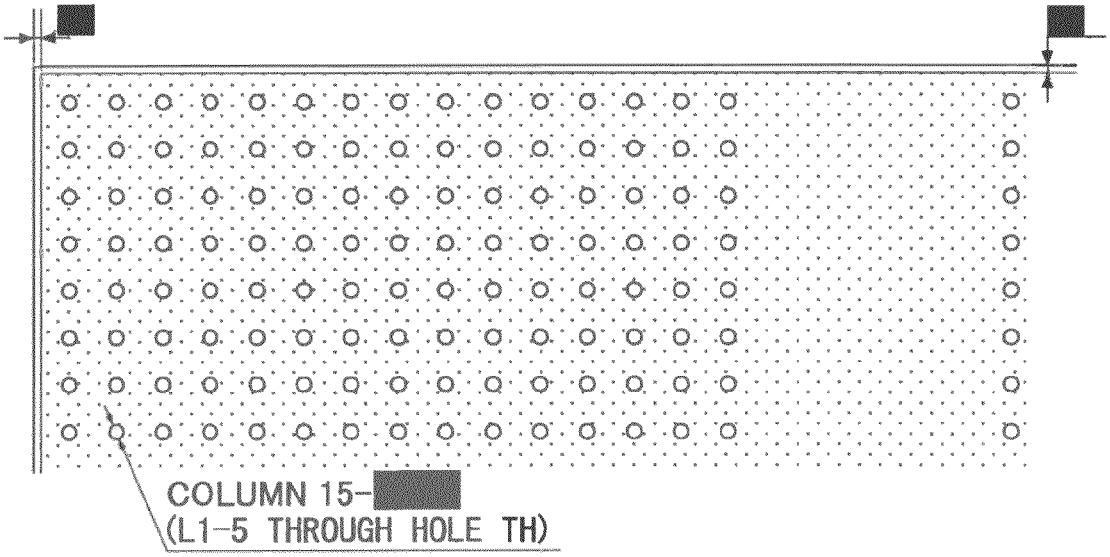
FIG. 73 is a diagram detailing a region shown as "E section" in the L5 layer.

FIG. 73 shows in detail a region (a part of a band or a column) shown as "E section" in the L5 layer in FIG. 67. As shown in FIG. 65, the L5 layer provides a ground plate for the sixth through 20th elements. This ground plate is shown in FIG. 73.

7.4 Horizontal Control at 45 Degrees (Part 2)

Figure 74:
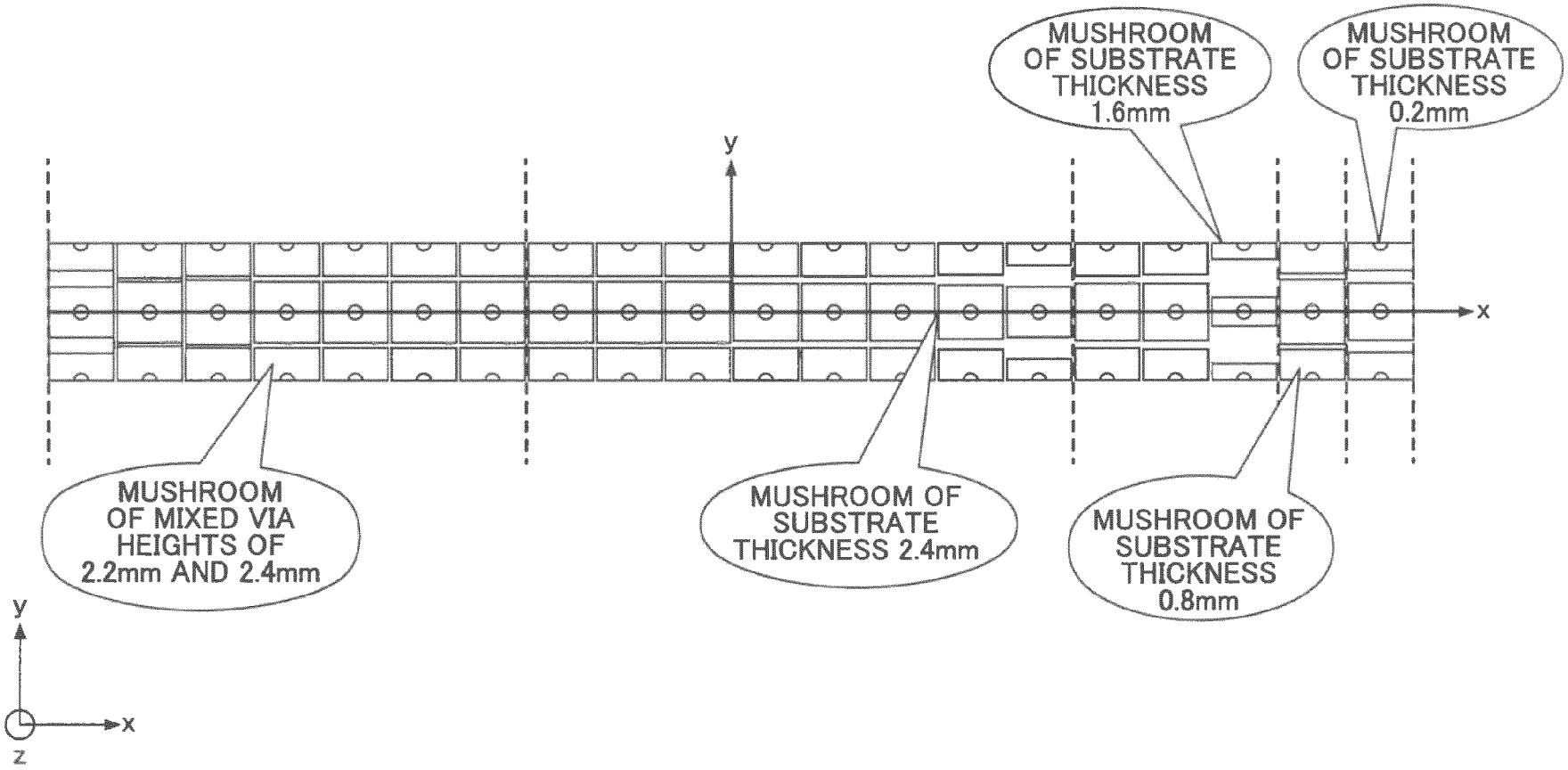
FIG. 74 is a second part of the plane view of the reflect array in which the second and third structures are combined.

Similar to FIG. 58, FIG. 74 also shows an exemplary configuration of a reflect array including a combination of the second and third structures. Primary differences are that heights of vias in the third structure on the left-hand side shown is a combination of 2.4 mm and 2.2 mm and that a substrate with a thickness of 0.2 mm, not a metal plate, is used in a second structure on the right-hand side. Consequently, as shown in FIG. 75, dimensions of each element differ by little from what is shown in FIG. 59.

Figure 76:
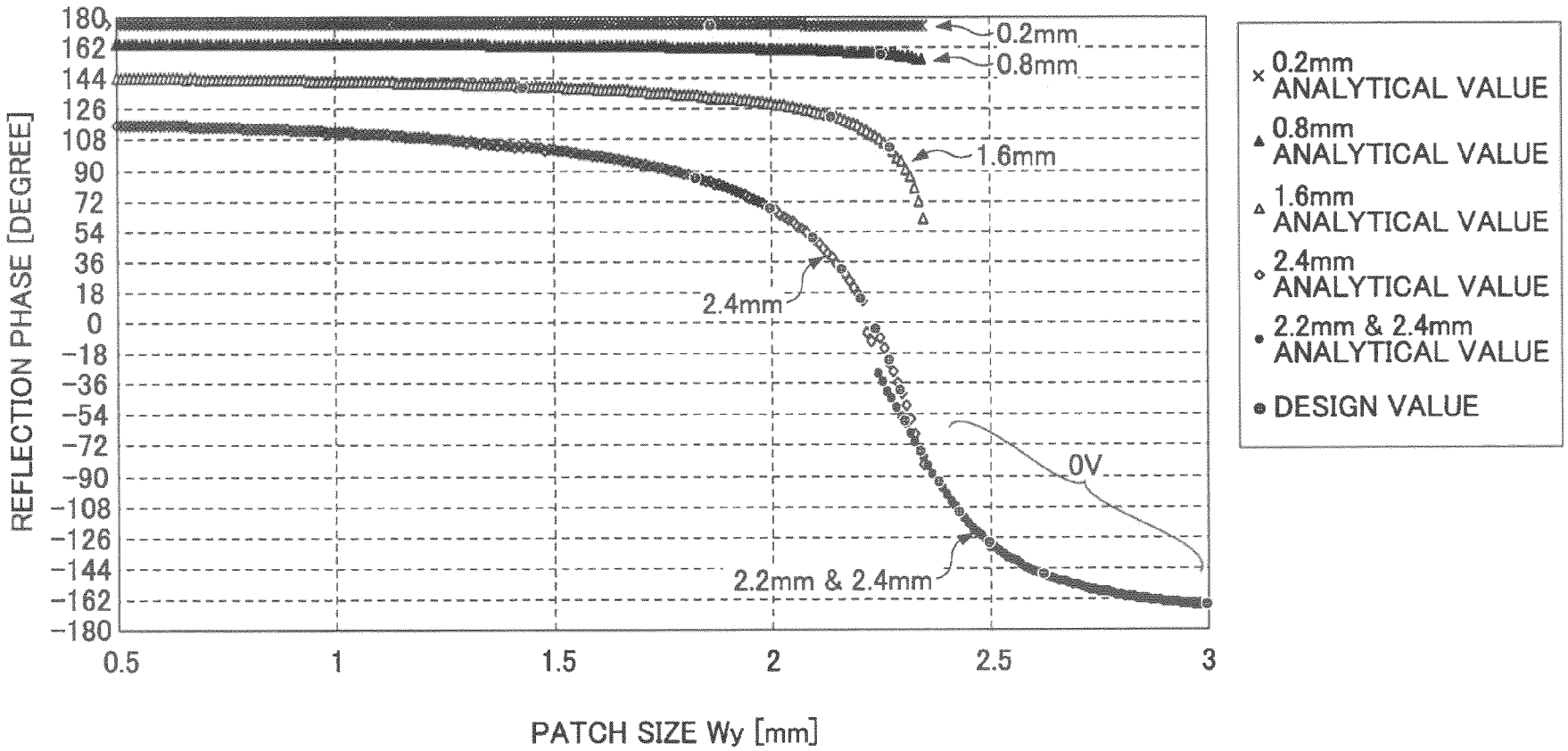
FIG. 76 is a diagram illustrating a relationship between the patch size and the reflection phase for different substrate thicknesses.

FIG. 76 shows a graph related to substrates (t=0.8 mm, 1.6 mm, 2.4 mm, 2.2 and 2.4 mm) used in a simulation model in FIG. 74, out of graphs shown in FIG. 56.

Figure 77:
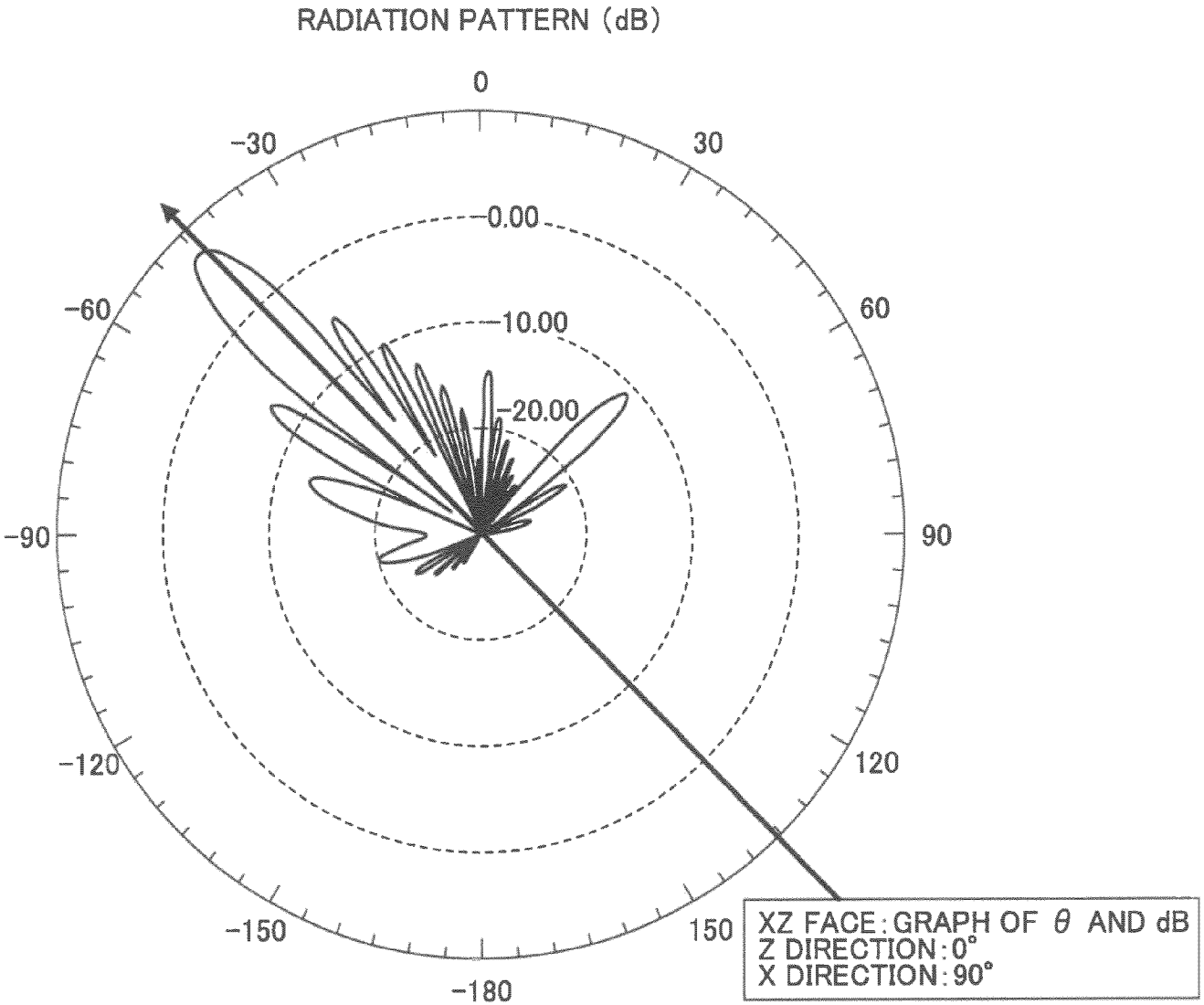
FIG. 77 is a diagram (H45) showing a far radiation field related to the reflect array in FIG. 74.

FIG. 77 shows a far radiation field of a reflect array formed as in the above. The reflect array is designed using the above-described numerical values such that it forms a reflection in a direction of −45 degrees relative to an incident wave. As shown in FIG. 77, it is seen that a reflected wave properly faces the direction of approximately −45 degrees. Moreover, it is seen that, compared with directivity in a case with only a two-layer mushroom structure (FIG. 15), radiation in a spurious direction is substantially suppressed.

Figure 78:
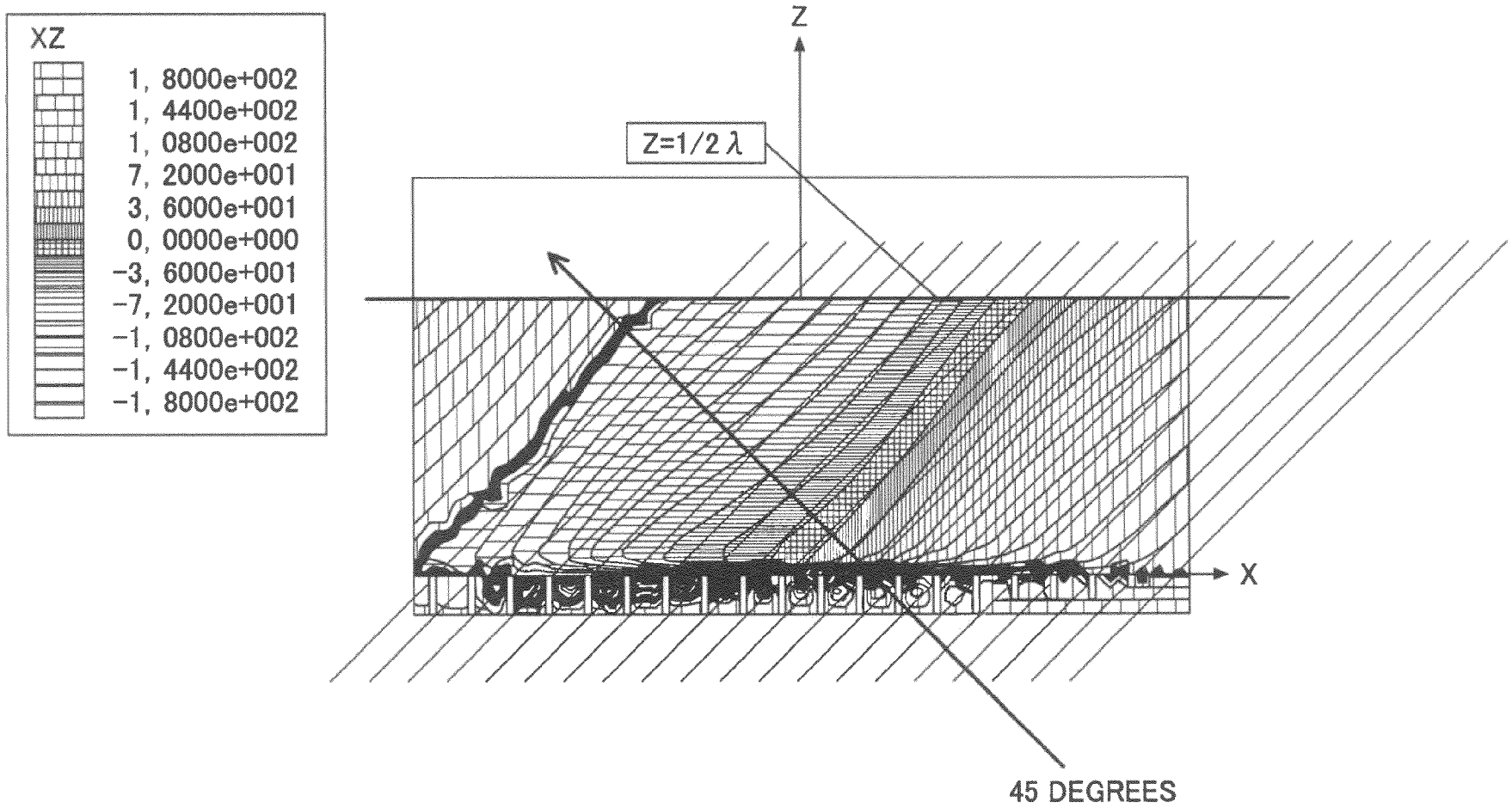
FIG. 78 is a diagram (H45) showing an iso-phase face of a reflected wave by the reflect array in FIG. 74.

FIG. 78 shows an iso-phase face of a wave reflected by a reflect array by a combination of the second and third structures. With twenty elements (mushroom structures according to the second or the third structure) being lined up along the x-axis, a radio wave reflects in a direction of −45 degrees relative to the z-axis which is a direction from which the radio wave arrives. It is seen that a normal of an iso-phase face faces a −45 degree direction relative to the z-axis, in which direction a reflected wave proceeds appropriately.

A structure of a reflect array partially shown in FIG. 74 is described in detail.

Figure 79:
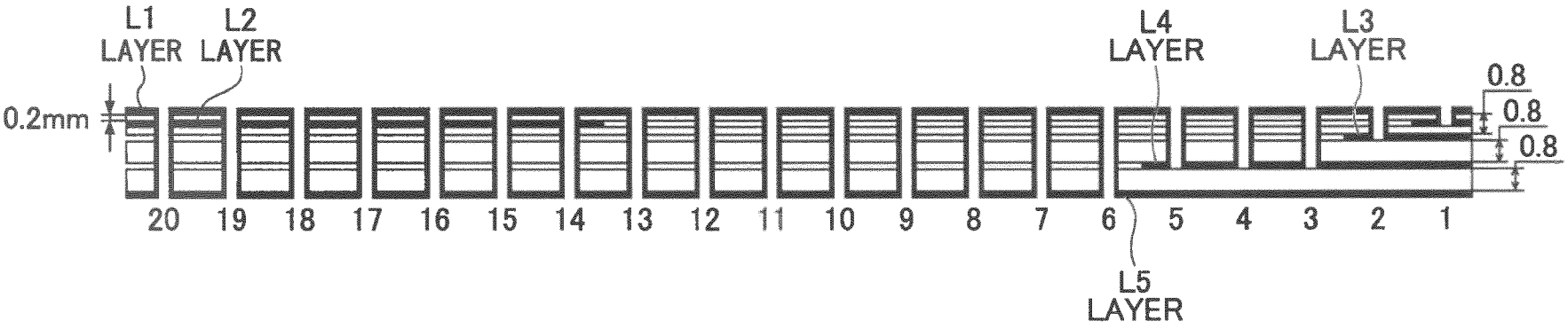
FIG. 79 is a diagram illustrating a layer structure of a reflect array which includes a region of the second structure and a region of the third structure.

FIG. 79 illustrates a layer structure of a reflect array which includes a region of the second structure and a region of the third structure. In general, as for FIG. 65, primary difference are that the first element is provided as a mushroom structure, and the L1 and L2 layers are common between the first element, and the 14th through the 20th elements, and a distance between the L1 and L2 layers is 0.2 mm.

The first element has the L1 layer as a patch and the L2 layer as a ground plate. The second element has the L1 layer as a patch and the L3 layer as a ground plate. The third through fifth elements have the L1 layer as a patch and the L4 layer as a ground plate. The sixth through thirteenth elements have the L1 layer as a patch and the L5 layer as a ground plate. The 14th through 20th elements are according to the third structure. In this case, the L1 and L2 layers correspond to two patches with a partial overlap. The L5 layer is a ground plate in the 13th through 20th elements. As an example, a distance between the L1 and L2 layers is 0.2 mm, and a distance between the L1 and L3 layers, a distance between the L3 and L4 layers, and a distance between the L4 and L5 layers are 0.8 mm respectively. Moreover, a diameter of via is 0.5 mm.

As described above, the L1 and L2 layers are common in the first element and in the 14th to 20th elements. This means that the L1 layer in the first element and the L1 layer in the 14th through the 20th elements are formed on the same substrate. Moreover, the L2 layer in the first element and the L2 layer in the 14th through the 20th elements may be formed on the same substrate. In this way, a reflect array structure may be simplified and a manufacturing process may be simplified, etc. While the L1 and L2 layers are common in both structures in the example shown, (if possible) any layer of the L1 through L5 layers may be in common in the second and third structures. In this way, in combining different structures, making at least one of multiple conductive layers common may be done not only between the second and third structures, but also between other structures. For example, in a structure combining the first and second structures, and a structure combining the first and third structures, at least one out of the L1 through L5 layers may be common.

Figure 80:
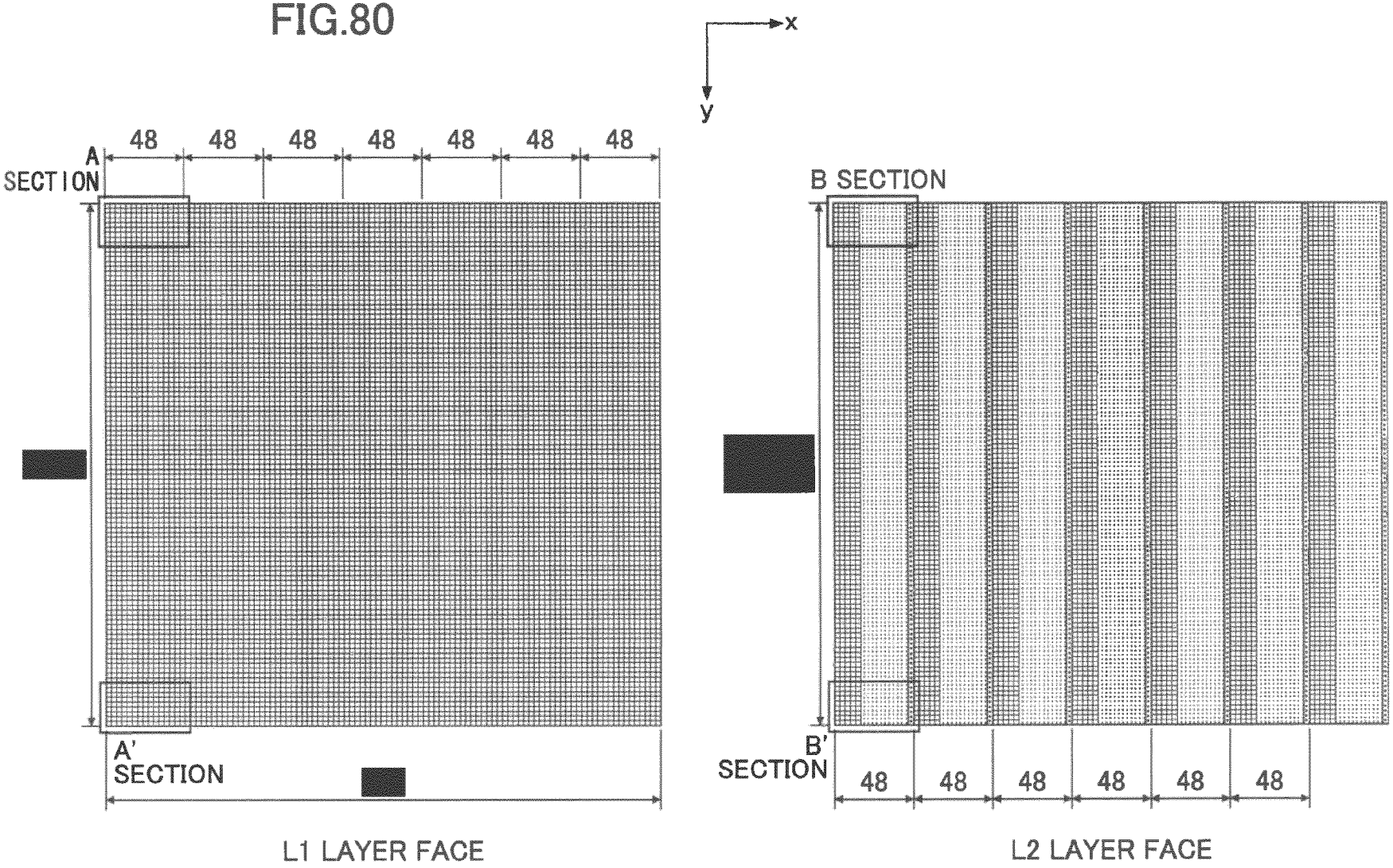
FIG. 80 is a plane view schematically illustrating the L1 and L2 layers.
Figure 81:
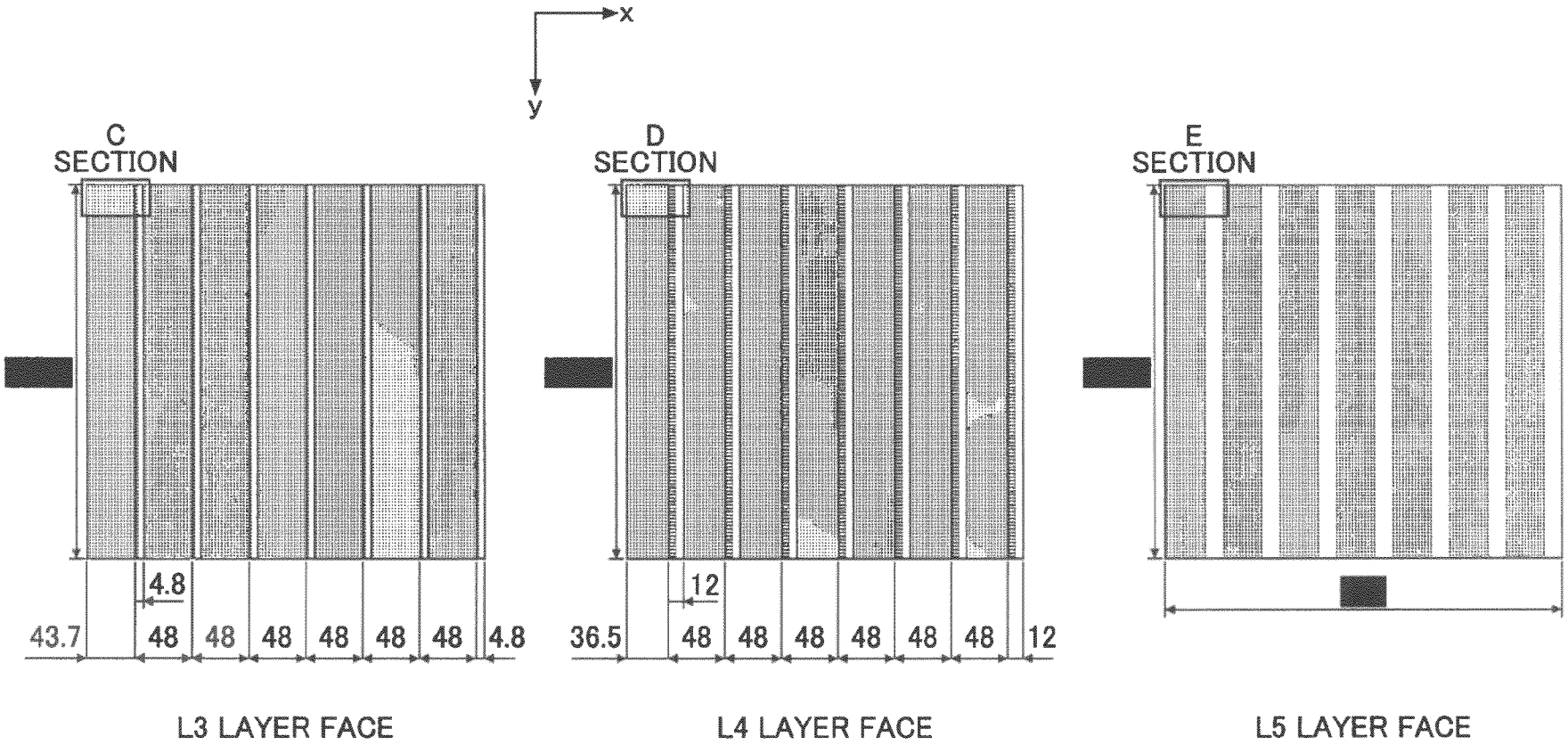
FIG. 81 is a plane view schematically illustrating the L3, L4 and L5 layers.

FIG. 80 schematically illustrates a plane view of the L1 and L2 layers. FIG. 81 schematically illustrates a plane view of the L3, L4, and L5 layers. Elements, one of which is formed with mushroom structures as shown in FIG. 24, are arranged in a matrix form. In an illustrated example, one of bands of 7 columns extending in the y-axis direction includes 20×130 elements. Numbers shown is an example of a dimension (millimeter), and a gap between elements is 2.4 mm. The reflect array illustrated is designed such that it reflects, to the x-axis direction (the vertical direction) at a 45 degree angle relative to an incident direction, a polarized wave with an electric field in the x-axis direction and such that the reflection phase difference between neighboring elements is 18 degrees. In other words, gaps between 20 elements (2.4 mm×20) extending in the Y direction are designed such that the reflection phase change by 2π between both ends of a gap of 20 elements. Such a band or column may be lined up repeatedly in multiple numbers to realize a larger-sized reflect array. In FIGS. 80 through 87, specific dimensional details are omitted as they are not essential to the present invention.

Figure 82:
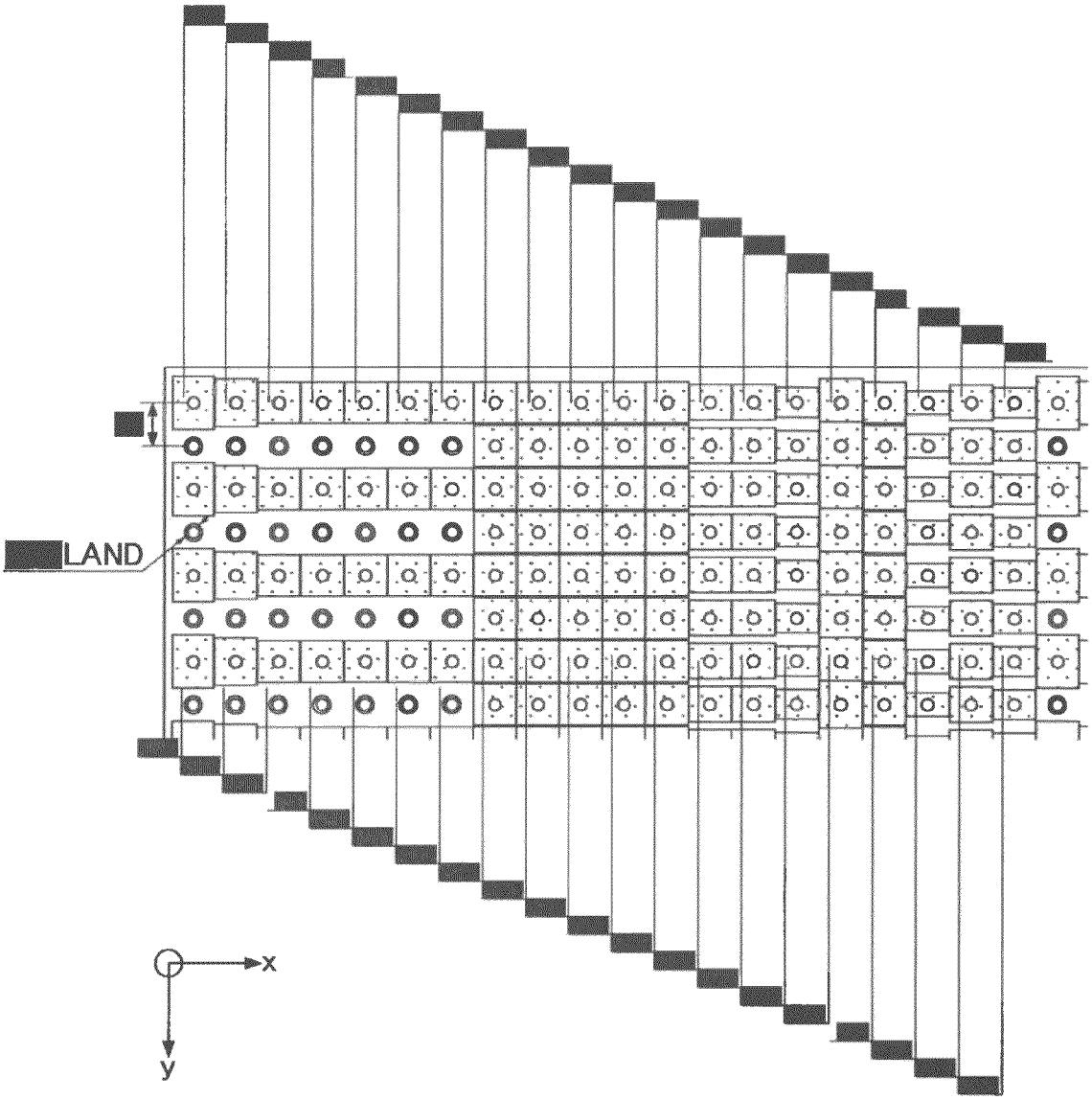
FIG. 82 is a diagram detailing a region shown as "A section" in the L1 layer.

FIG. 82 shows in detail a region (a part of a band or a column) shown as "A section" in the L1 layer in FIG. 80. With respect to one row (x-axis direction), parts corresponding to twenty elements are shown. Each one of rectangles included in parts corresponding to twenty elements corresponds to a patch 123 (FIG. 24) having a size of Wx and Wy. Each of these elements has a certain phase difference (18 degrees=360 degrees/20) with a neighboring element. A numerical value of a patch size shown corresponds to what is shown in FIG. 75.

Figure 83:
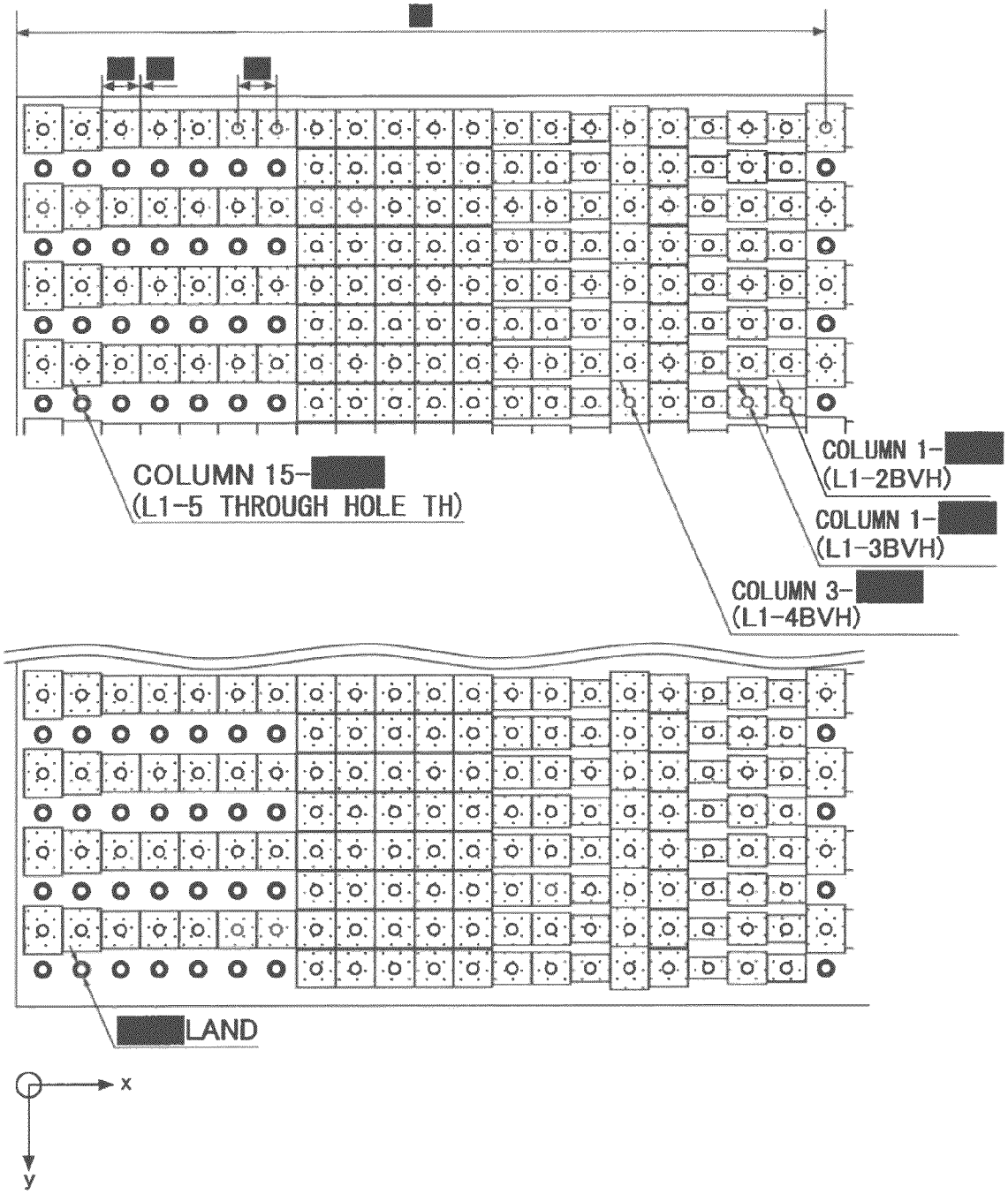
FIG. 83 is a diagram detailing regions shown as "A section" and "A' section" in the L1 layer.

FIG. 83 shows in detail a region (a part of a band or a column) shown as "A section" and "A' section" in the L1 layer in FIG. 80.

Figure 84:
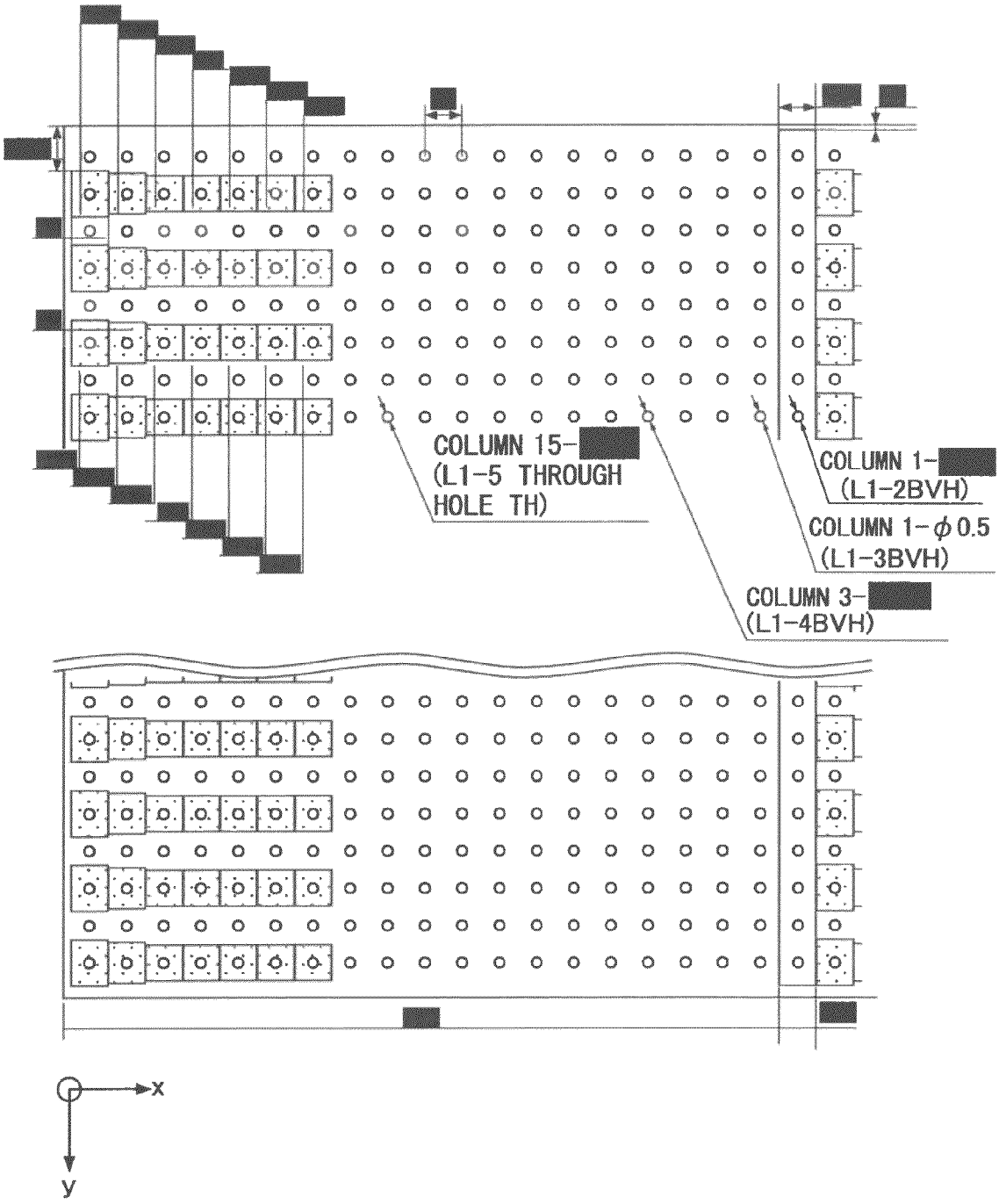
FIG. 84 is a diagram detailing regions shown as "B section" and "B' section" in the L2 layer.

FIG. 84 shows in detail a region (a part of a band or a column) shown as "B section" and "B' section" in the L2 layer in FIG. 80. Focusing on one row along the x-axis direction, seven patches from the left are lined up. These correspond to patches in the L2 layer that overlap patches in the L1 layer in the third structure in which overlap between patches are allowed.

Figure 85:
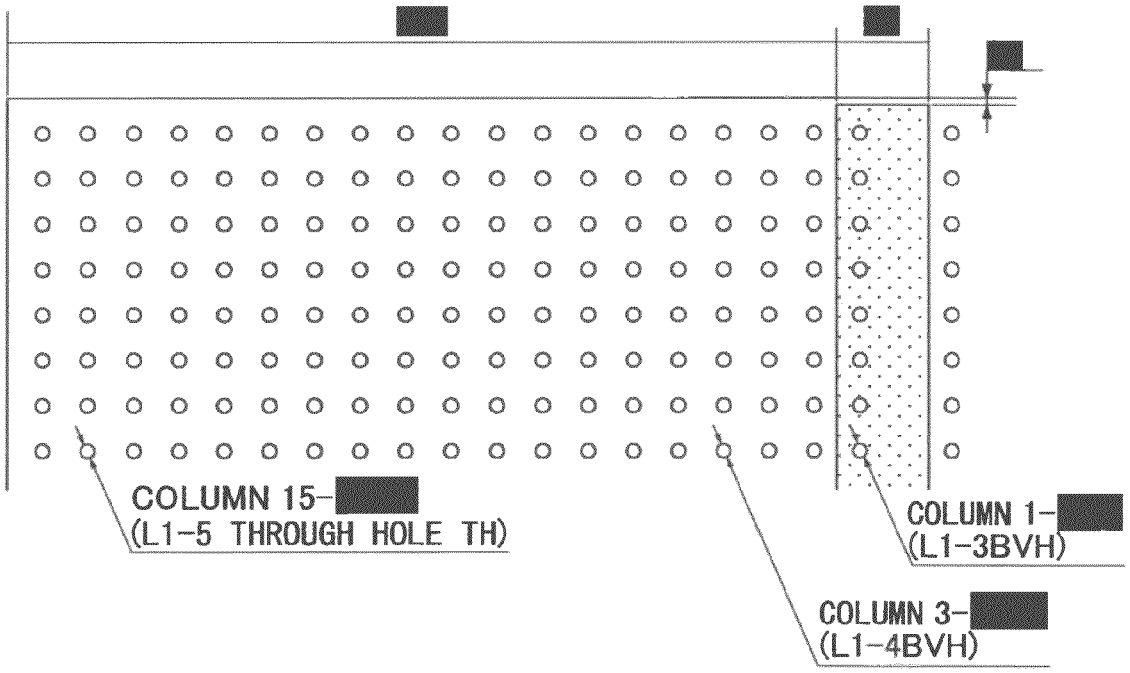
FIG. 85 is a diagram detailing a region shown as "C section" in the L3 layer.

FIG. 85 shows in detail a region (a part of a band or a column) shown as "C section" in the L3 layer in FIG. 81. As shown in FIG. 79, the L3 layer provides a ground plate for the first and second elements. This ground plate is shown on the right hand side in FIG. 85.

Figure 86:
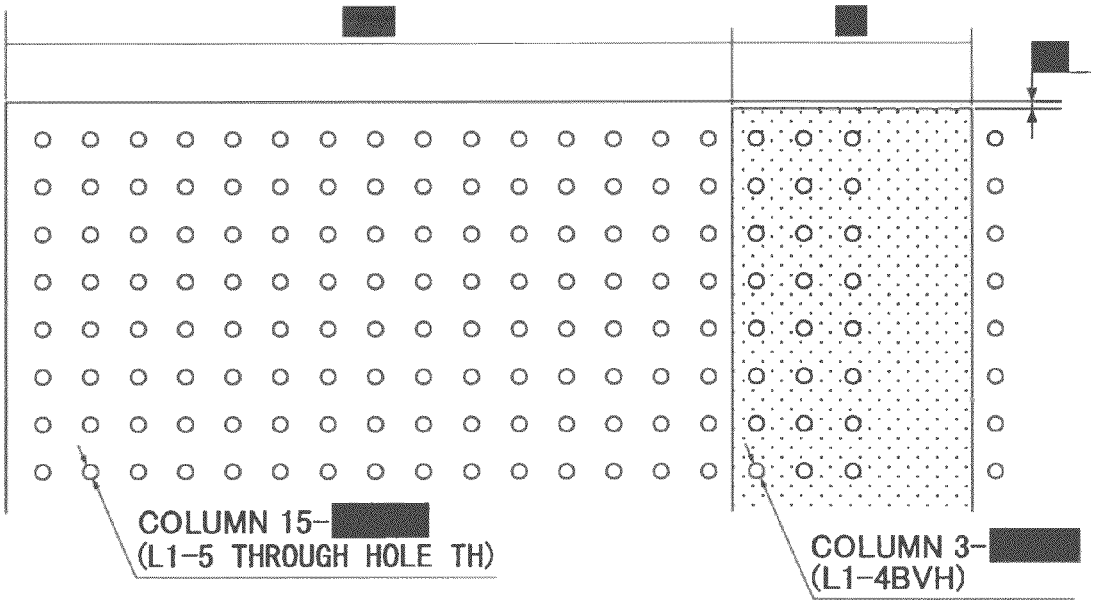
FIG. 86 is a diagram detailing a region shown as "D section" in the L4 layer.

FIG. 86 shows in detail a region (a part of a band or a column) shown as "D section" in the L4 layer in FIG. 81. As shown in FIG. 79, the L4 layer provides a ground plate for the third through fifth elements. This ground plate is shown on the right hand side in FIG. 86.

Figure 87:
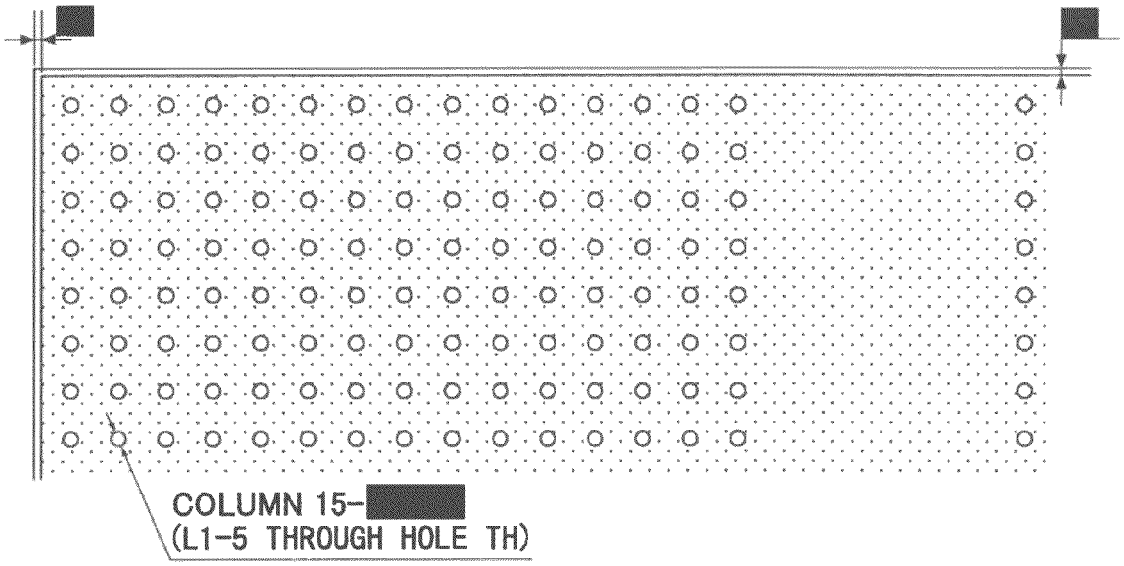
FIG. 87 is a diagram detailing a region shown as "E section" in the L5 layer.

FIG. 87 shows in detail a region (a part of a band or a column) shown as "E section" in the L5 layer in FIG. 81. As shown in FIG. 79, the L5 layer provides a ground plate for the sixth through 20th elements. This ground plate is shown in FIG. 87.

7.5 Vertical Control at 45 Degrees

In FIGS. 58 through 87, exemplary simulation and structure of a reflect array have been described from a point of view of reflecting in the horizontal direction relative to the electric field. However, a reflect array which combines a second structure and a third structure may be designed such that it reflects in the vertical direction relative to the electric field.

Figure 88:
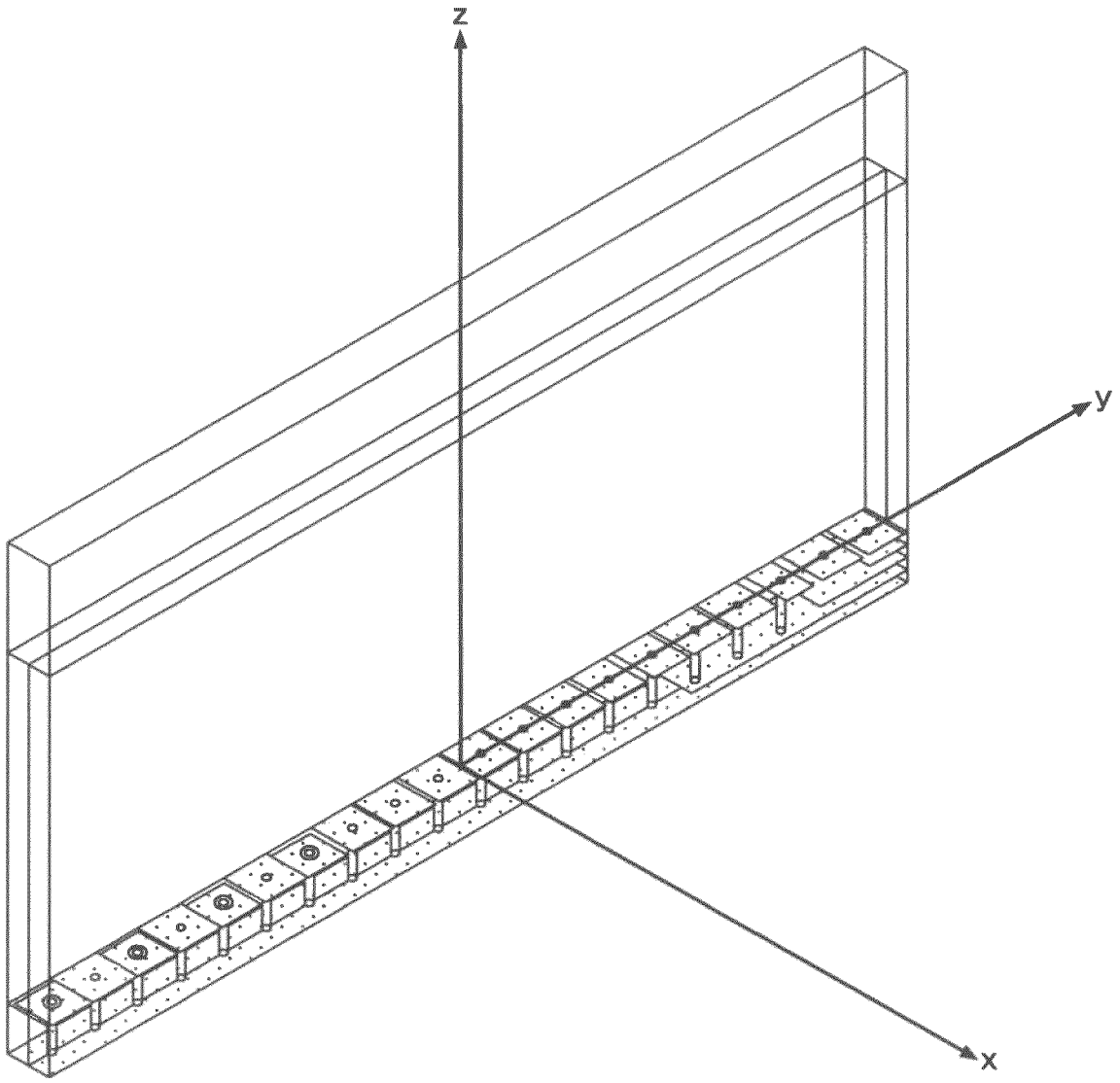
FIG. 88 is a schematic perspective view (V45) of a reflect array having a second structure with four types of patch heights and a third structure which allows overlapping of patches.

FIG. 88 shows a schematic perspective view of a reflect array having a second structure with four types of patch heights t of the mushroom structures, and a third structure which allows an overlap with a neighboring patch. It is necessary to note that only a part of a number of elements is drawn.

Figure 89:
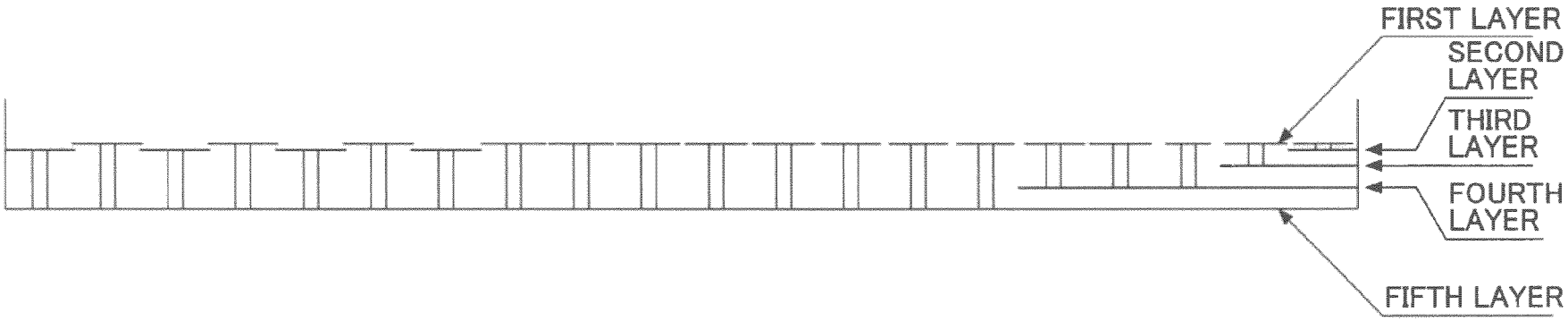
FIG. 89 is a cross-sectional diagram illustrating a layer structure.

FIG. 89 is a cross-sectional diagram illustrating a layer structure. As shown, five layers of a first through fifth layer is used as layers which includes a conductive layer in at least some thereof, between which a dielectric layer is interposed. As an example, the dielectric layer is an FR4 substrate which has a relative permittivity of 4.4 and tan δ of 0.018. The first and second layers are separated by 0.2 mm. The first and third layers are separated by 0.8 mm. The first and fourth layers are separated by 1.6 mm. The first and fifth layers are separated by 2.4 mm.

Figure 90:
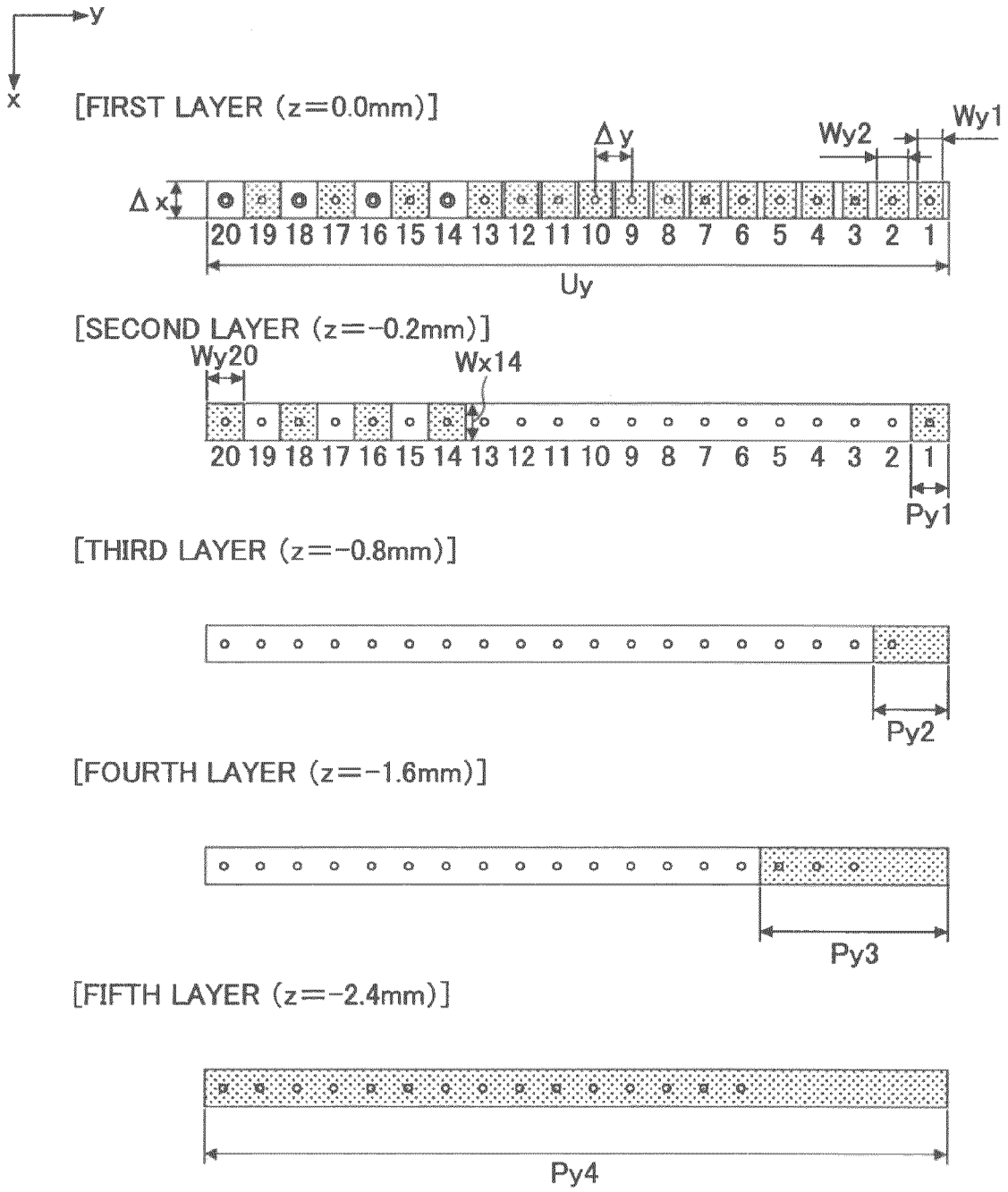
FIG. 90 is a diagram illustrating a position of a conductive layer in an L1 layer or an L5 layer.

FIG. 90 shows a location (shaded portion) of a conductive layer in the first through the fifth layers. As shown, 20 circles lined up in the y-axis direction correspond to via holes. For convenience, from the right, they are referred to as the first, the second . . . to the 20th elements. For the first layer, patches corresponding to each of first to 20th elements are shown. The thirteenth through the 20th elements allow overlap between patches, so that what differ in patch heights (14th, 16th, 18th, or 20th) does not occur in the first layer. For the second layer, at a location corresponding to the first element, a conductive layer having a length Py1 is provided and patches of 14th, 16th, 18th, and 20th elements are provided. At other locations, a conductive layer is not provided. As an example, Py1 is 2.4 mm. FIG. 91 shows a size of 20 patches in the first and second layers. For the third layer, a conductive layer having a length Py2 is provided at a location corresponding to the first and second elements, and no conductive layers are provided at other locations. As an example, Py2 is 4.8 mm. For the fourth layer, a conductive layer having a length Py3 is provided at a location corresponding to the first to fifth elements, and no conductive layers are provided at other locations. As an example, Py3 is 12 mm. For the fifth layer, a conductive layer having a length Py4 is provided at a location corresponding to all of the first to thirteenth elements. As an example, Py4 is 31.2 mm.

Figure 92:
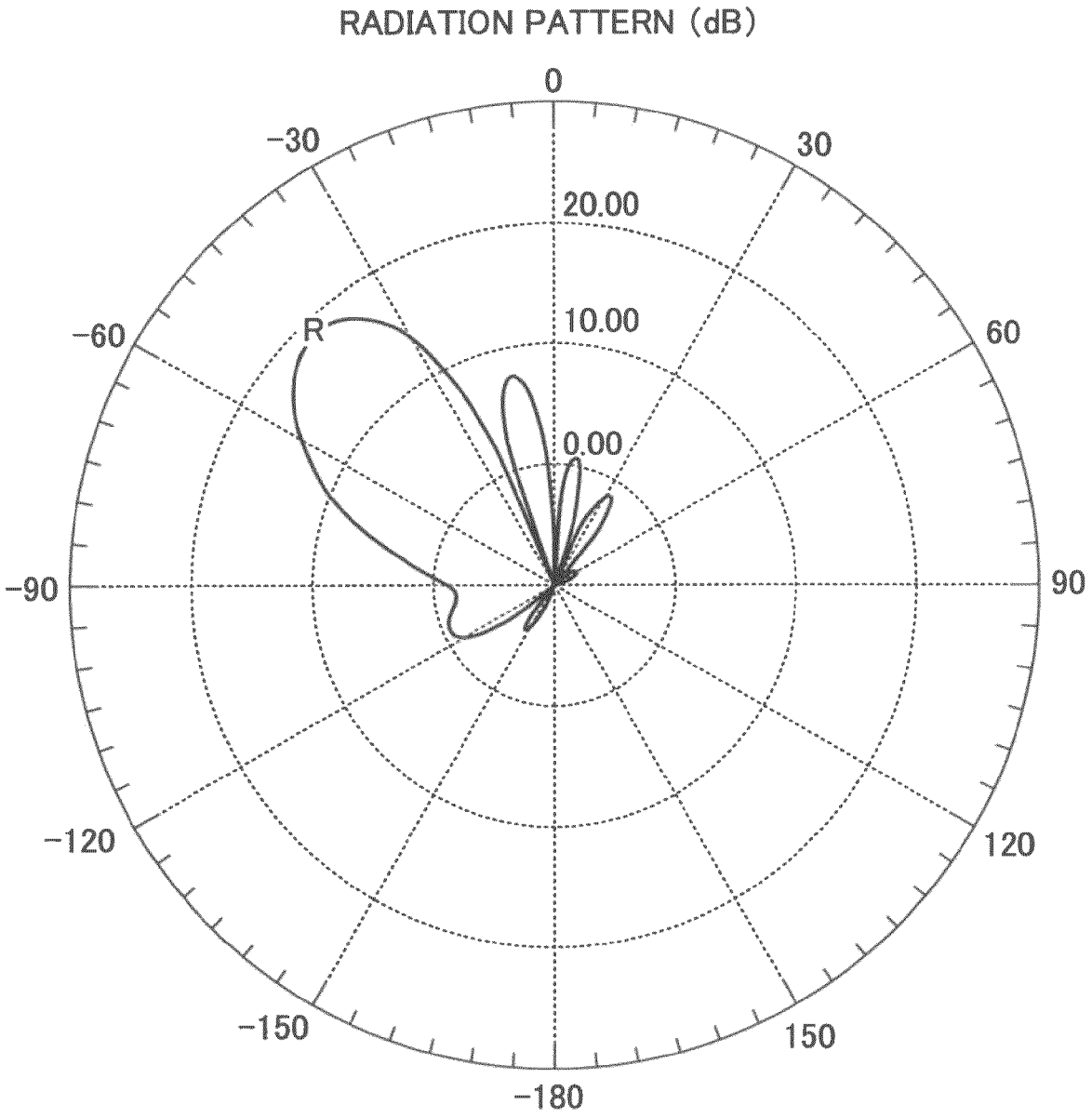
FIG. 92 is a diagram (V45) showing a far radiation field related to the reflect array in FIG. 88.

FIG. 92 shows a far radiation field of a reflect array formed as in the above. A reflect array is designed using the above-described numerical values such that it forms a reflection in a direction of −45 degrees relative to an incident wave. As shown in FIG. 92, it is seen that a reflected wave properly faces the direction of approximately −45 degrees (In the illustrated example, a reflected wave of 18.55 dB is obtained in the direction of −43 degrees.)

7.6 Combination of Improved Second Structure and Third Structure

As described in the section 5.6 "Vertical control by improved second structure", from a point of view of accurately specifying inductance produced in the second structure, it is preferable that the ground plate is substantially terminated at a via location. In the explanations below, specific dimensional details, which are not essential to the present invention, are omitted.

Figure 93:
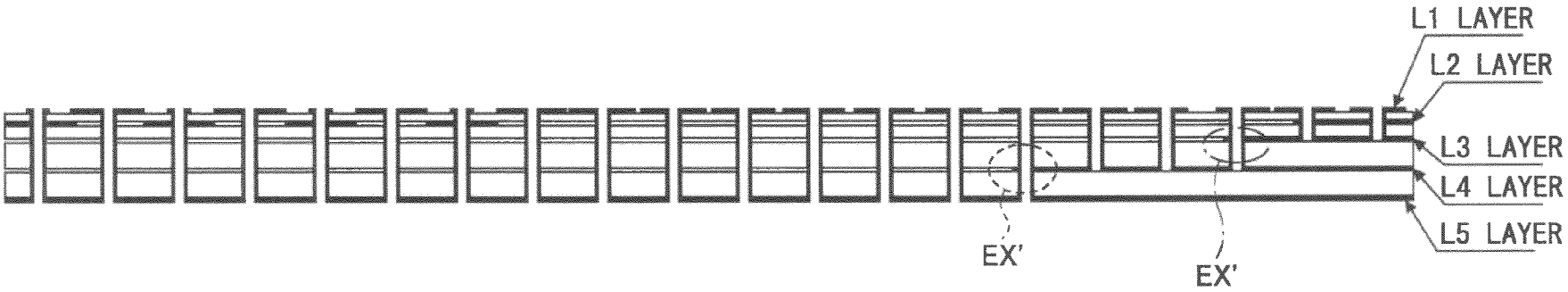
FIG. 93 is a diagram illustrating a layer structure of a reflector array which includes the third structure and an improved region of the second structure.

FIG. 93 illustrates a layer structure of a reflect array which includes a region of the improved second structure and a region of the third structure. As shown, five layers of a first through fifth layer is used as layers which includes a conductive layer in at least some thereof, between which a dielectric layer is interposed. As an example, the dielectric layer is an FR4 substrate which has a relative permittivity of 4.4 and tan δ of 0.018. The layer structure, which is generally the same as the structure of FIGS. 79, 89, etc., is largely different in that, as shown as "EX7'" in the third and fourth layers, a ground plate is substantially terminated at via location. For the structure in FIGS. 79, 89, etc., an end of a ground plate is not substantially terminated at a via location, an end of the ground plate exists between neighboring elements, and a step of the ground plane is formed. For a reason of a manufacturing process, an end of a ground plate extends a little beyond a via in a part shown with "EX'", which does not substantially affect inductance produced between elements.

Figure 94A:
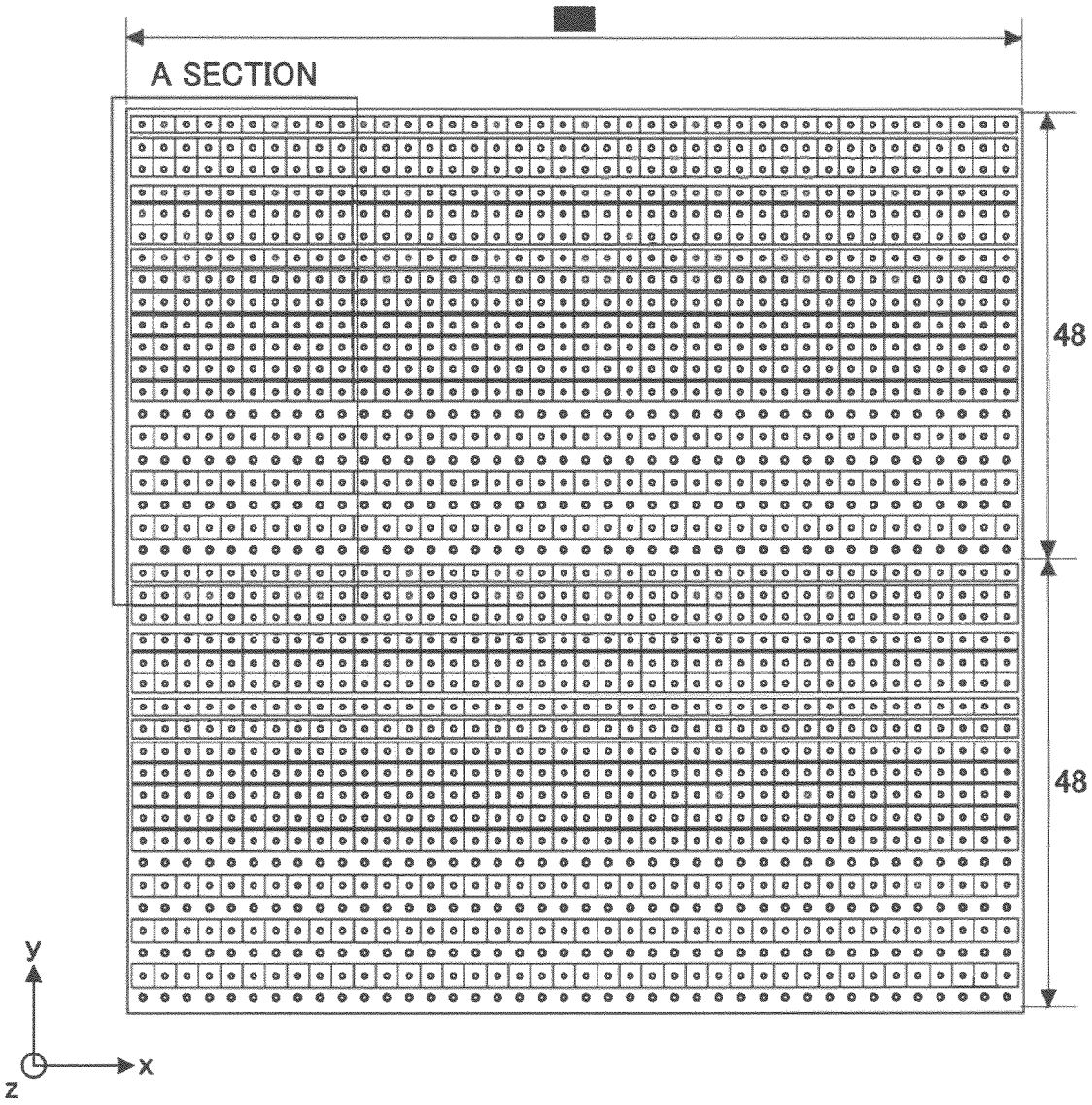
FIG. 94A is a plane view of the L1 layer in FIG. 93.
Figure 94B:
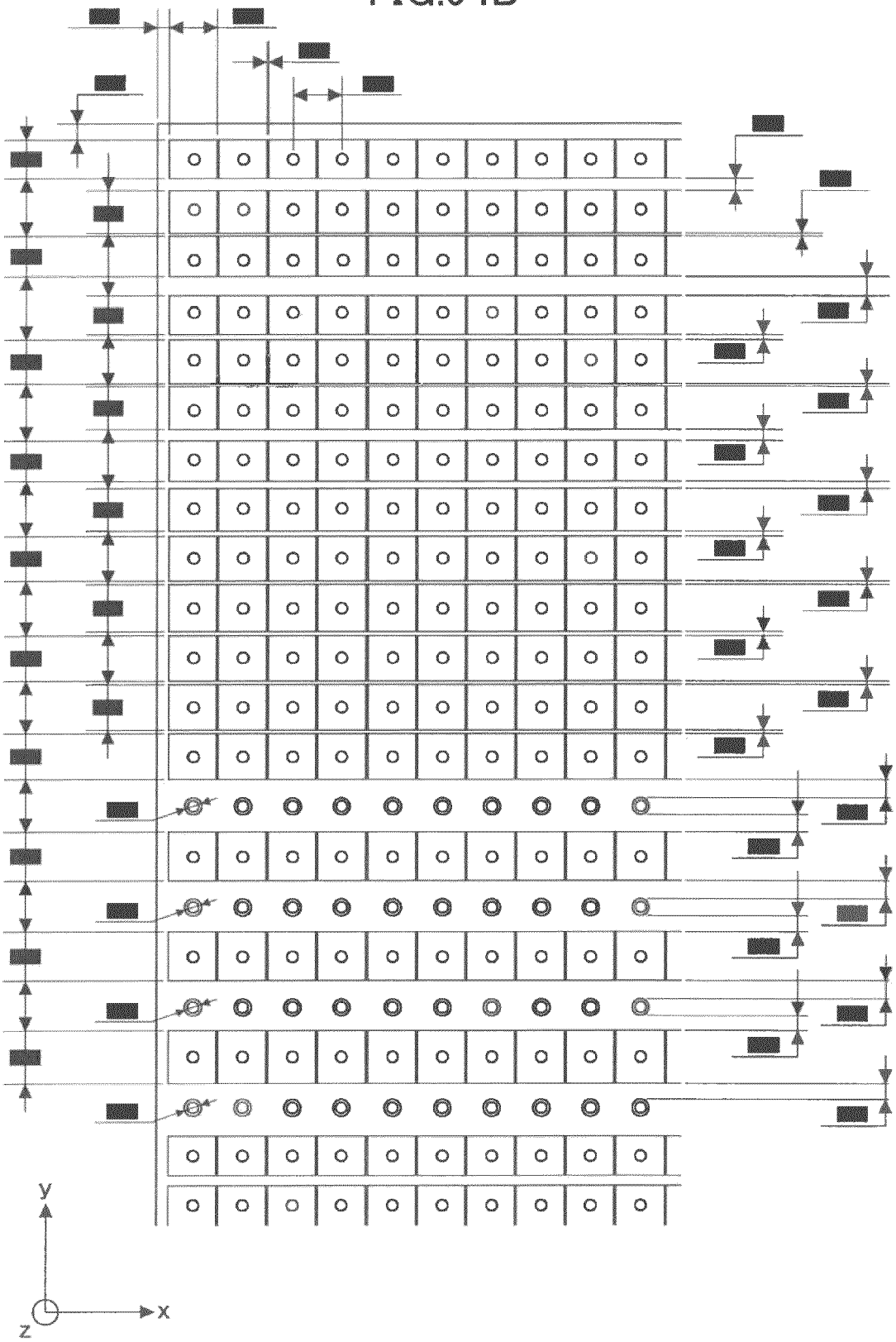
FIG. 94B is a drawing detailing "A section" of L1 layer shown in FIG. 94A.

FIG. 94A shows a plane view of the L1 layer in FIG. 93. While, in the structure illustrated, a structure (approximately 48 mm) shown in FIG. 93 in which twenty elements are lined up is repeated twice in the y-axis direction and is repeated 40 times in the x-direction, the number of elements (vias), the number of repetitions in the y-axis direction, and the number of repetitions in the x-axis direction are merely exemplary, so that any appropriate numerical value may be used. FIG. 94B shows in detail "A section" of the L1 layer shown in FIG. 94A.

Figure 95A:
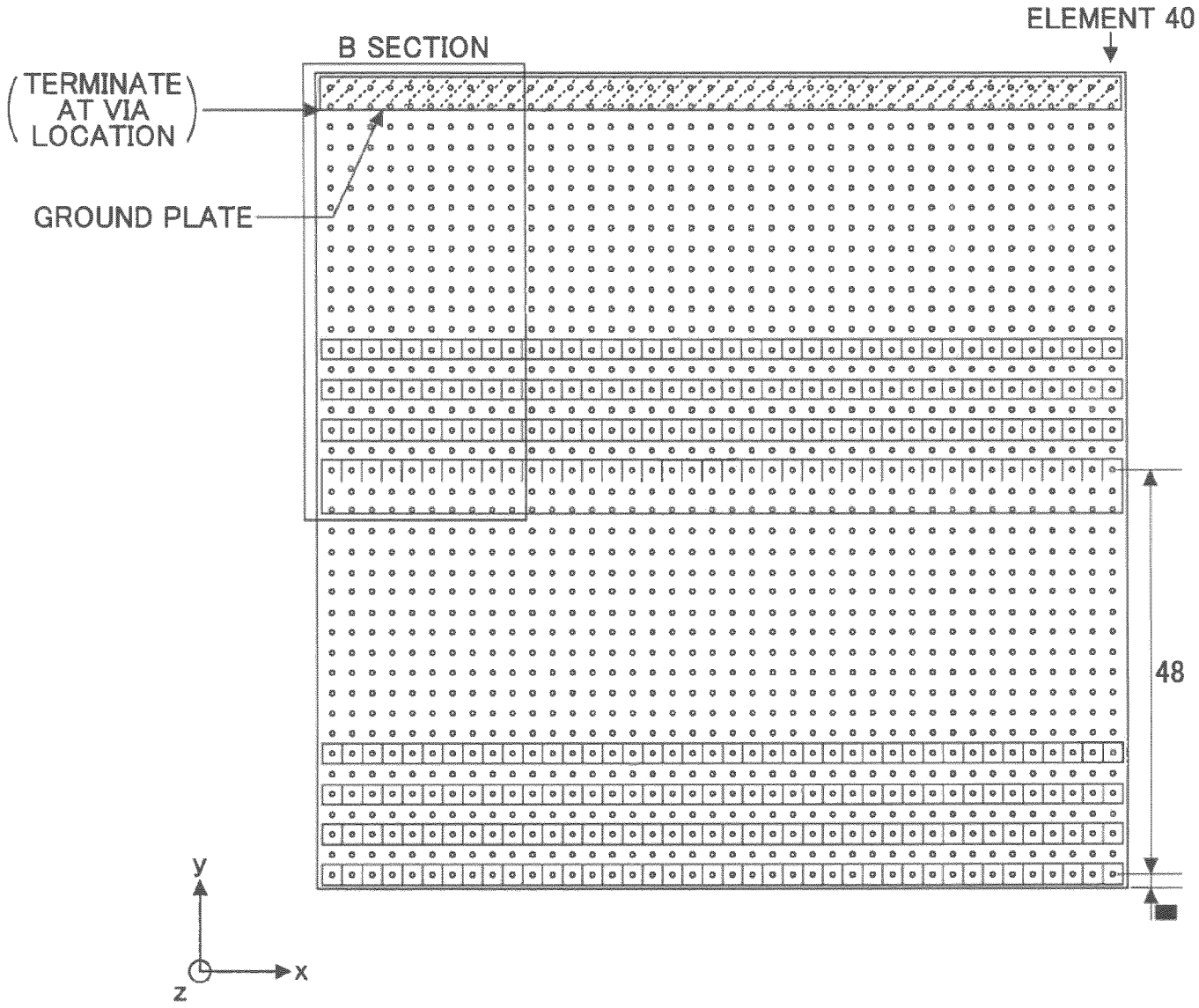
FIG. 95A is a plane view of the L2 layer shown in FIG. 93.
Figure 95B:
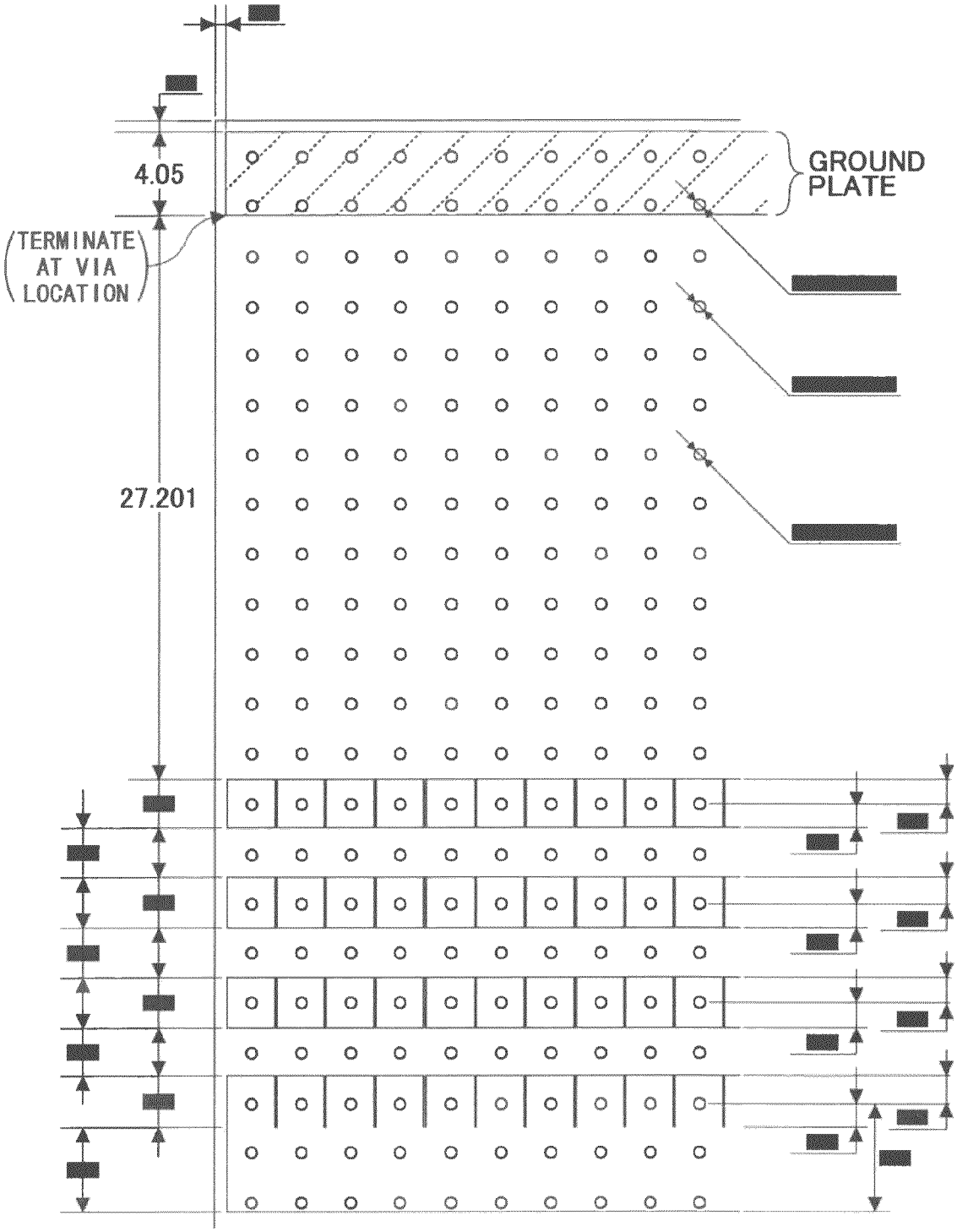
FIG. 95B is a drawing detailing "B section" of L2 layer shown in FIG. 95A.

FIG. 95A shows a plane view of the L2 layer shown in FIG. 93. FIG. 95B shows in detail "B section" of the L2 layer shown in FIG. 95A. "B section" is located on the lower side of "A section". The L2 through L5 layers make up the ground plate. As shown in FIGS. 95A and 95B, an end or an edge of a ground plate is terminated in a via location.

Figure 96A:
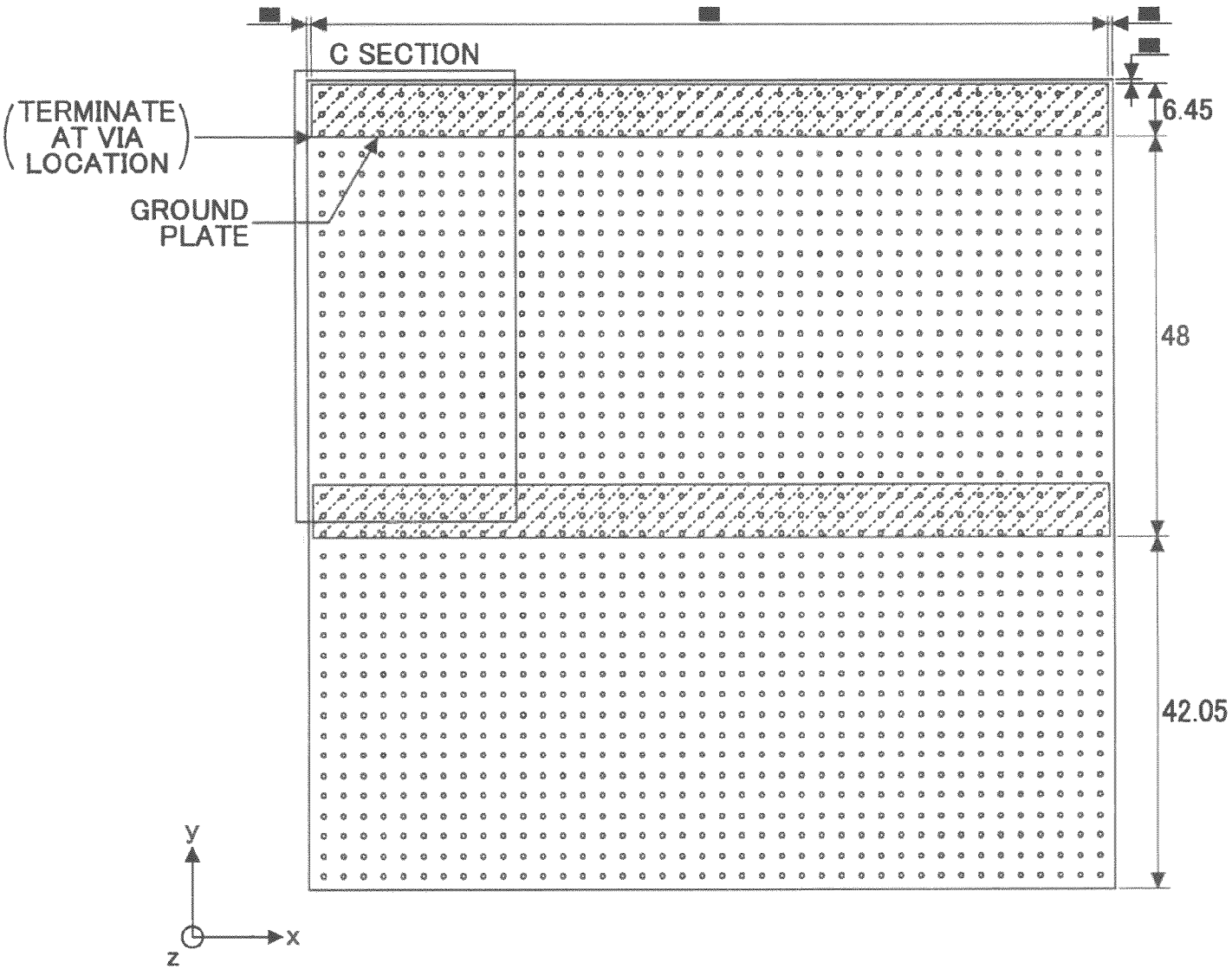
FIG. 96A is a plane view of the L3 layer shown in FIG. 93.
Figure 96B:
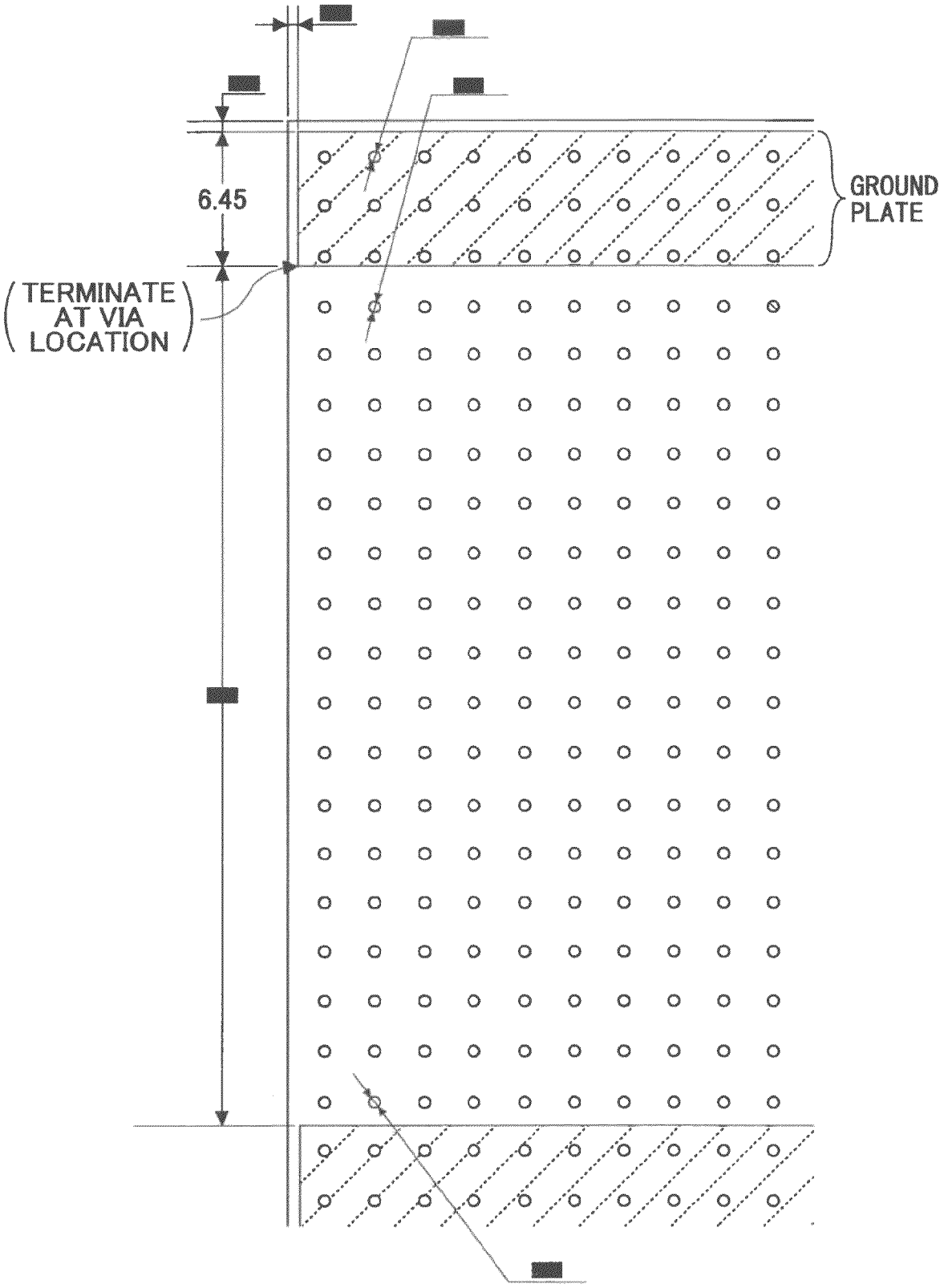
FIG. 96B is a drawing detailing "C section" of L3 layer shown in FIG. 96A.

FIG. 96A shows a plane view of the L3 layer shown in FIG. 93. FIG. 96B shows in detail "C section" of the L3 layer shown in FIG. 96A. "C section" is located on the lower side of "A section" and "B section". As shown in FIGS. 96A and 96B, an end or an edge of a ground plate is terminated at a via location.

Figure 97A:
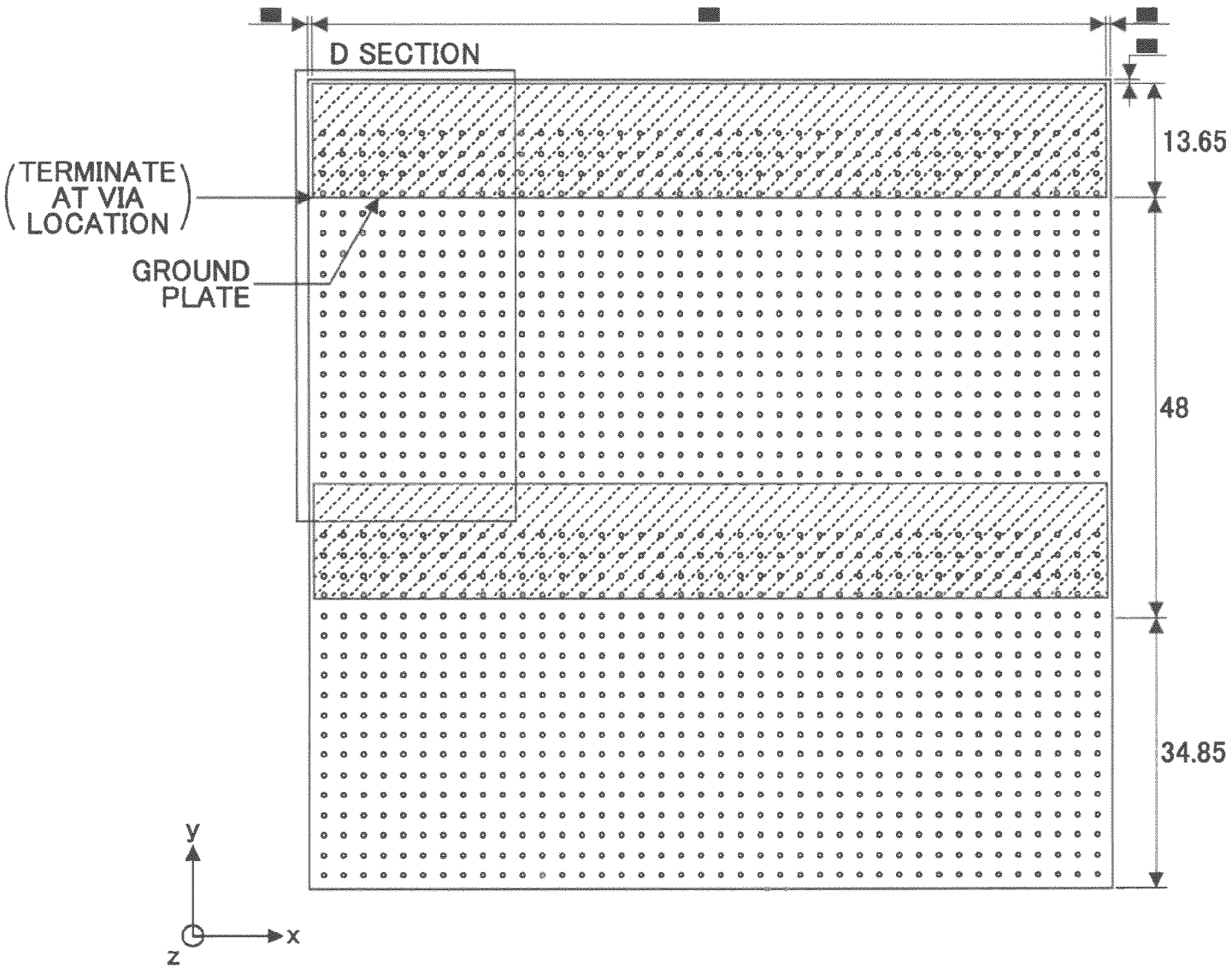
FIG. 97A is a plane view of the L4 layer shown in FIG. 93.
Figure 97B:
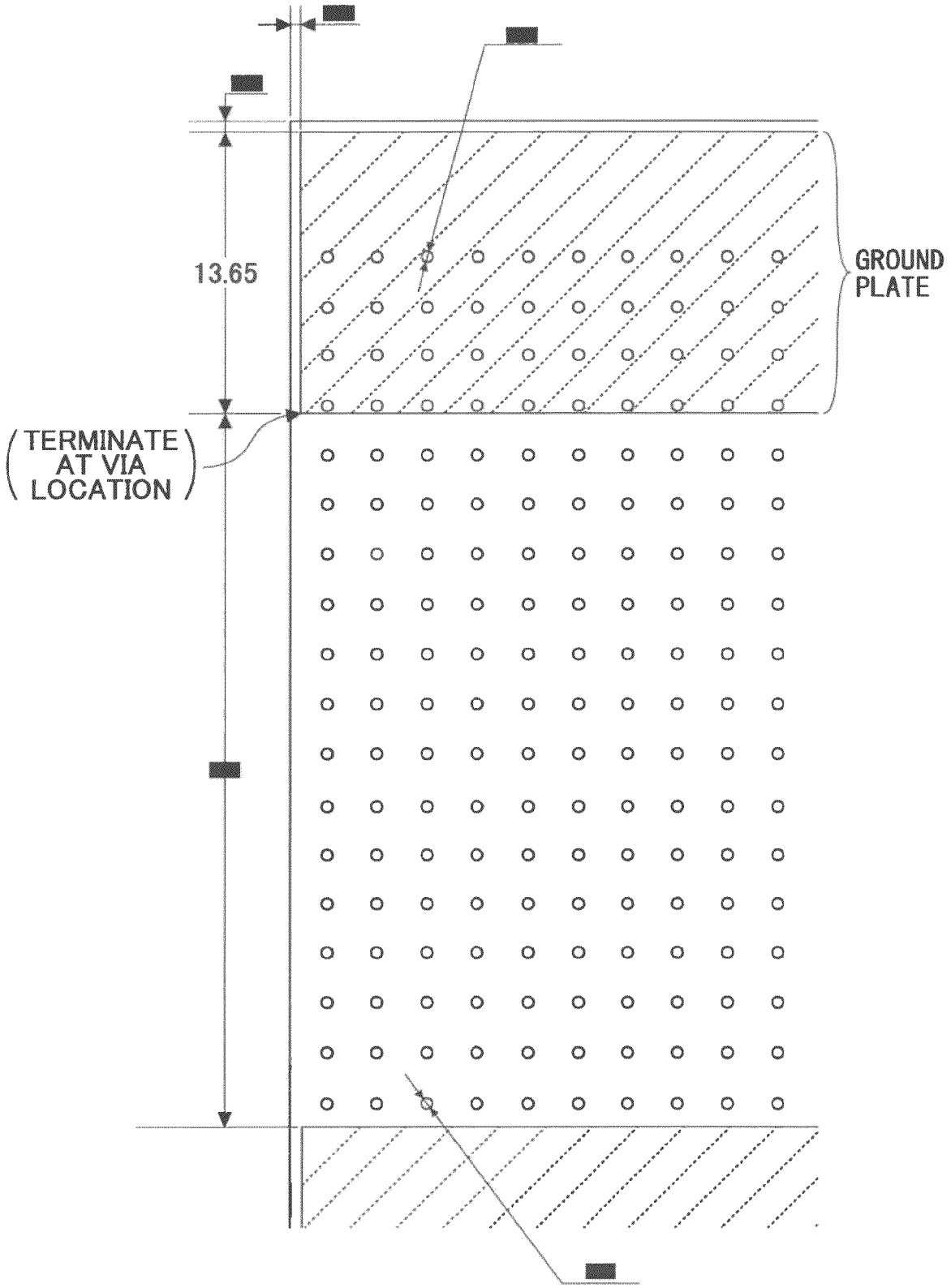
FIG. 97B is a drawing detailing "D section" of L4 layer shown in FIG. 97A.

FIG. 97A shows a plane view of the L4 layer shown in FIG. 93. FIG. 97B details a "D section" of the L4 layer shown in FIG. 97A. The "D section" is located on the lower side of "A section", "B section", and "C section". As shown in FIGS. 97A and 97B, an end or an edge of a ground plate is terminated at a via location.

Figure 98A:
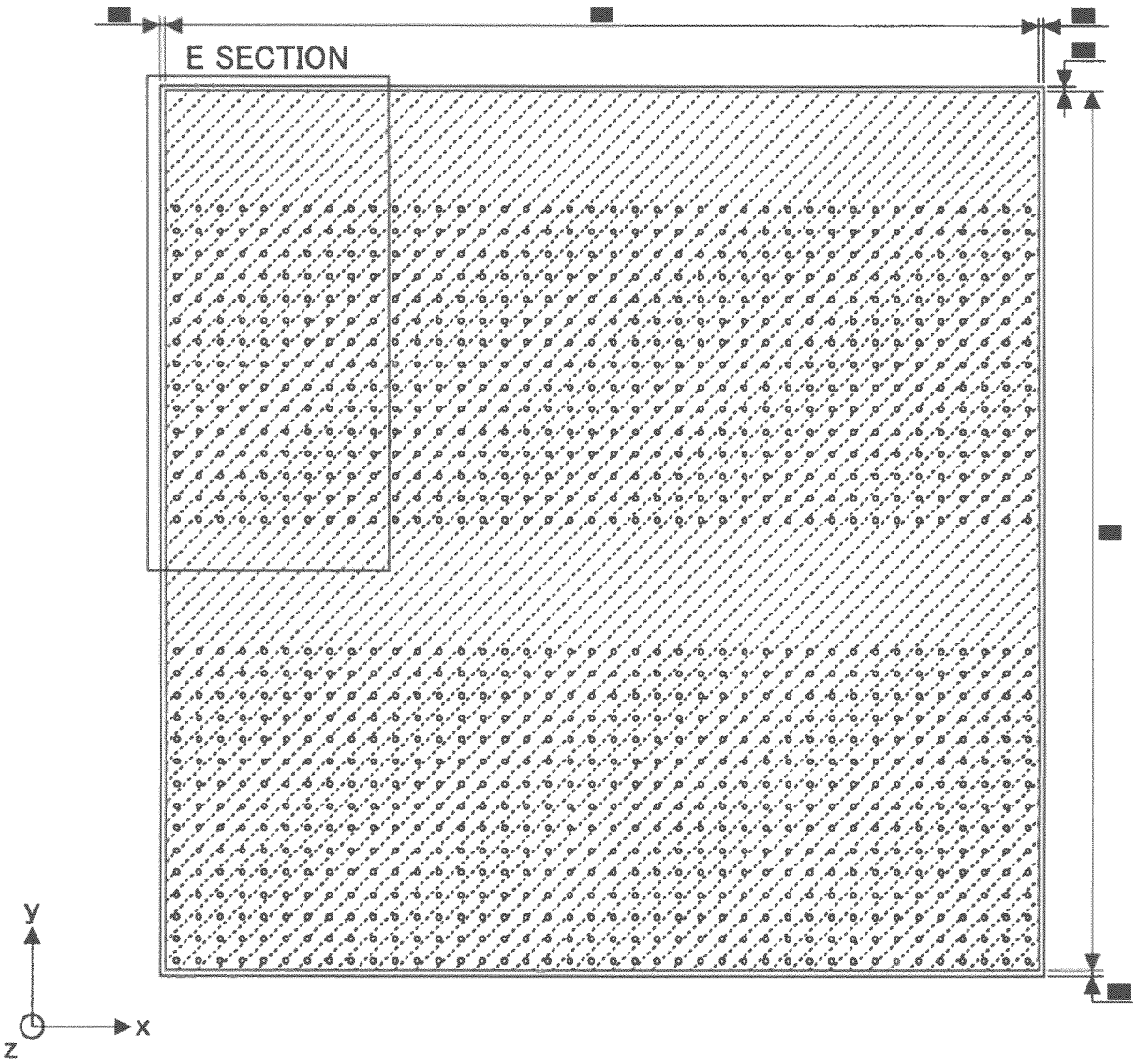
FIG. 98A is a plane view of the L5 layer shown in FIG. 93.
Figure 98B:
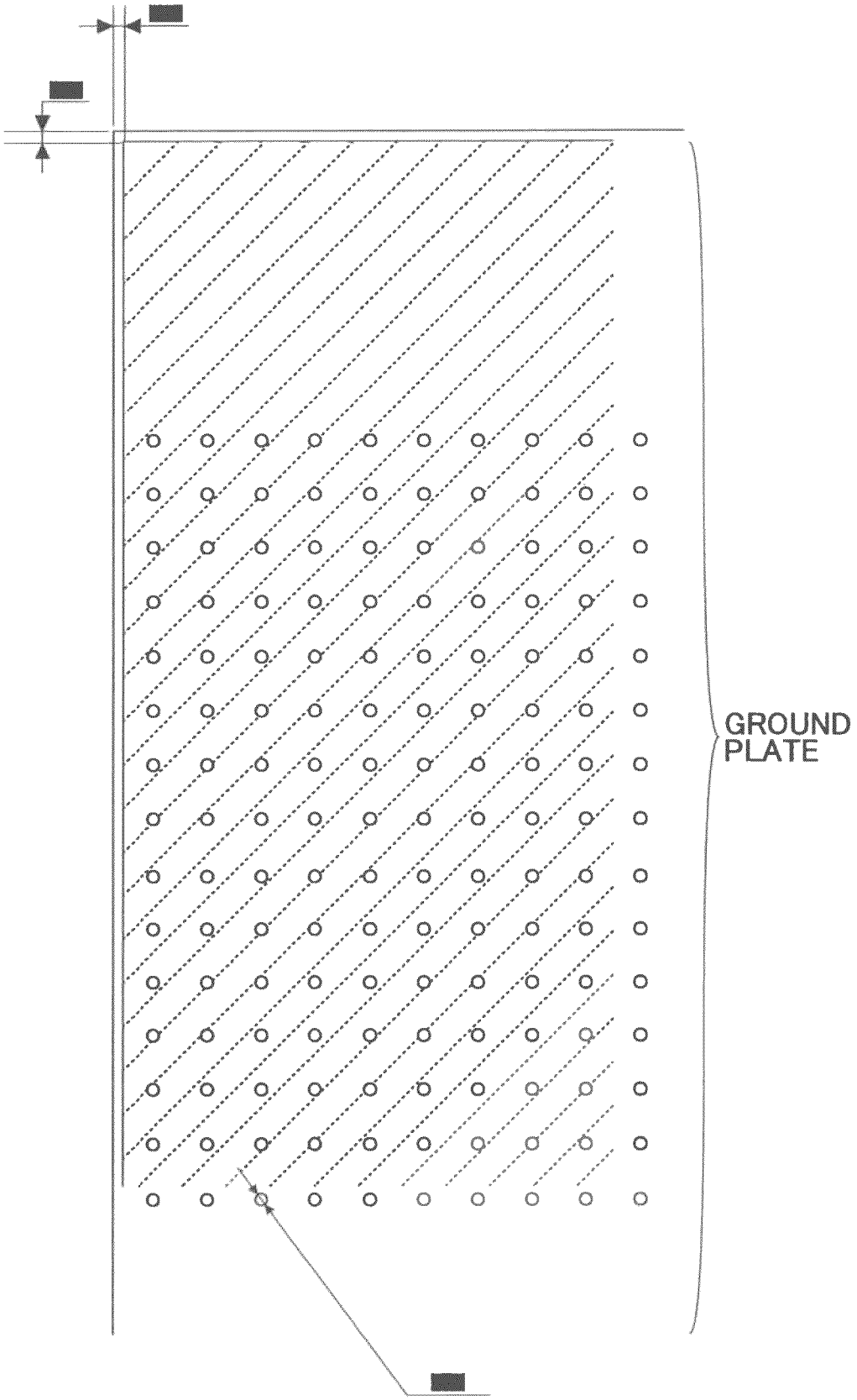
FIG. 98B is a drawing detailing "E section" of L5 layer shown in FIG. 98A.

FIG. 98A shows a plane view of the L5 layer shown in FIG. 93. FIG. 98B details an "E section" of L5 layer shown in FIG. 98A. The "E section" is located on the lower side of "A section", "B section", "C section", and "D section".

Figure 99A:
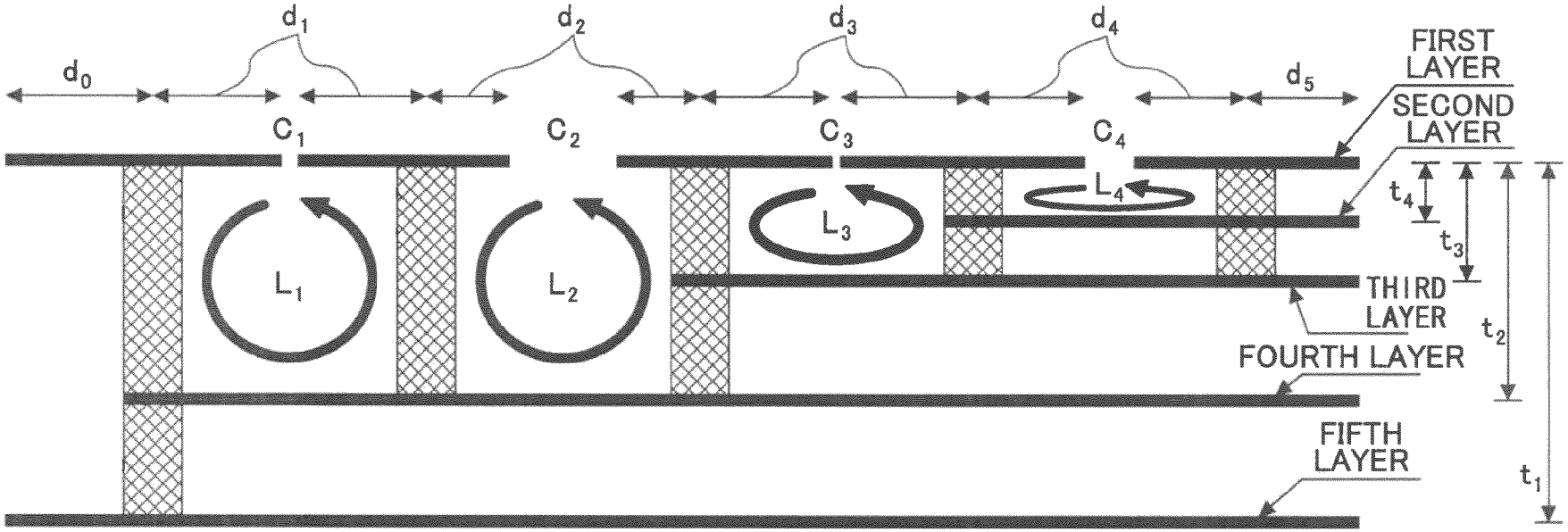
FIG. 99A is a diagram illustrating a structure for performing vertical control used in a simulation (a patch is unsymmetrical relative to a via)
Figure 99B:
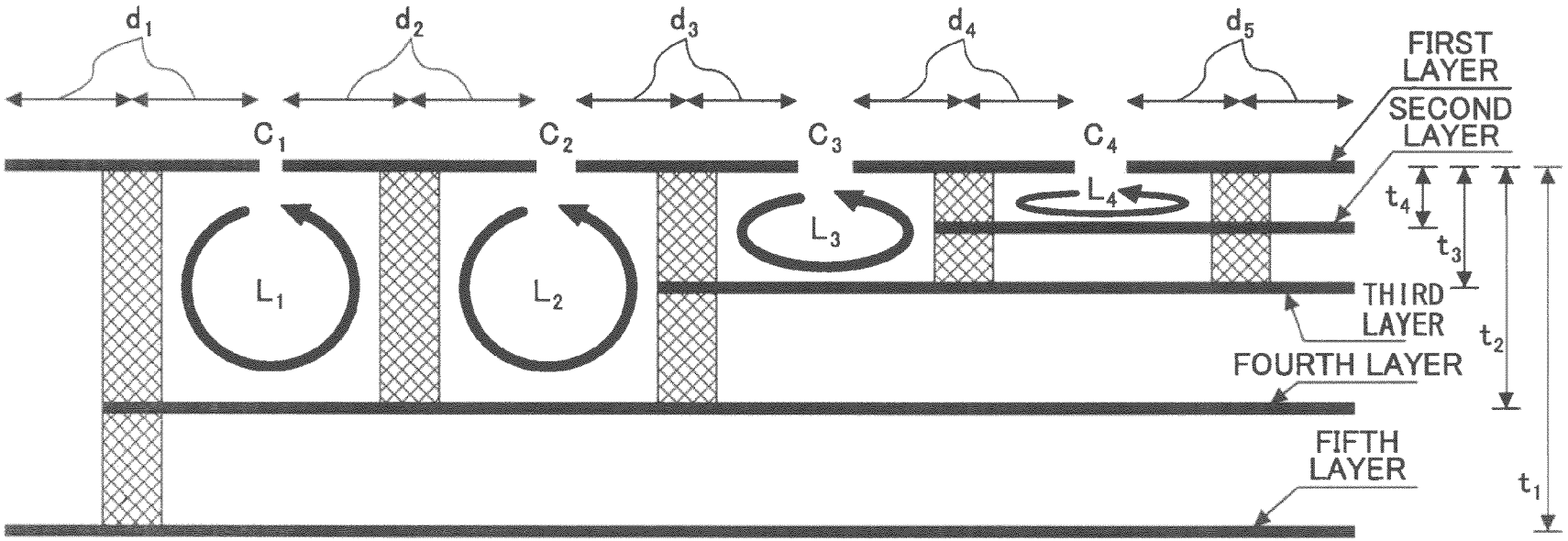
FIG. 99B is a diagram illustrating a structure for performing vertical control used in a simulation (a patch is symmetrical relative to a via)

Next, results of simulation on a combination of a third structure and an improved second structure is shown. In the simulation, two structures are compared which conduct vertical control as shown in FIGS. 99A and 99B. Either structure uses the improved second structure, and the ground plate is terminated at a via location. However, patch design varies. The structure in FIG. 99A, as shown in FIG. 34A, is such that neighboring patches have the same size. On the contrary, the structure in FIG. 99B, as shown in FIG. 34B, is such that a patch is used which is symmetrical with a via as a center.

Figure 99C:
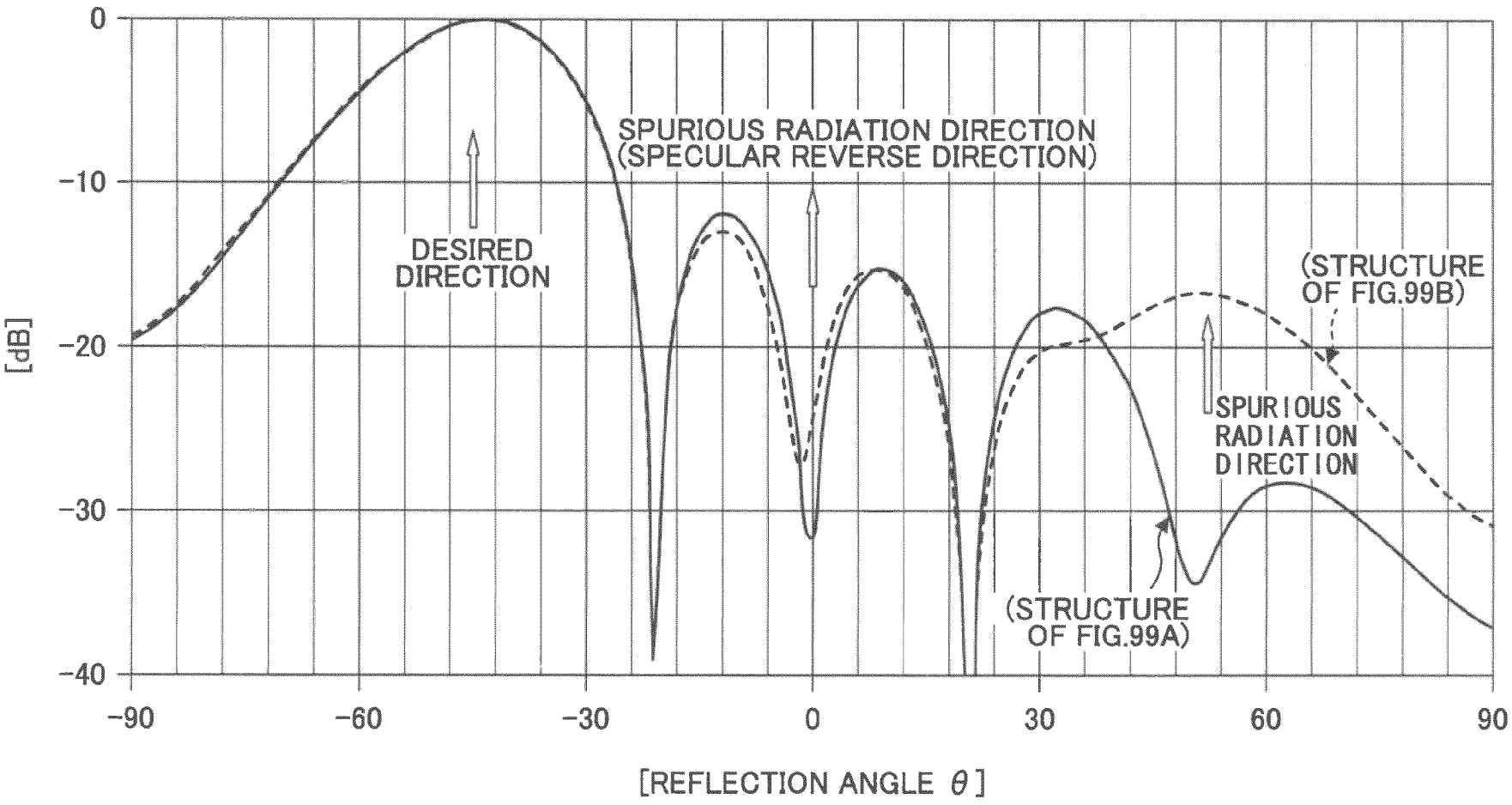
FIG. 99C is a diagram illustrating a simulation result of a far radiation field of each of two structures.

FIG. 99C shows a simulation result of a far radiation field of each of two structures. The structures in FIGS. 99A and 99B are designed such that a radio wave with an electric field facing the y-axis direction arrives from a z-axis ∞ direction, and is reflected in a −45 degree direction. A magnitude or strength of a beam is normalized according to a value in a desired direction (−45 degrees). Either structure forms a large reflection beam in a desired direction. Around +45 degrees, the structure in FIG. 99B forms a relatively large spurious reflected beam. On the other hand, the structure in FIG. 99A may properly suppress such a spurious reflected wave. Moreover, also for a specular reflected beam in a zero-degree direction, the structure of FIG. 99A may suppress a spurious reflected beam to a level which is smaller than that which may be suppressed by the structure of FIG. 99B. Thus, for vertical control, the structure in FIG. 99A is preferable to the structure in FIG. 99B.

Next, how a ground plate is terminated at a via location affects cases of conducting vertical control and horizontal control using structures with different via heights is described.

Figure 100A:
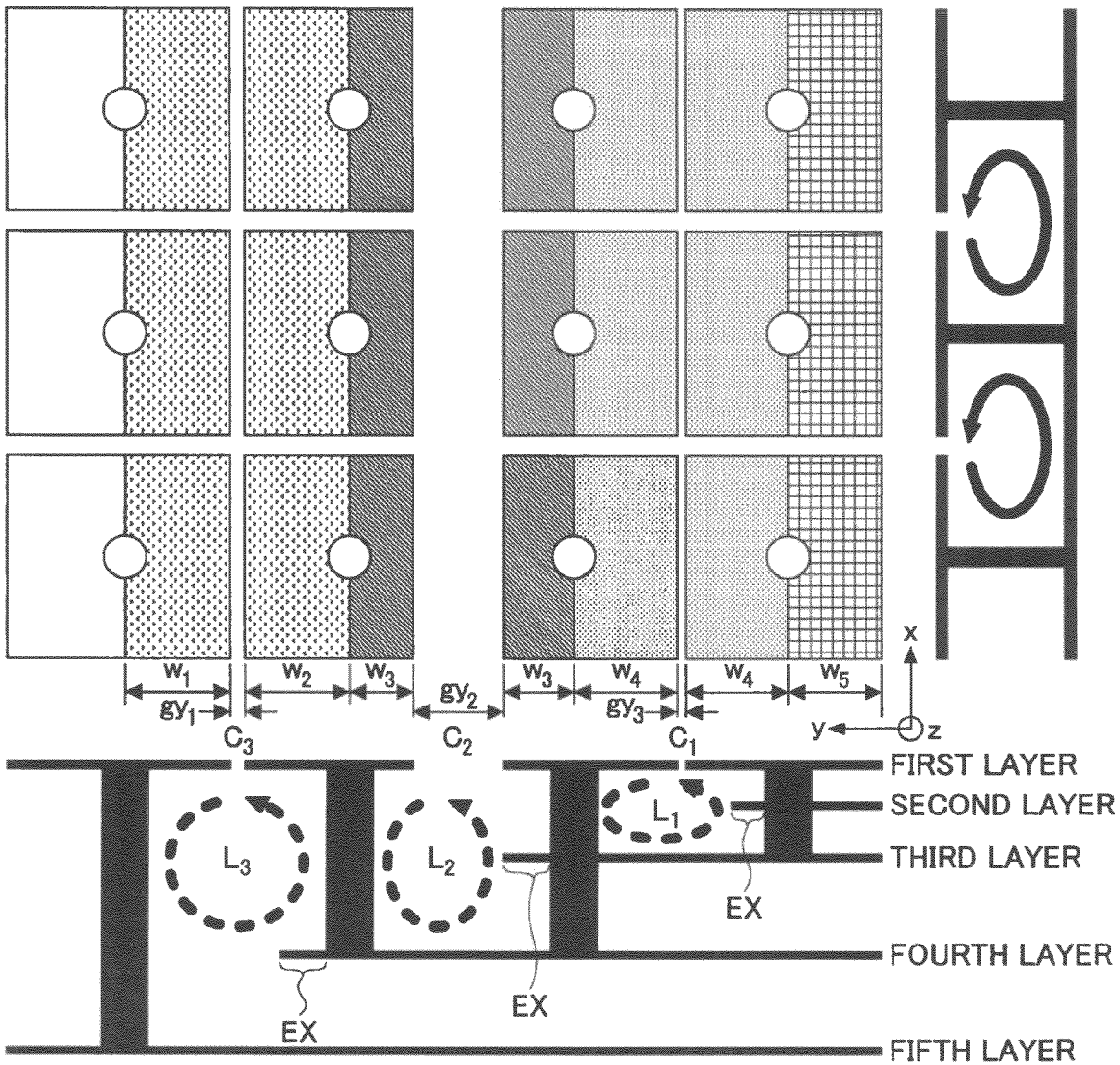

FIG. 100A shows a structure which conducts vertical control with a structure which includes a second structure. As shown in FIG. 100A, a pair of L and C from which a desired LC resonance is obtained may be arranged in the y-axis direction. As described above, when arranging a combination of L and C of different values, the ground plate is desirably terminated at the via location. FIG. 100A shows a schematic plane view, a cross-sectional diagram in the x-direction and a cross-sectional diagram in the y-direction. Along the y-axis direction, the first layer, which is a patch layer, four ground plates (the second through the fifth layers) exist, and, as shown as "EX", an end of the second layer, the third layer, and the fourth layer of the ground plate is located between neighboring elements. Therefore, in elements lined up in the y-axis direction, it becomes difficult to produce an inductance of an appropriate value. An inductance is also produced between elements lined up in the x-axis direction. However, for reflecting, in a desired direction, a radio wave with an electric field facing the y-axis direction, an inductance which is produced by elements lined up in the y-axis direction is more important. Thus, as described above, it should be improved such that an end of a ground plate is terminated at a via location.

Figure 100B:
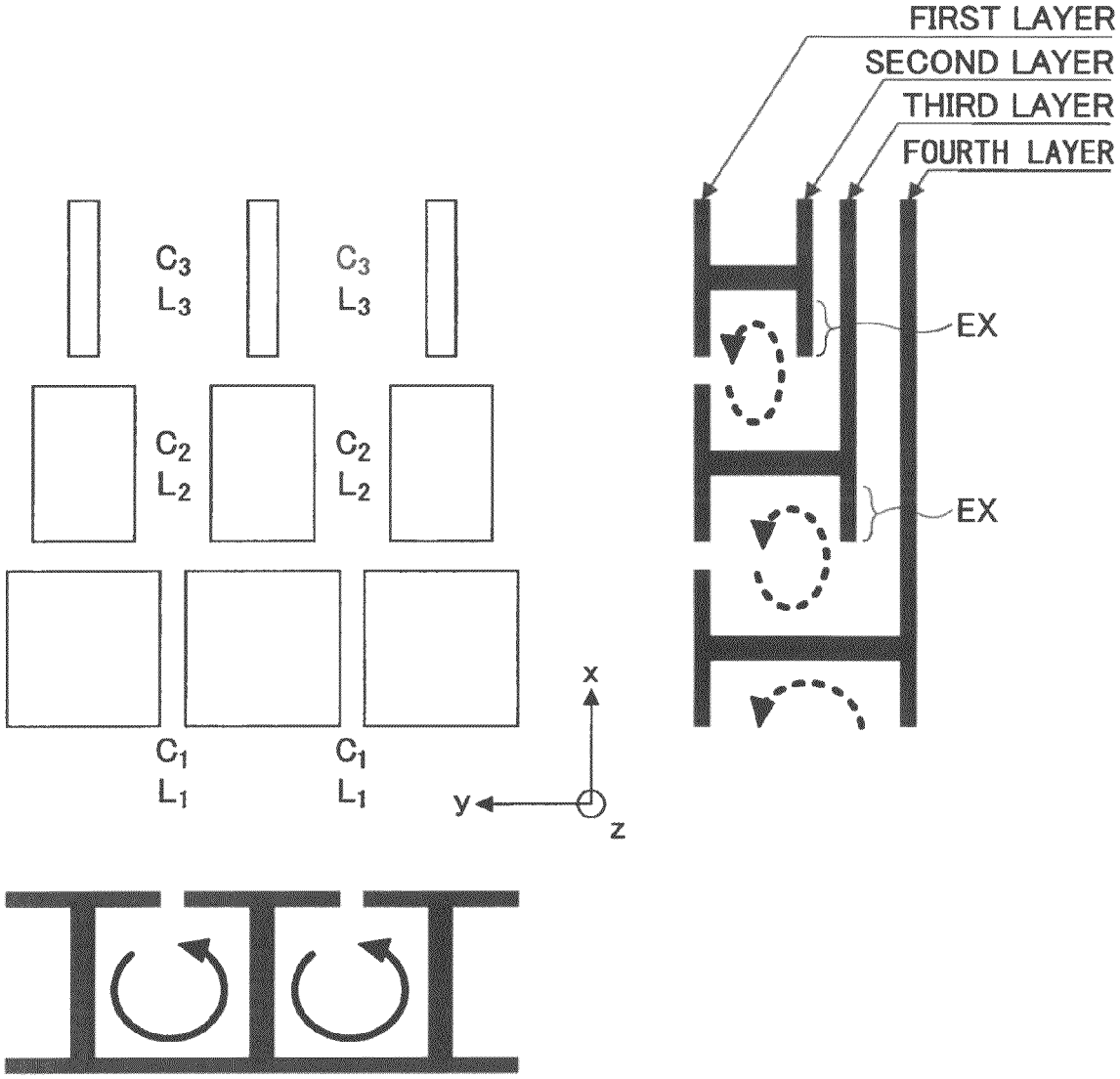

FIG. 100B shows a structure which conducts horizontal control with a structure which includes a second structure. For horizontal control, as shown in FIG. 100B, a pair of L and C from which a desired LC resonance is obtained can be arranged in the x-axis direction. Also in FIG. 100B are shown a schematic plane view, a cross-sectional diagram in the x-direction and a cross-sectional diagram in the y-direction. For horizontal control, multiple ground plates are exhibited in a cross section of an x-axis direction. Along the x-axis direction, the first layer, which is a patch layer, and three ground plates (the second through the fourth layers) exist, and, as shown as "EX", an end of the second layer and the third layer of the ground plate is located between neighboring elements. Thus, in the x-axis direction, it becomes difficult to produce an inductance of an appropriate value. However, as described above, for reflecting a radio wave of the y-axis direction, an inductance which is produced by elements lined up in the y-axis direction is more important. For elements lined up in the y-axis direction, via heights of neighboring elements are the same, so that the inductance L takes a value expected by a product of a permeability μ and a via height t. Thus, for horizontal control, an impact of a step of a ground plate is not as serious as for vertical control. In other words, desired inductances L1, L2, and L3 may be obtained since ground plates of vias over a gap are connected as shown as shown in a cross-sectional diagram in the y-axis direction, even though the ground plate is not terminated at the via location as shown in a cross-sectional diagram in the x-axis direction. As a matter of course, an operation as designed may be expected further by terminating, at a via location, a ground plate which extends in the x-axis direction even in the structure in FIG. 100B.

As described above, while the present invention is described with reference to specific embodiments, the respective embodiments are merely exemplary, so that a skilled person will understand variations, modifications, alternatives, replacements, etc. While specific numerical value examples are used to facilitate understanding of the present invention, such numerical values are merely examples, so that any appropriate value may be used unless specified otherwise. While specific mathematical expressions are used to facilitate understanding of the present invention, such mathematical expressions are merely examples, so that any appropriate mathematical expression may be used unless specified otherwise. A breakdown of embodiments or items is not essential to the present invention, so that matters described in two or more embodiments or items may be used in combination as needed, or matters described in a certain embodiment or item may be applied to matters described in a different embodiment or item (as long as they do not contradict). The present invention is not limited to the above embodiments, so that variations, modifications, alternatives, and replacements are included in the present invention without departing from the spirit of the present invention.

Below, measures taught by the present invention are listed in an exemplary manner.

(M1)

An apparatus having multiple mushroom structures, each of the multiple mushroom structures including:

a ground plate;

a first patch provided parallel to the ground plate with a separation of a distance to the ground plate; and a second patch provided parallel to the ground plate with a separation of another distance to the ground plate, which another distance being different from the distance from the first patch to the ground plate, wherein the second patch is a passive element which is capacitatively coupled with at least the first patch.

(M2)

The apparatus as recited in M1, wherein a certain number of mushroom structures out of the multiple mushroom structures is lined up along a certain line;

a different number of mushroom structures out of the multiple mushroom structures is lined up along a different line; and a gap between a first patch of a mushroom structure along the certain line and a first patch of a mushroom structure along the different line gradually changes along the certain line and the different line.

(M3)

The apparatus as recited in M1, wherein a gap between first patches of neighboring mushroom structures out of a certain number of mushroom structures lined up along a certain line gradually changes along the certain line.

(M4)

The apparatus as recited in M3, wherein a distance from an end of one of neighboring first patches for determining the gap to a reference line of the one of the first patches equals a distance from an end of the other of the neighboring first patches to a reference line of the other of the first patches, and a distance between reference lines to multiple mushroom structures is uniformly maintained.

(M5)

The apparatus as recited in M3, wherein a first patch of each of first, second, and third mushroom structures sequentially lined up along the certain line is of a mutually equal size, and a distance between a center of the first patch of the first mushroom structure and a center of the first patch of the second mushroom structure is different from a distance between the center of the first patch of the second mushroom structure and a center of the first patch of the third mushroom structure.

(M6)

The apparatus as recited in M3, wherein a distance between a center line which bisects a gap between a first patch of a first mushroom structure and a first patch of a second mushroom structure that neighbor along the certain line and a center line which bisects a gap between the first patch of the second mushroom structure and a first patch of a third mushroom structure that neighbor along the certain line is maintained uniformly for multiple mushroom structures lined up along the certain line.

(M7)

The apparatus as recited in one of M2 to M6, wherein a phase difference of radio waves reflected from each of a first mushroom structure and a second mushroom structure out of the first mushroom structure, the second mushroom structure, and a third mushroom structure lined up sequentially along the certain line is equal to a phase difference of radio waves reflected from each of the second mushroom structure and the third mushroom structure.

(M8)

The apparatus as recited in any one of M1 through M7, wherein an array which includes a certain number of mushroom structures lined up at least along the certain line is lined up in multiple numbers repeatedly on the same plane.

(M9)

The apparatus as recited in any one of M1 through M8, further including at least one patch which is provided parallel to the ground plate, the first patch and the second patch with a separation of a distance to the ground plate, the first patch and the second patch.

(A1)

An apparatus having multiple mushroom structures, each of the multiple mushroom structures including:

a ground plate;

a patch provided parallel to the ground plate with a separation of a distance to the ground plate, wherein a distance between a ground plate and a patch in a certain mushroom structure is different from a distance between a ground plate and a patch in a different mushroom structure.

(A2)

The apparatus as recited in A1, wherein the patch in the certain mushroom structure and the patch in the different mushroom structure are provided within the same plane.

(A3)

The apparatus as recited in A2, wherein the ground plate in the certain mushroom structure and the ground plate in the different mushroom structure are not formed in a multi-layer structure.

(A4)

The apparatus as recited in A1, wherein the ground plate in the certain mushroom structure and the ground plate in the different mushroom structure are provided within the same plane.

(A5)

The apparatus as recited in (A1), further including the features of (M2) to (M9).

(B1)

An apparatus having multiple mushroom structures, each of the multiple mushroom structures including:

a ground plate; and a patch provided parallel to the ground plate with a separation of a distance to the ground plate, wherein patches of neighboring mushroom structures mutually form a gap within a same plane, while patches of different neighboring mushroom structures are provided on mutually different planes with a positional relationship such that at lease some are laminated in multiple levels.

(B2)

The apparatus as recited in (B1), including the features of (M2) to (M9).

(C1) M+A

An apparatus having multiple mushroom structures of a first group and multiple mushroom structures of a second group, wherein each of the multiple mushroom structures of the first group includes:

a ground plate;

a first patch provided parallel to the ground plate with a separation of a distance to the ground plate; and a second patch provided parallel to the ground plate with a separation of another distance to the ground plate, which another distance being different from the distance from the first patch to the ground plate, wherein the second patch is a passive element which is capacitatively coupled with at least the first patch, and wherein each of the multiple mushroom structures of the second group includes:

a ground plate; and a patch provided parallel to the ground plate with a separation of a distance to the ground plate, wherein a distance between a ground plate and a patch in a certain mushroom structure belonging to the second group is different from a distance between a ground plate and a patch in a different mushroom structure belonging to the second group.

(C2) M+A+B

The apparatus as recited in C1, wherein the apparatus further includes multiple mushroom structures of a third group, wherein patches of neighboring mushroom structures belonging to the third group mutually form a gap within the same plane, and wherein patches of different neighboring mushroom structures are provided in different planes with a positional relationship such that at least some overlap in multiple levels.

(C3)

The apparatus as recited in C1 or C2, wherein one layer out of three layers which make up a ground plate, a first patch, and a second patch in a mushroom structure of the first group is provided on the same plane as one layer out of two layers which make up a ground plate and a patch in a mushroom structure of the second group, wherein another one layer within the three layers is provided on the same plane as another one layer out of the two layers.

(C4) M+B

An apparatus having multiple mushroom structures of a first group and multiple mushroom structures of a second group, wherein each of the multiple mushroom structures of the first group includes:

a ground plate;

a first patch provided parallel to the ground plate with a separation of a distance to the ground plate; and a second patch provided parallel to the ground plate with a separation of another distance to the ground plate, which another distance being different from the distance from the first patch to the ground plate; and the second patch is a passive element which capacitatively couples with at least the first patch, and each of the multiple mushroom structures of the second group includes a ground plate; and a patch provided parallel to the ground plate with a separation of a distance to the ground plate, wherein patches of neighboring mushroom structures mutually form a gap within the same plane, while patches of different neighboring mushroom structures are provided on mutually different planes with a positional relationship such that at lease some are laminated in multiple levels.

(C5)

The apparatus as recited in C4, wherein one layer out of three layers which make up a ground plate, a first patch, and a second patch in a mushroom structure of the first group is provided on the same plane as one layer out of three layers which make up a patch provided on the different plane and a ground plate in a mushroom structure of the second group, and wherein a different one layer out of the three layers which make up the ground plate, the first patch, and the second patch in a mushroom structure of the first group is provided on the same plane as a different one layer out of the three layers which make up the patch provided on the different plane and the ground plate in the mushroom structure of the second group.

(C6) A+B

An apparatus having multiple mushroom structures of a first group and multiple mushroom structures of a second group, wherein each of the mushroom structures includes a ground plate; and a patch provided parallel to the ground plate with a separation of a distance to the ground plate, wherein a distance between a ground plate and a patch in a certain mushroom structure belonging to the first group is different from a distance between a ground plate and a patch in a different mushroom structure belonging to the first group, and wherein patches of neighboring mushroom structures belonging to the second group mutually form a gap within the same plane, while patches of different neighboring mushroom structures are provided on mutually different planes with a positional relationship such that at lease some are laminated in multiple levels.

(C7)

The apparatus as recited in C6, wherein one layer out of two layers which make up a ground plate and a patch in a mushroom structure of the first group is provided on the same plane as one layer out of three layers which make up a patch provided on the different plane and a ground plate in a mushroom structure of the second group, and wherein another one layer out of the two layers is provided on the same plane as another one layer out of the three layers.

The present application is based on Japanese Priority Patent Applications No. 2010-043572 filed Feb. 26, 2010, No. 2010-156254 filed Jul. 8, 2010, and No. 2011-000245 filed Jan. 4, 2011, with the Japanese Patent Office, the entire contents of which are hereby incorporated herein by reference.

What is claimed is:

1. An apparatus having multiple mushroom structures, each of the multiple mushroom structures including:

a ground plate;

a first patch provided parallel to the ground plate with a separation of a distance to the ground plate; and a second patch provided parallel to the ground plate with a separation of another distance to the ground plate, which another distance being different from the distance from the first patch to the ground plate, wherein the second patch is a passive element which is capacitatively coupled with at least the first patch, a gap between first patches of neighboring mushroom structures out of a certain number of mushroom structures lined up along a certain line gradually changes along the certain line, and a distance from an end of one of neighboring first patches for determining the gap to a reference line of the one of the first patches equals a distance from an end of the other of the neighboring first patches to a reference line of the other of the first patches, and a distance between reference lines to multiple mushroom structures is uniformly maintained.

2. The apparatus as claimed in claim 1, wherein a phase difference of radio waves reflected from each of a first mushroom structure and a second mushroom structure out of the first mushroom structure, the second mushroom structure, and a third mushroom structure lined up sequentially along the certain line is equal to a phase difference of radio waves reflected from each of the second mushroom structure and the third mushroom structure.

3. The apparatus as claimed in claim 1, wherein an array which includes a certain number of mushroom structures lined up at least along the certain line is lined up in multiple numbers repeatedly on the same plane.

4. The apparatus as claimed in claim 1, further including at least one patch which is provided parallel to the ground plate, the first patch and the second patch with a separation of a distance to the ground plate, the first patch and the second patch, wherein the at least one patch is a passive element.

5. An apparatus having multiple mushroom structures, each of the multiple mushroom structures including:

a ground plate;

a first patch provided parallel to the ground plate with a separation of a distance to the ground plate; and a second patch provided parallel to the ground plate with a separation of another distance to the ground plate, which another distance being different from the distance from the first patch to the ground plate, wherein the second patch is a passive element which is capacitatively coupled with at least the first patch, a gap between first patches of neighboring mushroom structures out of a certain number of mushroom structures lined up along a certain line gradually changes along the certain line, and a distance between a center line which bisects a gap between a first patch of a first mushroom structure and a first patch of a second mushroom structure that neighbor along the certain line and a center line which bisects a gap between the first patch of the second mushroom structure and a first patch of a third mushroom structure that neighbor along the certain line is maintained uniformly for multiple mushroom structures lined up along the certain line.

6. The apparatus as claimed in claim 5, wherein a phase difference of radio waves reflected from each of the first mushroom structure and the second mushroom structure out of the first mushroom structure, the second mushroom structure, and the third mushroom structure lined up sequentially along the certain line is equal to a phase difference of radio waves reflected from each of the second mushroom structure and the third mushroom structure.

7. The apparatus as claimed in claim 5, wherein an array which includes a certain number of mushroom structures lined up at least along the certain line is lined up in multiple numbers repeatedly on the same plane.

8. The apparatus as claimed in claim 5, further including at least one patch which is provided parallel to the ground plate, the first patch and the second patch with a separation of a distance to the ground plate, the first patch and the second patch, wherein the at least one patch is a passive element.

* * * * *